US011957226B2

(12) United States Patent
Petrolino et al.

(10) Patent No.: US 11,957,226 B2
(45) Date of Patent: Apr. 16, 2024

(54) EXPANDABLE CONTAINER

(71) Applicant: John C. Petrolino, New Brunswick, NJ (US)

(72) Inventors: John C. Petrolino, New Brunswick, NJ (US); Bill Riley, Charlotte, NC (US); Dillan Shaffer, Charlotte, NC (US); Matt Green, Charlotte, NC (US); Steve Gerstein, Charlotte, NC (US)

(73) Assignee: John C. Petrolino, New Brunswick, NJ (US)

( * ) Notice: Subject to any disclaimer, the term of this patent is extended or adjusted under 35 U.S.C. 154(b) by 195 days.

(21) Appl. No.: 17/193,608

(22) Filed: Mar. 5, 2021

(65) Prior Publication Data

US 2021/0274901 A1 Sep. 9, 2021

Related U.S. Application Data

(60) Provisional application No. 62/985,542, filed on Mar. 5, 2020.

(51) Int. Cl.
*A45C 7/00* (2006.01)
*A45C 3/06* (2006.01)
(Continued)

(52) U.S. Cl.
CPC ..... *A45C 7/0022* (2013.01); *A45C 3/06* (2013.01); *A45C 5/03* (2013.01); *A45C 5/14* (2013.01);
(Continued)

(58) Field of Classification Search
CPC ..... A45C 7/0022; A45C 3/06; A45C 5/03; A45C 5/14; A45C 7/0063; A45C 13/04;
(Continued)

(56) References Cited

U.S. PATENT DOCUMENTS 643,416 A 2/1900 Kohout et al.
825,642 A 7/1906 Enright
(Continued)

FOREIGN PATENT DOCUMENTS

CN 102106638 A 6/2011
CN 204146516 2/2015
(Continued)

OTHER PUBLICATIONS

International Search Report and Written Opinion for PCT/US2021/021145 (ISA/EP) completed Jun. 15, 2021 (12 pages).
(Continued)

*Primary Examiner* — John K Fristoe, Jr.
*Assistant Examiner* — Jessica Kavini Tamil
(74) *Attorney, Agent, or Firm* — Alston & Bird LLP

(57) ABSTRACT

Provided are an expandable container, an expandable frame assembly, and associated components and methods. The expandable frame assembly for an expandable container may expand in at least two dimensions. The assembly may include a plurality of frame members configured to move relative to each other, a plurality of sizing members, and an adjustment mechanism operably coupled to the plurality of sizing members. Each of the plurality of sizing members may be connected to at least one of the plurality of frame members. The adjustment mechanism may be configured to move the plurality of sizing members between a first configuration and a second configuration. The first configuration may define a different distance between the plurality of frame members than the second configuration.

19 Claims, 77 Drawing Sheets

(51) Int. Cl.

| | |
|---|---|
| ***A45C 5/03*** | (2006.01) |
| ***A45C 5/14*** | (2006.01) |
| ***A45C 13/04*** | (2006.01) |
| ***A45C 13/10*** | (2006.01) |
| ***A45C 13/26*** | (2006.01) |

(52) U.S. Cl.
CPC ..... *A45C 7/0063* (2013.01); *A45C 13/04* (2013.01); *A45C 13/103* (2013.01); *A45C 13/262* (2013.01); *A45C 2013/267* (2013.01)

(58) Field of Classification Search
CPC ..... A45C 13/103; A45C 13/262; A45C 2013/267
USPC ..... 190/103
See application file for complete search history.

(56) References Cited

U.S. PATENT DOCUMENTS

| | | | | |
|---|---|---|---|---|
| 1,052,018 | A | 2/1913 | Spitz | |
| 1,126,479 | A | 1/1915 | Jozsy | |
| 1,184,525 | A | 5/1916 | Hammond | |
| 1,344,408 | A | 6/1920 | King | |
| 1,756,775 | A | 4/1930 | Winning | |
| 2,565,969 | A | 8/1951 | Judson | |
| 2,711,234 | A | 6/1955 | Rubens | |
| 2,907,420 | A | 10/1959 | Doppelt | |
| 3,211,160 | A | 10/1965 | Miller | |
| 3,441,115 | A | 4/1969 | Gunther | |
| 3,445,860 | A | 5/1969 | Rodell | |
| 3,465,363 | A | 9/1969 | Raney | |
| 3,557,633 | A | 1/1971 | Frerichs | |
| 3,592,314 | A | 7/1971 | Jacobson | |
| 3,914,832 | A | 10/1975 | Petrus | |
| 3,955,656 | A | 5/1976 | Kashinski | |
| 4,000,633 | A | 1/1977 | Evans | |
| 4,538,709 | A | 9/1985 | Williams et al. | |
| 4,624,382 | A | 11/1986 | Tontarelli | |
| 4,630,717 | A | 12/1986 | Tong | |
| 4,854,430 | A | 8/1989 | Peterson | |
| 4,942,628 | A | 7/1990 | Freund | |
| 4,953,673 | A | 9/1990 | Ambasz | |
| 5,038,842 | A | 8/1991 | Huang | |
| 5,082,094 | A | 1/1992 | Nechushtan | |
| 5,181,612 | A | 1/1993 | Liu | |
| 5,251,731 | A | 10/1993 | Cassese et al. | |
| 5,358,082 | A | 10/1994 | Armstrong, IV | |
| 5,392,906 | A | 2/1995 | Taniyama | |
| 5,526,907 | A | 6/1996 | Trawick et al. | |
| 5,590,825 | A | 1/1997 | Murdock | |
| 5,682,682 | A | 11/1997 | Renfrew et al. | |
| 5,743,447 | A | 4/1998 | McDermott | |
| 5,782,372 | A | 7/1998 | Weiss et al. | |
| 5,819,891 | A | 10/1998 | Wang et al. | |
| 5,878,903 | A | 3/1999 | Ung | |
| 5,954,611 | A | 9/1999 | Mills et al. | |
| 6,179,101 | B1 | 1/2001 | Lin | |
| 6,219,974 | B1 | 4/2001 | Hoberman | |
| 6,575,272 | B1 | 6/2003 | Krulik et al. | |
| 6,637,633 | B1 | 10/2003 | Eberle | |
| 7,077,251 | B1 | 7/2006 | Gaither | |
| 7,086,510 | B2 | 8/2006 | Smith et al. | |
| 7,093,699 | B2 | 8/2006 | Yu | |
| 7,195,109 | B2 | 3/2007 | Mitchell et al. | |
| 7,328,779 | B2 | 2/2008 | King et al. | |
| 7,334,669 | B2 | 2/2008 | Barker et al. | |
| 7,874,409 | B1 | 1/2011 | Lakhal | |
| 7,887,095 | B2 | 2/2011 | Bieg et al. | |
| 7,984,819 | B1 | 7/2011 | Davis | |
| 8,149,918 | B2 | 4/2012 | Seok et al. | |
| 8,459,146 | B2 | 6/2013 | Morizono et al. | |
| 8,850,681 | B2 | 10/2014 | Hardigg et al. | |
| 9,560,902 | B2 | 2/2017 | Hogan et al. | |
| 10,285,472 | B2 | 5/2019 | Wyatt et al. | |
| 2004/0020732 | A1 | 2/2004 | Chen | |
| 2005/0268622 | A1 | 12/2005 | Krieger | |
| 2005/0286807 | A1* | 12/2005 | Matheus | A45C 7/0063 190/103 |
| 2007/0045071 | A1 | 3/2007 | Gorga | |
| 2008/0251513 | A1 | 10/2008 | Vatn et al. | |
| 2012/0070104 | A1 | 3/2012 | Antonio | |
| 2014/0246425 | A1 | 9/2014 | Janin | |
| 2015/0060221 | A1 | 3/2015 | Bourette | |
| 2015/0327639 | A1 | 11/2015 | Antonelli | |
| 2016/0374441 | A1 | 12/2016 | Atlas et al. | |
| 2017/0006949 | A1 | 1/2017 | Lacy et al. | |
| 2017/0295899 | A1* | 10/2017 | Chen | A45C 5/03 |
| 2018/0057031 | A1 | 3/2018 | Kinnee | |
| 2020/0022473 | A1* | 1/2020 | Hashish | A45C 13/04 |

FOREIGN PATENT DOCUMENTS

| | | | |
|---|---|---|---|
| CN | 204306216 | | 5/2015 |
| CN | 104757761 | A | 7/2015 |
| CN | 205276269 | | 6/2016 |
| CN | 207230144 | | 4/2018 |
| EP | 0577093 | A1 | 1/1994 |
| EP | 1566328 | A1 | 8/2005 |
| EP | 2077080 | A1 | 7/2009 |
| GB | 191311589 | | 8/1913 |
| GB | 2519123 | A | 4/2015 |
| KR | 101355199 | B1 | 1/2014 |
| WO | WO-2017/103691 | A1 | 6/2017 |

OTHER PUBLICATIONS

Biaggi luggage that folds, [online] retrieved from Internet Apr. 7, 2021 <URL: https://biaggi.com/?gclid=EAIaIQobChMI9PLS9Lfz4AIVCorICh32SAu8EAAYASAAEgIOWvD_BwE)> (2 pages).

The Adjustable Bag A10—by Piorama [online] retrieved from Internet Apr. 7, 2021 <URL: https://www.kickstarter.com/projects/theadjustablebag/tab-the-worlds-most-versatile-convertible-bag)> (37 pages).

Fugu Luggage [online] retrieved from Internet Apr. 7, 2021 <URL: https://www.kickstarter.com/projects/1609691375/fugu-luggage-expandable-suitcase> (18 pages).

Gizmodo, An Expanding Suitcase That Goes From Carry-on To Check-in Sizes, [online] retrieved from Internet <URL: https://gizmodo.com/an-expanding-suitcase-that-goes-from-carry-on-to-check-1662551572> (5 pages).

Get Rollux: The Most Versatile 2-in-1 Suitcase Around [online] retrieved from Internet Apr. 7, 2021 <URL: https://www.kickstarter.com/projects/1391511229/rollux-the-most-versatile-2-in-1-suitcase-around> (29 pages).

* cited by examiner

EXPANDABLE CONTAINER

CROSS-REFERENCE TO RELATED APPLICATION

This application claims the benefit of U.S. Provisional Application Ser. No. 62/985,542, filed Mar. 5, 2020, and entitled "Expandable Container", which application is incorporated by reference herein in its entirety.

TECHNOLOGICAL FIELD

Example embodiments of the present disclosure relate generally to expandable storage and transportation containers for use with private, public, and commercial transportation.

BACKGROUND

Containers, such as suitcases, handbags, boxes, or the like, have been traditionally used for storing and/or transporting possessions and other goods. Such containers have been traditionally made to a fixed size and shape, which limits the users' options. In some instances, sets of multiple fixed-size containers of different sizes are sold together to allow the user to choose which size best fits their needs. However, these systems do not allow a user to change container sizes when the full set is not available and requires the purchase, storage, and maintenance of several additional containers.

Applicant has identified a number of deficiencies and problems associated with the manufacture, use, and maintenance of conventional container systems. Through applied effort, ingenuity, and innovation, Applicant has solved many of these identified problems by developing a solution that is embodied by the present invention, which is described in detail below.

BRIEF SUMMARY

In an example embodiment, an expandable container is provided for an expandable suitcase system. The expandable container is configured to expand in at least two directions and may include a shell and an expandable frame assembly which may be disposed inside the shell. The shell may at least partially include an elastic material and defines an internal cavity. The expandable frame assembly may include a plurality of frame members, at least one sizing band, and an adjustment mechanism. The plurality of frame members may be configured to move relative to each other in at least one direction. The sizing band may be configured to extend between the plurality of frame members. The sizing band may be further configured to adjust a distance between two or more of the plurality of frame members. The adjustment mechanism may be configured to selectively hold the at least one sizing band in at least a first configuration and a second configuration. The first configuration may define a different distance between the two or more of the plurality of the frame members than the second configuration.

In some embodiments, the shell at least partially includes an inelastic portion configured to maintain a substantially static shape and size. In some embodiments, the inelastic portion of the shell may comprise inelastic materials. The inelastic materials may further be configured with a knit or weave pattern which is configured for desired characteristics. The knit or weave pattern may include rigid supporting material (e.g., metal wire, hard rigid plastic, etc.) which may provide support or strength along at least one axis. The knit or weave pattern may define a ripstop fabric. In some embodiments, the inelastic portion of the shell may be natural, synthetic, semi-synthetic, regenerated, the like, or any combination thereof. In some embodiments, the inelastic portion of the shell may include a blend of materials providing for a plurality of desirable physical features and/or characteristics (e.g., color, physical strength, flexibility, water/fire resistance, antimicrobial, etc.). In some embodiments, the inelastic materials may be treated with additional chemical compounds and/or elements providing for a plurality of desirable physical features and/or characteristics (e.g., color, physical strength, flexibility, water/fire resistance, antimicrobial, etc.). The shell may define an opening through which a user can at least partially access a portion of the internal cavity. The opening may be a resealable opening, defined in an inelastic portion of the shell, configured to allow a user to access the whole internal cavity; and the resealable opening may include at least one of: a zipper, a series of magnets, a series of buttons, hook and loop fasteners, a series of turn snap fasteners, or the like, and/or any combination thereof.

In some embodiments, the shell can comprise one or more elastic materials including a 2-way stretch material and/or a 4-way stretch material. The 2-way stretch material defining two perpendicular axes may be configured to stretch or expand along one axis while remaining substantially undeformed along the other axes. When wrapped circumferentially around an expandable frame, the 2-way stretch fabric may wrap around the frame to be configured to allow the expandable container to expand in two dimensions (e.g., circumferentially along the expandable dimension of the 2-way fabric) while remaining tight along a non-expanding axis. In some embodiments, a 4-way stretch material may be configured to stretch along both axes as a planar fabric. In some embodiments, the 2-way stretch material and/or 4-way stretch material may further be configured with a knit or weave pattern which is configured for desired control of the material expansion or stretching characteristic. The knit or weave pattern may include rigid supporting material (e.g., metal wire, hard or rigid plastic, etc.) which may provide support or strength along at least one axis. The knit or weave pattern may define a ripstop fabric. In some embodiments, the 2-way stretch material and/or 4-way stretch material may be spandex, nylon, elastane, cotton, wool, rubber, neoprene, the like, or any combination or blend thereof (e.g., spandex blends, nylon blends, and/or polyester blends, etc.). For example, the elastic material may be a blend of 15% spandex and 85% nylon rash-guard material or similar material. In some embodiments, the 2-way stretch material and/or 4-way stretch material may be natural, synthetic, semi-synthetic, regenerated, the like, or any combination thereof. In some embodiments, the elastic material may include a blend of 2-way stretch materials and/or 4-way stretch materials providing for a plurality of desirable physical features and/or characteristics (e.g., color, physical strength, flexibility, water/fire resistance, antimicrobial properties, etc.). In some embodiments, the elastic materials may be treated with additional chemical compounds and/or elements providing for a plurality of desirable physical features and/or characteristics (e.g., color, physical strength, flexibility, water/fire resistance, antimicrobial, etc.).

In some embodiments, the at least one 2-way stretch material may be oriented to provide for stretching or expansion of the suitcase around the circumference of the expandable frame assembly while allowing the depth of the suitcase to remain constant during the expansion process. In some embodiments, the shell is attached to the expandable frame assembly via a series of grommets connected to the shell. The series of grommets may be configured to attach the shell to the expandable frame assembly together at each of a plurality of fastener connections. In some embodiments, at least one of the grommets of the series of grommets can be any fastener and/or combination of fasteners as described elsewhere herein. The shell may include a first portion of elastic material and at least one second portion. The at least one second portion of the shell may include at least an inelastic portion having an inelastic material. In some embodiments, the inelastic portion further defines at least a portion of two or more parallel surfaces of the shell and the elastic portion comprises a remainder of the shell. The at least one second portion may include at least two portions defining a front panel and a back panel, and the elastic portion may extend between the front panel and the back panel.

The shell may be configured to at least partially cover, enclose, or wrap around an expandable frame assembly. The shell may be configured to extend between the portions of the expandable frame assembly, such that the expandable frame assembly defines at least a portion of the shell. Overlapping frame members of the expandable frame assembly may define, at least partially, the shell. In some embodiments, the frame members of the expandable frame may define the whole of the shell. For example, the shell may be defined as an outer surface defined by a plurality of overlapping/interlocking slidably attached plates (e.g., frame members, or the like) that are configured to expand and contract.

In some embodiments, the expandable frame assembly is rectangular in shape in the first configuration, in which a frame member of the plurality of frame members is in contact with at least one adjacent frame member, and in a plurality of second configurations, in which a frame member of the plurality of frame members maintains a gap between at least one adjacent frame member, and the shell continuously maintains the shape of the expandable frame assembly in the first configuration and the plurality of second configurations. The expandable frame assembly may at least partially define a rectangular shape of the expandable container (e.g., a suitcase). The first configuration may further define the smallest configurable size of the expandable frame assembly and at least one of the plurality of second configurations defines the largest configurable size of the expandable frame assembly.

The expandable frame assembly may define one or more container shapes with substantially rounded edges and/or substantially rounded corners. The expandable frame assembly may define one or more homeomorphic container shapes between the first configuration and at least one of the plurality of second configurations. For example, a handbag configured with an expandable frame assembly may define a substantially circular, or cylindrical, shape in a first configuration and then a substantially saddle, or U-shape, in at least one of the plurality of second configurations. A suitcase, briefcase, and/or luggage container may transition, for example, from a substantially square shape (e.g., with respect to at least one cross-sectional plane and/or configuration) to a substantially rectangular shape and/or to a substantially cylindrical shape (e.g., with respect to at least one cross-sectional plane and/or configuration). The handbag container in a first configuration and/or a second configuration may define one or more of a backpack, baguette, bowler, bucket, clutch, cross-body, doctor, duffel, messenger, pouch, saddle, satchel, tote, trapeze, or any other handbag shape or style or any other common geometric shape (e.g., square, circle, rectangle, or the like). The expandable frame assembly, for example, of a handbag container, or other container as described herein, may be at least partially internal relative to an exterior surface defined by the handbag container.

In some embodiments, the plurality of frame members may further include one or more frame members of different three-dimensional shapes, cross-sectional shapes, sizes, and/or materials. The plurality of frame members may further include one or more corner members of different three-dimensional shapes, cross-sectional shapes, sizes, and/or materials. A frame member may take the form of one or more of a bar, plate, beam, rod, pipe, or other structural support elements as described herein (e.g., with respect to a sizing member, support member, etc.). The expandable container may further include one or more base members of different three-dimensional shapes, cross-sectional shapes, sizes, and/or materials. The expandable container may further include one or more support members of different three-dimensional shapes, cross-sectional shapes, sizes, and/or materials. The expandable container may further include one or more fasteners.

In some embodiments, the sizing band may include one or more sections comprising a plurality of three-dimensional shapes, cross-sectional shapes, sizes, and/or materials. The sizing band can further comprise a buckle and loop, one or more fastening snaps, a hook and loop fabric or tape, a tuck strap with a slide buckle and/or snap buckle, a D-ring strap, a cinch strap, a tieable portion, a bungee cord, a rope, a chain (e.g., roller chain, link chain, etc.), the like, and/or any combination thereof. The sizing band can further comprise at least partially one or more portions with teeth (e.g., trapezoidal, curvilinear, modified curvilinear, etc.), a smooth portion, the like, and/or any combination thereof. The sizing band can be configured to be an open or closed loop belt, chain, the like and/or any combination thereof. The sizing band can be configured in whole or in part with an adjustment mechanism to wrap around at least one of a spool, a gear, a pulley, the like, and/or any combination thereof. The sizing band may be configured as a sizing member.

A sizing member may be configured as an at least semi-rigid frame member configured to move linearly along at least a longitudinal axis. The sizing member may be configured, at least partially, as one or more of a bar, a rod, a beam (e.g., an I-beam, box beam, or any other structural beam), a rack (of a rack and pinion set), a linear actuator (e.g., mechanical, electrical, pneumatic, hydraulic, or the like), a linear ball screw, a pantograph (e.g., scissors mechanism, folding linkages, etc.), or any other types of mechanical linkages (including those described herein for a sizing band) that can at least transfer linear motion from an adjustment mechanism to an expandable frame assembly.

In some embodiments, the size and/or shape of any and all components can change with respect to a given direction, predefined plane, and/or predefined axis. For example, in some embodiments, the sizing band can have a tapered cross-section with respect to a predefined length dimension. For additional example, in some embodiments, a frame member of the plurality of frame members can taper to a wedge shape at one or more edges with respect to a predefined thickness dimension.

In some embodiments, the adjustment mechanism may include a ratcheting mechanism configured for incremental and/or continuous adjustment of the sizing band between extreme configurations. The ratcheting mechanism may include at least one of a torque limiter, a gear, a pawl, a spring, a pin (e.g., shear pin, roll pin, dowel, etc.), and/or one or more levers or arms. The ratcheting mechanism may provide for linear and/or rotary motion in one or more directions. The torque limiter may be configured to prevent damage to the adjustment mechanism and components thereof by way of preventing torque from being applied to the adjustment mechanism beyond a predefined torque amount. The torque limiter by way of configuration may define the predefined torque amount. The torque limiter can comprise at least one of a shear pin, a magnet, a ball bearing, a detent, a pawl, a rotor, a gear, a spring, a dowel, a friction plate, a pressure plate, the like, and/or any combination thereof. Additionally, the torque limiter maybe one of a plurality of types known to one skilled in the art in light of the present disclosure which can include a friction plate type, a magnetic particle type, a magnetic hysteresis type, a shear pin type, a synchronous magnetic type, a ball detent type, a spring and pawl type, the like, and/or any combination thereof. The one or more gears may include a differential mechanism, a pinion gear, a linear gear, a rack and pinion, a bevel gear, a spiral gear, a worm gear, a linear actuator (e.g., hydraulic, pneumatic, electric, etc.), the like, and/or any combination thereof. The one or more springs may include tension, compression, helical, conical, leaf, torsion, clip, clock, gas, the like, and/or any combination thereof.

In some embodiments, the expandable container may also include a liner defining at least a portion of the inner cavity of the expandable container. The liner may be configured to divide the inner cavity into at least a portion used for storage of goods during transportation and a portion used for housing the expandable frame assembly. The liner can be comprised of the same materials used to comprise the shell, different materials than those used to comprise the shell, or a combination thereof. The liner can be an integrated part of the shell, such that at least a portion of the liner and at least a portion of the shell comprise a single piece of material. The liner can be an integrated part of the expandable frame assembly, such that at least a portion of the liner and at least a portion of the expandable frame assembly comprise a single piece of material. The liner can be removably attached to the expandable frame assembly, shell, and/or the like by way of fasteners, such that the liner can be removed and reattached by a user. For example, if the liner is attached by way of a zipper and becomes damaged a user can unzip the liner and have the damaged liner fixed or purchase a new liner for replacement of the damaged liner. The liner can comprise a plurality of liner layers, wherein the liner layers are configured to provide padding, water resistance, insulation, the like, and/or any combination thereof. The liner can comprise a plurality of compartments, wherein the plurality of compartments are open on at least one side or configured with a resealable opening (e.g., zipper, button, magnets, etc.).

In some embodiments, a frame member of the plurality of frame members comprises a channel through which the sizing band is slidably connected to each frame member to move along at least one axis relative to the frame member. The sizing band may encircle at least a portion of the expandable frame assembly, defines a circumference, and allows the circumference to be expanded and/or contracted by way of the sizing band attachment and/or configuration with the adjustment mechanism. The sizing band is configured at a first end to slide relative to a second end.

In some embodiments, each frame member of the plurality of frame members may define a first end, comprising a first mating surface and a second end defining a second mating surface. The first mating surface and the second mating surface may define complementary shapes. The complementary shapes can be at least one of a peg and hole, a ball and socket, a tongue and groove, a biscuit joint, a butt joint, a lap joint, any other embodiment described herein, or the like, and/or any combination thereof. The first mating surface and the second mating surface may be configured to detachably interlock so as to prevent slippage along a plane of an interface formed by two or more mating frame members. Additionally, in some embodiments, the first mating surface and the second mating surface can be configured to permanently interlock.

In some embodiments, a frame member of the plurality of frame members may define a channel configured to receive the sizing band therethrough. The channel may extend from a first end of the frame member to a second end of the frame member. The channel can define a cross-sectional shape (e.g., circular, triangular, rectangular, etc.) that is of a complementary shape with the size and shape defined by the sizing band. The frame member and the sizing band can define a slidably attached interface by way of the channel. The channel can be lined with a low friction, self-lubricating, and/or the like material. The channel can extend through the center of a frame member defined by the cross-section of the frame member. The channel can extend along the length of at least one side of a frame member. The sizing band can be slidably attached to the channel using fasteners (e.g., belt guides, belt rollers, pulleys, loops etc.). The channel can be a separate component attached to a frame member by way of at least one fastener. The channel can be defined by the connection between two or more components.

In some embodiments, the plurality of frame members may include at least a first corner member. The first corner member may be configured to bend the sizing band at a substantially right angle between the start and the end of the corner member. The first corner member may define a channel configured to receive the sizing band therethrough. The channel may extend from a first end of the corner member to a second end of the corner member, and the channel may be bent, such that the channel is configured to bend the sizing band at the substantially right angle. The plurality of frame members may include at least four corner members including the first corner member; and the first corner member of the at least four corner members may be attached to the shell along at least one inner edge, at least one inner corner, or a combination thereof.

In some embodiments, the expandable frame assembly may further include at least one support member, wherein the support member is configured to extend between at least a first frame member of the plurality of frame members and a second frame member of the plurality of frame members. The support member may be slidably engaged with at least one of the first frame member and the second frame member. The support member may be configured to allow movement between the first frame member and the second frame member along a first path of motion while substantially preventing motion between the first frame member and the second frame member along a plurality of secondary paths of motion.

In some embodiments, the support member may be slidably and/or non-slidably attached to at least one of the first frame member and the second frame member by way of at least a pin and groove, a channel, a loop, a fastener, or the like, and/or any combination thereof. The support member can be flexible, rigid, the like, and/or any combination thereof. In some embodiments, the support member may be more rigid than the sizing band. In some embodiments, the support member is configured to slidably engage a frame member via a channel reserved for the sizing band. The support member can comprise in whole or in part a low friction, self-lubricating, and/or the like material. The support member can comprise a gas and/or mechanical spring and/or damper assembly. The support member can be configured to rotate and/or pivot about at least a fastener connection.

In some embodiments, the expandable container further includes a handle. The handle may further include at least one telescoping arm which is configured to attach the handle to at least a portion of the shell, a portion of the expandable frame assembly, and/or a portion of the base. The handle can be configured to be attached directly to at least a portion of the shell, a portion of the expandable frame assembly, and/or a portion of the base. The telescoping arm can be configured to telescope in a linear and/or a rotational directional. The telescoping arm can be configured to be non-adjustable with a fixed length, wherein the telescoping arm is slidably attached or rigidly attached to the expandable container. The handle can comprise a plurality of materials (e.g., plastic, metal, gel and/or foam padding, etc.), shapes (e.g., straight cylinder, finger grooves, custom ergonomic grip, etc.), and sizes. The handle can be attached to the at least one telescoping arm by way of a plurality of fasteners. The handle may further include a locking mechanism which can lock the telescoping arm in a plurality of continuous and/or discrete locking positions between a first locking position and a second locking position, wherein the first locking position defines a fully collapsed position and the second locking position defines a fully extended locking position.

In some embodiments, the expandable container may also include a base. The base can comprise at least one of a base member, a corner member, a frame member, a support member, a sizing member, a sizing band, the like, and/or any combination thereof. The base member can be a single continuous piece of material or an assembly of a plurality of pieces of material. The base member can be attached to the expandable frame assembly by way of at least one fastener. In various embodiments, at least two corner members may be slidably connected to the base member and may be configured to expand and contract with the sizing band. The base can further comprise at least one tire, wheel, bearing, strut, shock absorber, damper, peg, kick stand, roller, ball, the like, and/or any combination thereof attached by way of a fastener to at least one of a base member, corner member, frame member, support member, the like, and/or any combination thereof. In some embodiments, wheels may be attached to the expandable frame assembly and a base member may be omitted. The shell can be configured with at least one hole, slot, cutout, the like, and/or combination thereof to allow at least one portion of at least one wheel, peg, kick stand, roller ball, the like, and/or any combination thereof to protrude through the shell.

In some embodiments, the expandable suitcase system is configured to expand in a third or more dimensions by configuring the opening or a second expanding section to fold, stretch, and/or otherwise expand and/or contract. The opening or the second expanding section may be formed in an inelastic portion of the shell.

In some embodiments, the fasteners used for any and all components, portions thereof, combinations thereof, and/or connections therebetween, can include: nuts, bolts, nails, screws, rivets, cotter pins, safety wire, zip ties, zippers, buttons, snaps, turn snap buttons, spring clips, anchors, washers, chemical adhesives (e.g., cyanoacrylates, epoxy resins, etc.), welds (e.g., metal, plastic, etc.), tapes, friction interfaces, press fits, hooks, grommets, hook and loop fabric, stitches, laces, cinch straps, staples, tarp fasteners, any other components disclosed herein, or the like, and/or any combination thereof.

In some embodiments, the materials used for any and all components or portions thereof can include: rubber, plastic, leather, pure metal or alloy (e.g., steel, aluminum, titanium, etc.), metalloid (e.g., silicon, etc.), non-metal (e.g., carbon, etc.) carbon fiber, ceramic, composite, paper, cardboard, the like, and/or any combination thereof. The features and/or characteristics of materials used for any and all components or portions thereof can include being: natural, synthetic, of a particular optical feature (e.g., color, clarity, reflectivity, absorption, refraction, photoluminescence, etc.), rigid, semi-rigid, flexible, elastic, inelastic, ductile, malleable, hardened (e.g., chemically hardened, heat-treated, work hardened, etc.), wear resistant, water resistant, waterproof, thermally insulated, electrically insulated, fire resistant, fireproof, impact resistant, puncture resistant, stab resistant, tear resistant, abrasion resistant, self-lubricating, cut resistant, bulletproof, stain resistant, wear resistant, chemical resistant, cost effective (i.e., inexpensive), luxurious/precious (e.g., gold, sapphire, etc.), renewable, the like, and/or any combination thereof. Various materials can be implemented such that any and all components or portions thereof can utilize one or more characteristics of the materials in an embodiment as described herein and/or in an embodiment of the present invention as recognized, in whole or in part, by one of skill in the art in light of the present disclosure. Applicant further appreciates that future advancements in engineering and science may provide for additional materials, fasteners, techniques, and/or other additions to be incorporated with the present disclosure by one skilled in the art in light of the present disclosure.

According to various embodiments of the present disclosure, there may be provided an expandable frame assembly for an expandable container configured to expand in at least two dimensions. The expandable frame assembly may comprise a plurality of frame members configured to move relative to each other. The expandable frame assembly may further comprise a plurality of sizing members, each of the plurality of sizing members connected to at least one of the plurality of frame members. The expandable frame assembly may further comprise an adjustment mechanism operably coupled to the plurality of sizing members. The adjustment mechanism may be configured to move the plurality of sizing members between a first configuration and a second configuration, wherein the first configuration may define a different distance between the plurality of frame members than the second configuration.

In some embodiments, the expandable frame assembly further defines a width dimension and a length dimension, wherein the length dimension may be perpendicular to the width dimension, wherein the width dimension in the first configuration may be less than the width dimension in the second configuration, and wherein the length dimension in the first configuration may be less than the length dimension in the second configuration.

In some embodiments, the expandable frame assembly further defines a depth dimension that is perpendicular to a plane defined by at least the width dimension and the length dimension, and wherein the depth dimension in the first configuration may be less than the depth dimension in the second configuration.

In some embodiments of the expandable frame assembly, the adjustment mechanism may be configured to cause linear movement of a respective sizing member of the plurality of sizing members. In some embodiments of the expandable frame assembly, the adjustment mechanism may be configured to move at least a first sizing member in a first linear direction along a first axis and a second sizing member in a second linear direction along a second axis, and wherein the first axis may intersect at least the second axis.

In some embodiments of the expandable frame assembly, the plurality of sizing members may include at least four sizing members defining two pairs of sizing members, and wherein a respective pair of the two pairs of sizing members may include a first sizing member configured for linear movement along a first axis and a second sizing member configured for linear movement along a second axis. In some embodiments of the expandable frame assembly, the first axis and the second axis may be one or more of colinear, coplanar, parallel, offset, perpendicular, or intersecting. In some embodiments of the expandable frame assembly, a first pair of sizing members of the two pairs of sizing members may be offset from a second pair of sizing members of the two pairs of sizing members at least at a location of the adjustment mechanism, wherein the offset may be in a direction perpendicular to both the first axis and the second axis. In some embodiments of the expandable frame assembly, the adjustment mechanism may define a center axis that is equidistant from a respective distal end of each of the plurality of sizing members, and wherein the respective distal end of each of the plurality of sizing members may be shaped to align with a respective axis perpendicular to the center axis and intersecting the center axis.

In some embodiments of the expandable frame assembly, the first linear direction may be between the first configuration and the second configuration and the second linear direction may be between the second configuration and the first configuration. In some embodiments of the expandable frame assembly, the first linear direction and the second linear direction are associated with one or more of a shared axis or a shared magnitude, and wherein the first linear direction may be opposite the second linear direction.

In some embodiments of the expandable frame assembly, the plurality of frame members may include a plurality of corner members, a respective corner member of the plurality of corner members defining a first corner member portion substantially perpendicular to a second corner member portion. In some embodiments of the expandable frame assembly, the respective corner member of the plurality of corner members may be configured to, at least partially, structurally define a respective corner of the expandable container. In some embodiments of the expandable frame assembly, a respective sizing member of the plurality of sizing members may be connected to a respective corner member of the plurality of corner members at an intersection of the first corner member portion and the second corner member portion of the respective corner member.

In some embodiments of the expandable frame assembly, the adjustment mechanism and the plurality of sizing members may be configured to translate each of the plurality of frame members away from the adjustment mechanism when moving from the first configuration to the second configuration. In some embodiments of the expandable frame assembly, the adjustment mechanism and the plurality of sizing members may be further configured to translate each of the plurality of frame members toward the adjustment mechanism when moving from the second configuration to the first configuration.

In some embodiments of the expandable frame assembly, a respective sizing member of the plurality of sizing members may be a rigid linkage configured to translate forces between the adjustment mechanism and a respective frame member of the plurality of frame members. In some embodiments of the expandable frame assembly, the plurality of frame members may include a plurality of corner members, and wherein the forces may include one or more of a compressive force, a tension force, or a torque. In some embodiments of the expandable frame assembly, a respective sizing member of the plurality of sizing members may be configured to move relative to at least a channel defined by the adjustment mechanism, and wherein the channel may be configured to at least partially direct linear movement of the respective sizing member.

In some embodiments of the expandable frame assembly, the adjustment mechanism may include one or more of a gear configured to engage one or more teeth of a respective sizing member, a pin configured to engage one or more holes of a respective sizing member, a clamp configured to engage a surface of at least a respective sizing member, or a screw configured to engage one or more threads or teeth of a respective sizing member. In some embodiments of the expandable frame assembly, the respective sizing member may at least partially include a sizing band. In some embodiments of the expandable frame assembly, the adjustment mechanism may include at least one gear, and wherein the at least one gear may be disposed between the plurality of sizing members to at least partially engage at least one tooth of each sizing member of the plurality of sizing members, and wherein the at least one gear may be disposed along at least the first axis and the second axis.

According to various embodiments of the present disclosure, there may be provided an expandable container comprising an expandable frame assembly. The expandable frame assembly may further comprise a plurality of frame members configured to move relative to each other. The expandable frame assembly may further comprise a plurality of sizing members, each of the plurality of sizing members connected to at least one of the plurality of frame members. The expandable frame assembly may further comprise an adjustment mechanism operably coupled to the plurality of sizing members. The adjustment mechanism may be configured to move the plurality of sizing members between a first configuration and a second configuration, wherein the first configuration defines a different distance between the plurality of frame members than the second configuration.

In some embodiments, the expandable container may further comprise an elastic shell portion extending between two or more of the plurality of frame members, wherein the elastic shell portion may comprise one or more of a sizing band, a support member, or an elastic fabric. In some embodiments, the expandable container may further comprise a zipper expansion section configured to allow the expandable container to expand in at least one direction of the at least three directions. In some embodiments, the expandable container may further comprise an inelastic shell portion comprising a zipper. In some embodiments, the expandable container may further comprise an interior compartment, wherein the zipper may be configured to provide access an interior compartment. In some embodiments, the expandable container may be expandable in at least three directions.

In some embodiments of the expandable container, expansion in at least one direction of the at least three directions of the expandable container may be passively caused by pushing or pulling on the elastic shell portion, and wherein expansion in at least one direction of the at least three directions of the elastic shell portion may be actively caused by expansion or contraction of an expandable frame assembly.

In some embodiments of the expandable container, the plurality of frame members may be rigidly fixed relative to each other each of the first configuration and the second configuration when not moving between configurations, and wherein the adjustment mechanism may be affixed to a rigid panel disposed at a rear of the expandable container. In some embodiments of the expandable container, the plurality of frame members corner frame members may each connect two sides of the expandable container, and wherein the adjustment mechanism may be disposed in a location between each of the plurality of frame members.

In some embodiments of the expandable container, the plurality of frame members may define at least a plurality of corners of the expandable container, wherein the plurality of sizing members may be configured to move the plurality of frame members at least partially away from a central point defined by the expandable container when moving from the first configuration to the second configuration, and wherein the plurality of sizing members may be configured to move the plurality of frame members at least partially toward the central point defined by the expandable container when moving from the second configuration to the first configuration.

In some embodiments of the expandable container, the plurality of sizing members may be configured to move the plurality of frame members away from the adjustment mechanism when moving from the first configuration to the second configuration and towards the adjustment mechanism when moving from the second configuration to the first configuration.

According to various embodiments of the present disclosure, there may be provided an expandable container configured to expand in at least two directions. The expandable container may comprise a shell at least partially comprising an elastic material, the shell defining an internal cavity. The expandable container may further comprise an expandable frame assembly. The expandable frame assembly may comprise a plurality of frame members configured to move relative to each other in at least one direction. The expandable frame assembly may further comprise at least one sizing band extending between the plurality of frame members, wherein the at least one sizing band may be configured to adjust a distance between two or more of the plurality of frame members. The expandable frame assembly may further comprise an adjustment mechanism configured to selectively hold the at least one sizing band in at least a first configuration and a second configuration, wherein the first configuration may define a different distance between the two or more of the plurality of frame members than the second configuration.

In some embodiments of the expandable container, the expandable frame assembly may be rectangular in shape in the first configuration, in which a frame member of the plurality of frame members may be in contact with at least one adjacent frame member, and in a plurality of second configurations, in which a frame member of the plurality of frame members maintains a gap between at least one adjacent frame member, and the shell may continuously maintain the shape of the expandable frame assembly in the first configuration and the plurality of second configurations. In some embodiments of the expandable container, the first configuration may define a smallest configurable size of the expandable frame assembly.

In some embodiments of the expandable container, the adjustment mechanism may comprise a ratcheting mechanism configured for incremental or continuous adjustment of the at least one sizing band and/or at least one sizing member. In some embodiments of the expandable container, the ratcheting mechanism may comprise a torque limiter. In some embodiments of the expandable container, a frame member of the plurality of frame members comprise a channel through which the at least one sizing band may be slidably attached to each frame member. In some embodiments of the expandable container, the at least one sizing band may encircle at least a portion of the expandable frame assembly and allow a circumference of a circle formed by the at least one sizing band to be expandably and contractably attached to the adjustment mechanism. In some embodiments of the expandable container, the sizing band and/or sizing member may be configured at a first end to slide relative to a second end.

In some embodiments of the expandable container, each frame member of the plurality of frame members may define a first end comprising a first mating surface and a second end defining a second mating surface, and wherein the first mating surface and the second mating surface may define complementary shapes. In some embodiments of the expandable container, the plurality of frame members may comprise at least a first corner member, wherein the first corner member may be configured to bend the at least one sizing band at a substantially right angle. In some embodiments of the expandable container, the first corner member may define a channel configured to receive the at least one sizing band therethrough, wherein the channel may extend from a first end of the corner member to a second end of the corner member, and wherein the channel may be bent, such that the channel may be configured to bend the at least one sizing band at the substantially right angle.

In some embodiments of the expandable container, the plurality of frame members may comprise at least four corner members including the first corner member. In some embodiments of the expandable container, the first corner member of the at least four corner members may be attached to the shell along at least one inner edge, at least one inner corner, or a combination thereof.

In some embodiments of the expandable container, the expandable frame assembly may further comprise at least one support member, wherein the support member may be configured to extend between a first frame member of the plurality of frame members and a second frame member of the plurality of frame members, wherein the support member may be slidably engaged with at least one of the first frame member and the second frame member. In some embodiments of the expandable container, the support member may be configured to allow movement between the first frame member and the second frame member along a first path of motion while substantially preventing motion between the first frame member and the second frame member along a plurality of secondary paths of motion.

In some embodiments of the expandable container, a series of grommets may be connected to the shell. In some embodiments of the expandable container, a grommet of the series of grommets may be configured to slide within a channel defined by a frame member of the plurality of frame members via a fastener connection. In some embodiments of the expandable container, the series of grommets may attach the shell and the expandable frame assembly together at each of a plurality of fastener connections. In some embodiments of the expandable container, the shell may comprise an elastic portion, comprising the elastic material, and at least one second portion. In some embodiments of the expandable container, the at least one second portion of the shell may comprise an inelastic portion, comprising an inelastic material, and the inelastic portion may define at least a portion of two or more parallel surfaces of the shell, wherein the elastic portion may comprise a remainder of the shell.

In some embodiments, the expandable container may further comprise a handle attached to at least the at least one second portion of the shell. The handle may be configured with at least one telescoping arm. In some embodiments of the expandable container, the at least one second portion may comprise at least two portions defining a front panel and a back panel. The front panel and/or the back panel may comprise, or define, at least one sleeve configured to slidably receive the at least one telescoping arm. In some embodiments of the expandable container, the elastic portion may extend between the front panel and the back panel. In some embodiments, the expandable container may further comprise a resealable opening, embedded in the inelastic portion of the shell, configured to allow a user to access the internal cavity. In some embodiments of the expandable container, the resealable opening may comprise at least one of a zipper, a series of magnets, a series of buttons, hook-and-loop fasteners, a series of turn snap fasteners, a buckle, a clip, and/or a combination thereof.

In some embodiments, the expandable container may further comprise a base comprising at least two corner members slidably connected to a base member and may be configured to expand and contract with the at least one sizing band. In some embodiments of the expandable container, the base member may be attached to the shell by at least one grommet and at least one fastener connection. In some embodiments of the expandable container, the base may comprise at least one wheel or peg attached to at least one frame member, base member, corner member, or combination thereof. In some embodiments of the expandable container, the shell may be configured with at least a hole to allow at least one wheel or peg to protrude through the shell.

In some embodiments, an expandable container may be provided, which may include a shell defining a volume; at least one sizing member connected directly or indirectly to at least a portion of the shell; and an adjustment mechanism operably coupled to the at least one sizing member. The adjustment mechanism may be configured to move the at least one sizing member between a first configuration and a second configuration, and wherein the first configuration may define a different volume of the shell than the second configuration.

In some embodiments, the shell may include an opening. The at least one sizing member and/or the at least one adjustment mechanism may be disposed on a side edge of the expandable container.

In some embodiments, the expandable container may be a handbag. In some embodiments, the expandable container may be a backpack. In some embodiments, the expandable container may be a suitcase.

Various other aspects are also described in the following detailed description and in the attached claims. The various aspects may be configured according to, and/or in combination with, one or more other aspects and/or one or more portions of other aspects, as described by the present disclosure.

BRIEF DESCRIPTION OF THE SEVERAL VIEWS OF THE DRAWING(S)

Having thus described the invention in general terms, reference will now be made to the accompanying drawings, which are not necessarily drawn to scale, which may omit some components described herein, and wherein:

Figure 13A:
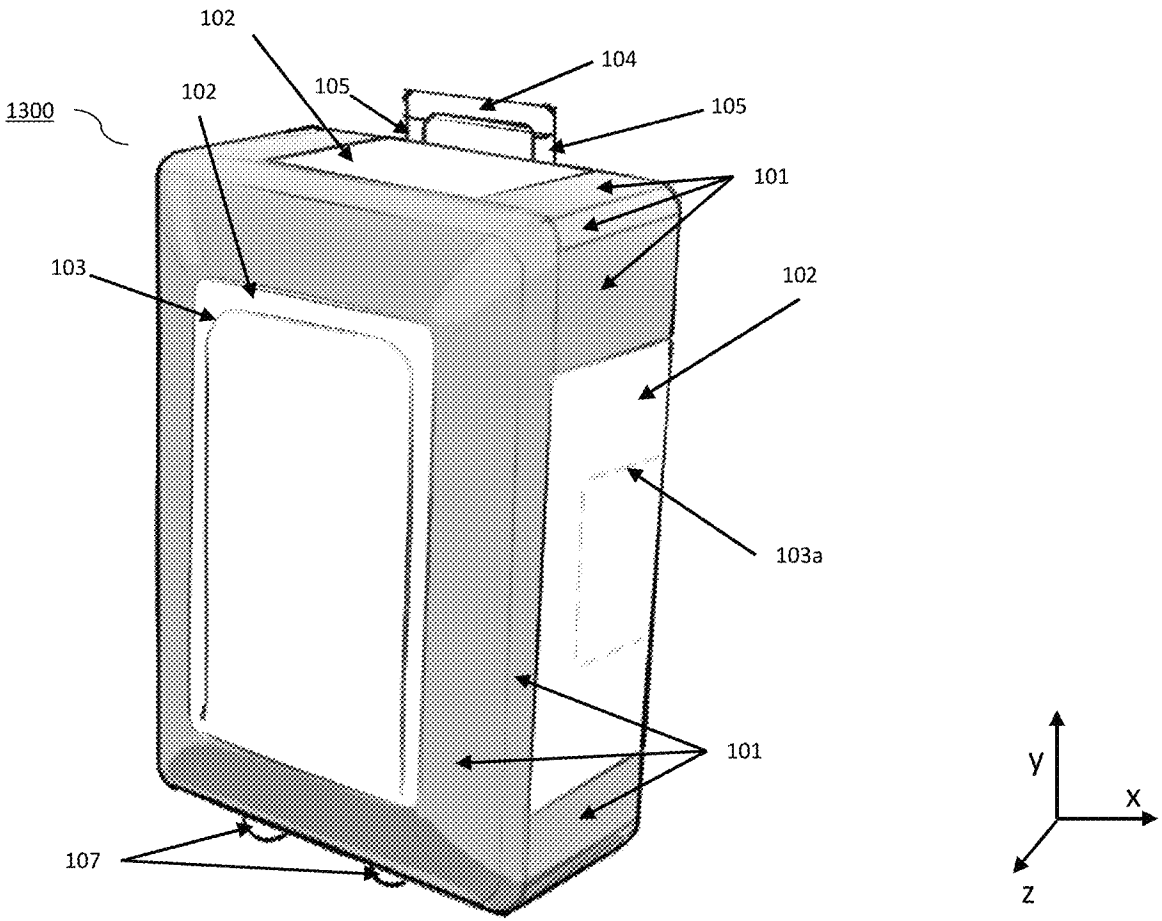
Figure 13C:
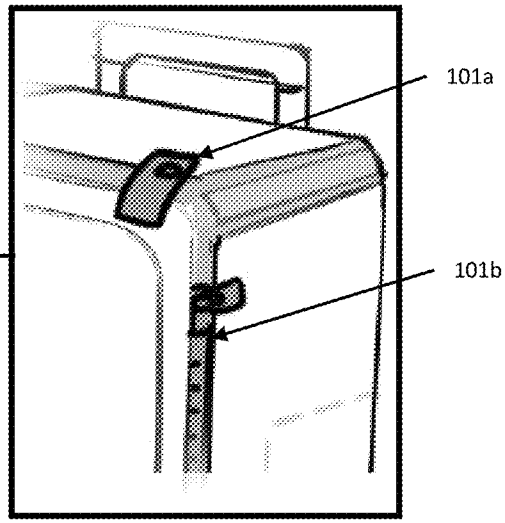
Figure 13B:
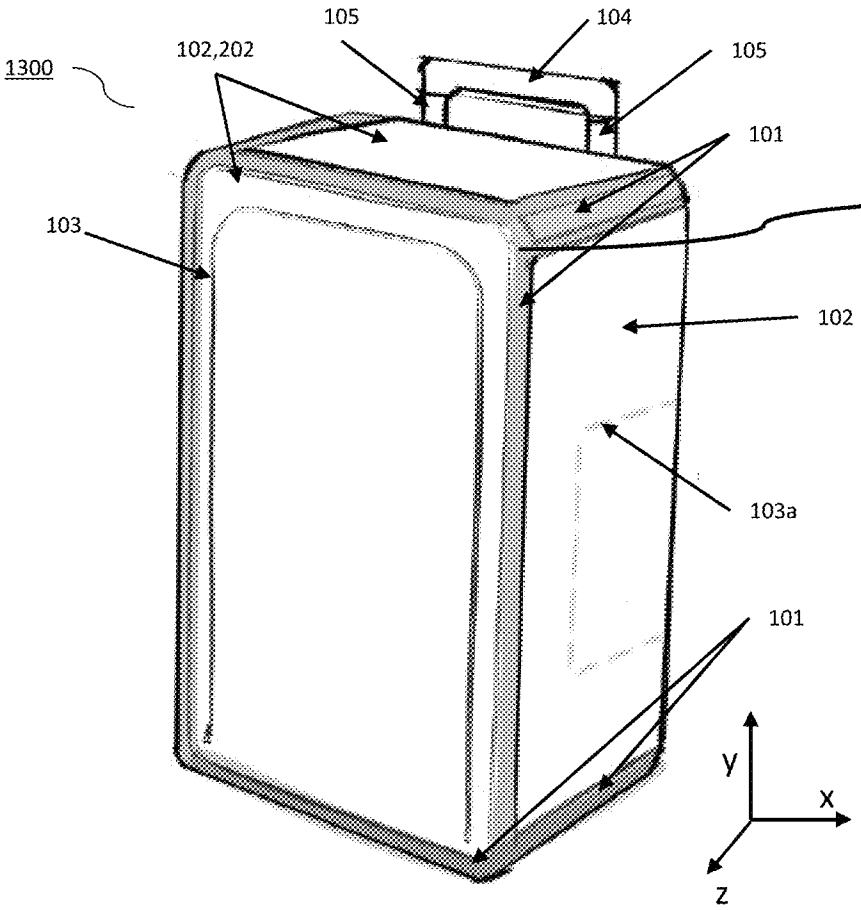
Figures 14A, 14B:
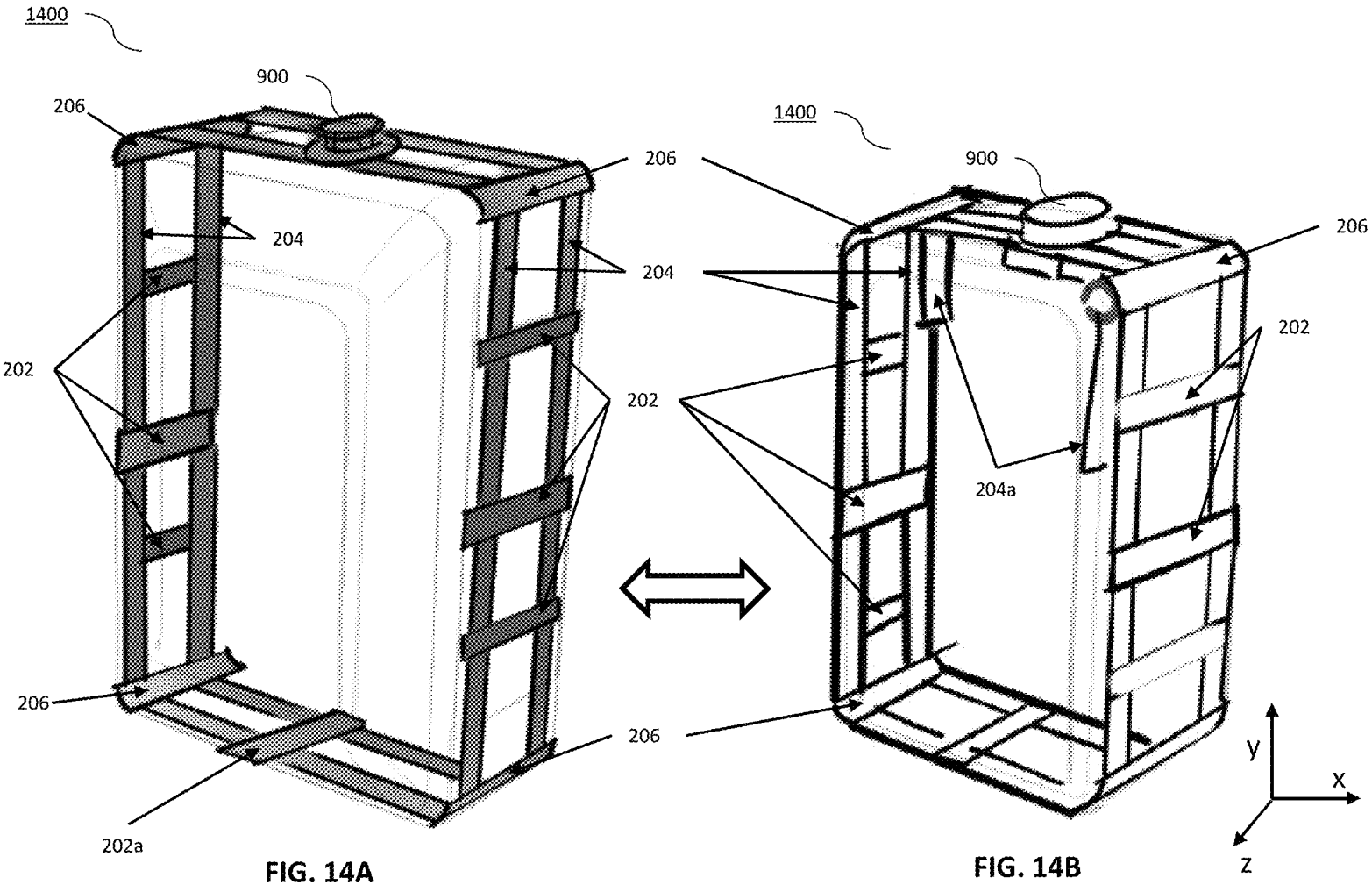
Figures 15A, 15B:
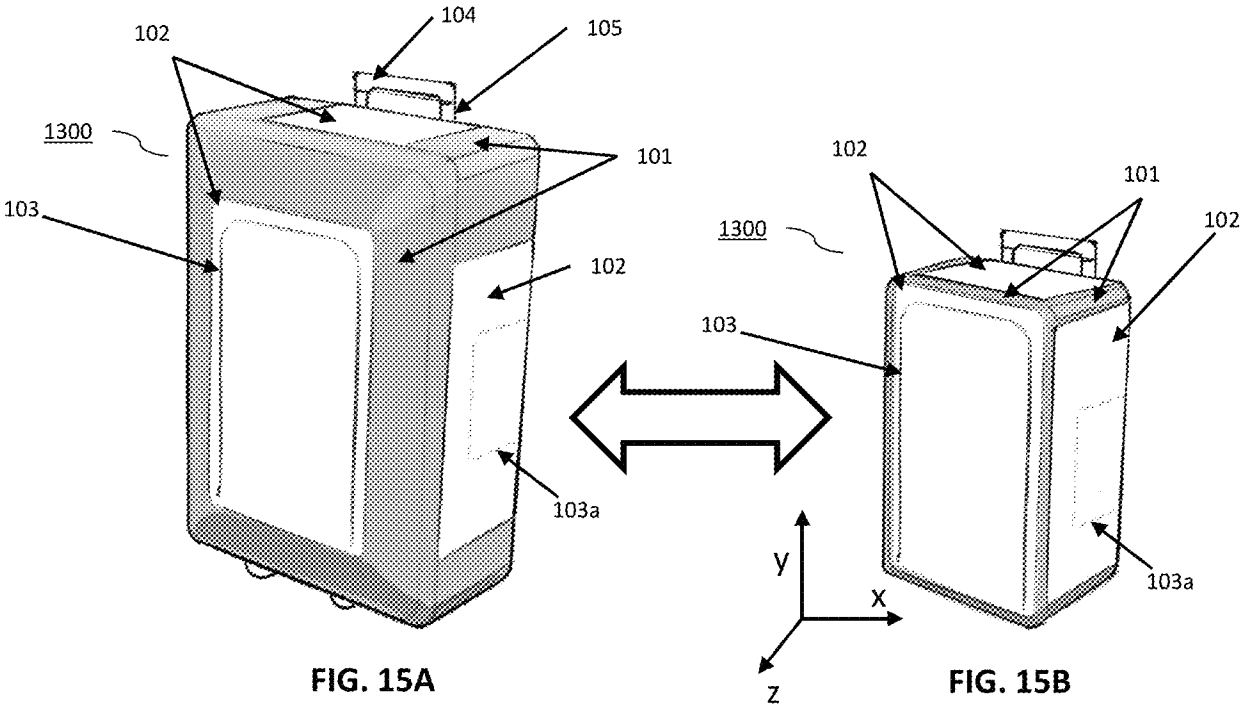
Figure 16A:
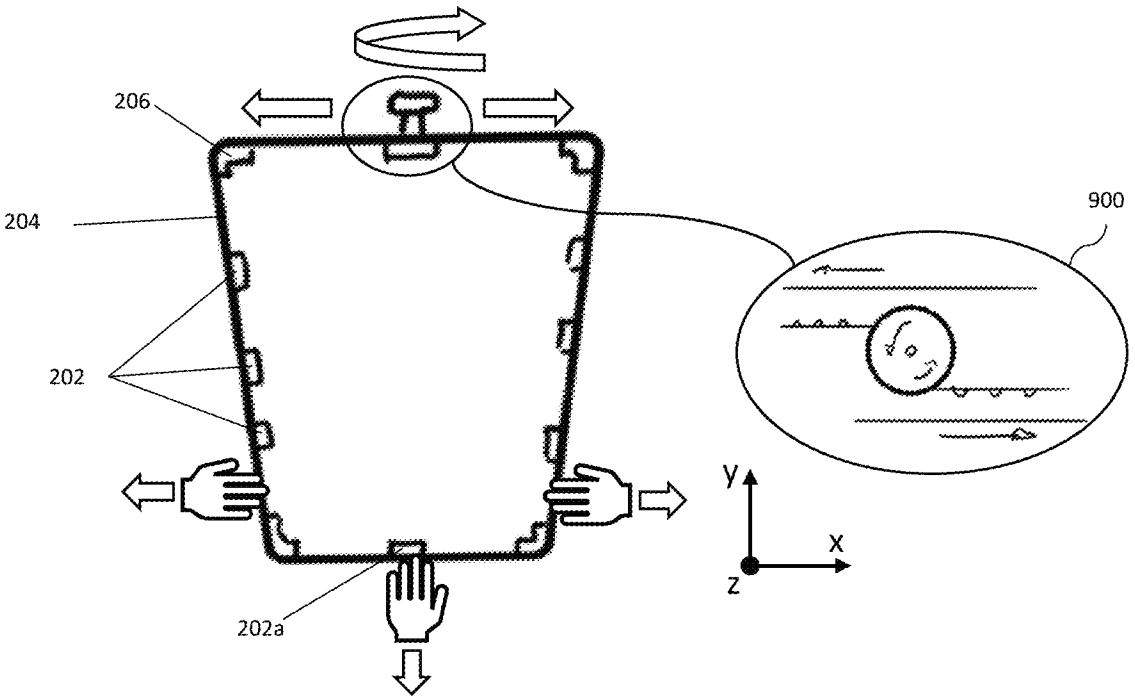
Figure 16B:
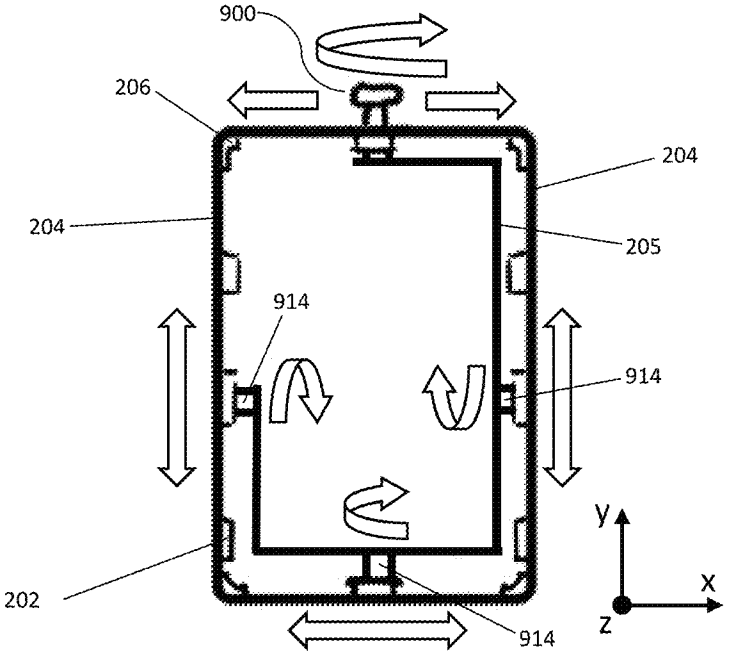
Figure 16C:
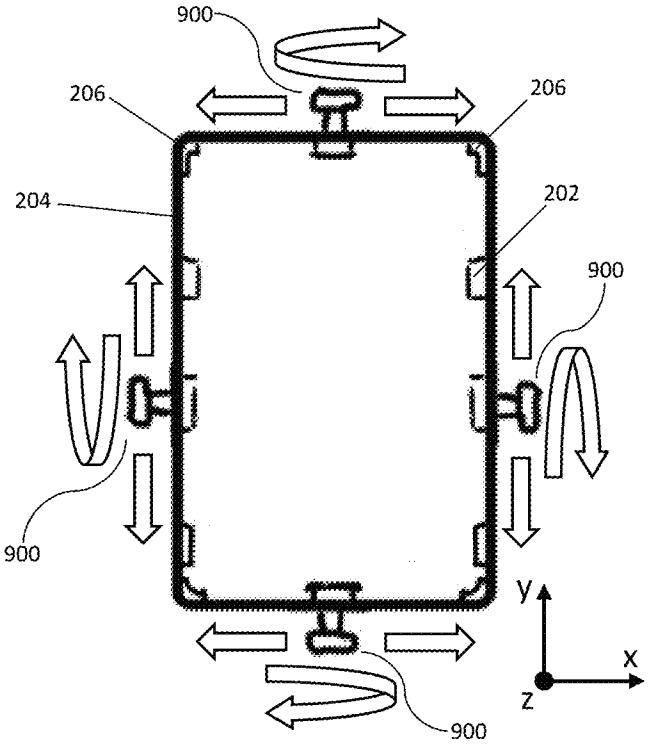
Figure 17:
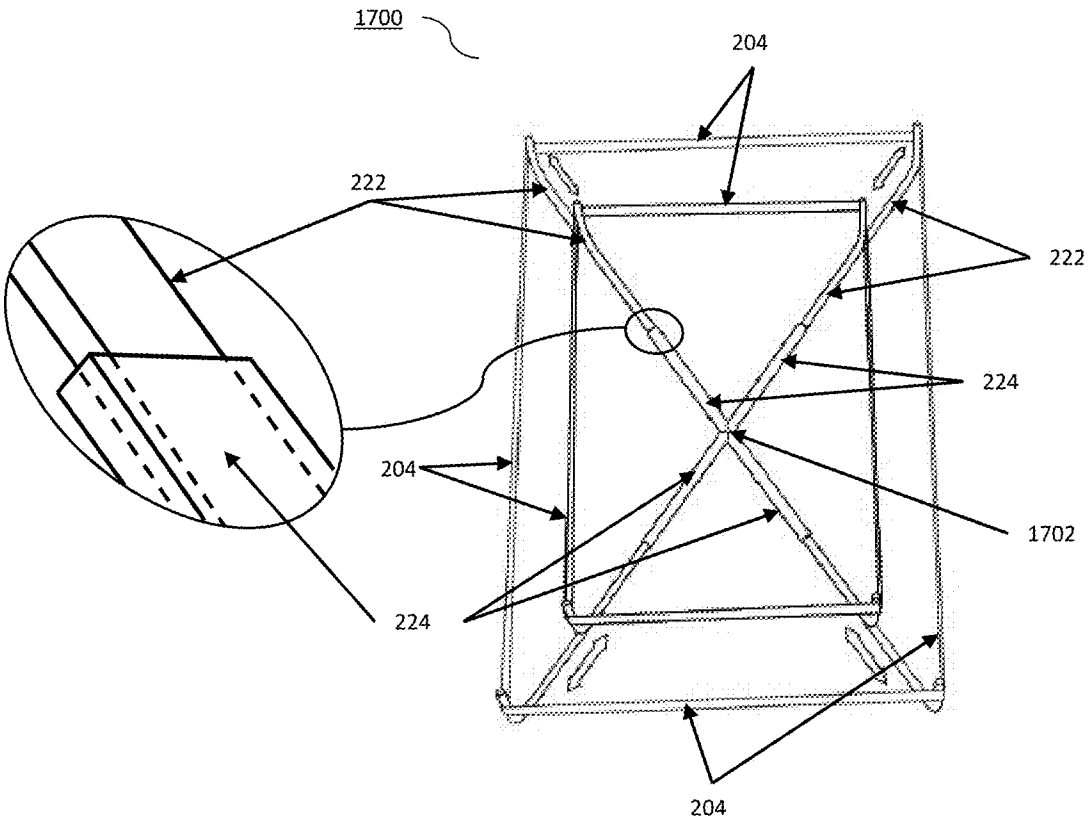
Figures 18A, 18B:
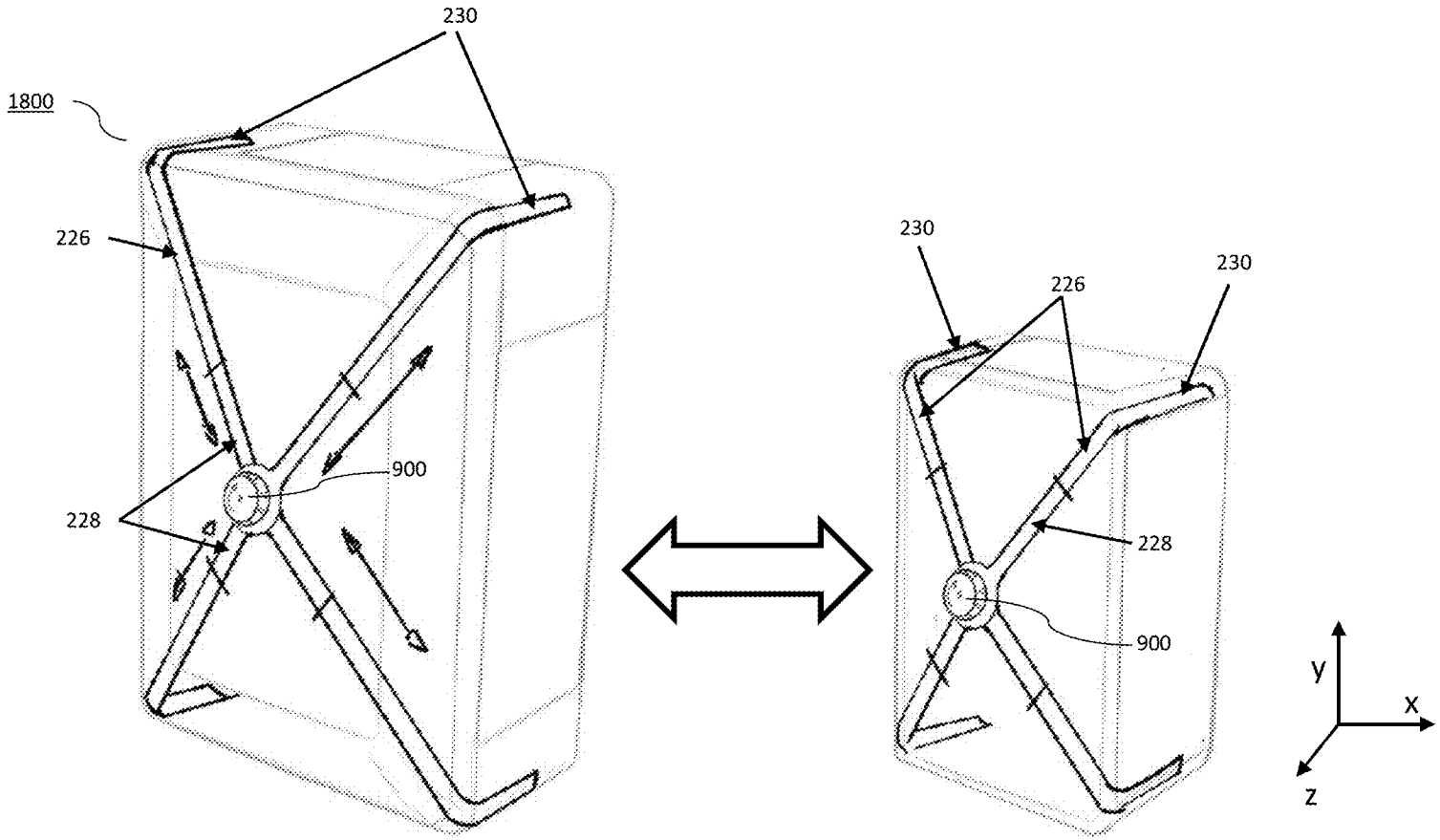
Figure 18C:
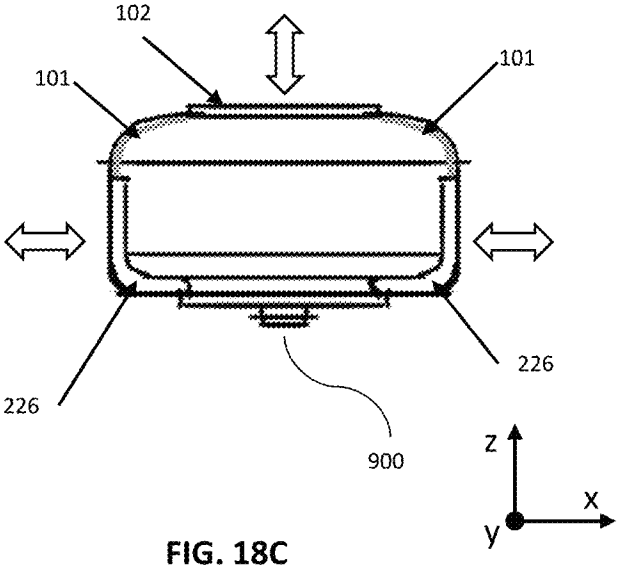
Figure 18D:
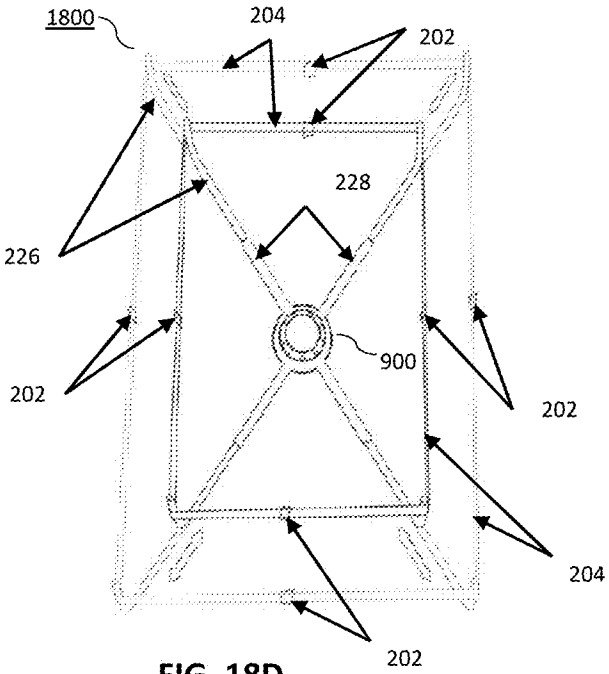
Figure 19B:
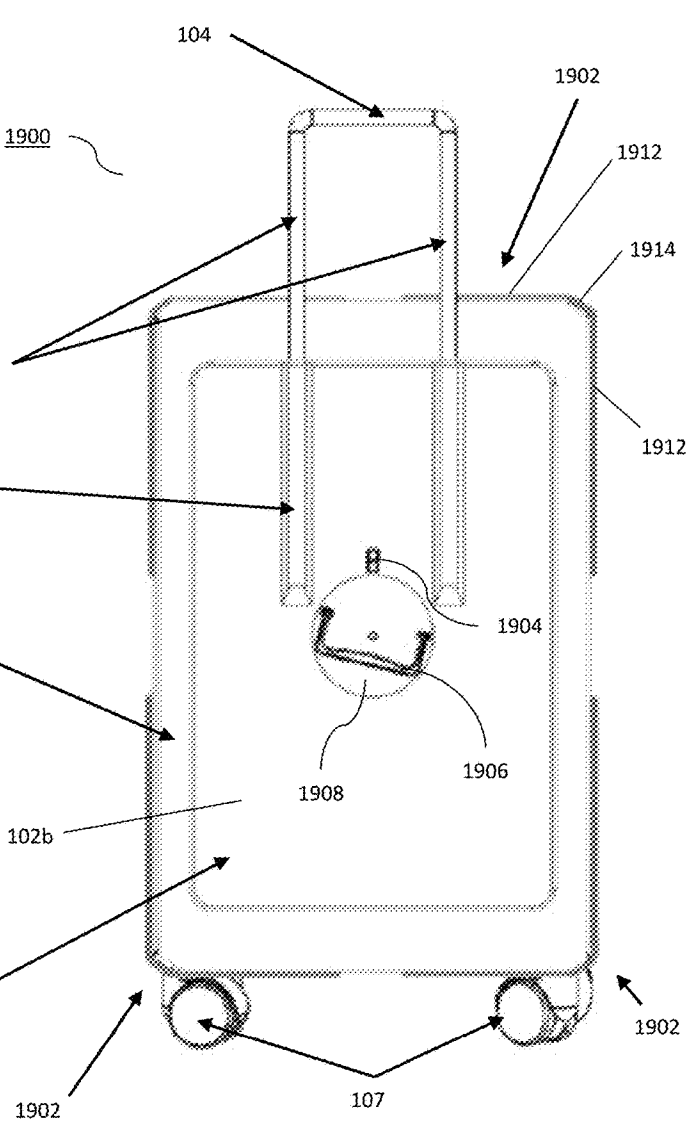
Figure 19A:
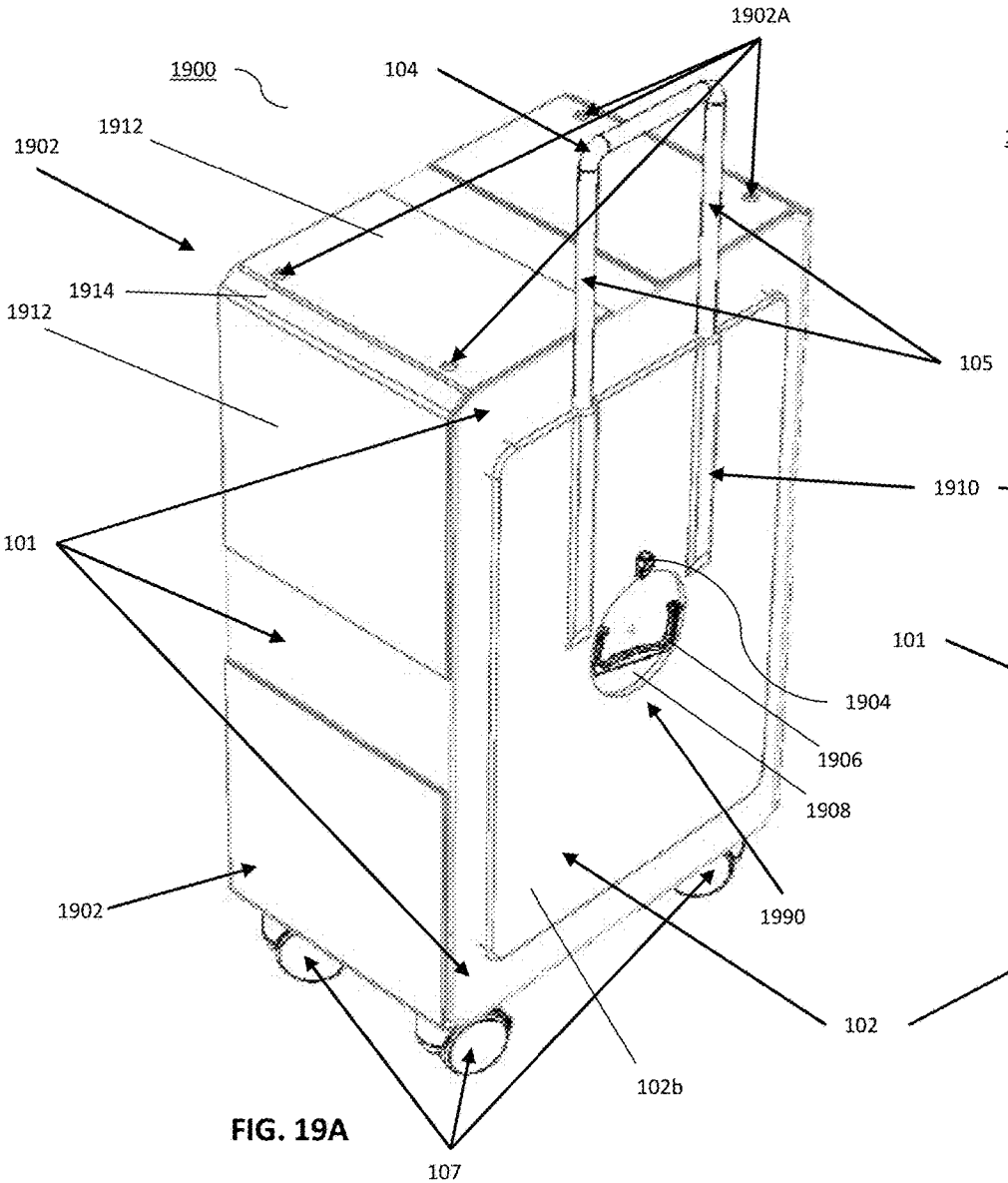
Figures 20A, 20B:
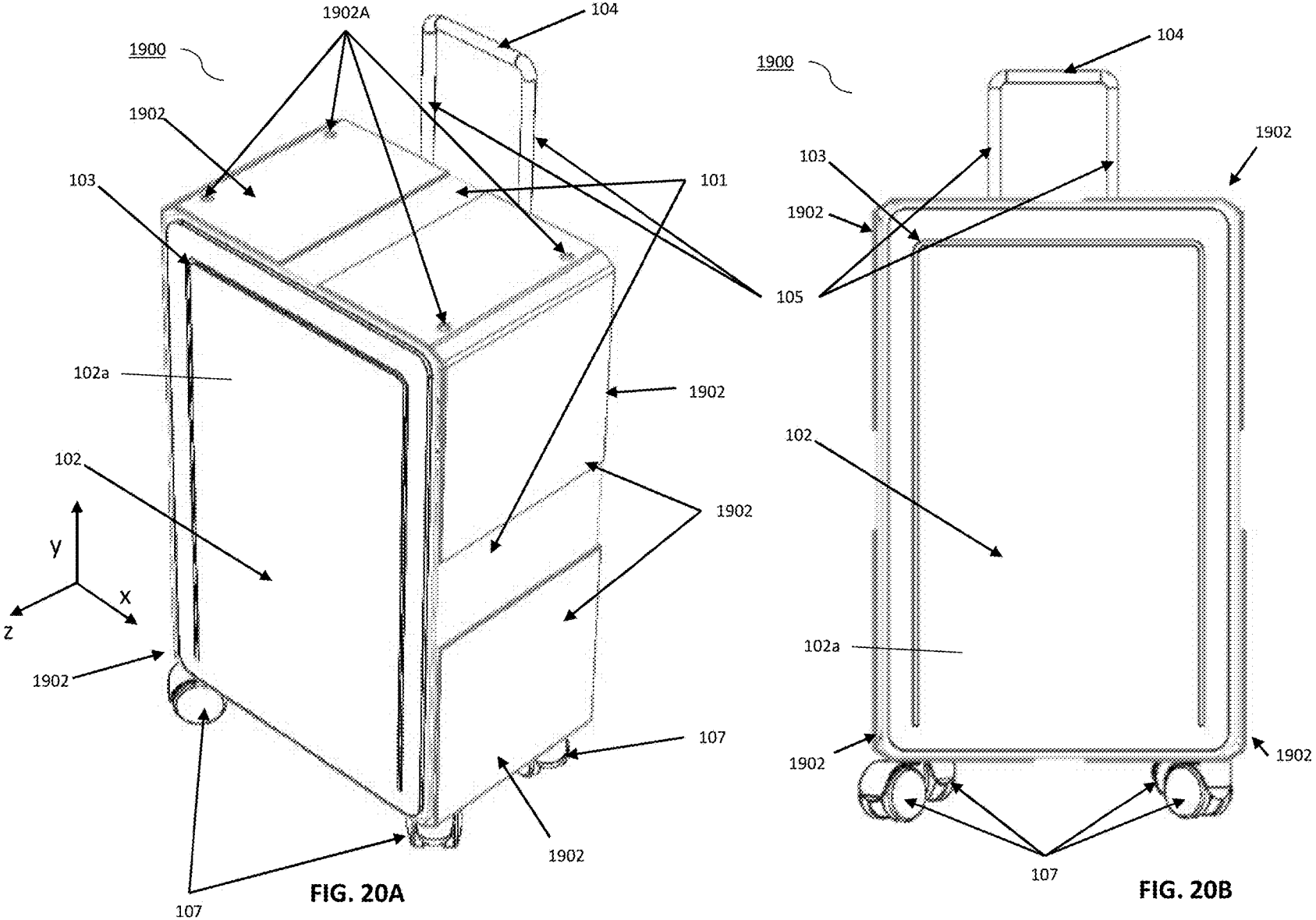
Figure 21B:
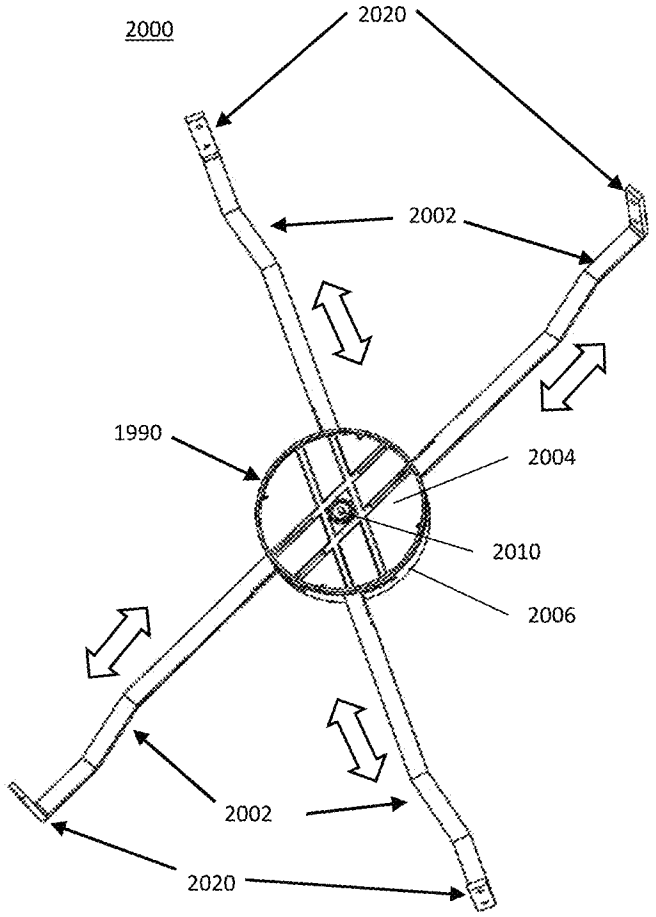
Figure 21A:
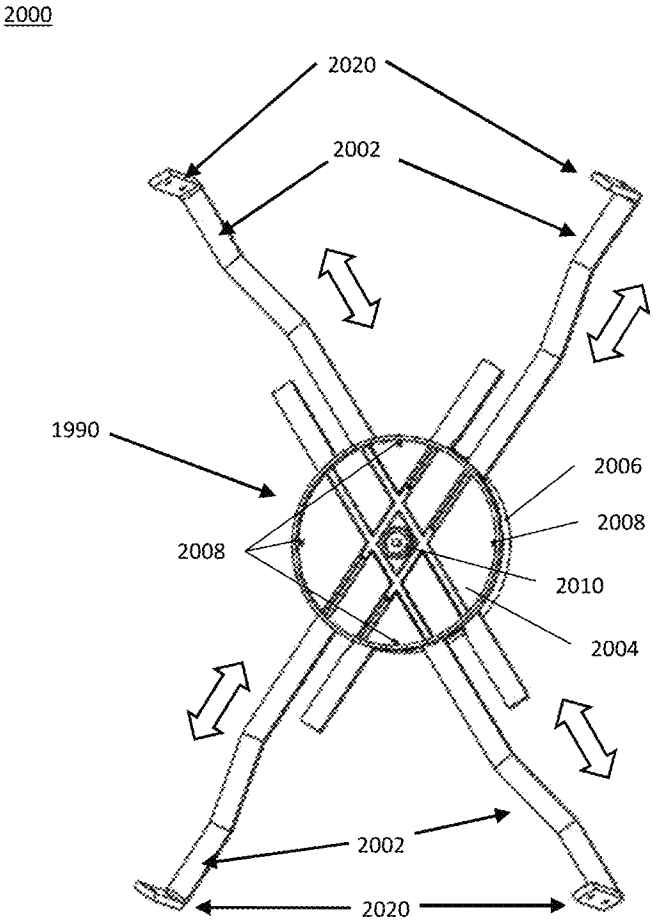
Figures 22A, 22B:
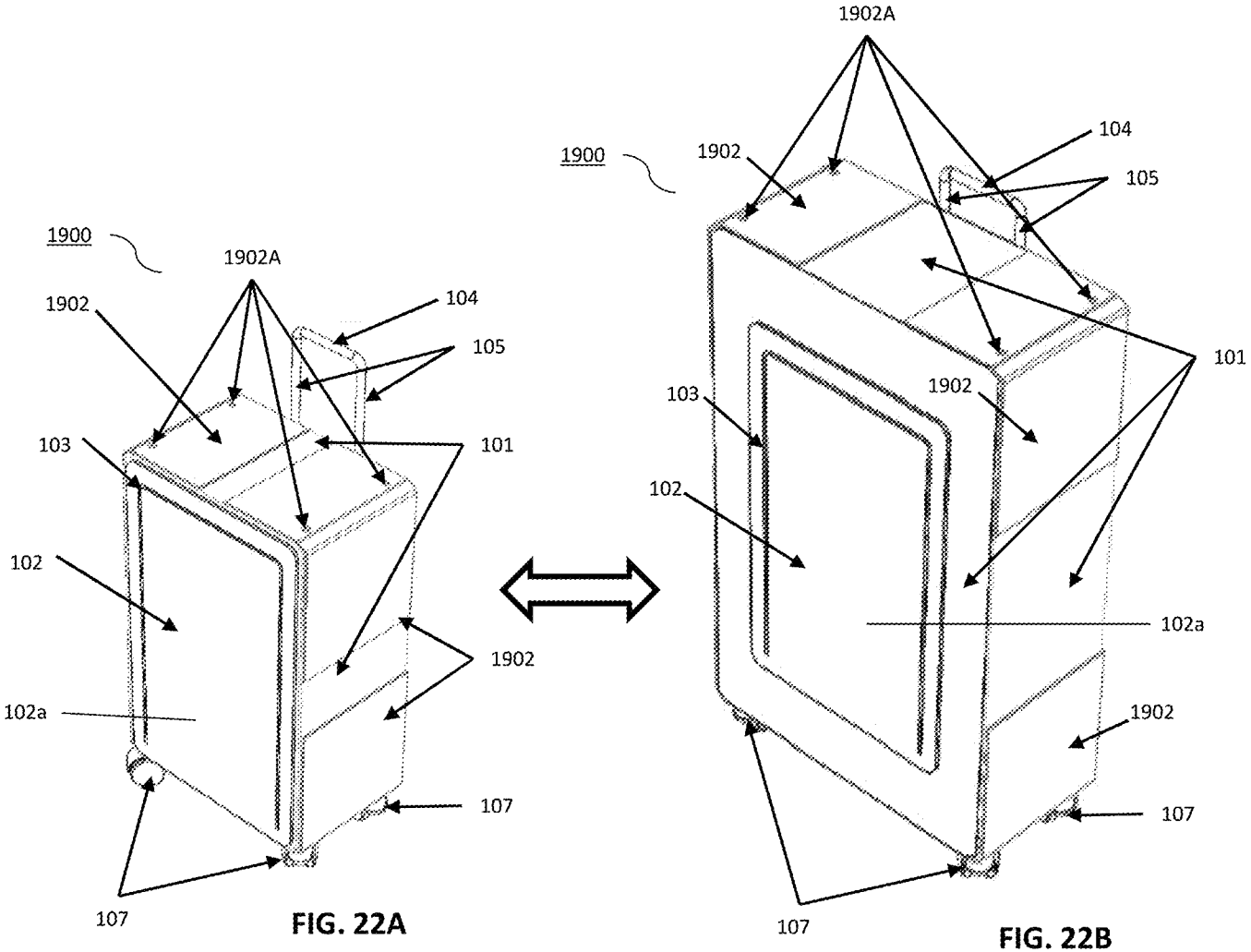
Figure 23B:
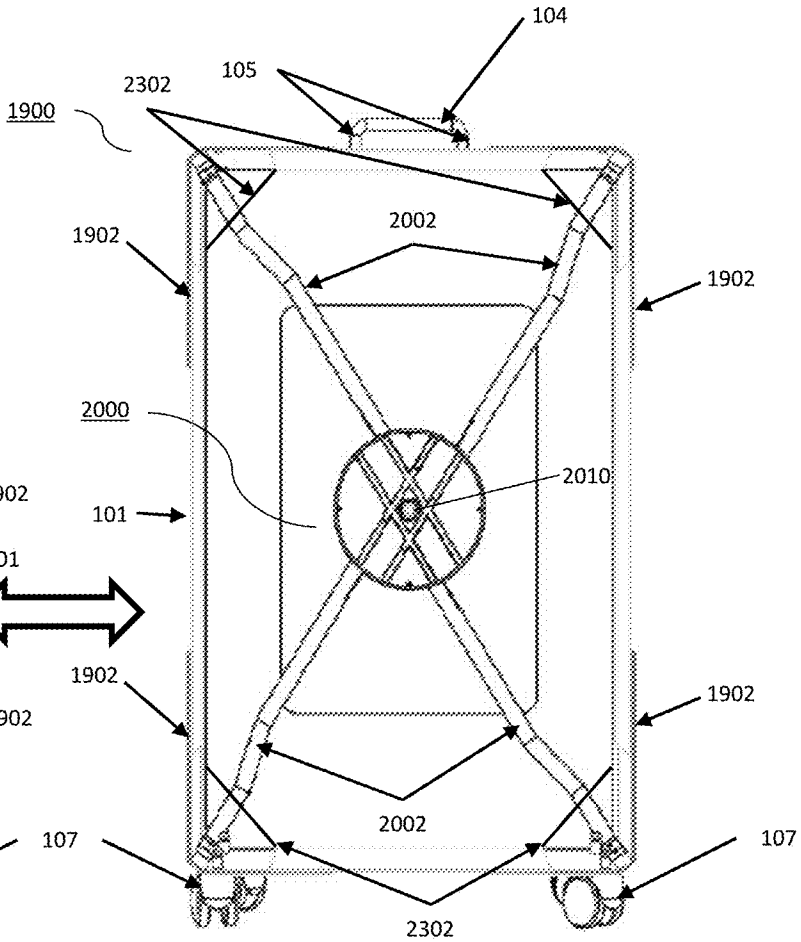
Figure 23A:
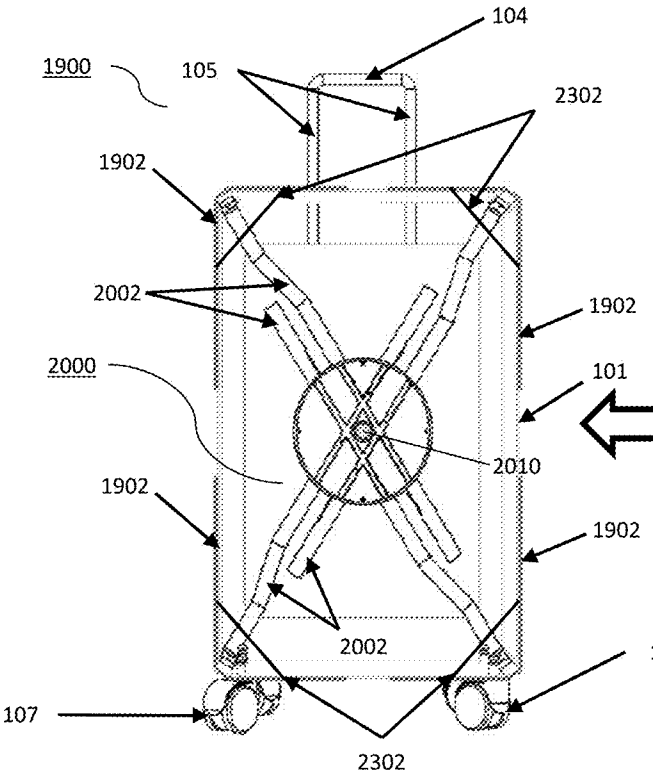
Figures 24A, 24B:
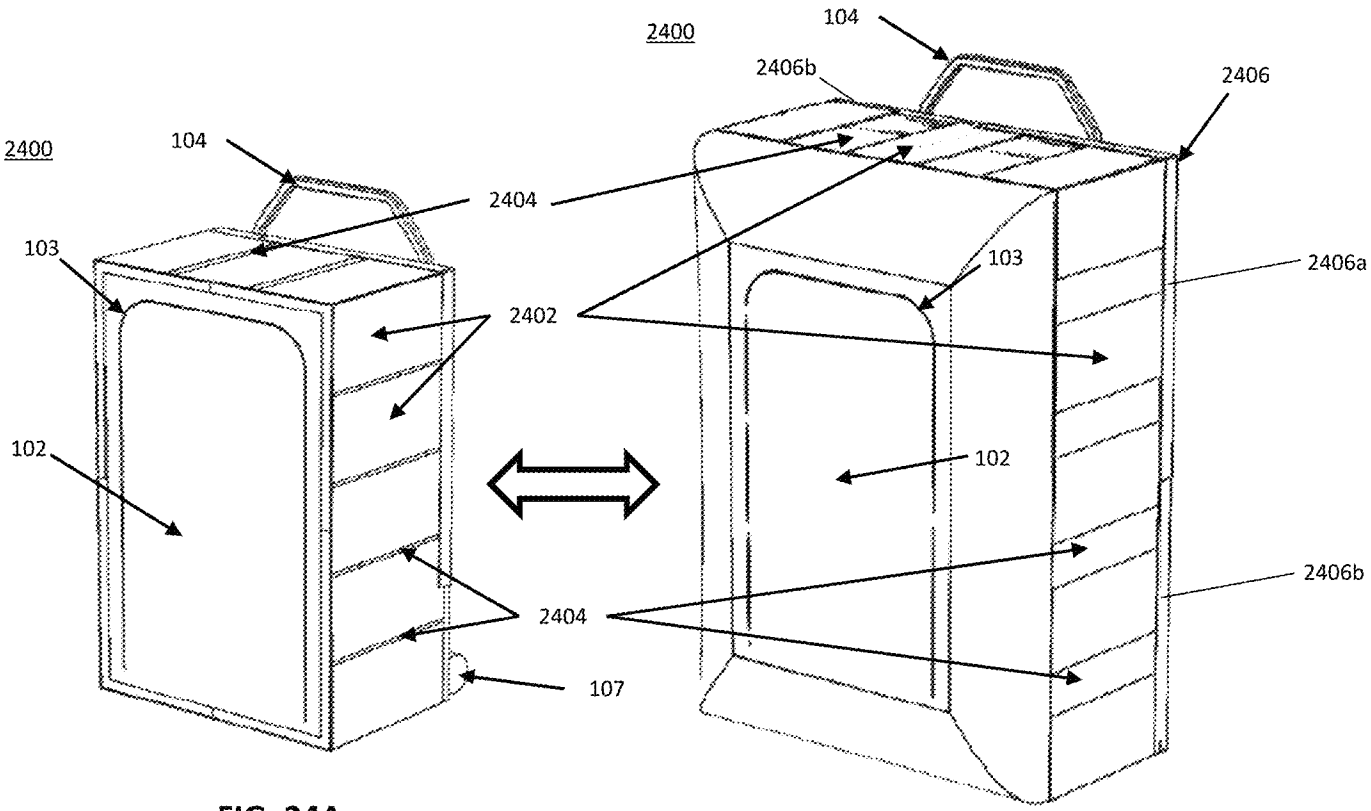
Figures 25A, 25B:
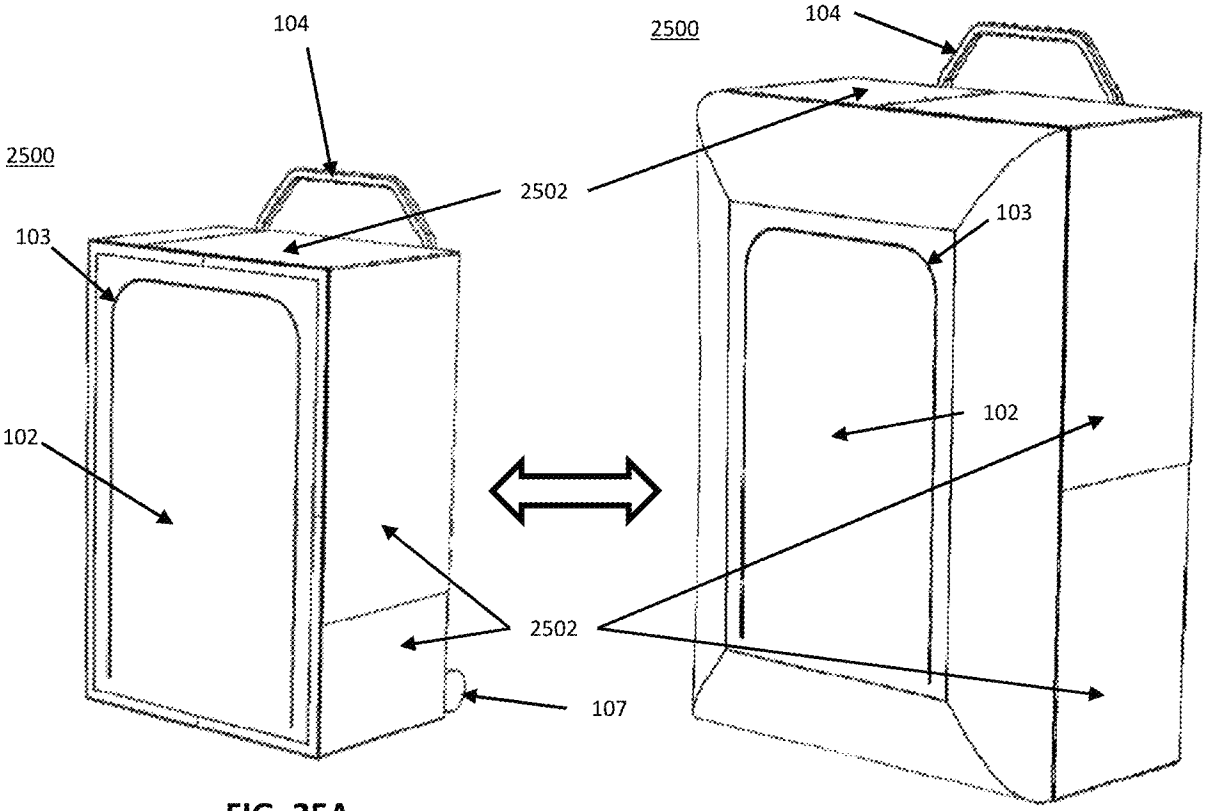
Figure 26A:
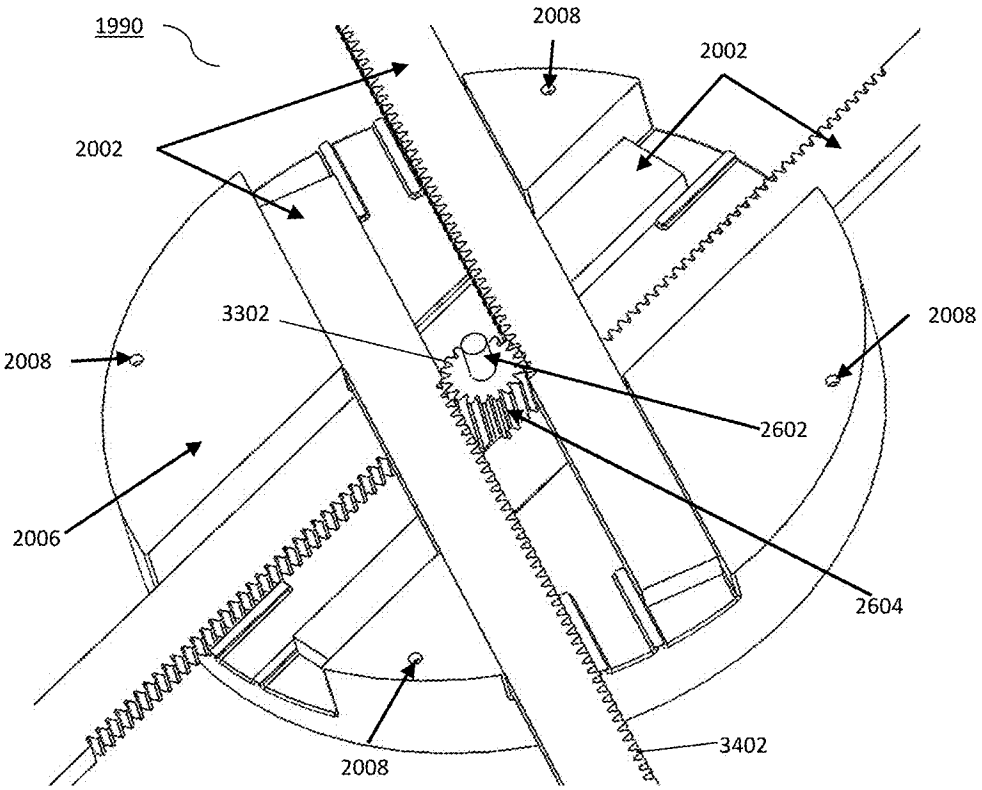
Figure 26B:
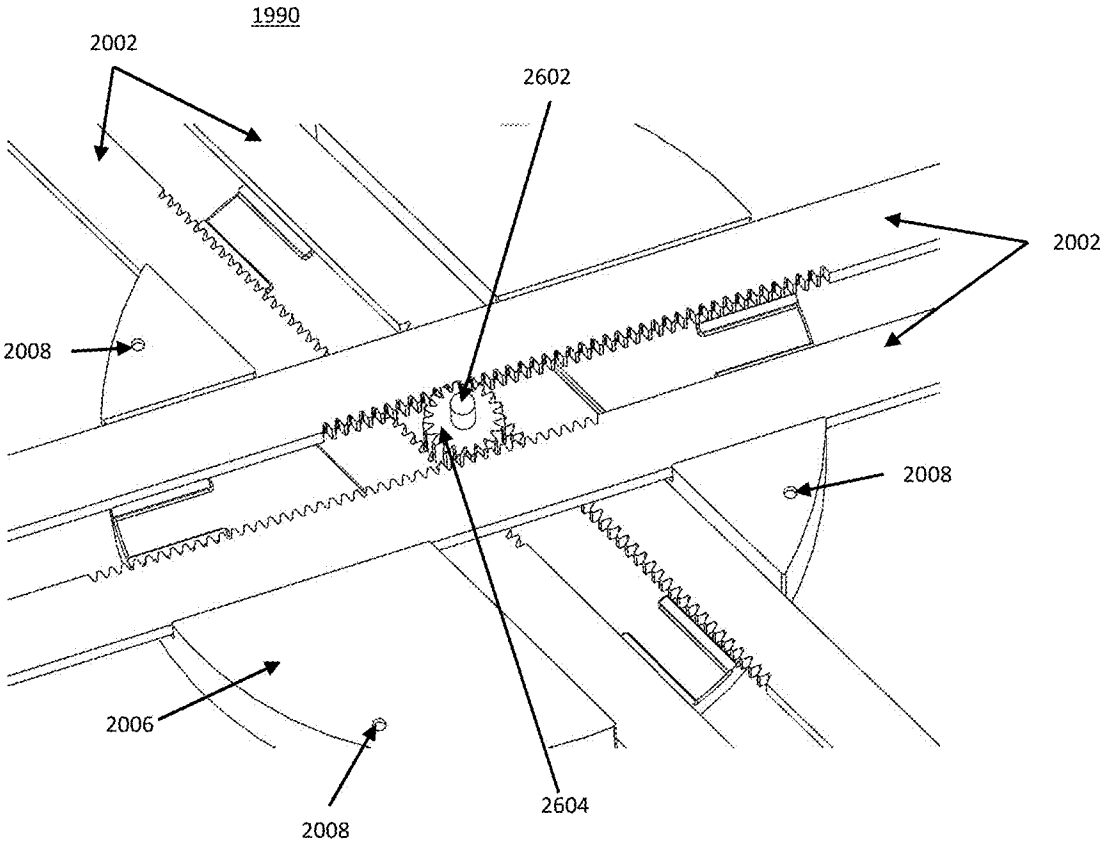
Figure 27A:
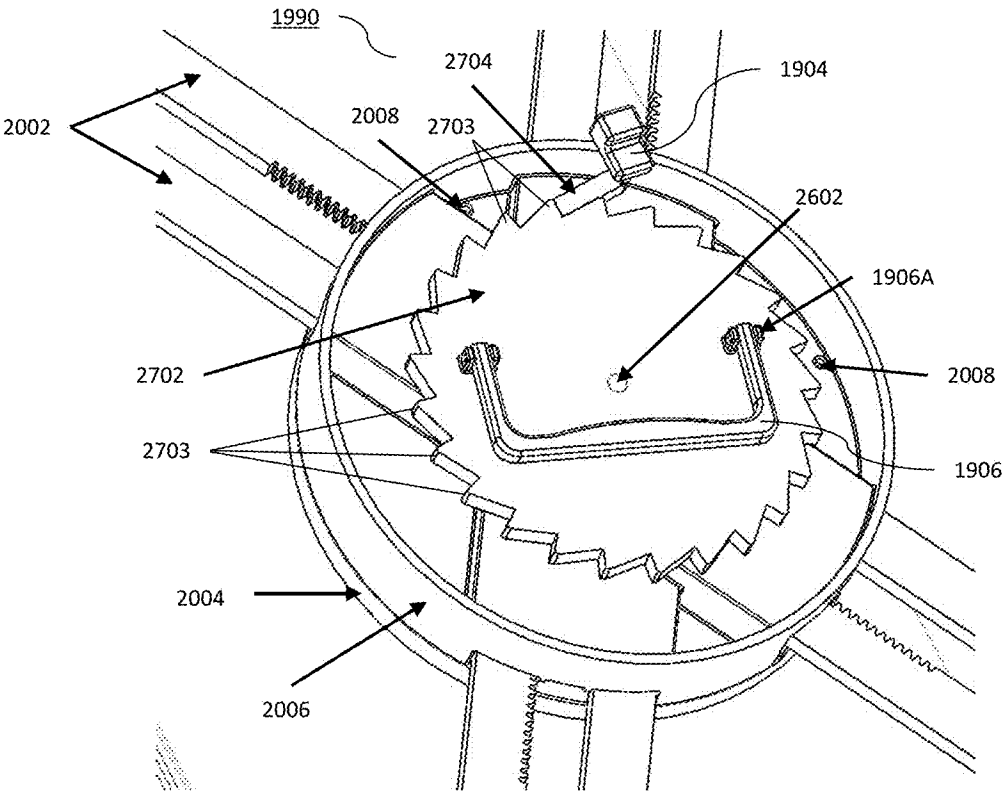
Figure 27B:
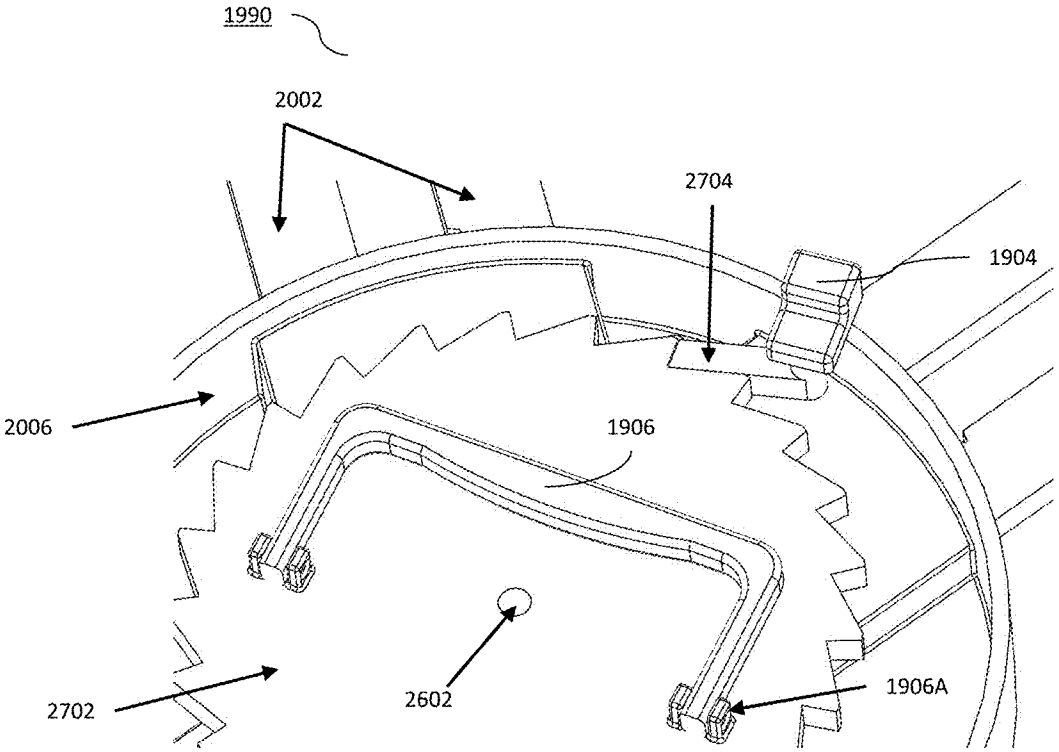
Figure 28B:
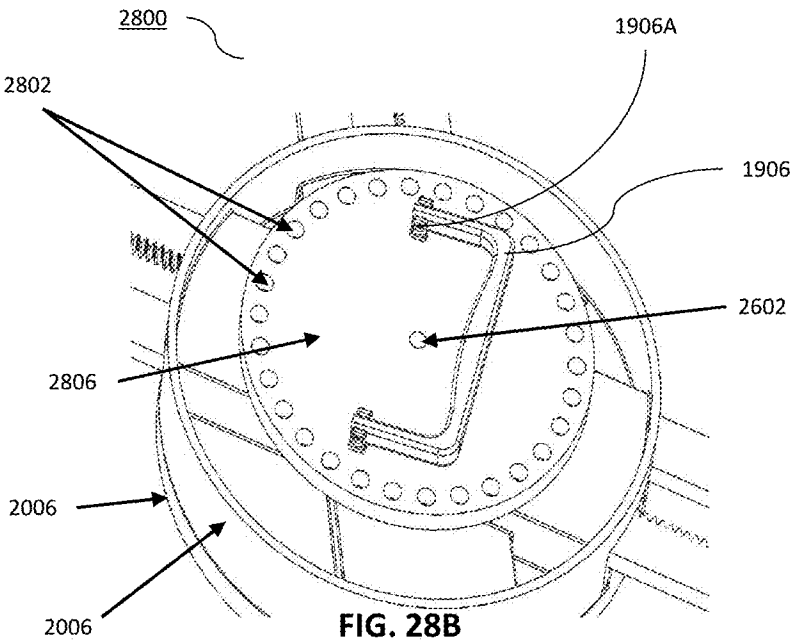
Figure 28A:
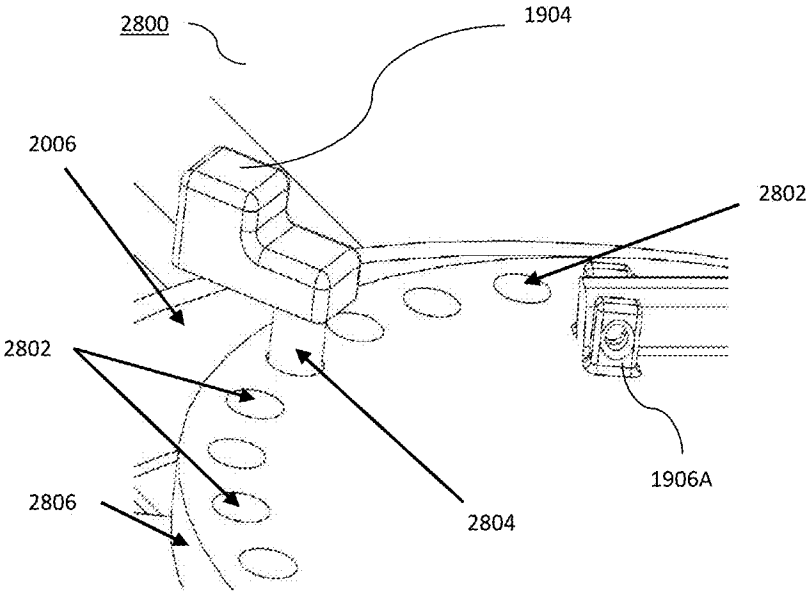
Figure 29B:
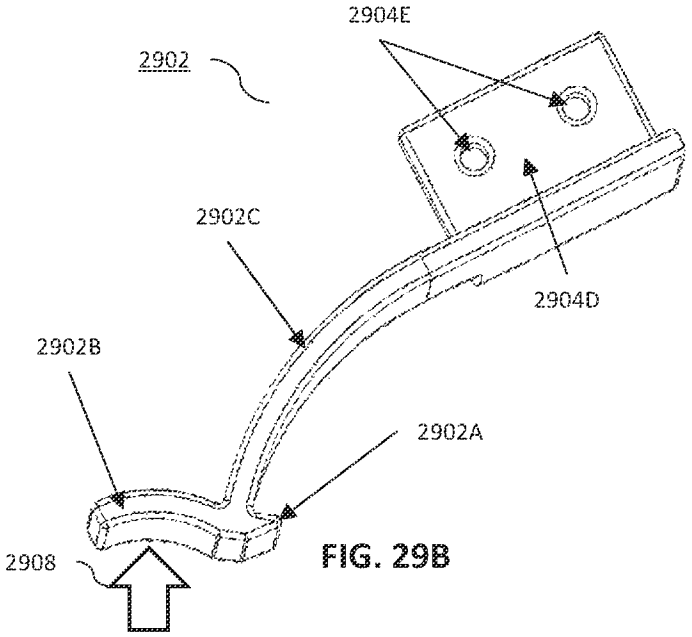
Figure 29A:
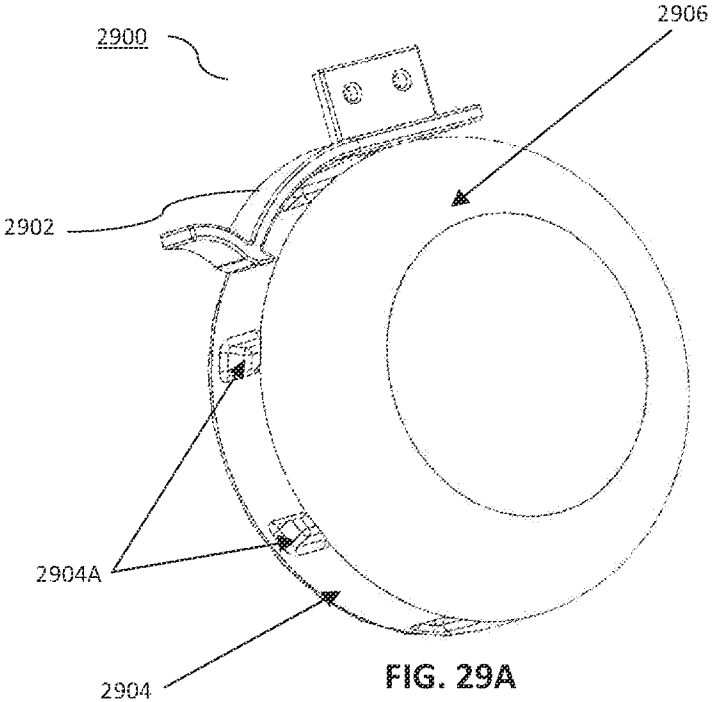
Figures 30A, 30B:
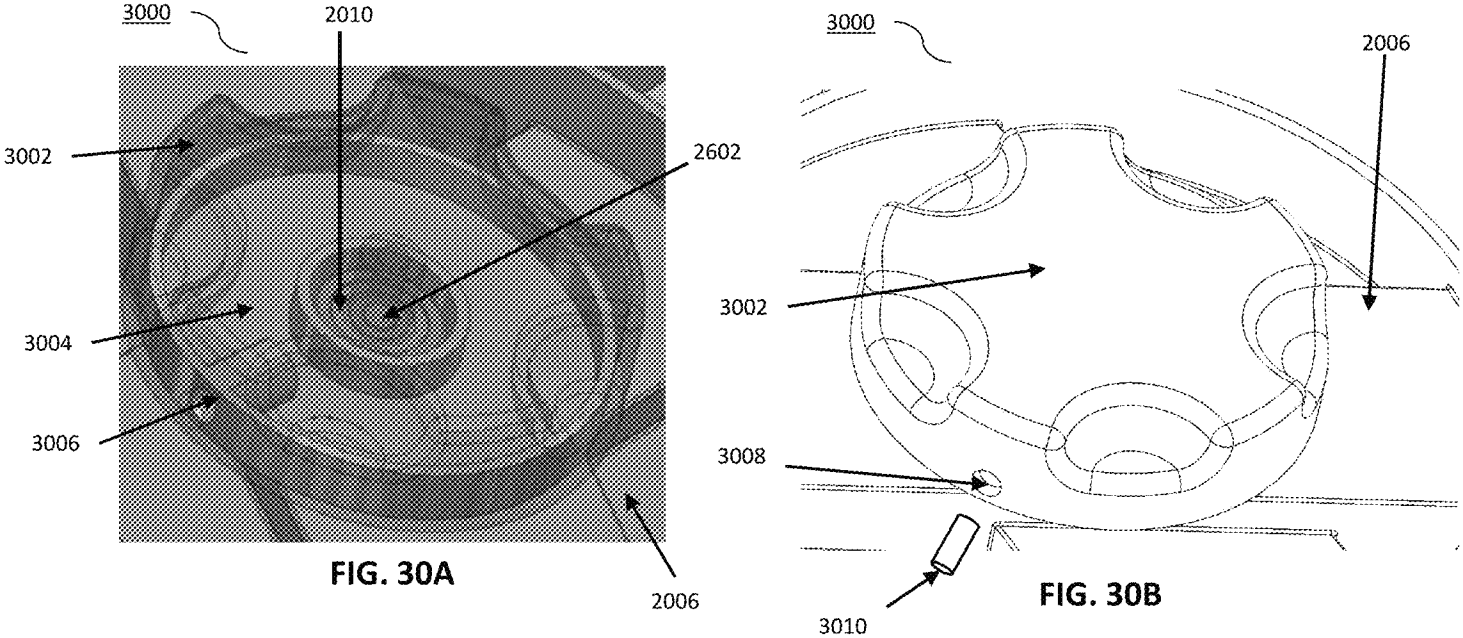
Figure 31:
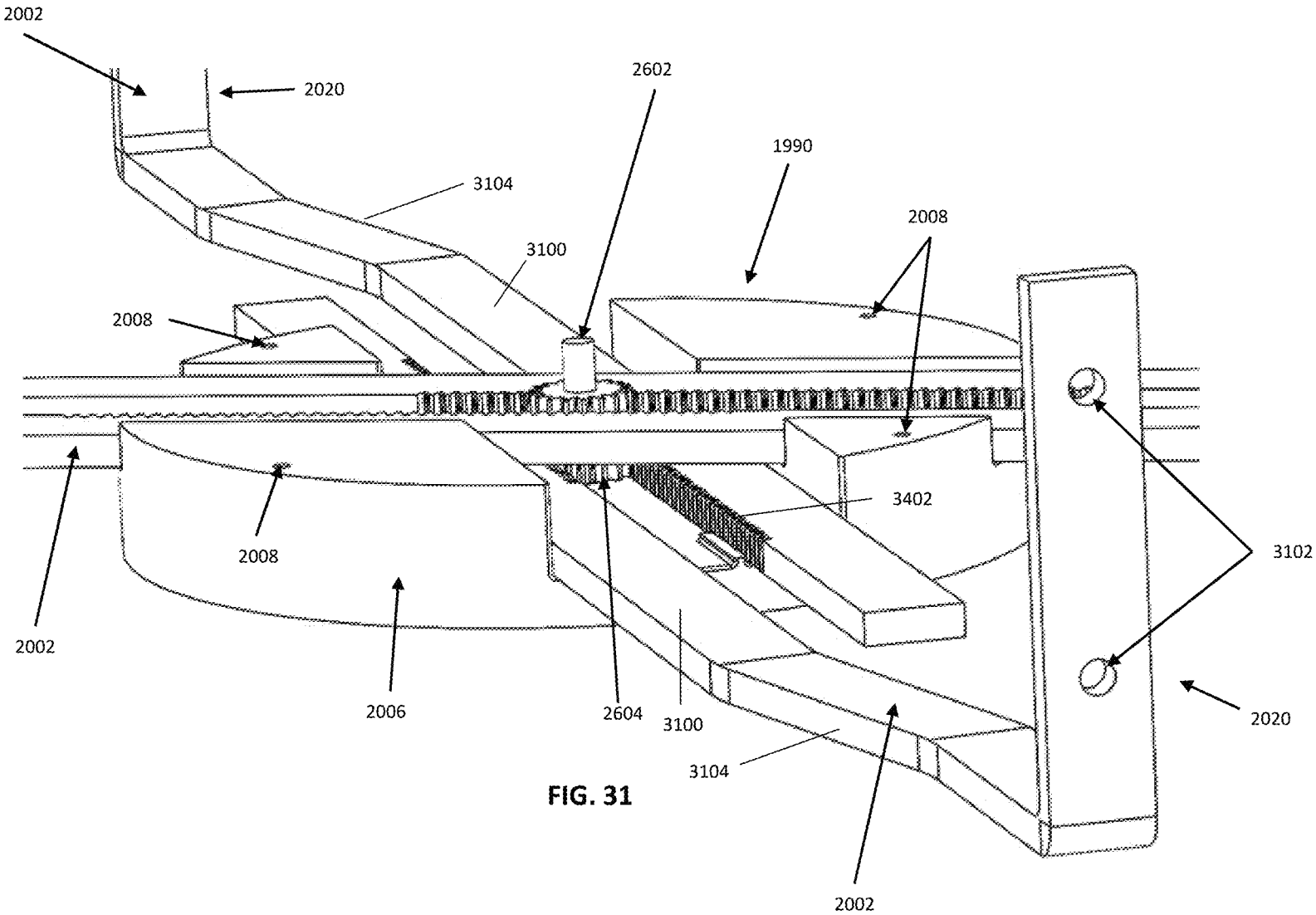
Figure 32A:
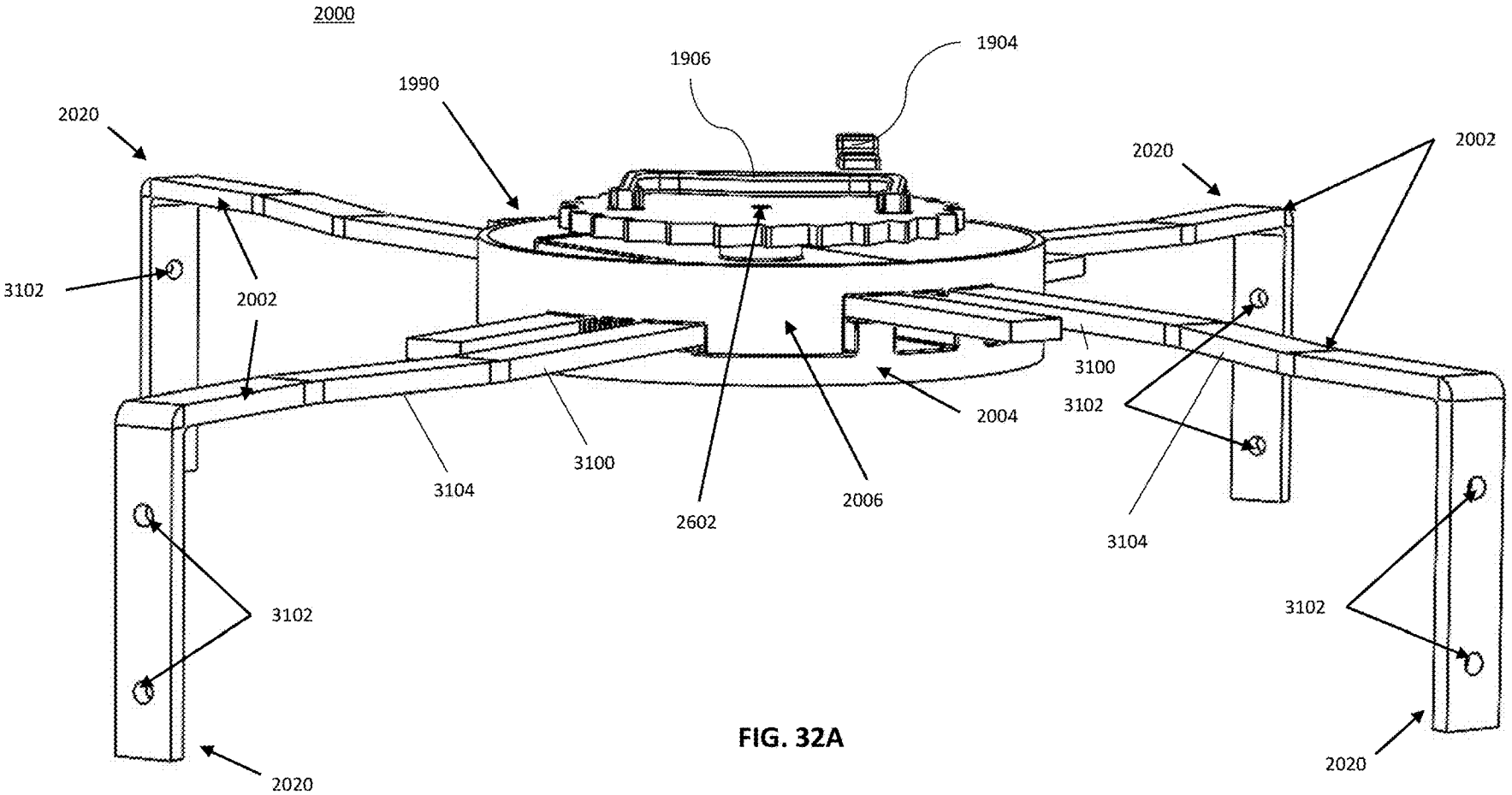
Figure 32B:
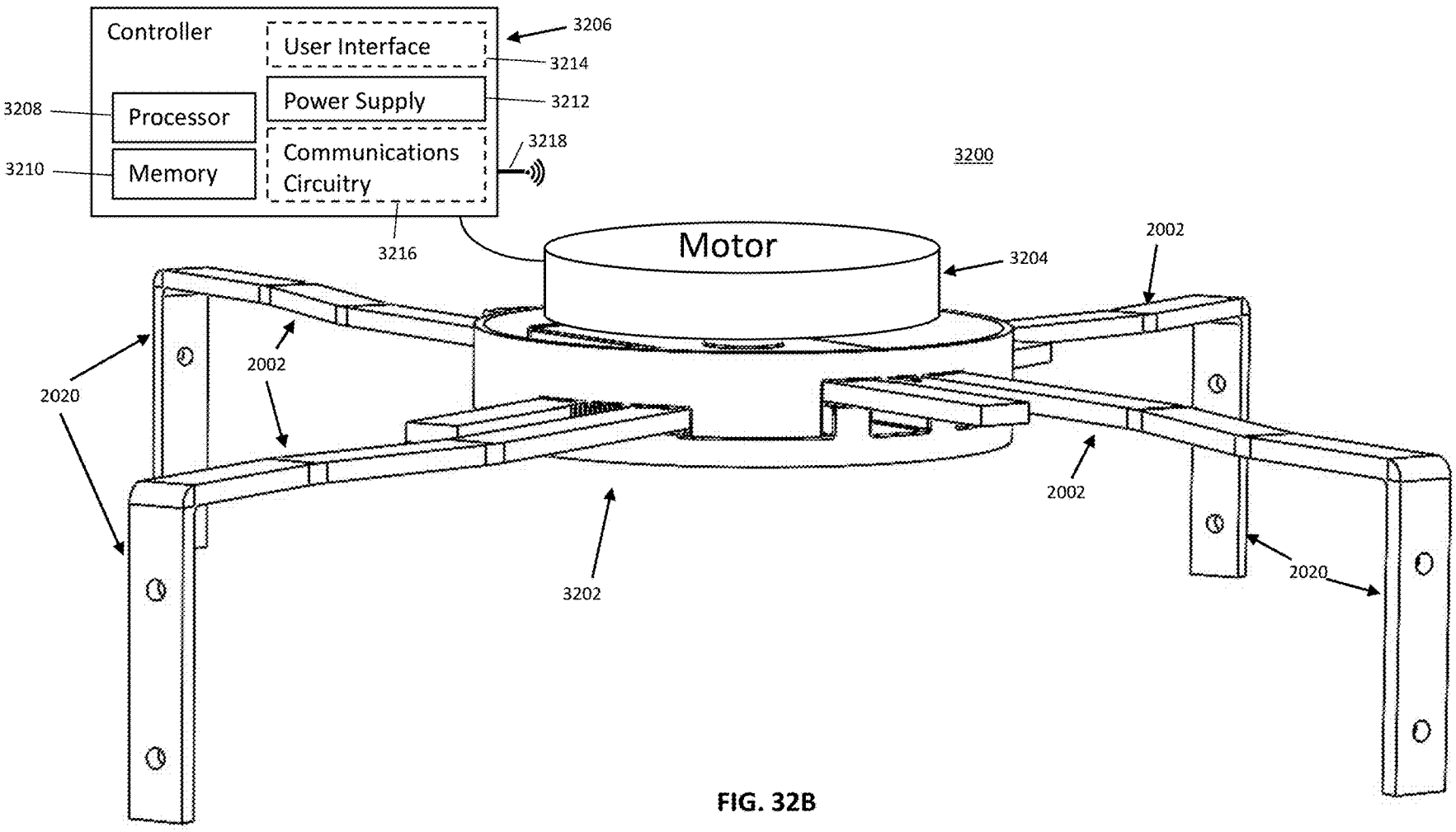
Figure 33:
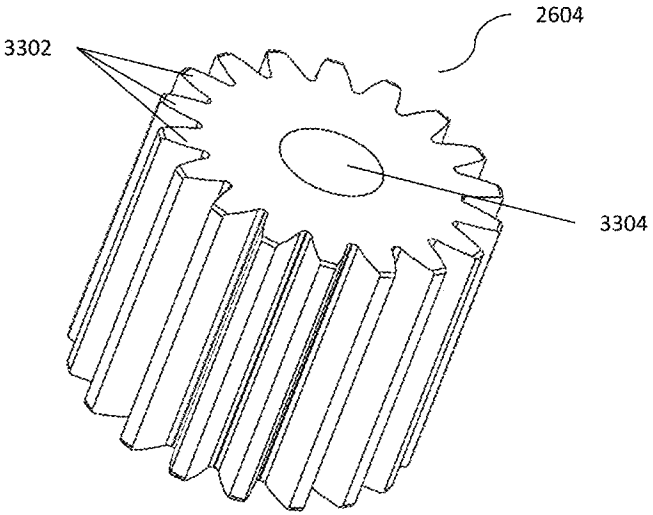
Figure 34:
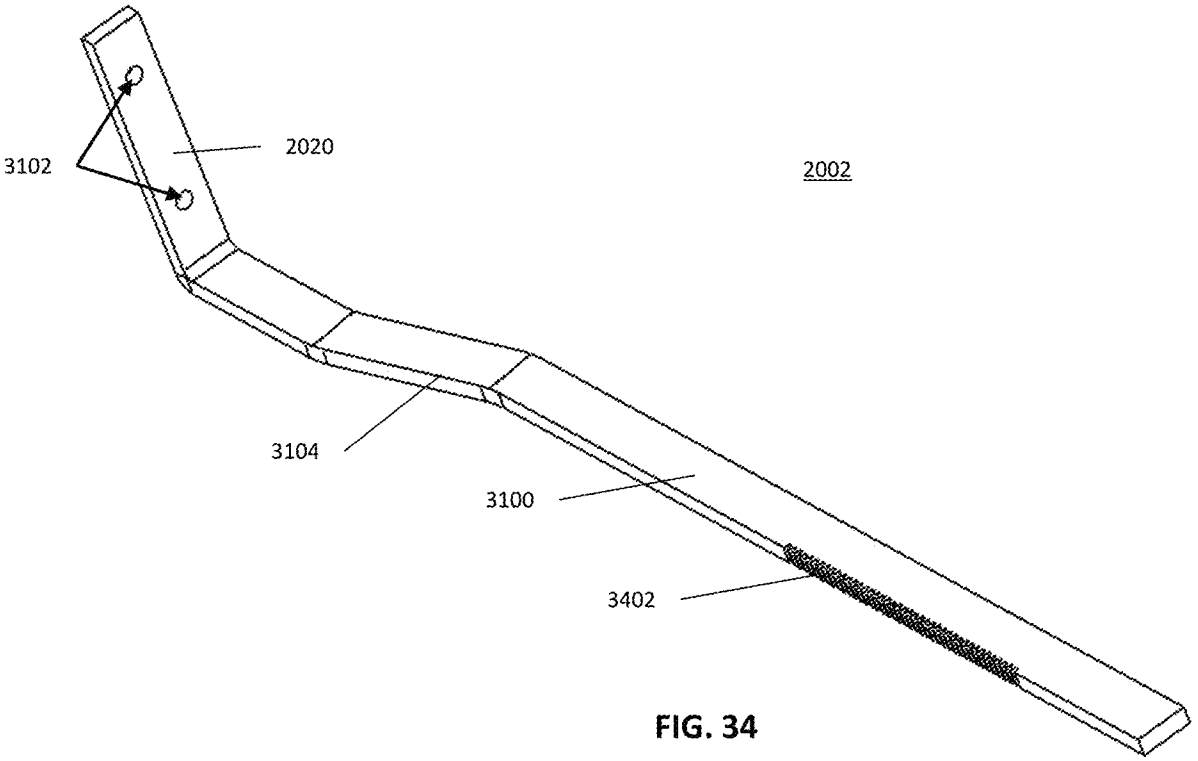
Figure 35A:
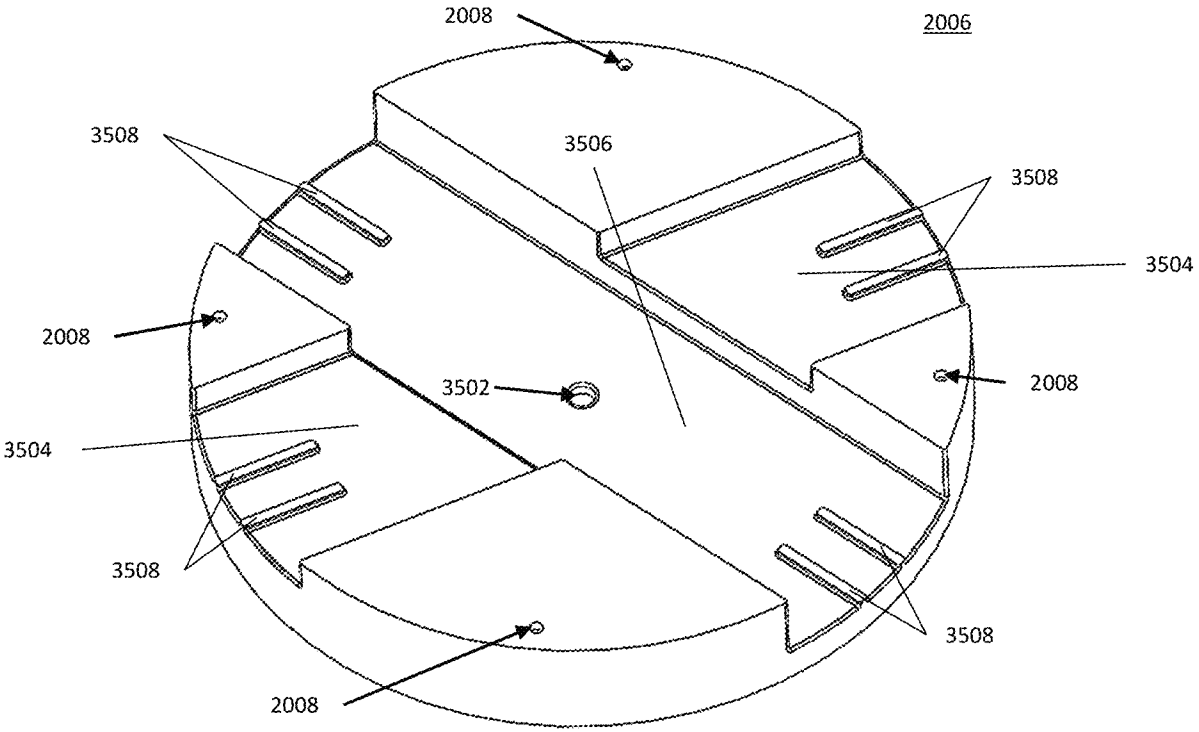
Figure 35B:
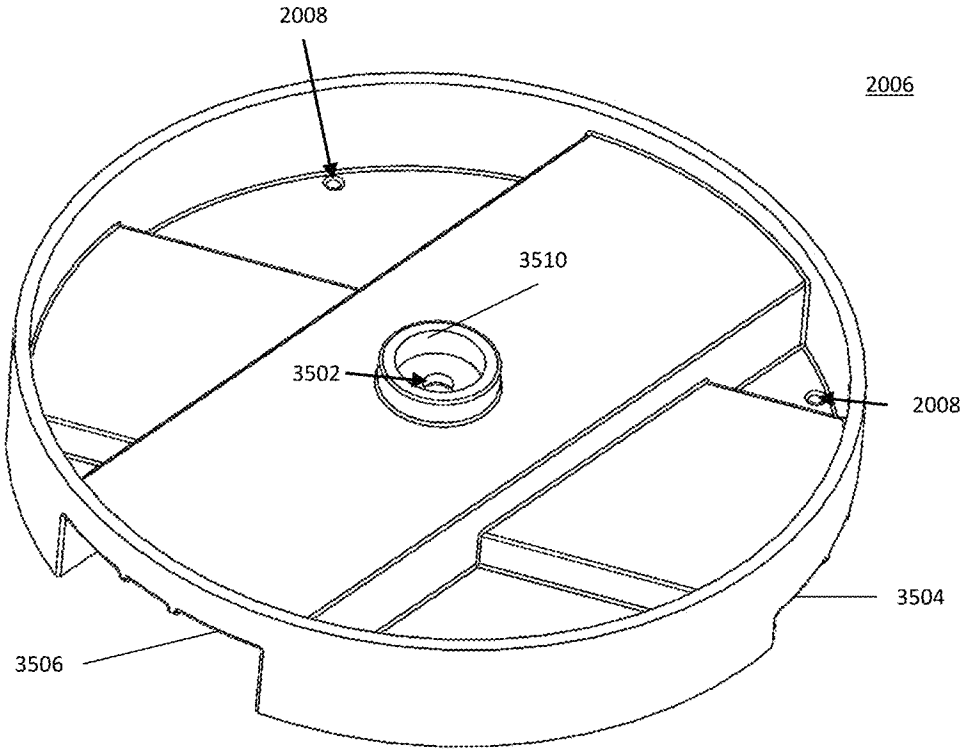
Figure 36A:
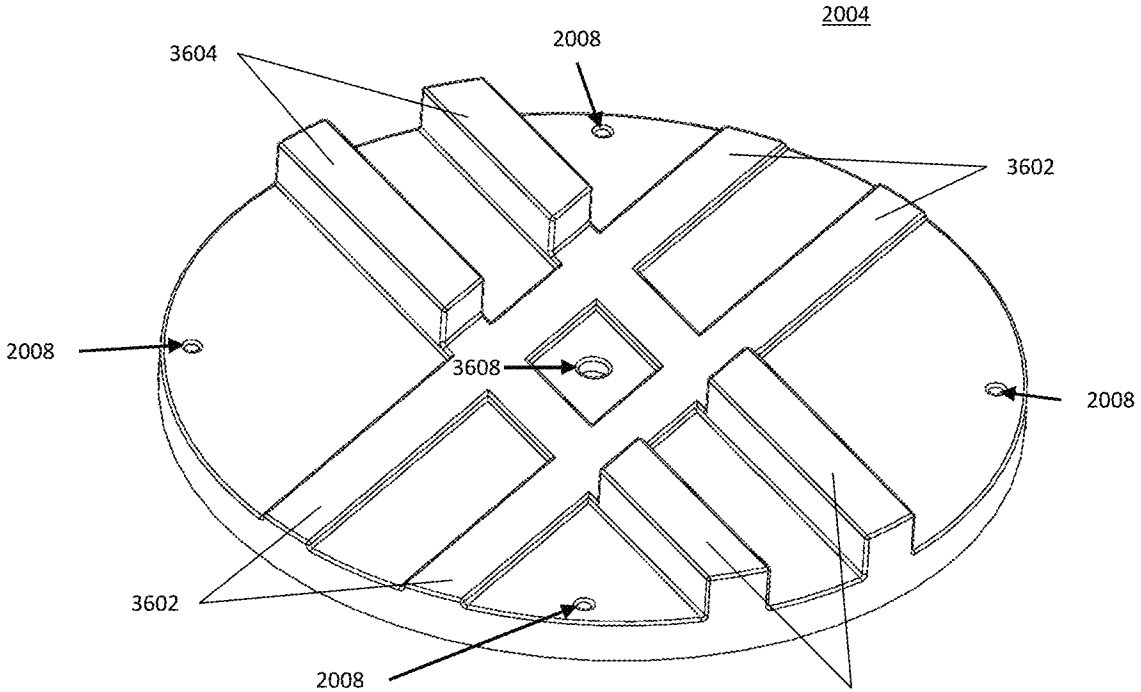
Figure 36B:
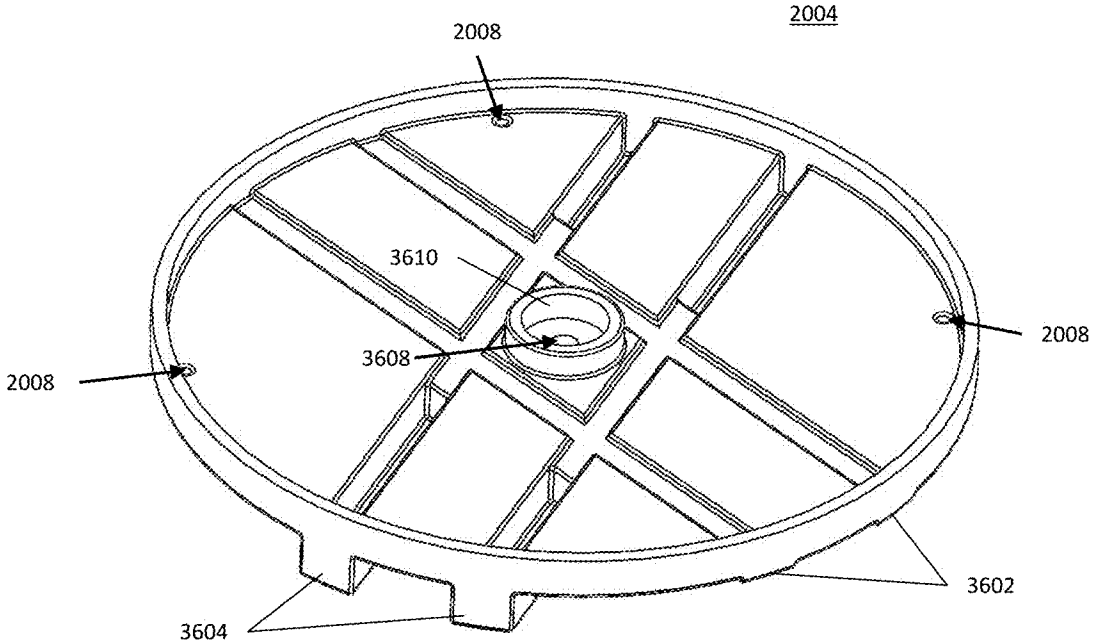
Figure 37:
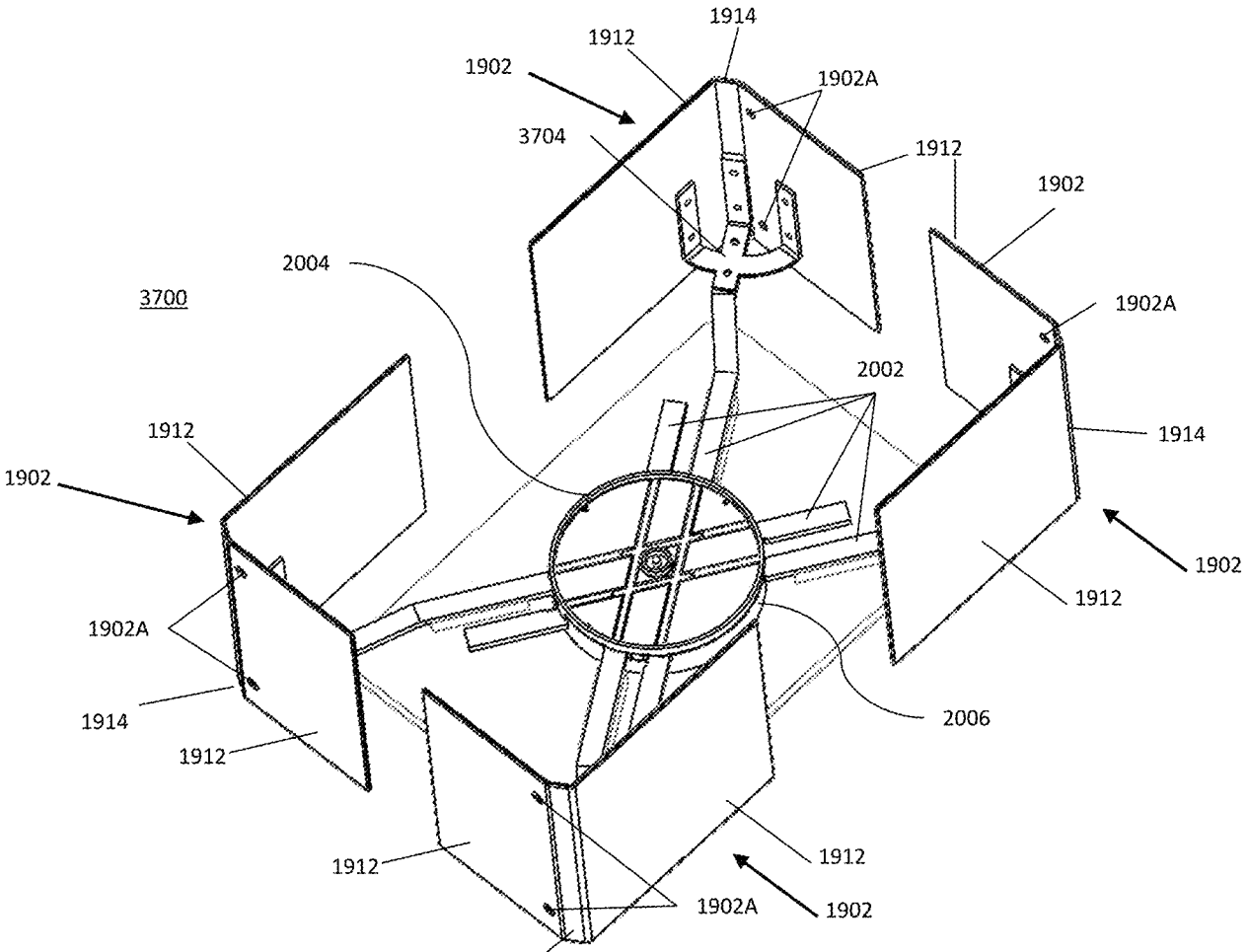
Figure 38:
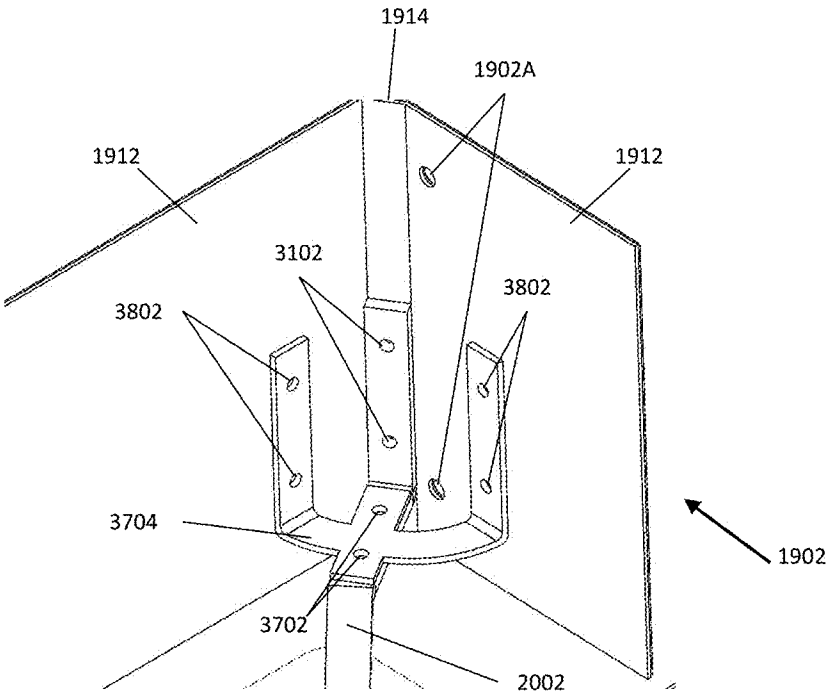
Figure 39:
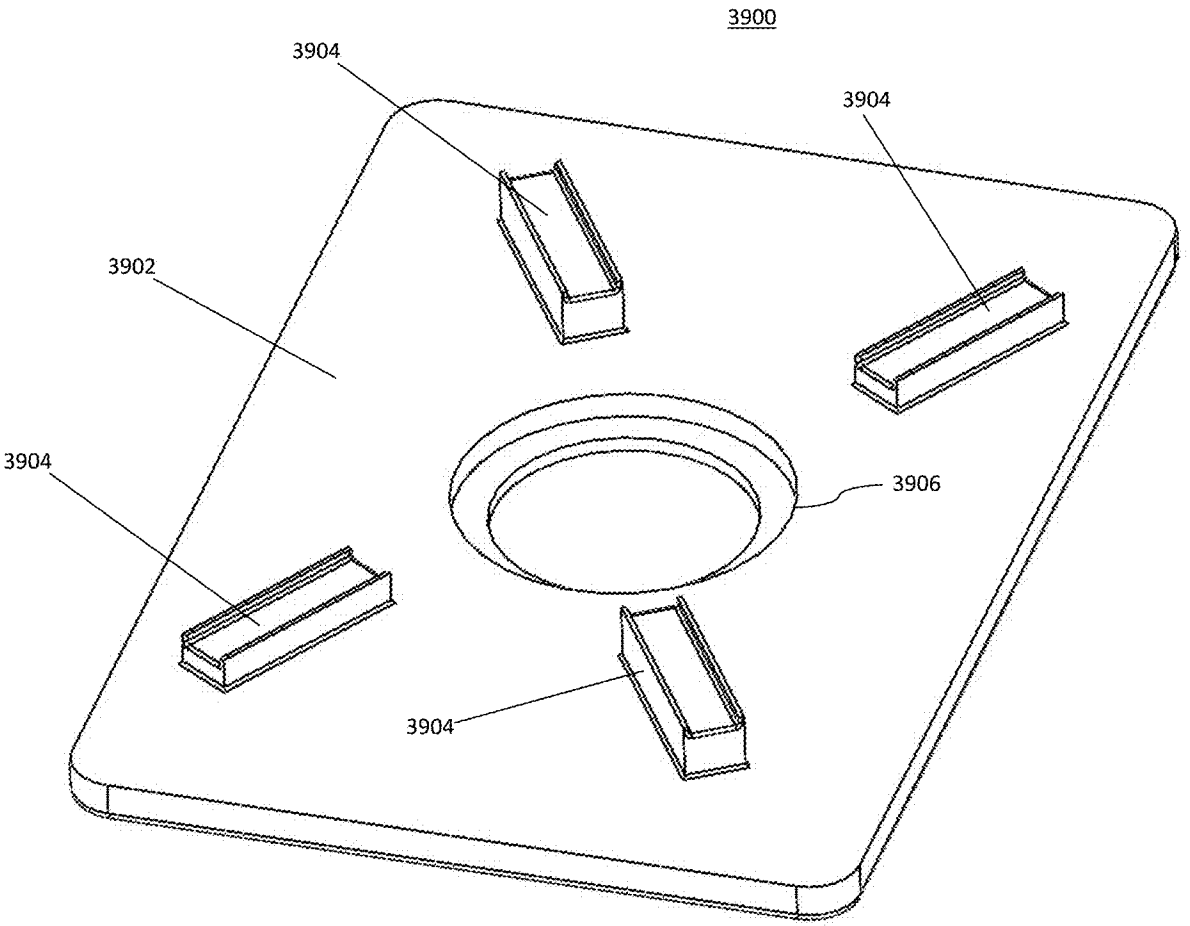
Figure 40:
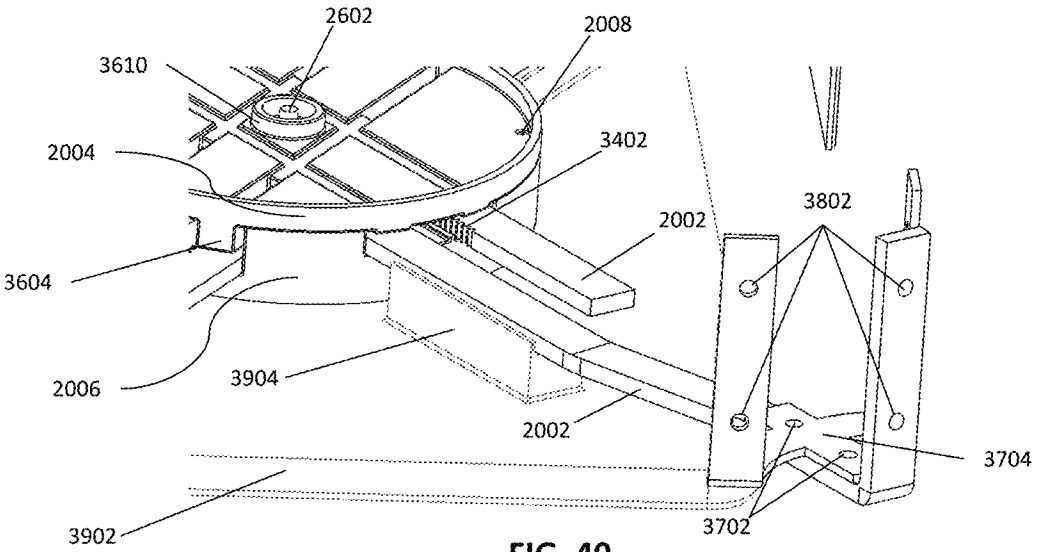
Figure 41:
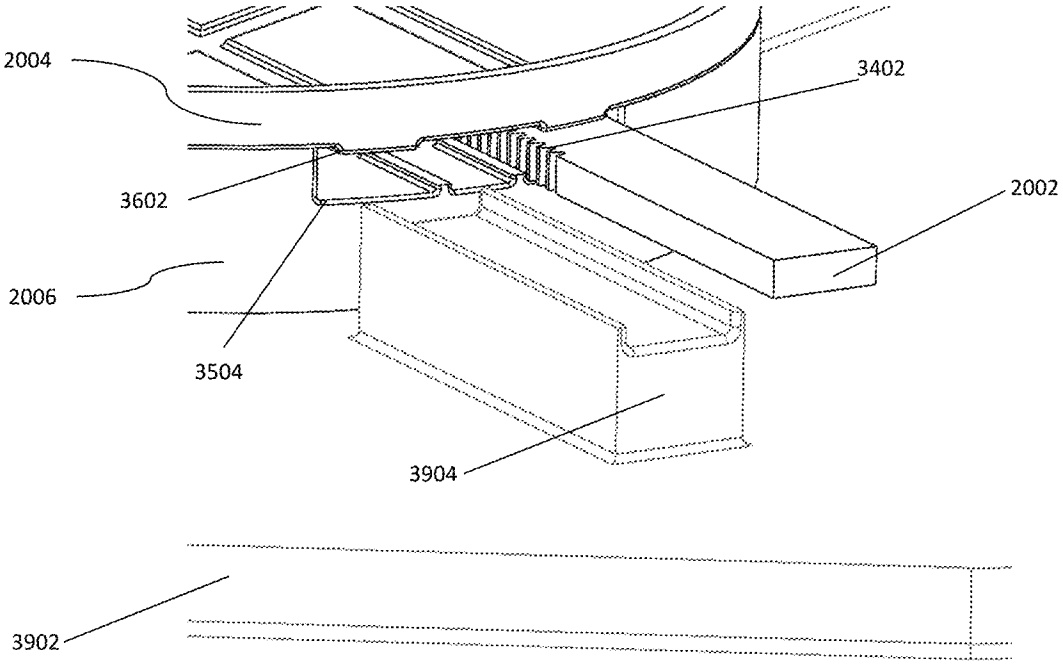
Figure 42:
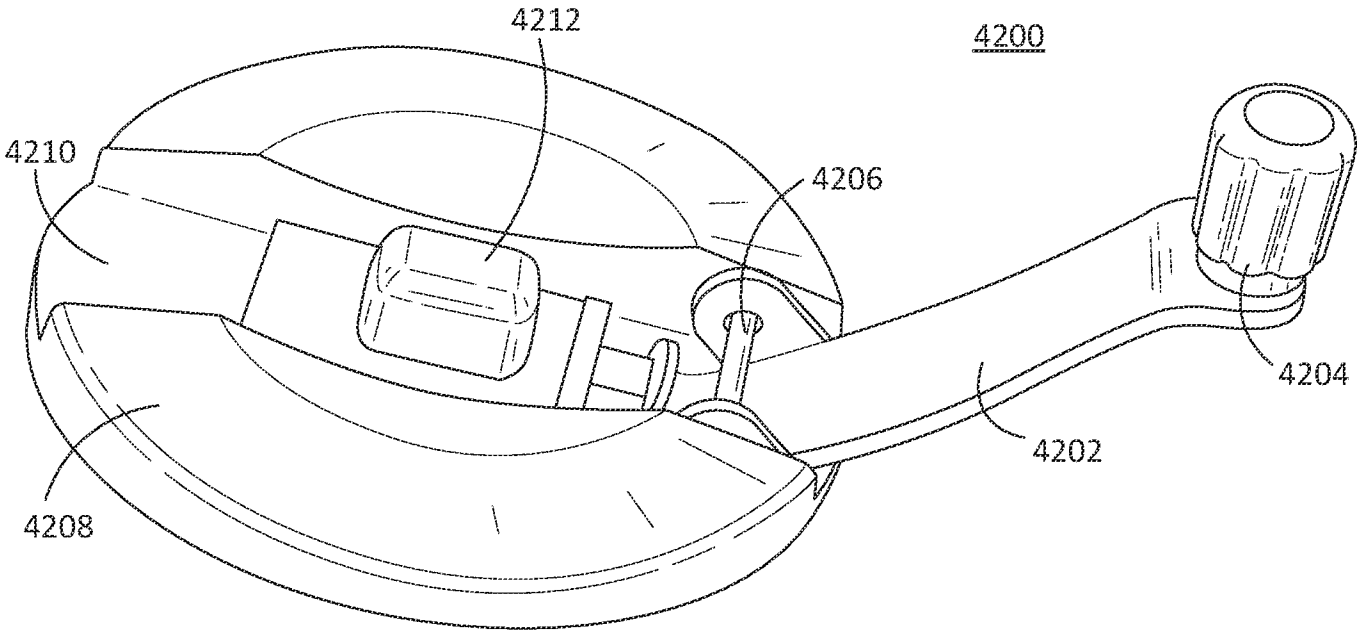
Figure 43:
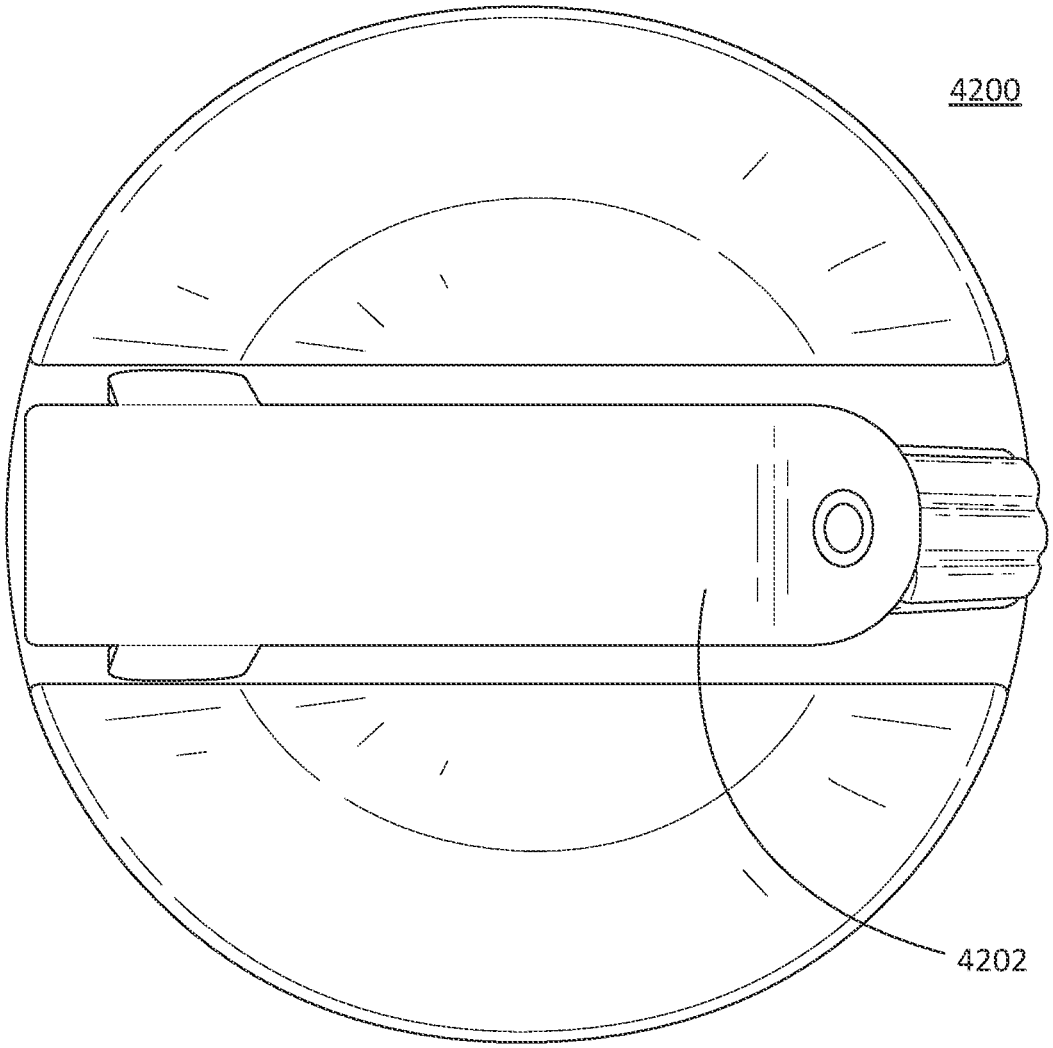

FIGS. 13A, 13B, and 13C are perspective views of an expandable container according to some embodiments of the present disclosure;

FIGS. 14A and 14B are perspective views of an expandable frame assembly according to some embodiments of the present disclosure;

FIGS. 15A and 15B are perspective views of an expandable container according to some embodiments of the present disclosure;

FIGS. 16A, 16B, and 16C are front views of an expandable frame assembly according to some embodiments of the present disclosure;

FIG. 17 is a perspective view of an expandable frame assembly according to some embodiments of the present disclosure;

FIGS. 18A and 18B are perspective views of an expandable frame assembly according to some embodiments of the present disclosure;

FIG. 18C is a top view of an expandable container according to some embodiments of the present disclosure;

FIG. 18D is a perspective view of an expandable frame assembly according to some embodiments of the present disclosure;

FIGS. 19A and 19B are views of an expandable container according to some embodiments of the present disclosure;

FIGS. 20A and 20B are views of an expandable container according to some embodiments of the present disclosure;

FIGS. 21A and 21B are views of an expandable frame assembly according to some embodiments of the present disclosure;

FIGS. 22A and 22B are views of an expandable container according to some embodiments of the present disclosure;

FIGS. 23A and 23B are views of an expandable container according to some embodiments of the present disclosure;

FIGS. 24A and 24B are views of an expandable container according to some embodiments of the present disclosure;

FIGS. 25A and 25B are views of an expandable container according to some embodiments of the present disclosure;

FIGS. 26A and 26B are views of an adjustment mechanism and sizing members according to some embodiments of the present disclosure;

FIGS. 27A and 27B are views of an adjustment mechanism and sizing members according to some embodiments of the present disclosure;

FIGS. 28A and 28B are views of an adjustment mechanism and sizing members according to some embodiments of the present disclosure;

FIG. 29A is a view of a portion of an adjustment mechanism according to some embodiments of the present disclosure;

FIG. 29B is a view of a portion of an adjustment mechanism component according to some embodiments of the present disclosure;

FIGS. 30A and 30B are views of an adjustment mechanism according to some embodiments of the present disclosure;

FIG. 31 is a view of an adjustment mechanism and sizing members according to some embodiments of the present disclosure;

FIG. 32A is a view of an adjustment mechanism and sizing members according to some embodiments of the present disclosure;

FIG. 32B is a view of an adjustment mechanism and sizing members according to some embodiments of the present disclosure;

FIG. 33 is a view of a gear according to some embodiments of the present disclosure;

FIG. 34 is a view of a sizing member according to some embodiments of the present disclosure;

FIGS. 35A and 35B are views of an adjustment mechanism component according to some embodiments of the present disclosure;

FIGS. 36A and 36B are views of an adjustment mechanism component according to some embodiments of the present disclosure;

FIG. 37 is a view of an expandable frame assembly according to some embodiments of the present disclosure;

FIG. 38 is a partial view of a corner of an expandable frame assembly according to some embodiments of the present disclosure;

FIG. 39 is a view of rear plate according to some embodiments of the present disclosure;

FIG. 40 is a partial view of a corner of an expandable frame assembly and rear plate according to some embodiments of the present disclosure;

FIG. 41 is a partial view of a corner of an expandable frame assembly and rear plate according to some embodiments of the present disclosure;

FIGS. 42-43 are views of an adjustment mechanism component according to some embodiments of the present disclosure;

FIGS. 44A-45B are views of an expandable container according to some embodiments of the present disclosure; and FIGS. 46A-48B are views of an expandable container according to some embodiments of the present disclosure.

DETAILED DESCRIPTION

Some embodiments will now be described more fully hereinafter with reference to the accompanying drawings, in which some, but not all, embodiments are shown. Indeed, various embodiments may be embodied in many different forms and should not be construed as limited to the embodiments set forth herein; rather, these embodiments are provided so that this disclosure will satisfy applicable legal requirements. Like reference numerals refer to like elements throughout. As used herein, the term "along" means near or on, but not necessarily requiring directly on, an edge or other referenced location. For example, "along" may mean parallel to, and/or offset from, an axis. Additionally, the term "component(s)" refers to at least one of a frame member, corner member, support member, sizing band, fastener, shell, liner, handle, base, adjustment mechanism, expandable frame assembly, or other physical element of the embodiments described herein and/or any portion and/or combination thereof. Additionally, the term "attachment surface" means the part of the first component body to which at least one second component is attached, connected, or integrated. As used herein, the term "expandable" refers to one or more components capable of transitioning between two or more configurations and does not suggest a directionality (e.g., "expandable" may comprise contraction, expansion, or other movement). Further, the term "angled" refers to an angle between zero and 180 degrees. Thus, use of any such terms should not be taken to limit the spirit and scope of embodiments of the present disclosure.

The present disclosure relates to expandable containers, frames and frame assemblies, associated components and sub-assemblies, and associated methods of using and manufacturing such containers. Various embodiments of the expandable containers discussed herein relate to expandable suitcases, bags, handbags, or any other containers usable with the disclosed structures herein, which may transition between two or more configurations, which may define different sizes of container capable of holding different quantities of user belongings and/or capable of fitting into different storage spaces. The expandable container thereby allows a single device to possess the storage and transportation capabilities of two or more different containers. In some embodiments, the expandable container may expand along at least two perpendicular axes (e.g., width and height).

By way of example, in various embodiments, an expandable container according to the embodiments discussed herein may convert between a personal item or carry-on sized suitcase to a full, checked-bag-sized suitcase and may transition to one or more configurations therebetween. For example, if a user were to travel on vacation, they may only need a small suitcase for clothing and personal items on the flight to their destination. This small suitcase could be small enough to meet an airlines personal item size, which is smaller than the carry-on requirements, thus not incurring additional fees. On the flight returning from vacation a user may have additional items (e.g., souvenirs, gifts, food, etc.) which require additional space in their luggage. In such instances, the expandable containers described herein may be expanded to accommodate the size and shape of the user's additional items for the return trip. The expandable container may then expand to the size of the airlines carry-on item standard, thus allowing for more space over a personal item while avoiding checked bag fees. The expandable container can be expanded to larger sizes, if needed by the user, which can then be checked while still allowing for the convenience of a single piece of luggage that conforms to the size of a user's belongings while also remaining small and easy to travel with. In some embodiments, the expandable container may be configured to expand between a maximum size and a minimum size. In some embodiments, the maximum size and the minimum size of the expandable container may be configured with one or more incremental sizes therebetween. The incremental sizes may be predefined at discrete sizing intervals or may be defined by a continuous range of expansion between the maximum and minimum sizes. Similarly, the expandable container may take any other form (e.g., handbags, crates, backpacks, or any other container described herein) for similar purposes and to achieve similar benefits of having a single container capable of operation in multiple sizes. The expandable container may be configured to transition between a plurality of forms (e.g., suitcases, handbags, briefcases, backpacks, and/or any other form described herein) during the continuous range of expansion between the maximum and minimum sizes.

In some embodiments, the maximum size of the expandable container may be a predefined checked baggage size. In some embodiments, the maximum size of the expandable container may be a predefined carry-on baggage size. In some embodiments, the minimum size of the expandable container may be a predefined carry-on baggage size. In some embodiments, the minimum size of the expandable container may be a predefined personal item size.

In some embodiments, the maximum size of the expandable container may be a predefined checked baggage size or dimensions and the minimum size may be a personal item size or dimensions, which personal item size may be smaller than the checked baggage size. In some embodiments, the maximum size of the expandable container may be a predefined checked baggage size or dimensions and the minimum size may be a predefined carry-on baggage size or dimensions, which carry-on baggage size may be smaller than the checked baggage size. In some embodiments, the maximum size of the expandable container may be a predefined carry-on baggage size or dimensions and the minimum size may be a personal item size or dimensions, which personal item size may be smaller than the checked baggage size. In some embodiments, the maximum size of the expandable container may be some size or dimensions greater than, equal to, or less than an airline's predefined checked baggage size or dimensions. In some embodiments, the minimum size of the expandable container may be some size or dimensions greater than, equal to, or less than an airline's predefined personal item size or dimensions. In some embodiments, the maximum or minimum size of the expandable container may be some size or dimensions greater than, equal to, or less than an airline's predefined carry-on baggage size or dimensions. For reference, in some embodiments, it is contemplated that airline dimensions may vary across respective airlines and even between particular flights and aircraft among a single airline. For reference, in some embodiments, a personal item size may be any size that is stowable under a passenger seat of an aircraft. For reference, in some embodiments, a carry-on item size may be any size that is stowable in a passenger overhead compartment of an aircraft. For reference, in some embodiments, a checked item size may be any size that is larger than can be safely stowed either under a passenger seat of an aircraft or in a passenger overhead compartment of an aircraft. In some embodiments, the maximum and minimum sizes may be generalized to first, second, and/or more (e.g., third, fourth, fifth, etc.) sizes of varying length, width, height, and/or circumference.

An expandable container, such as embodied as a suitcase or any other container, may include a plurality of: frame members, corner members, support members, sizing bands, fasteners, shells, liners, handles, bases, adjustment mechanisms, expandable frame assemblies, and/or any combination thereof or any combination of any other components described in this disclosure disposed therein. The frame members as described herein, or assembly comprised thereof, may provide means for at least generally maintaining the shape of the suitcase (e.g., maintaining a rectangular shape, which may have generally the same proportions between configurations) and/or guiding the sizing members (e.g., a sizing band or other sizing members shown or described herein) for adjusting the size of the container. At least a portion of the frame members may be corner members. The corner members as described herein, or assembly comprised thereof, may at least partially provide means for at least generally maintaining the shape of the suitcase and/or guiding the sizing band.

In some embodiments, support members as described herein, or assembly comprised thereof, may provide means for at least generally maintaining the shape of the suitcase and/or guiding the sizing band. For example, in some embodiments, support members may be used to reinforce connections between various other components for providing structural rigidity to the frame assembly and/or container. Sizing member(s) as described herein, or assembly comprised thereof, may provide means for at least holding the expandable frame assembly together in a plurality of configurations and allowing a gap between frame members, or the like, to expand and contract by way of an adjustment mechanism. Some embodiments of the sizing member(s) may be rigid and provide further stability to the expandable container. Some embodiments of the sizing member(s) may be at least partially flexible. In some embodiments, the sizing member(s) may take the form of sizing band(s) extending between adjacent frame members.

A shell as described herein, or assembly comprised thereof, may provide means for at least covering at least a portion of the expandable frame assembly and contents of the suitcase. A liner as described herein, or assembly comprised thereof, may provide means for at least dividing the inner cavity of the suitcase into two areas or portions; (1) a storage area for items to be transported by the suitcase, and (2) a functional component area for the expandable frame assembly, and any other components of the suitcase need for functional purposes, to reside. A handle as described herein, or assembly comprised thereof, may include a handle and means for at least attaching the handle to the expandable container so that a user can grip and transport the container by way of lifting, carrying, and/or rolling.

A base as described herein, or assembly comprised thereof, may include a base member or the like and means for at least attaching wheels or other devices for supporting the weight of the suitcase and the contents therein. In some embodiments, a portion of the remainder of the expandable container (e.g., one or more frame members) may perform the functions of a base without requiring a separate base. An adjustment mechanism as described herein, or assembly comprised thereof, may provide means by which a user can at least selectively adjust the size and/or shape of the suitcase.

While some embodiments described herein relate to suitcases and other particular expandable containers, one of ordinary skill in the art will appreciate that the teachings herein may also apply to a wide range of additional containment, storage, and transportation applications. Non-limiting examples of some such additional applications include: delivery containers for online purchases; delivery containers for fast food delivery and/or takeout; commercial shipping containers (e.g., crates, barrels, freight containers, etc.); personal shipping containers (e.g., mailing boxes, etc.); cases, such as for appliances and electronics (e.g., mobile device adjustable case fitted for a range of models, camera protective case adjustable for optional accessories, etc.); storage bins (e.g., laundry bins, tote boxes, toy boxes, etc.); pet applications (e.g., pet carriers, kennels, fish tanks, etc.); outdoor and camping equipment (e.g., tents, mobile showers, other portable structures, etc.); backpacks, handbags, and other personal containers; trunks; outdoor structures (e.g., car ports, sheds, etc.); rubbish receptacles (e.g., garbage cans, recycling bins, dumpsters, ashtrays, etc.); construction applications (e.g., concrete molds, casts, forms, equipment storage, tool boxes, etc.); containers for manufacturing applications; containers for mining applications; containers for computer applications; containers for law enforcement applications; containers for maritime applications; containers for marine applications; containers for sports applications; containers for military applications; containers for airline applications; containers for entertainment applications; containers for toy applications; etc.

The embodiments described herein may be scalable to accommodate any application, including at least the aforementioned applications. Various components of embodiments described herein can be added, removed, modified, and/or duplicated as one skilled in the art would find convenient and/or necessary to implement a particular application in conjunction with the teachings of the present disclosure. In some embodiments, specialized features, characteristics, materials, components, and/or equipment may be applied in conjunction with the teachings of the present disclosure as one skilled in the art would find convenient and/or necessary to implement a particular application.

Figure 1A:
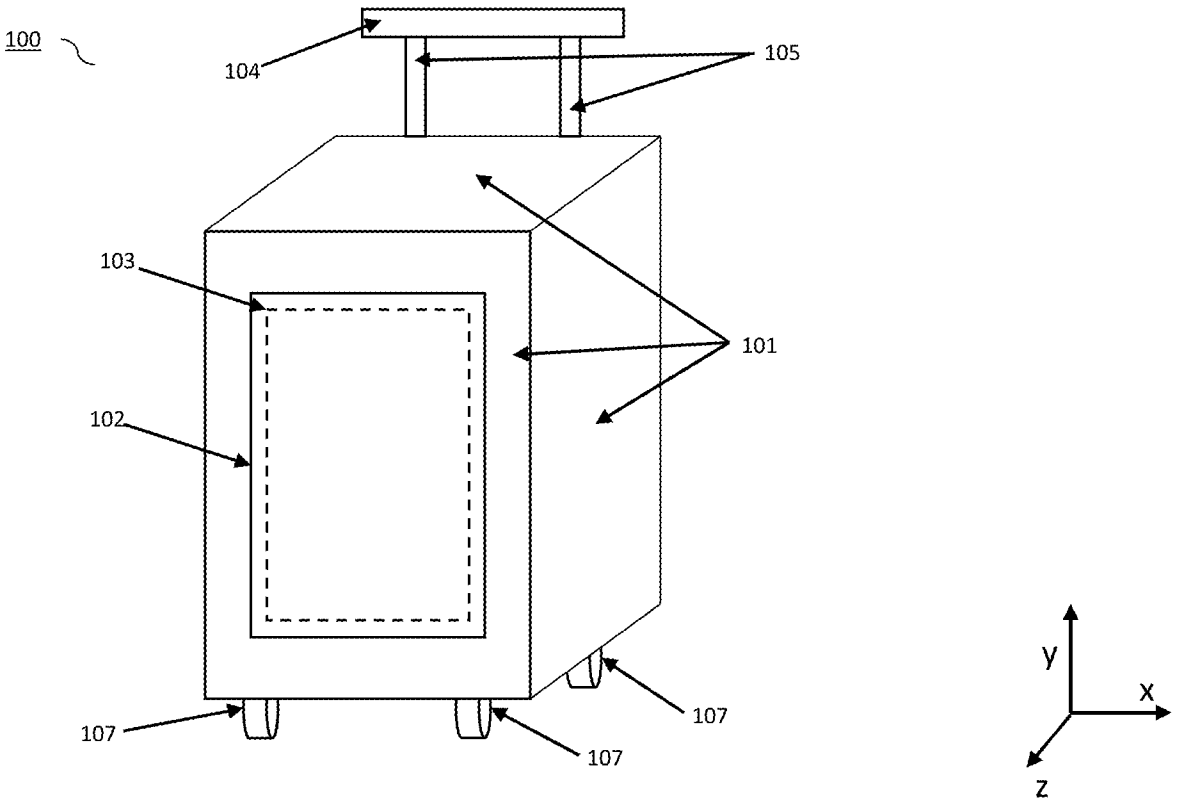
FIG. 1A is a front perspective view of an expandable container according to at least one embodiment of the present disclosure.

FIG. 1A shows an expandable container in the form of a suitcase 100. The depicted suitcase 100 is configured to expand its size in at least two perpendicular dimensions (e.g., along at least the x and y axes depicted in FIG. 1A). The depicted suitcase 100 includes a shell with an elastic portion 101 and inelastic portion 102. The shell may be a covering over an internal frame (described herein). The frame may define the shape of the suitcase 100 in the various configurations, while the shell 101, 102 conforms to the shape of the frame and encloses the suitcase to prevent items inside the suitcase from escaping and being lost. In some embodiments, the shell 101, 102 also allows access to the interior of the suitcase 100 (e.g., via zipper or other opening).

As used herein, the term "elastic" may refer to a portion of the shell capable of deforming to change its surface area as needed in the various configurations described herein. While the elastic portion may deform elastically, it need not be perfectly elastic. In some embodiments, the elastic material may comprise any of the materials and may have any of the features described herein, including, but not limited to, a 2-way stretch material and/or 4-way stretch material, which may be spandex, nylon, elastane, cotton, wool, rubber, neoprene, the like, or any combination thereof. In some embodiments, the 2-way stretch material and/or 4-way stretch material may be natural, synthetic, semi-synthetic, regenerated, the like, or any combination thereof. For example, the elastic material may be a blend of 15% spandex and 85% nylon rash-guard material or similar material. In some embodiments, the elastic material may be a blend of spandex or elastane and one or more other fabrics. The elastic portion 101 is shown covering and maintaining the generally rectangular shape of the expandable frame assembly (discussed herein). In some embodiment, the inelastic portion may be made of flexible or semi-flexible fabric, rigid material, and/or semi-rigid material according to any embodiment discussed herein. For example, in some embodiments, the inelastic portion may comprise a hard shell. In some embodiments, the inelastic portion may comprise a structural nylon material or other non-stretch abrasion resistant fabric. The depicted inelastic portion 102 forms a front panel on the suitcase 100. The inelastic portion 102 further has a resealable opening 103 (e.g., zipper, etc.) allowing a user to access the contents of suitcase 100. In some embodiments, the inelastic portion 102 may define an expandable pocket that allows the user to add additional volume by expanding the suitcase 100 along the z axis shown in FIG. 1A (e.g., unzipping a section of the inelastic portion 102 may expose an additional piece of fabric to allow the suitcase to expand outwardly along the z axis). Resealable opening 103 can be locked with a variety of security devices (e.g., key locks, combination locks, electronic locks, etc.) (not shown) meeting industry or government standards and requirements. A handle assembly comprising handle 104 and two telescoping arms 105 is shown opposite the side of suitcase 100 from resealable opening 103. In other embodiments, inelastic portion 102 and resealable opening 103 can be configured, relative FIG. 1A, to attach to the top, left or right sides, and/or bottom portion of suitcase 100. Suitcase 100 is supported by wheels 107 attached to the base (described herein).

Figure 1B:
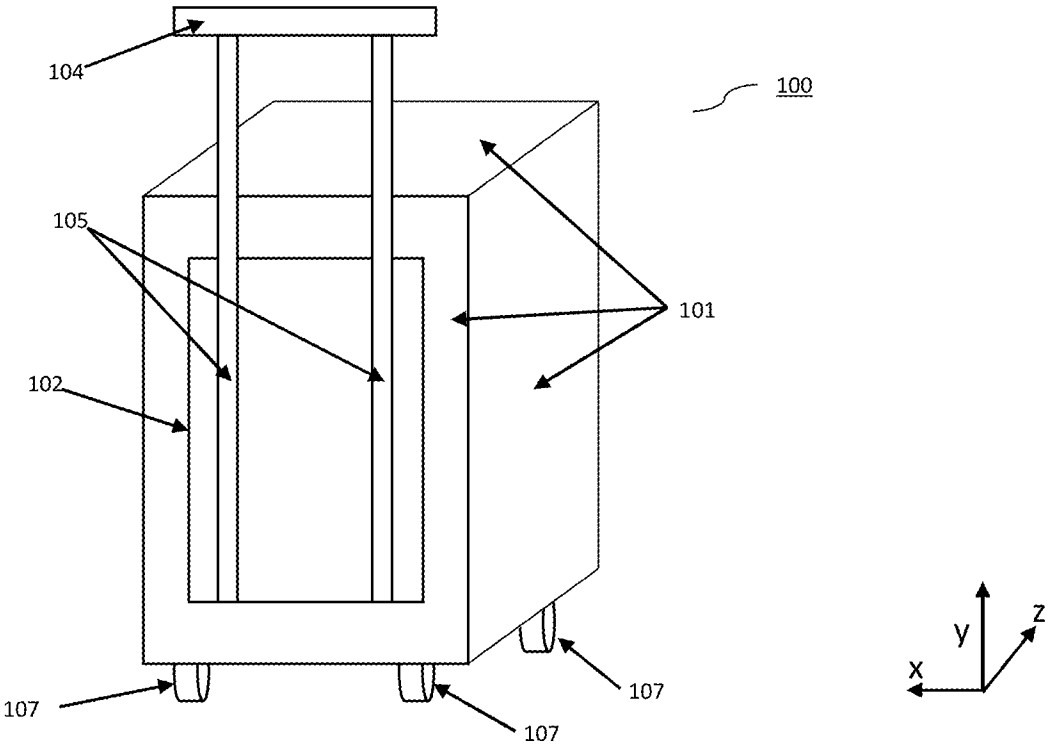
FIG. 1B is a rear perspective view of the expandable container of FIG. 1A.

FIG. 1B shows a rear perspective view of the suitcase 100 as shown and described with respect to FIG. 1A. In the depicted embodiment, the handle 104 and telescoping arms 105, which support the handle (collectively a handle assembly) are shown at least partly attached to a second inelastic portion 102 of the shell by way of fastener connections, such as adhesive, screws, integral molding, stitching, rivets, welding, or the like (not shown). The telescoping arms 105 may comprise two or more concentric pieces that slide relative to each other as would be understood by a person of ordinary skill in the art in light of the present disclosure, with the lowermost piece being connected fixedly to the inelastic portion 102. In the depicted embodiment, the telescoping arms 105 are not otherwise connected to the frame, base, or other structure of the suitcase. In some embodiments, the arms may be directly attached to the frame and/or base for further rigidity as described herein. The suitcase 100 as shown in FIGS. 1A-1B is configured with a set of four wheels 107. In other embodiments the number of wheels 107 can be increased or decreased. Wheels 107 can be configured to be fixed in a single direction or swivel about one or more axes. Wheels 107 can further comprise bearings, tubes, tires, treads, mudguards, spokes, airless tires, the like, and/or any combination thereof.

Figure 1C:
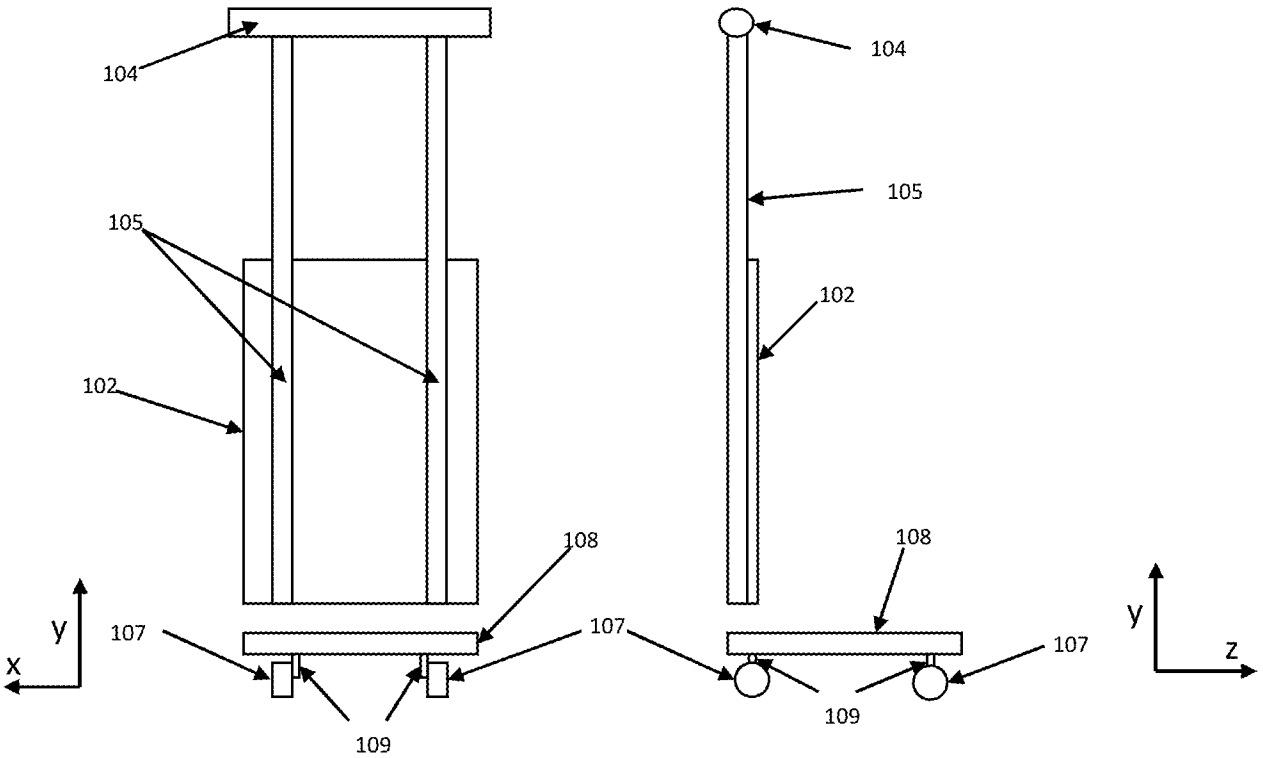
FIG. 1C shows portions of a shell, a handle, and a base according to at least one embodiment of the present disclosure.

FIG. 1C shows portions of suitcase 100 of FIGS. 1A-1B, including depictions of the handle 104, telescoping arms 105, inelastic portion 102, base 108, and wheels 107, with the elastic portion of the shell and the frame components removed for simplicity of illustration. The handle 104 and telescoping arms 105 are shown attached to the inelastic portion 102 of the shell by way of the fastener connections. Base member 108 is shown attached to wheels 107. The handle assembly comprising handle 104, telescoping arms 105, and inelastic portion 102 is not attached directly to the base assembly comprising base member 108 and wheels 107 in the embodiment depicted in FIG. 1C. In some embodiments, the handle assembly and the base assembly are directly attached by way of at least one direct fastener connection, such as adhesive, screws, integral molding, stitching, rivets, welding, or the like between at least one component of each assembly (e.g., the telescoping arms 105 may be attached to the base 108 as shown in FIG. 3B. In some embodiments, the handle assembly and the base assembly are indirectly attached by way of at least one direct fastener connection between at least one component of each assembly with an intermediary assembly (e.g., an expandable frame assembly, etc.) (not shown).

Figure 2A:
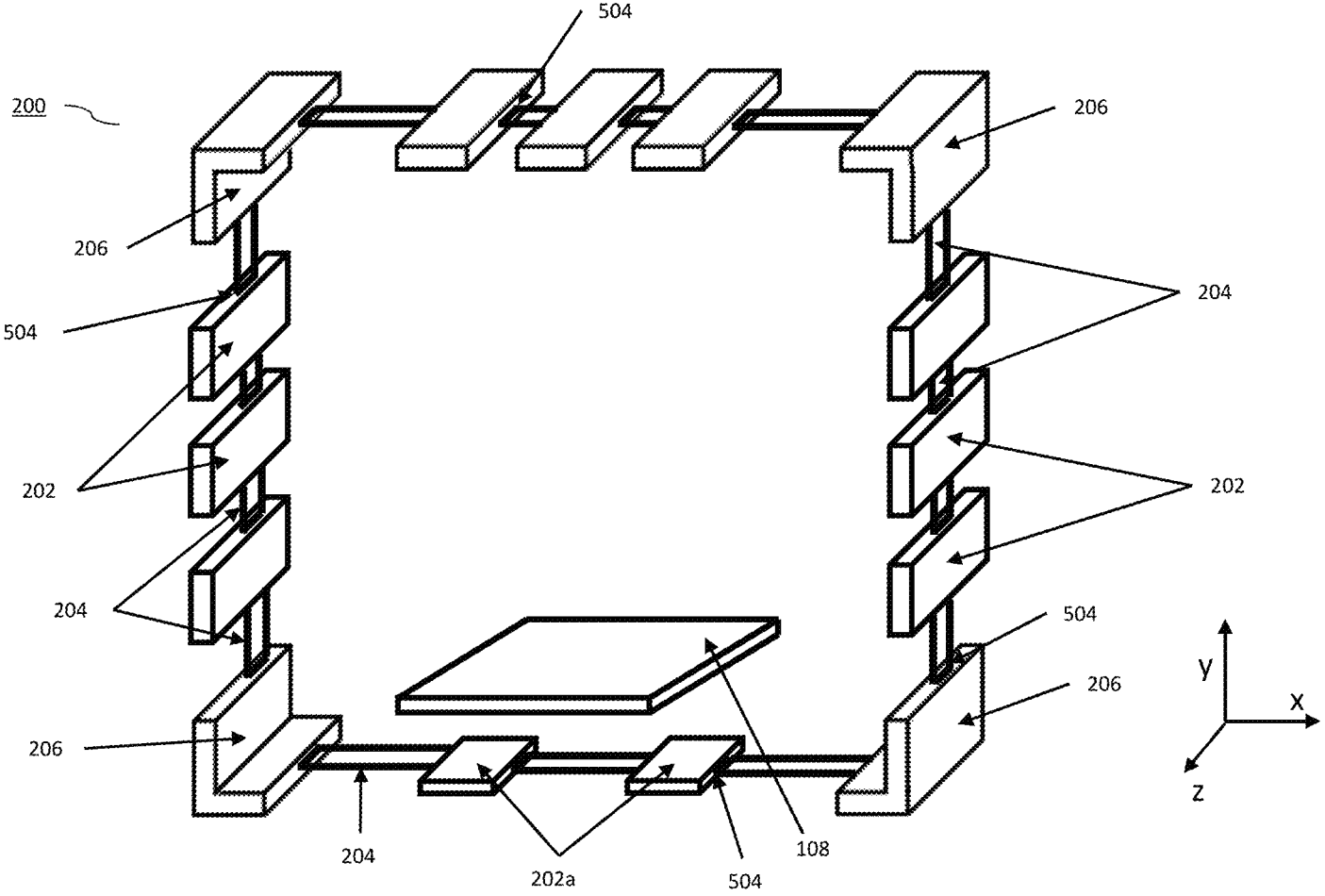
FIGS. 2A and 2C are perspective views of an expandable frame assembly according to at least one embodiment of the present disclosure.

FIG. 2A shows an expandable frame assembly 200 comprising a plurality of frame members 202, 202*a*, 206 and a single sizing band 204. FIG. 2A further depicts a base member 108, which may be connected to the expandable frame assembly 200. The expandable frame assembly 200 may be disposed inside and may define the shape of the shell 101, 102 described above with respect to FIGS. 1A-1B (e.g., with the inelastic panels 102 aligning with front and rear of the rectangle of frame members 202, 202*a*, 206 along the z axis and the elastic portion 101 contacting the frame members 202, 202*a*, 206). The depicted expandable frame assembly 200 shows a single series of frame members 202, 202*a*, 206 including corner members 206 with a sizing band 204 slidably attached by way of at least channels 504 (some examples labeled in FIG. 2A) in each of the frame members 202, 202*a*, 206. The expandable frame assembly 200 is shown in an expanded position with a gap (also referred to as a space) between each of the frame members 202, 202*a*, 206. The expandable frame assembly 200 in the fully collapsed position, shown in FIG. 2C, is contracted into a smaller rectangular shape, the sizing band 204 are not visible in the gaps between frame members 202, 202*a*, 206, and the frame members 202, 202*a*, 206 may touch along their sides with planes perpendicular to the sizing band 204. In some embodiments, the collapsed position may define at least a partial gap between two or more frame members 202, 202*a*, 206 rather than a complete collapse. An example configuration of the expandable frame assembly 200 may be embodied as part of any expandable container, such as an expandable container in the form of a suitcase as shown in FIGS. 13A-13B, 15A-15B.

Turning back to FIG. 2A, the sizing band 204 is shown forming a closed loop, but in some embodiments sizing band 204 can form an open loop. Base member 108 can be directly or indirectly attached to one or more of the frame members 202 and 202*a*, corner members 206, and/or sizing band 204 by way of a fastener connection, such as adhesive, screws, integral molding, stitching, rivets, welding, or the like. In some embodiments, the frame members 202 and 202*a* are of the same size and shape. The sizing band 204 may define any width (i.e., the z dimension) that fits within the parameters of the suitcase (e.g., 0.5 inches wide, 1 inch wide, 1.5 inches wide, etc.), and the sizing band 204 may be narrower in a thickness direction (i.e., the x/y dimension defining the narrowest dimension of the sizing band) to facilitate the sizing band bending around the circumference of the expandable frame assembly 200.

Figure 2B:
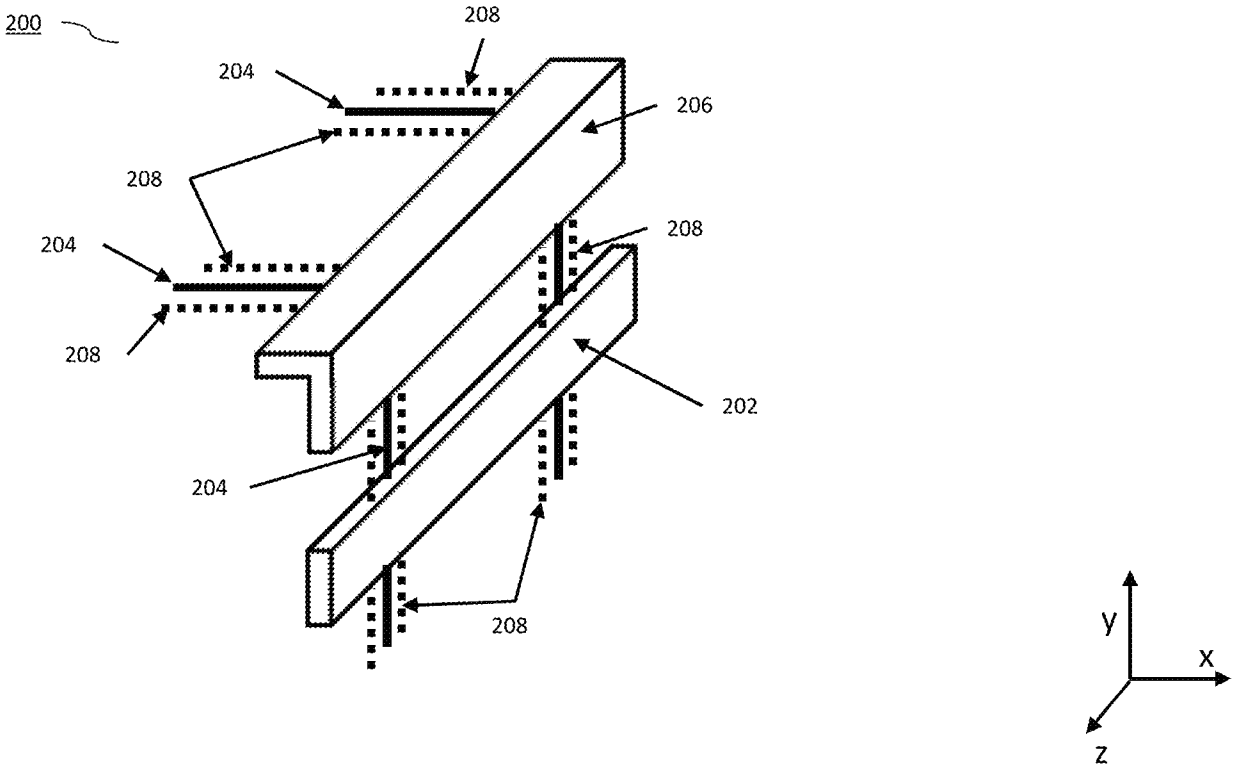
FIG. 2B is a detailed view of a plurality of frame members of a portion of an expandable frame assembly according to at least one embodiment of the present disclosure.
Figure 2C:
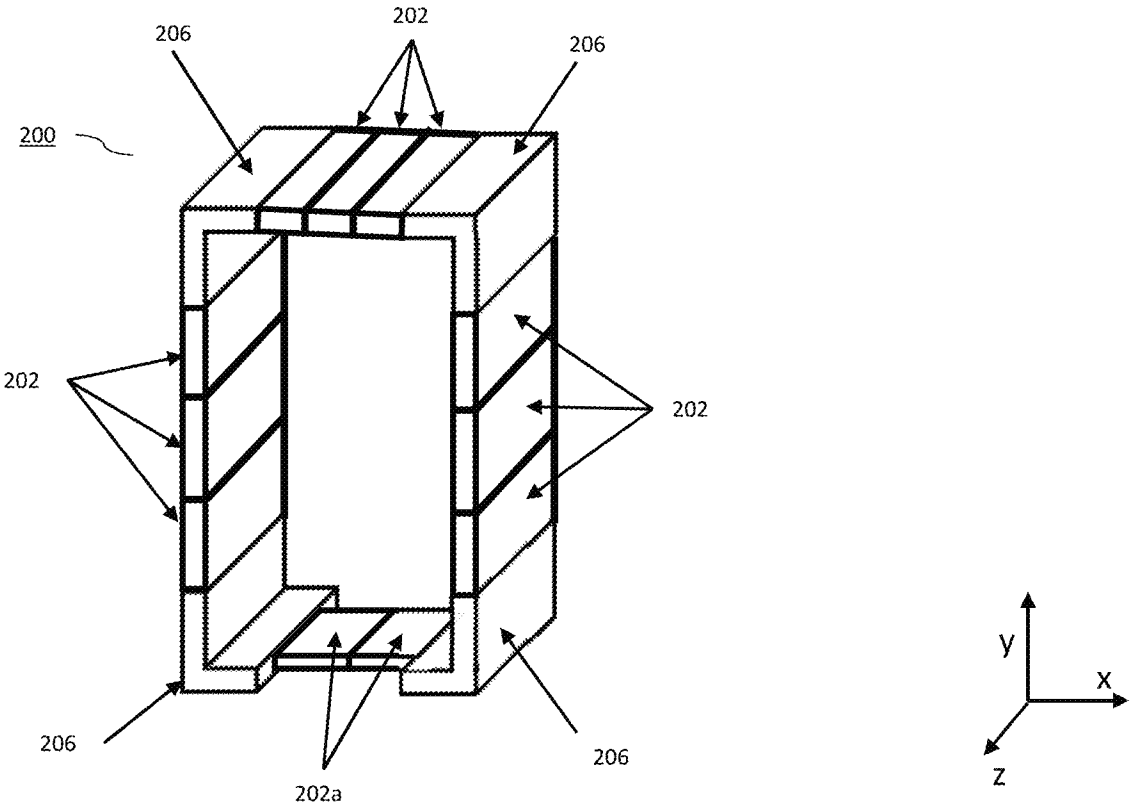

FIG. 2B shows a portion of an embodiment of the expandable frame assembly 200.

The portion of expandable frame assembly 200 comprises frame members 202, 206, sizing bands 204, and support members 208. The portion of expandable frame assembly 200 shows frame member 202, corner member 206, sizing bands 204, and support members 208 (as described herein). In the depicted embodiment, two parallel sizing bands 204 extend around the expandable frame assembly 200. The sizing bands 204 extend through sequential frame members 202, 206. The sizing bands 204 and support member 208 are slidably attached to frame member 202 and/or corner member 206 by way of at least channels (e.g., channels 504 shown in FIG. 2A) in each of the frame members 202, 206. Support members 208 can be rigid, flexible, elastic, inelastic, solid, hollow, the like, and/or any combination thereof. In some embodiments, some or all of the frame members 202, 206 lack support members 208. In some embodiments, a sizing band 204 is slidably attached to a support member 208 by way of a channel extending through the support member 208 and support member 208 is slidably attached to a frame member 202 and/or a corner member 206 by way of a channel extending through the frame member 202 and/or the corner member 206. As described below, each of the support members 208 may be configured to maintain rigidity of the expandable frame assembly 200 in a particular direction (e.g., the support members may be more rigid than the sizing band).

Figure 3A:
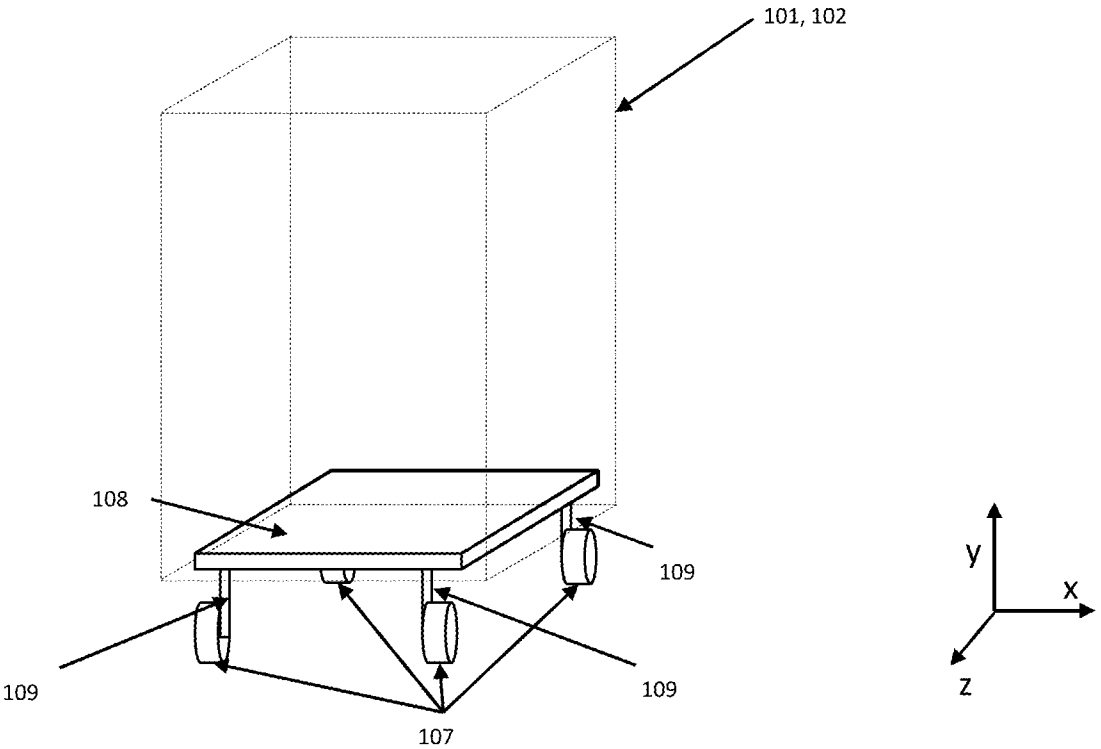
FIG. 3A is a perspective view of a base with a plurality of wheels according to at least one embodiment of the present disclosure.
Figure 3B:
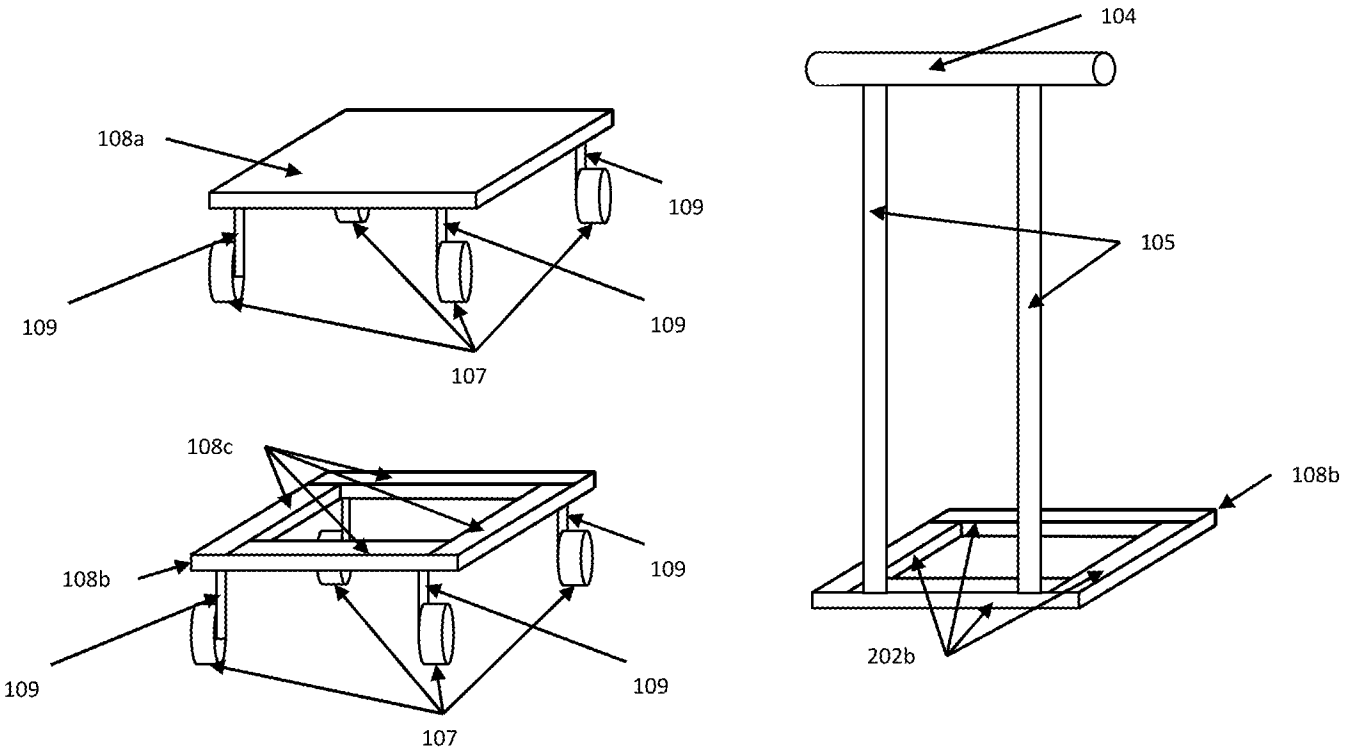
FIG. 3B shows perspective views of bases each structured according to at least one embodiment of the present disclosure.

FIG. 3A shows an embodiment of the base 108 with the elastic portion 101 of the shell shown in broken line for reference. The expandable frame assembly 200 has been removed for simplicity of illustration. The base comprises base member 108 and wheels 107. The wheels 107 are shown protruding from the base member 108 attached to wheel stems 109, which base member is inside the shell to a region outside of the perimeter of the elastic portion 101 of the shell. In some embodiments, the wheels 107 protrude wholly or partially to a region outside of the perimeter of the shell (e.g., through one or more openings in the elastic portion 101).

FIG. 3B shows multiple embodiments of the base member 108. One example base member 108*a* is shown as a single, planar member with four wheels 107 attached. A second example base member 108*b* is shown as a composite member comprising a plurality of base frame members 108*c* connected to each other by way of fasteners. Base member 108*b* is further shown with a plurality of wheels 107 attached thereto. In some embodiments, the base member may define an open, frame structure in one or more pieces such as base member 108*b*. Base member 108*b* is further shown with a handle 104 connected to two telescoping arms 105 which arms are directly, rigidly attached to a surface of the base member 108*b*. In the depicted embodiment, the telescoping arms 105 may extend along the shell and may protrude through the shell at a predetermined location (e.g., at the inelastic portion 102 shown in FIG. 1A). The telescoping arms 105 may define an extension distance capable of stowing the handle 104 flush with or below the upper surface of the suitcase 100 when the suitcase is in its most collapsed position and capable of projecting the handle 104 above the upper surface of the suitcase 100 when the suitcase is in its most expanded position. In some embodiments, the handle 104, telescoping arms 105, base member 108, and/or any combination thereof may comprise a single component without fastener connections; such as a single injection molded plastic part for example. In some embodiments, as shown with respect to FIGS. 1A and 1B, the handle 104 may not be rigidly connected to the base member.

Figure 3C:
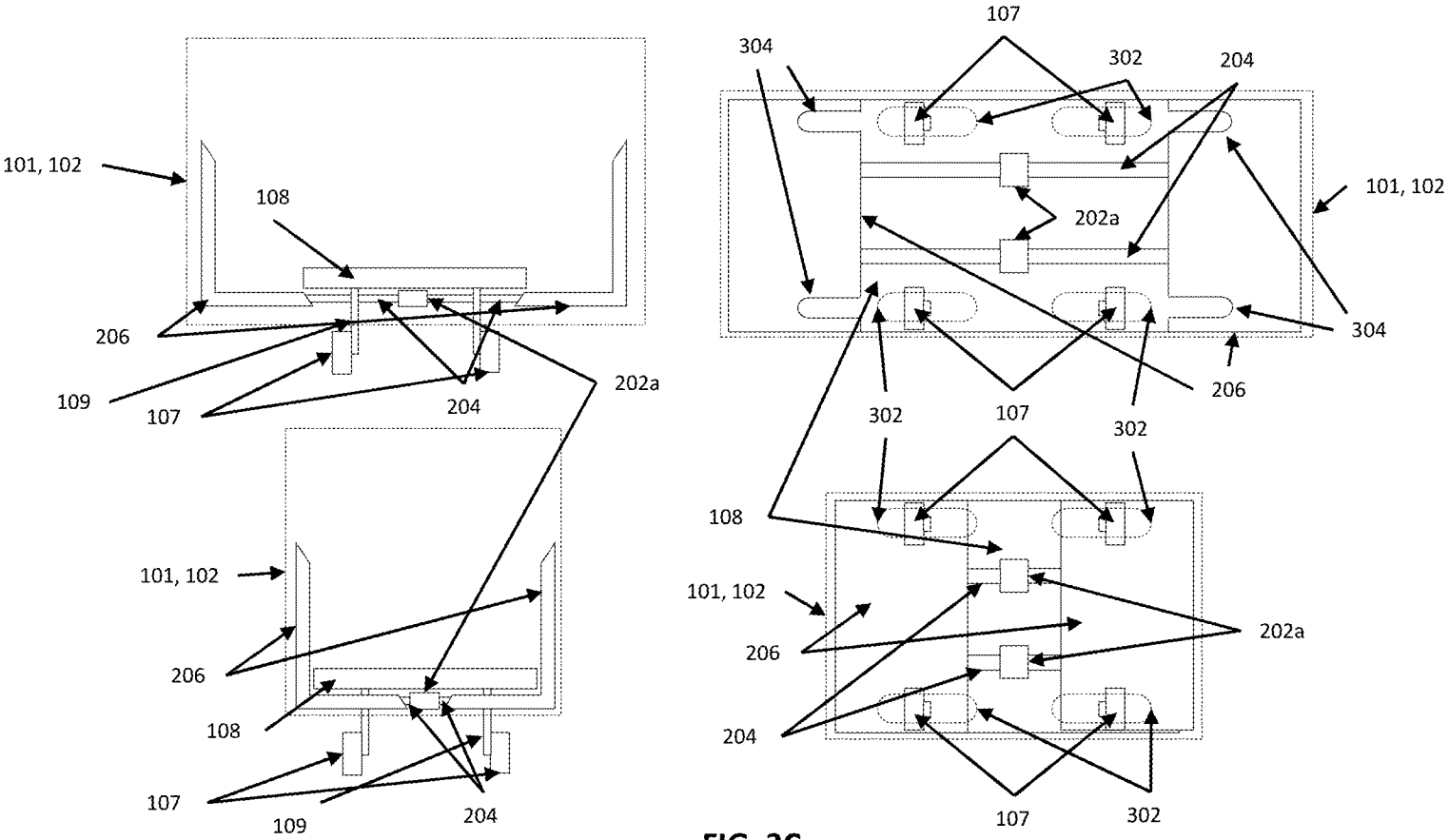
FIGS. 3C-3F show views of bases and frame members according to at least one embodiment of the present disclosure.

In various embodiments discussed herein, the base member 108 may support the rest of the expandable container 100, including the remaining components of the expandable frame assembly 200, and the wheels 107 may support the base member 108. In some embodiments, the base member 108 is directly attached to one or more frame members (e.g., frame members 202*a* at the bottom of the expandable frame assembly 200). FIG. 3C shows multiple views of an embodiment of the base assembly. The base comprises a base member 108 and wheels 107 attached thereto. The base is at least partially connected, directly or indirectly, to the expandable frame assembly 200 and the shell 100. In the depicted embodiment, the corner members 206 and sizing bands 204 are configured to slide relative to and adjacent to the base member 108. The depicted bottom frame members 202*a* are directly, fixedly attached to the base member 108 by way of fastener connections to the base member such as adhesive, screws, integral molding, stitching, rivets, welding, or the like. The bottom frame member(s) 202*a* may be narrower than the outer dimensions of the suitcase to allow clearance for the wheels on either side. Although depicted as two bottom frame members 202*a* in FIG. 3C, there may be a single bottom frame member slidably connected to each sizing band 204 (in embodiments using multiple bands), and/or in some embodiments, multiple bottom frame members 202*a* may extend laterally between corner members 206 along a single sizing band 204. In some embodiments, the corner members 206 may take up the full thickness of the suitcase (i.e., the z direction in FIG. 1A) and may include cutouts 304 to receive the wheel stems 109. In some embodiments, the corner members 206 may stop against the wheel stems 109 when the suitcase is in its most compact configuration so that no cutout is necessary. In some embodiments, the corner members 206 and/or other frame members 202, 202*a* may be less than the full thickness of the suitcase such that the wheel stems 109 travel alongside the corner members 206 and/or other frame members 202, 202*a*. In some embodiments, there may be multiple corner members 206 and/or other frame members 202, 202*a* along the thickness of the suitcase (i.e., the z direction in FIG. 1A), such as the configuration shown in FIG. 2B. In such embodiments, the wheel stems 109 may pass between the multiple corner members 206 and/or other frame members 202, 202*a*. In the depicted embodiment, the uppermost images show an expanded configuration and the lowermost images show a collapsed configuration.

The depicted shell 101, 102 is configured with holes 302 through which the wheels 107 protrude to roll on the ground. The holes 302 can be configured to be in the elastic portion 101 (depicted) and/or the inelastic portion 102 (not shown) of the shell. As the elastic portion 101 of the shell expands and contracts, the shell material may slide adjacent to wheels 107 in at least one direction via the holes 302, and the holes may be configured to enable the deformation of the elastic portion during expansion and contraction of the suitcase while the wheels remain in contact with the ground. In some embodiments, one hole may be used for multiple wheels (e.g., a hole extending between wheels in the direction of expansion of the elastic portion 101. In the depicted embodiment, the expandable frame assembly 200 may expand outwardly relative to the base member 108 such that the center of gravity of the suitcase and the geometric center of the wheels 107 remain in substantially the same positions, which prevents tipping of the suitcase or instability caused by moving the wheels relative to the center of gravity. In some embodiments, as discussed below, the wheels may also move outwardly in opposite directions (e.g., the left two wheels may move left, and the right two wheels may move right by the same amount) such that the geometric center of the wheels remains the same. In some embodiments, holes 302 may be a substantially square, circular, rectangular, ovular, triangular, and/or the like shape. In the configuration depicted in FIG. 3C, the weight of the suitcase 100 and the articles therein is borne by the base member 108, and many of the articles in the suitcase may rest on the base member when the suitcase is upright or be supported by the base member via the connection to the bottom frame members 202*a*. In embodiments having an inner liner (e.g., liner 402 shown in FIGS. 4A-5), the liner may be disposed between the base member 108 and the articles inside the suitcase 100 or alternatively may be disposed between the base member 108 and the expandable frame assembly 200.

Figure 3D:
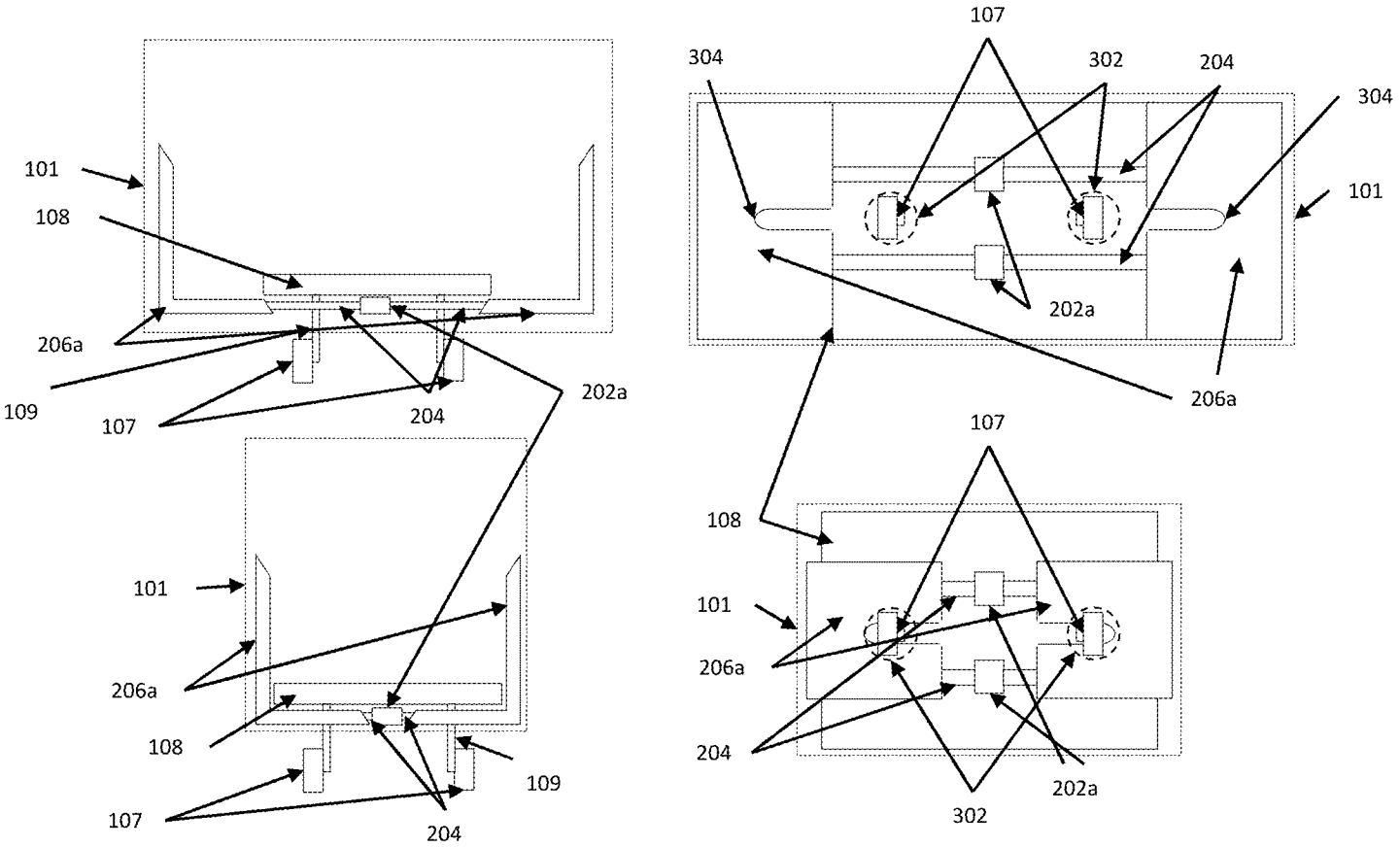

FIG. 3D shows multiple views of an embodiment of the base having the same configuration as the embodiment of FIG. 3C except that the suitcase includes only two wheels along the center of the thickness of the suitcase. The base comprises a base member 108 and wheels 107 attached thereto. The base is at least partially connected, directly or indirectly, to the expandable frame assembly 200 and the shell (e.g., via bottom frame members 202*a*). The corner members 206*a* and sizing bands 204 are configured to slide adjacent to the base member 108. The corner members 206*a* are further configured with cutouts 304 configured to allow corner members 206*a* to slide around wheels 107. The frame members 202 are attached by way of fastener connections to the base member such as adhesive, screws, integral molding, stitching, rivets, welding, or the like. The shell is configured with holes 302 through which the wheels 107 are configured to protrude through the shell. The holes 302 can be configured to be in the elastic portion 101 and/or the inelastic portion 102 (not shown) of the shell. As the elastic portion 101 of the shell expands and contracts the shell material slides adjacent to wheels 107 in at least one direction by way of holes 302. In the embodiment shown in FIG. 3D, the suitcase includes two wheels 107 disposed along a midline of the suitcase. In some embodiments, the wheels 107 may be at or adjacent a frontmost or rearmost (i.e., relative to the axis z in FIG. 1A) edge of the bottom surface of the suitcase (e.g., spaced from the midline along the base member 108). In some embodiments, the wheels 107 may be disposed on a same side of the suitcase as the handle 104 relative to the midline of the suitcase (shown in FIGS. 1A-1B), while pointing downwardly, to allow the suitcase to be leaned and rolled by a user holding the handle. In some embodiments, a two wheeled version of the suitcase may include wheels placed at the location of two of the four-wheeled versions shown in the figures.

Figure 3E:
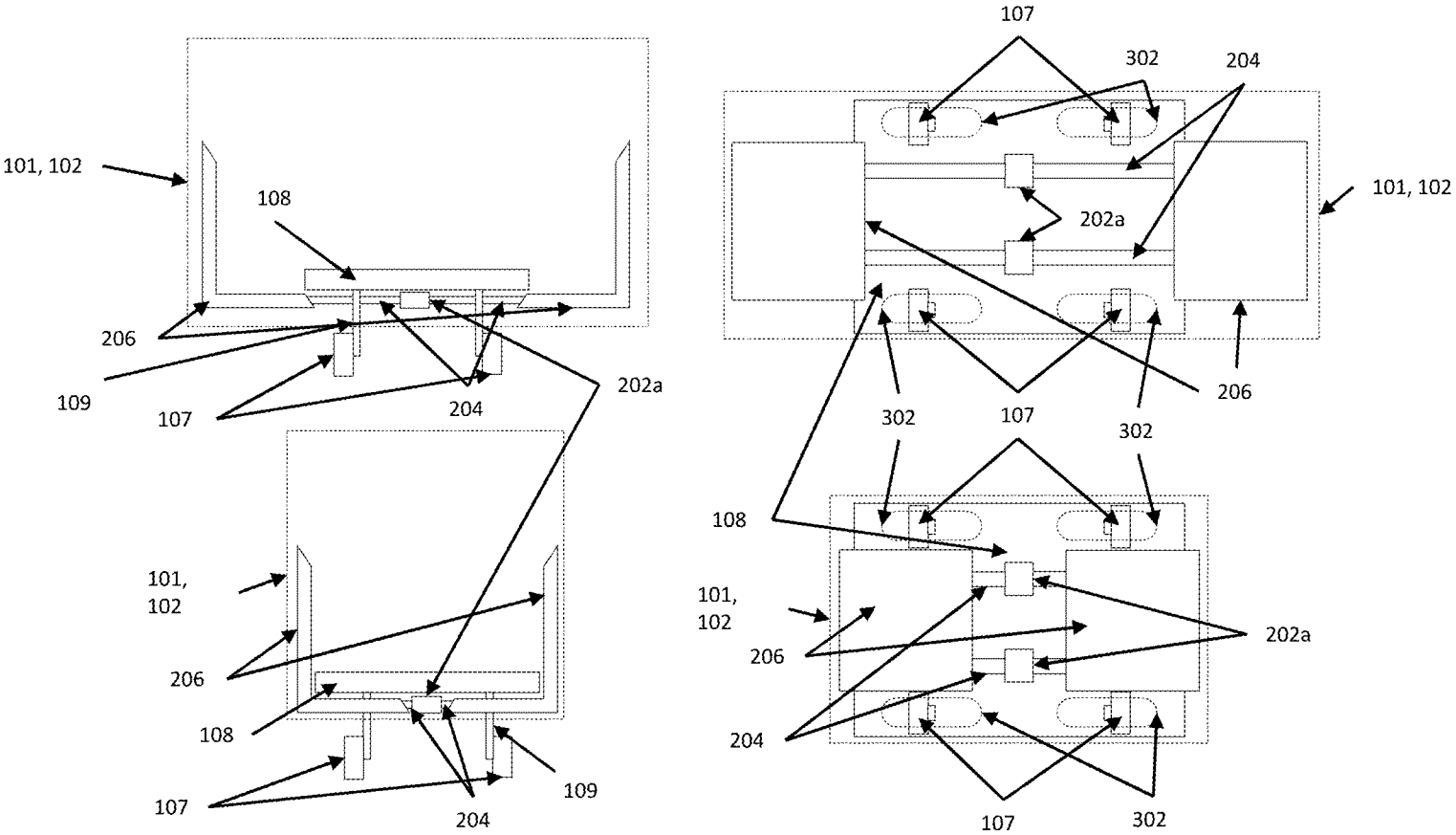

FIG. 3E shows multiple views of an embodiment of the base having the same configuration as the embodiment of FIG. 3C except that the corner members 206 have a thickness less than the thickness of the suitcase so that the wheel stems 109 are able to pass to either side of the corner members. In some embodiments, a portion of the corner members 206 not in the path of the wheel stems 109 during the transition between configurations (e.g., portions of the corner members 206 that would not impinge the wheel stems 109 when expanding or contracting the suitcase) may be the full thickness of the suitcase.

Figure 3F:
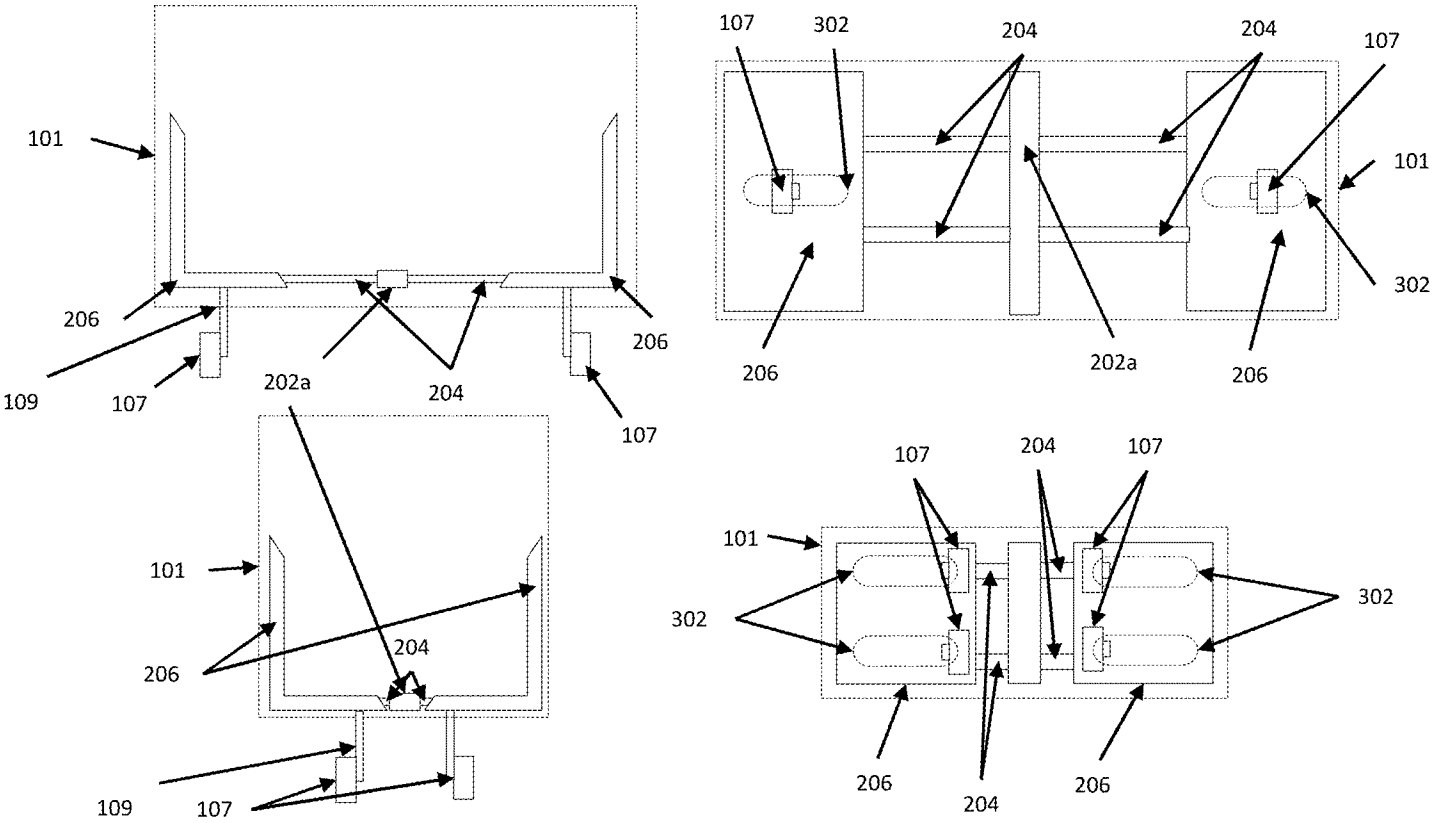

In various embodiments discussed herein, the expandable container 100 may not include any base member. In some such embodiments, the wheels may be directly attached to the expandable frame assembly 200. FIG. 3F shows multiple views of two embodiments of the base lacking a base member. In both embodiments, the base of the suitcase is instead formed by corner members 206 and wheels 107 attached thereto. The base is integrated into the expandable frame assembly 200 by way of utilizing the corner members 206 to support the wheels. In some embodiments the base frame members 202*a* may be used to support one or more wheels. The wheels 107 are configured to slide with the corner members 206 as the expandable frame assembly 200 expands and contracts by way of the adjustment mechanisms and procedures described herein. In the embodiment shown in FIG. 3F, the uppermost images include two wheels 107 disposed along a midline of the suitcase. In some embodiments, the wheels 107 may be at or adjacent a frontmost or rearmost (i.e., relative to the axis z in FIG. 1A) edge of the bottom surface of the suitcase (e.g., spaced from the midline along the corner member 106). In some embodiments, the wheels 107 may be disposed on a same side of the suitcase as the handle 104 relative to the midline of the suitcase (shown in FIGS. 1A-1B), while pointing downwardly, to allow the suitcase to be leaned and rolled by a user holding the handle. In some embodiments, a two wheeled version of the suitcase may include wheels placed at the location of two of the four-wheeled versions shown in the figures. The lowermost images shown in FIG. 3F include four wheels with two attached to each corner member 106.

The shell is configured with holes 302 through which the wheels 107 are configured to protrude through the shell. The holes 302 can be configured to be in the elastic portion 101 and/or the inelastic portion 102 (not shown) of the shell. As the elastic portion 101 of the shell expands and contracts the shell material slides adjacent to wheels 107 in at least one direction by way of holes 302, and the holes 302 may be shaped to allow uninterrupted expansion of the elastic portion 101 of the shell while the wheels extend through the shell. In some embodiments, the wheels 107 are slidably attached to the corner members 206 such that each wheel 107 can slide with a corner member 206 to which said wheel 107 is attached in order to increase and/or decrease the wheelbase and/or track of the suitcase 100 during expansion of the expandable frame assembly 200. Additionally, the holes 302 can be configured in such a way as to accommodate a plurality of wheel 107 placements and fastener connections. Further, any wheel 107, or the like, configuration described or shown for the base member 108 can be similarly configured for the corner members and vice versa. While FIGS. 3C-3F only depict portions of the expandable frame assembly 200 for simplicity of illustration, any of the expandable frame assemblies discussed herein (e.g., the expandable frame assemblies 200 of FIGS. 2A-2C) may be used with the features shown in FIGS. 3C-3F.

Figure 4A:
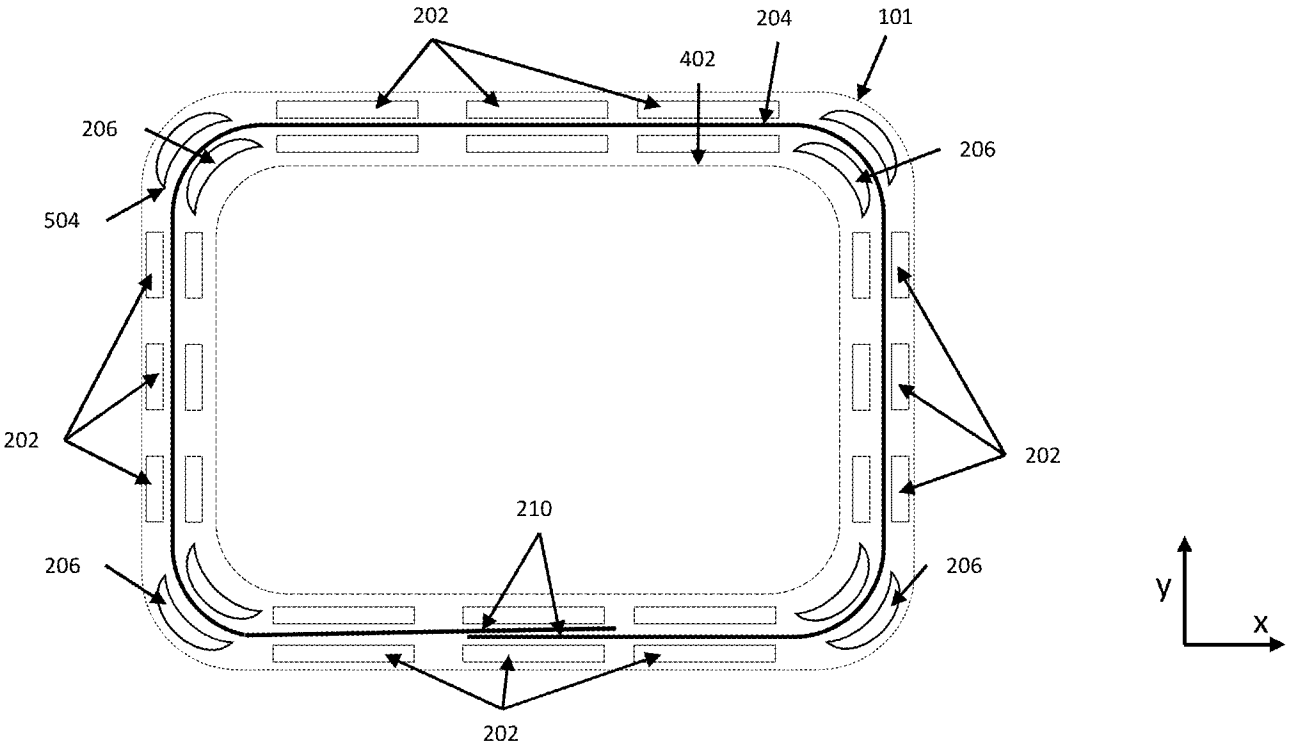
FIGS. 4A-4C are sectional views of an expandable container according to at least one embodiment of the present disclosure.
Figure 4B:
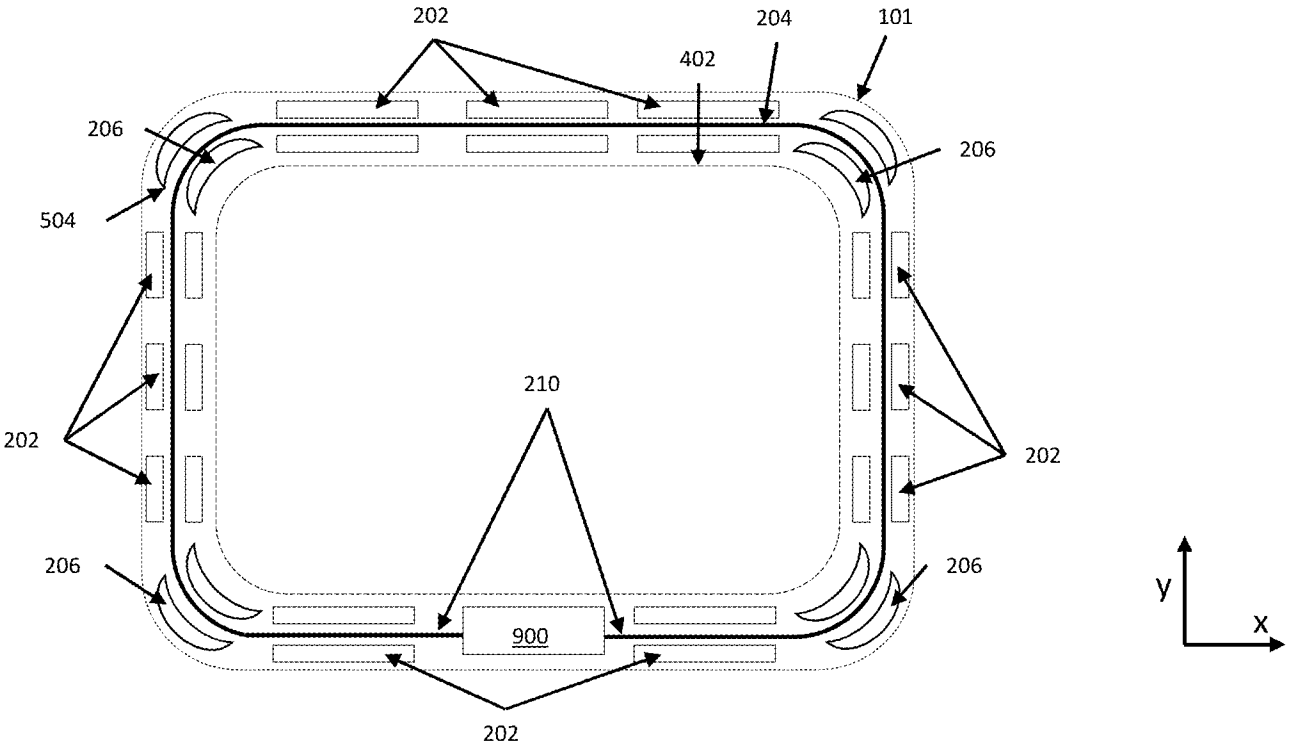

FIGS. 4A-4B shows a sectional view of an embodiment of suitcase 100 with a cross-section taken within the plane formed by axes x, y in FIG. 2A. The sectional view of suitcase 100 shows the cross-section of: an expandable frame assembly 200, a liner 402, an elastic portion 101 of the shell, a plurality of frame members 202, a plurality of corner members 206, and a sizing band 204. The sizing band 204 extends entirely around the circumference of the expandable frame assembly 200 through channels defined in each of the frame members 202, 206, 202*a*. The sizing band 204 is configured to slide relative to at least some of the frame members. The sizing band 204 may be adjusted in its length by pulling the ends 210 of the sizing band relative to and along each other to either increase (expansion) or decrease (contraction) the length of the circumference of the sizing band and thereby the expandable frame assembly 200. As described herein, an adjustment mechanism (e.g., adjustment mechanisms 900 shown in FIGS. 9-12) may engage one or both of the ends 210 of the sizing band to cause the ends to move relative to each other to change the total circumference of the sizing band and adjust the configuration of the suitcase. As illustrated in FIG. 4B, any of the adjustment mechanisms 900 may be used with the various depicted embodiments herein (e.g., attached to or between one or more of the frame members 202 or replacing one or more of the frame members). Via the sizing band 204, the entire size of the suitcase 100 may be adjusted in two dimensions (e.g., the x and y dimensions in the depicted embodiment) with only a single point of adjustment (e.g., by changing the length of the sizing band using an adjustment mechanism). As further depicted in FIGS. 4A-5, the channels 504 defined by the corner members 206 may turn at an angle to redirect the sizing band 204 and maintain a rectangular shape for the suitcase. In some embodiments, for example, the angle of the channel 504 in the corner members 206 may be ninety (90) degrees.

In some embodiments, a liner 402 may be disposed within the suitcase 100 to cover the expandable frame assembly 200 and protect the contents of the suitcase from pinches or other damage. The liner 402 may be made of any suitable elastic, inelastic, or partially elastic material. In embodiments using an inelastic material, the liner may be sized to the maximum possible volume of the suitcase and may fold onto itself during contraction of the suitcase to a smaller size. Similarly, in some alternative embodiments, the shell 101, 102 may be entirely made of inelastic or partially elastic portions and may fold onto itself in smaller configurations (e.g., a zippered section or other concealable fold may be used).

Figure 4C:
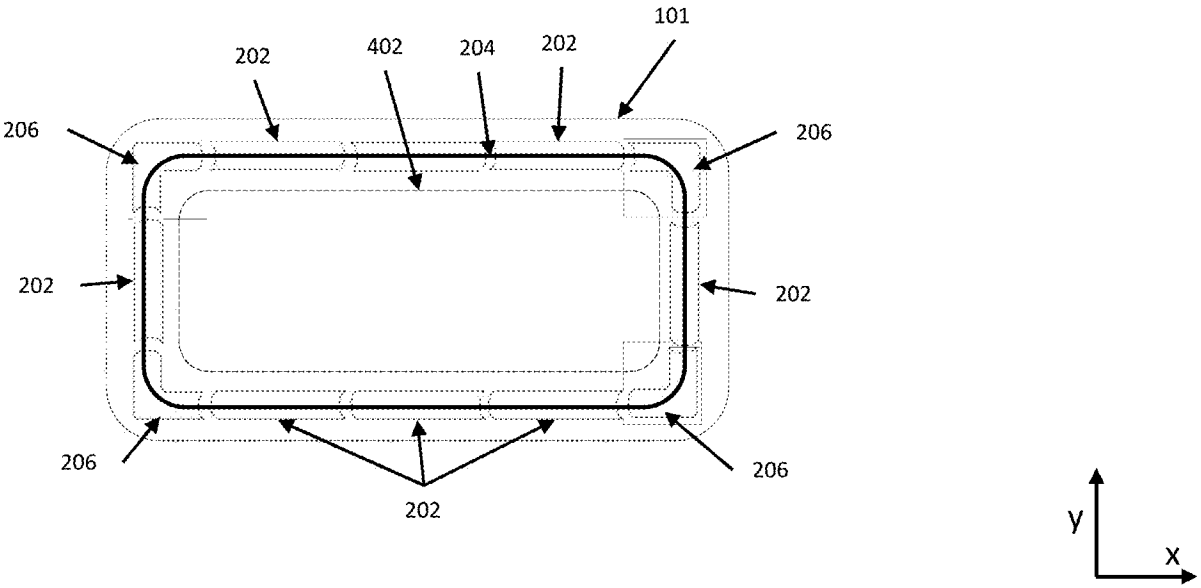

FIG. 4C shows a sectional view of another embodiment of suitcase 100 with a cross-section taken within the plane formed by axes x, y in FIG. 2A. The sectional view of suitcase 100 shows the cross-section of: an expandable frame assembly 200, a liner 402, an elastic portion 101 of the shell, a plurality of frame members 202, a plurality of corner members 206, and a sizing band 204.

Figure 5:
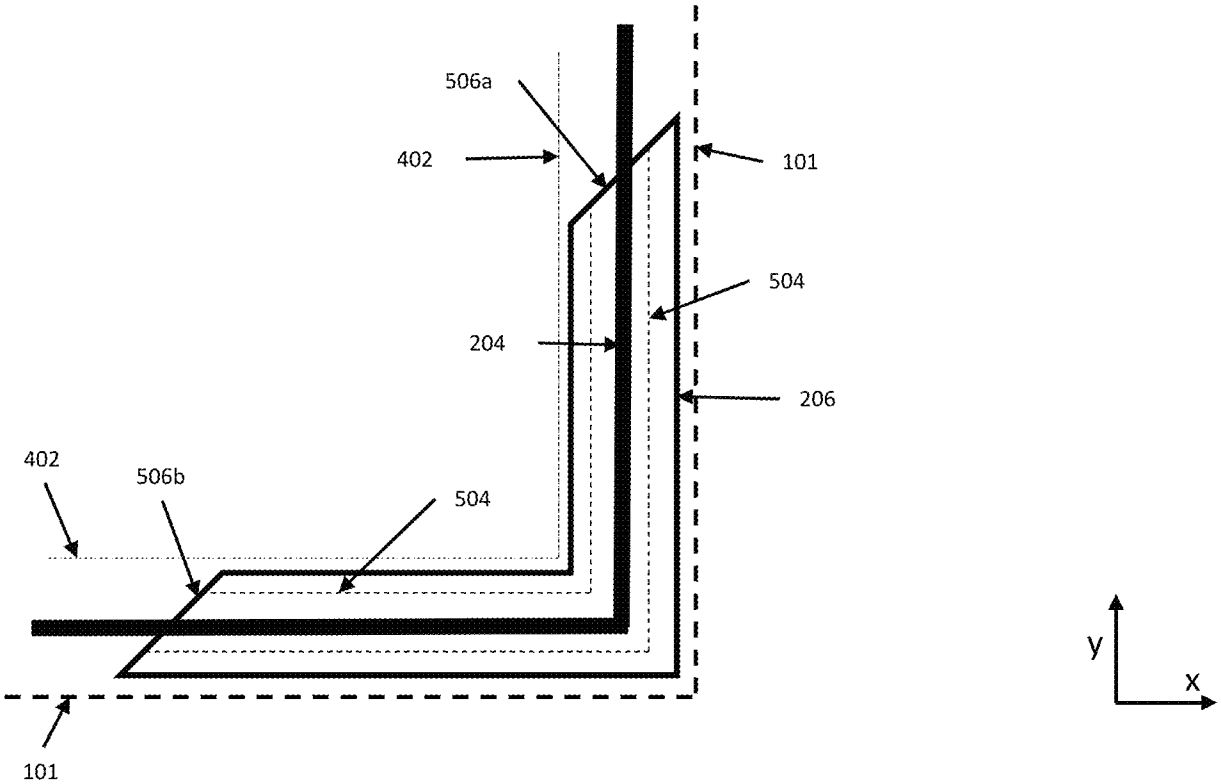
FIG. 5 is a detailed sectional view of a portion of an expandable container according to at least one embodiment of the present disclosure.

FIG. 5 shows a sectional view of a corner member 206 of an embodiment of suitcase 100. The sectional view of the corner portion of suitcase 100 shows the cross-section of a corner member 206. The inner side of the corner member is abutted by the liner 402. The outer side of the corner member is abutted by the elastic portion 101 of the shell. A channel 504 extends from a first end 506*a* of the corner member 206 to a second end 506*b* of the corner member 206, and the channel 504 as shown is bent, such that the channel is configured to bend the sizing band 204 at an angle of substantially 90-degrees. In reference to FIGS. 4A-4B one skilled in the art will appreciate that bending the sizing band 204 an angle of substantially 90-degrees does not exclude rounded corners and/or rounded embodiments of corner members 206 or rounded channels 504 within the corner members. At least partially rounded corner members 206 may be configured to meet user demand for comfort, safety regulations, popular aesthetic design trends, functional mechanical requirements, and/or the like. For example, the channel 504 maybe substantially curved as shown in FIG. 4A to reduce binding of the sizing band 204 and/or to reduce the build-up of stresses in the material of corner member 206. The ends 506*a*, 506*b* of the corner member 506 are depicted at an angle; however, the ends may be flat or may have another shape (e.g., the interlocking shapes shown in FIGS. 7A-7B).

Figure 6:
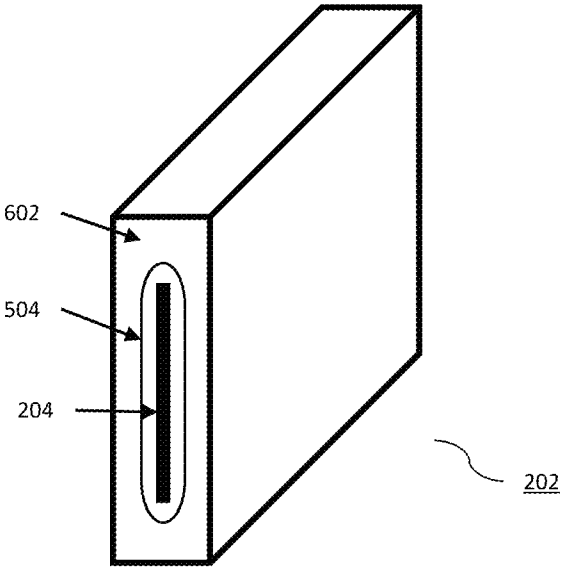
FIG. 6 is a perspective view of a frame member according to at least one embodiment of the present disclosure.

FIG. 6 shows a perspective view of a single frame member 202 embodiment. The single frame member 202 comprises at least a mating surface 602 and a channel 504, wherein a portion of sizing band 204 is shown inside of channel 504 for reference. In various embodiments of the frame members 202, 202*a*, 206 discussed herein, the channels 504 may be defined within an interior of the frame members, such that the sizing band is held within the channel and allowed to slide axially along the channel as depicted in FIG. 6.

Figure 7A:
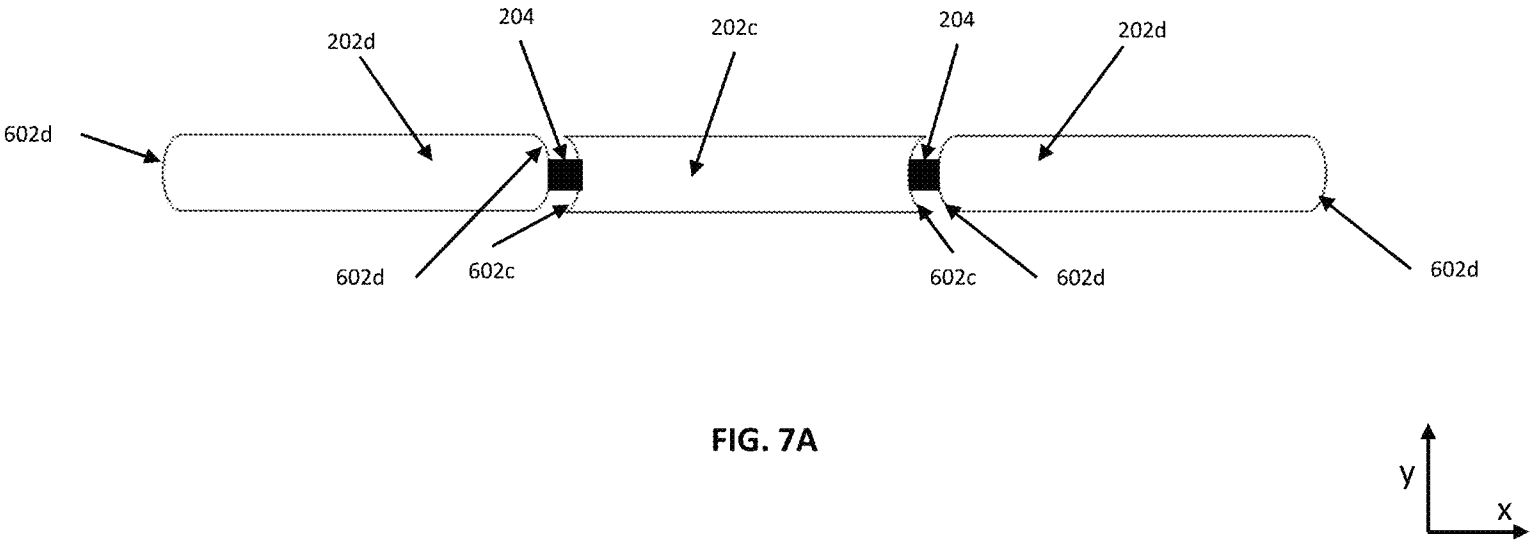
FIGS. 7A-7B are views of a plurality of frame members and a sizing band according to at least one embodiment of the present disclosure.

FIG. 7A shows a view of a series of frame members 202 of a portion of an expandable frame assembly according to an embodiment according to the present disclosure. The depicted embodiment includes mating surfaces 602*c* and 602*d* on the frame members 202*c* and 202*d* that are complementary in shape to each other. The domed frame members 202*d* are configured with domed mating surfaces 602*d*. The concave frame member 202*c* is configured with concave mating surfaces 602*c*. The domed mating surfaces 602*d* are configured to sit within the recessed portions of the concave mating surfaces 602*c*. Additionally, corner members 206*c* and 206*d* (not shown) are configured with concave mating surfaces 602*c* and domed mating surfaces 602*d* respectively.

Figure 7B:
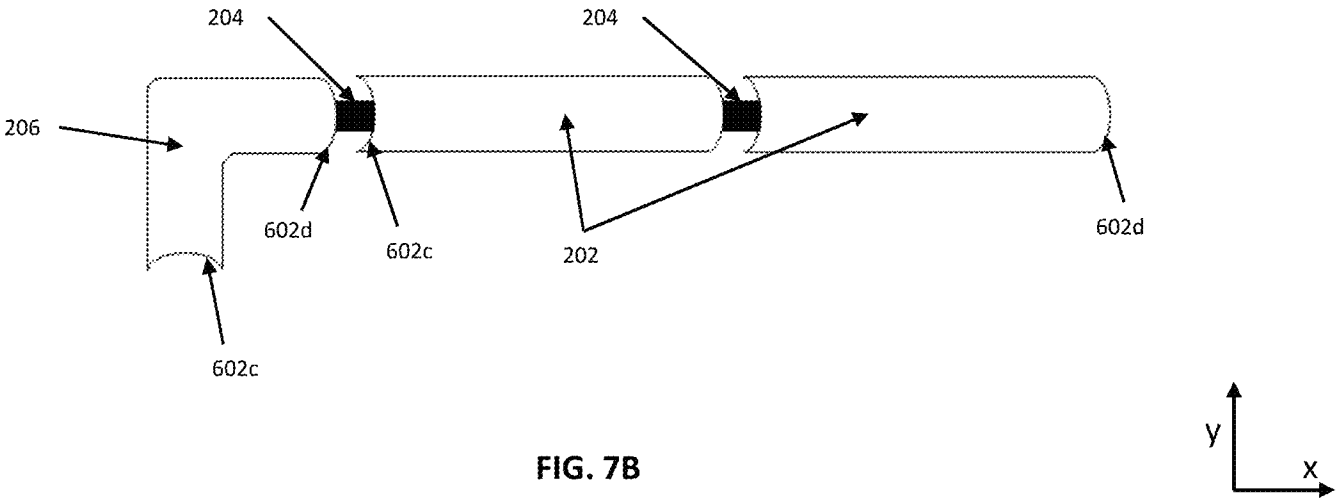

FIG. 7B shows a view of a series of frame members 202 of a portion of an expandable frame assembly according to an embodiment according to the present disclosure. The mating surfaces 602 of the frame members 202 are complementary in shape to each other. The frame members 202 and corner frame member 206 are configured with one concave mating surfaces 602*c* and one domed mating surfaces 602*d*. The frame members 202 and corner frame member 206 are configured with complementary mating surfaces at opposite ends. The domed mating surfaces 602*d* are configured to sit within the recessed portions of the concave mating surfaces 602*c*.

In various embodiments of the frame members 202, 202*a*, 206 discussed herein, the frame members may be configured with domed mating surfaces or concave mating surfaces at either end along the path of the sizing band 204 to cause the frame members adjacent to each other to align when pulled together in the most compressed, smallest configuration of the suitcase. In some embodiments, the mating surfaces between adjacent frame members 202, 202*a*, 206 may comprise complementary elliptical, wedge, conical, or similar geometric shaped features configured to ensure proper joinder between adjacent frame members. The complementary geometric shapes may form the shape of the mating surfaces in whole or in part. In a partial configuration embodiment the complementary geometric shapes form a peg and a hole along a flat mating surface of a respective frame member and the peg and the hole are configured to fit into each other upon the joining of the respective frame members. The size and shape of the mating surface complementary features may be configured to allow for proper movement and/or restriction of the sizing band through the frame members. In some embodiments, any type of alignment features, including those shown in FIGS. 7A and 7B, may be used between surfaces of the adjacent frame members 202, 202*a*, 206. In some embodiments, the alignment features may align the frame members 202, 202*a*, 206 with respect to at least one axis (e.g., alignment in the y direction shown in FIGS. 7A, 7B). In some embodiments, the alignment features may align the frame members 202, 202*a*, 206 with respect to at least two axes (e.g., alignment in both the x and y direction shown in FIGS. 7A, 7B). In some embodiments, the alignment features may be any complementary shapes, such as tapers, domes, wedges, keys, notches, pegs, and/or any other elements that would be appreciated by a person of ordinary skill in the art in light of the present disclosure.

As described herein, in some embodiments, the linear frame members 202, 202*a* and the corner members 206 of the expandable frame assembly 200 may at least partially define the rectangular shape of the suitcase so that the suitcase remains substantially rectangular during its transition between each of the configurations. In some embodiments, one or more support members 208 may at least partially define and enforce the rectangular shape of the suitcase. In some embodiments, the shell 101, 102 and/or the liner 402 may also contribute to maintaining the rectangular shape. For example, the shell 101, 102 and/or liner 402 may be attached to one or more of the frame members 202, 202*a*, 206 and may be structured to apply forces to the one or more of the frame members 202, 202*a*, 206 to constrain the motion of the one or more frame members to a rectangular shape. In an example, the final dimensions of the most expanded, largest shape of the suitcase 100 may correspond to the most extreme dimensions to which the shell 101, 102 and/or liner 402 are configured to expand, such that the respective shell 101, 102 and/or liner 402 ensures that the most expanded position retains the rectangular suitcase shape. In some embodiments, at least the corner members 206 may be fixedly attached to at least one point on the shell 101, 102 and/or liner 402 such that the relationship between corner members is maintained by the respective shell 101, 102 and/or liner 402 during transformation. In embodiments using an elastic shell portion 101 or liner 402, the elastic forces applied by the respective elastic components against the expandable frame assembly 200 may be configured to maintain the rectangular shape of the suitcase in all configurations by maintaining tension on the elastic components according to the intended proportions of the dimensions of the suitcase. For example, the various aligning components described herein may be configured to maintain the length-to-width proportions of the suitcase, such that in an instance in which the adjustment member 900 is lengthening or shortening the sizing band 204 and one side becomes longer or shorter than the rectangular proportions should maintain, the aligning components (e.g., the shell 101, 102 and/or liner 402) may automatically apply a force to one or more of the sides to pull them generally back into alignment.

Figure 8A:
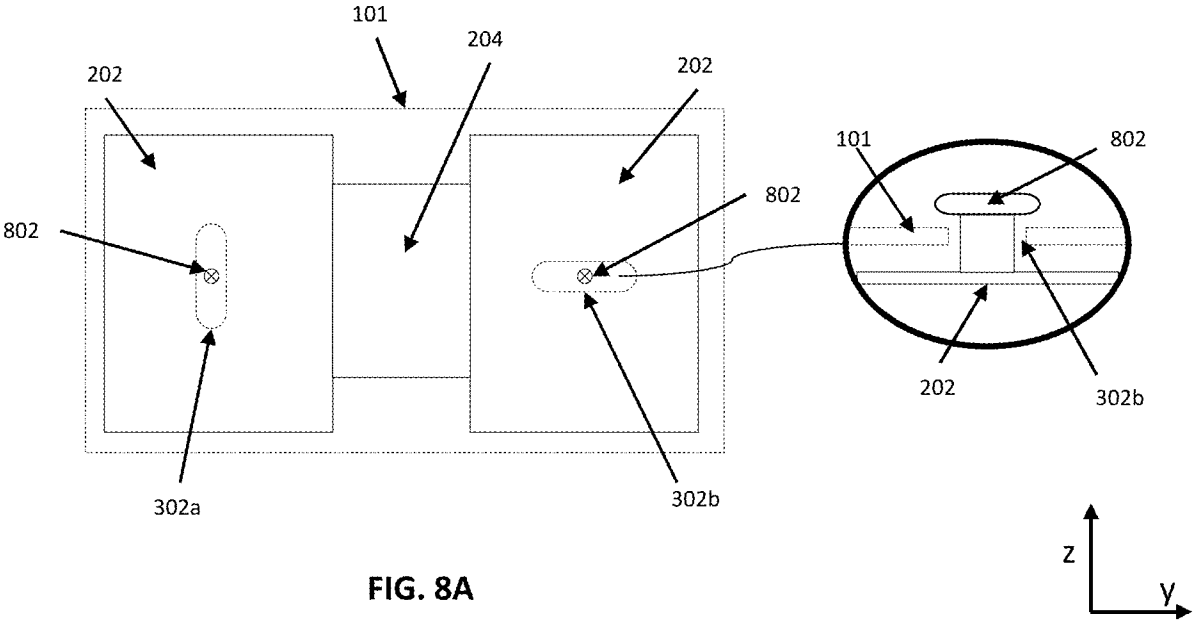
FIGS. 8A-8G are side views of various frame members, sizing bands, and support members according to at least one embodiment of the present disclosure.

FIG. 8A shows a detailed side view of a portion of an expandable frame assembly of an embodiment showing example attachments between the shell 101, 102 and the expandable frame assembly 200 with the shell shown as transparent for purposes of visualizing the components. In the depicted embodiment, the shell 101 and its holes 302 are shown in dashed line to illustrate the underlying structural components and the breakout view shown to the right of the image shows a lateral view of the grommet 802 extending through the shell 101. Although described as "grommets" herein, the attachment between the frame members and the shell may be via any means, such as adhesive, screws, integral molding, stitching, rivets, welding, or the like. Two frame members 202 are shown (as depicted, the frame members may be any of the frame member embodiments discussed herein) with a single wide sizing band 204 (as depicted, the sizing band(s) may be any of the sizing band embodiments discussed herein). The frame members are slidably and/or non-slidably attached to the elastic portion 101 of the shell by way of grommets 802 and holes 302. The two holes 302 are shown as being perpendicular relative to each other for illustration of the possible orientations, and one skilled in the art in light of the present disclosure will appreciate that the configuration of holes 302 can be parallel with each other and/or configured in such a way as to follow the expansion and contraction of the elastic portion 101 of the shell. For example, the leftmost hole 302*a* may be oriented to cause the leftmost frame member 202 to move with the elastic portion 101 of the shell during expansion (e.g., to enforce the rectangular shape of the suitcase as discussed above). The leftmost hole 302*a* may define a slot vertically such that the elastic portion 101 is allowed to expand in the z direction without moving the frame member 202. The rightmost hole 302*b* may allow the elastic portion 101 to expand around the circumference of the suitcase (e.g., in the y direction) while not causing the elastic portion to snag on the grommet 802. Similarly, because there is only one grommet 802, the elastic portion may expand in the z direction away from the grommet while the grommet maintains the centering of the elastic portion 101 along the edge of the suitcase. In some embodiments, the grommet 802 or other fastening means may be attached to the frame, such as via any means, such as adhesive, screws, integral molding, stitching, rivets, welding, or the like.

Figure 8B:
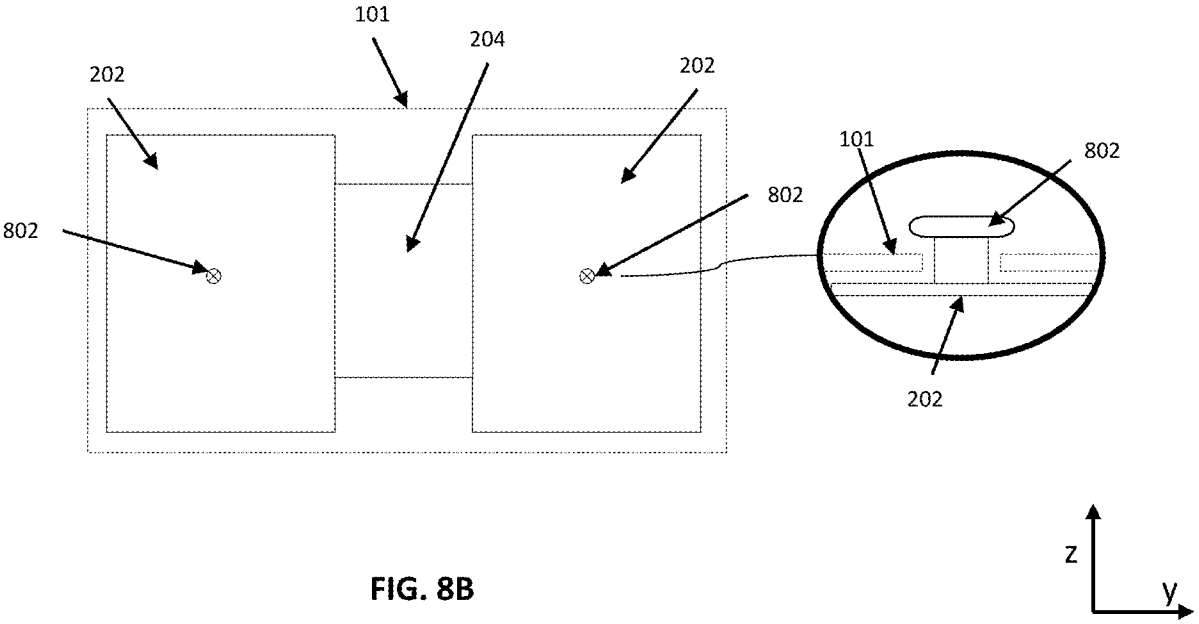

FIG. 8B shows a detailed side view of a portion of an expandable frame assembly of an embodiment showing example attachments between the shell 101, 102 and the expandable frame assembly 200 with the shell shown as transparent for purposes of visualizing the components. In the embodiment of FIG. 8B, the grommets 802 extend through small holes in the elastic portion 101 such that the attachment points remain fixed relative to the respective frame members 202 (e.g., to enforce the rectangular shape of the suitcase as discussed above). The elastic portion 101 may expand and contract with the expandable frame assembly due at least partially to the forces exerted on the shell. In order to prevent damage to the elastic portion 101 reinforcements (not shown) (e.g., a reinforced seam, etc.) are added to the elastic portion 101 around the grommet-shell interfaces.

Figure 8C:
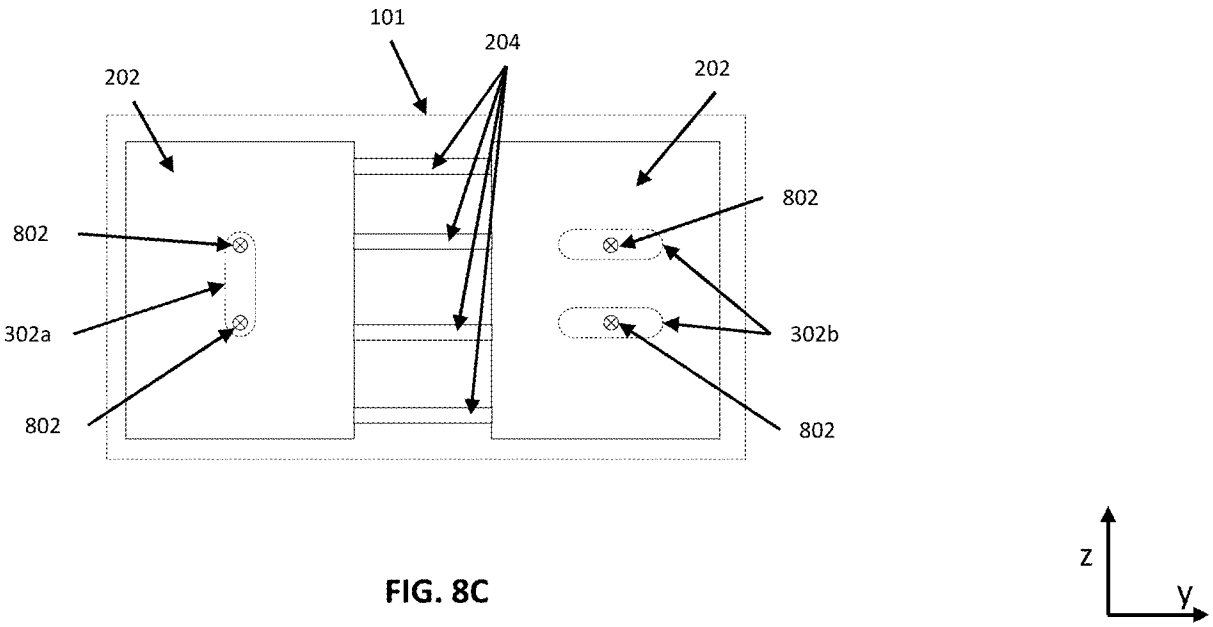

FIG. 8C shows a detailed side view of a portion of an expandable frame assembly of an embodiment showing example attachments between the shell 101, 102 and the expandable frame assembly 200 with the shell shown as transparent for purposes of visualizing the components. Two frame members 202 are shown with four narrow sizing bands 204. The frame members are slidably and/or non-slidably attached to the elastic portion 101 of the shell by way of grommets 802 and holes 302. Holes 302 can be configured parallel, perpendicular, and/or horizontal relative to each other. Multiple grommets 802 can be configured to utilize a single hole 302. The leftmost hole 302*a* may connect the grommets 802 vertically such that the elastic portion 101 is allowed to expand in the z-direction without moving the frame member 202. The rightmost holes 302*b* may expand in the y-direction without moving the frame member 202. In some embodiments, a hole 302 may be sized to receive a single grommet 802 and one or more rivets (not shown), or other fasteners, may be slidably connected to the grommet 802 at a first end and fixed to the frame member 202 at a second end. As described above, the depicted orientations and hole configurations for each of the embodiments herein are provided to show the variety possible orientations and configurations for the shell/expandable frame assembly interface, and multiple of any one configuration (e.g., all vertical slots), a mixture of any two or more configurations, or any other combination or alternative thereof may be used.

As described above, in some embodiments, one or more support members 208 may be used to help enforce the rectangular shape of the suitcase. In some embodiments, one or more support members 208 may extend between each adjacent pair of frame members 202, 202*a*, 206. In some embodiments, the support members 208 may be sufficiently rigid (e.g., made of metal, such as aluminum, titanium, or steel; made of rigid plastic; or made of other similarly-rigid materials) that it cannot turn along the corner members 206 and slide around the corner in the same manner as the sizing band 204. In some embodiments, a separate support member 208 may extend between each adjacent pair of frame members 202, 202*a*, 206.

Figure 8D:
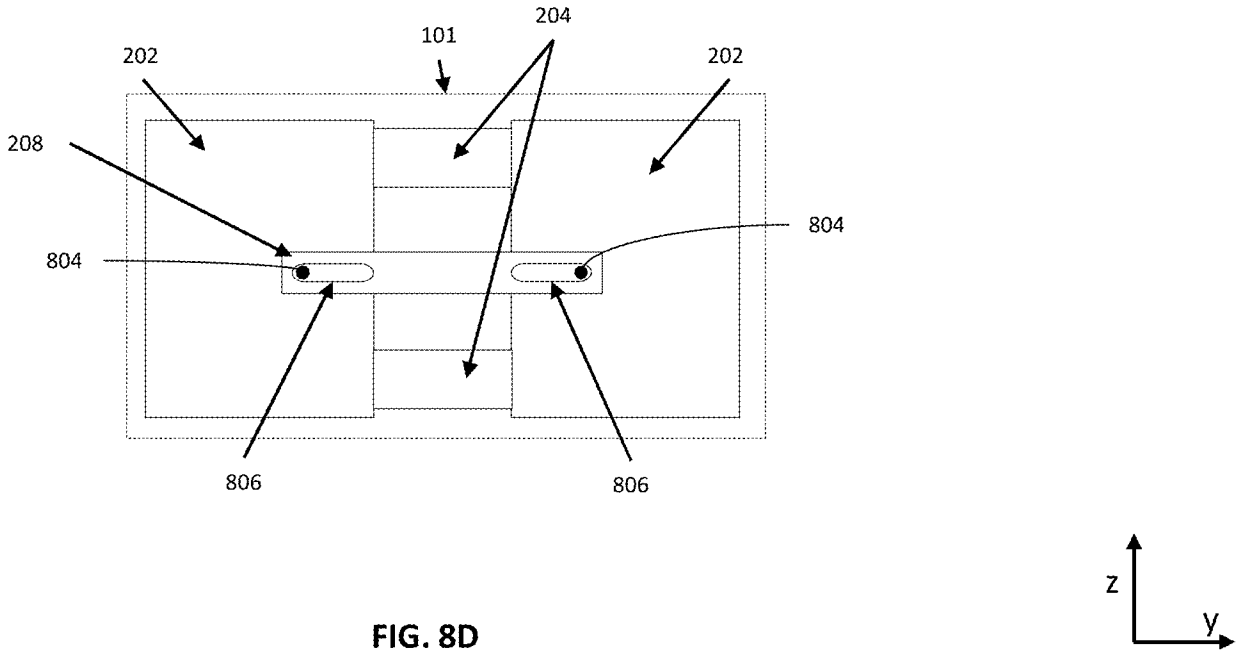

FIG. 8D shows a detailed view of a portion of an expandable frame assembly of an embodiment having a support member 208 according to an embodiment of the present disclosure. Two frame members 202 are shown with two sizing bands 204 of equal size and shape. The frame members 202 are slidably and/or non-slidably attached to the elastic portion 101 of the shell by way of grommets (e.g., grommets 802 shown in FIGS. 8A-8C) and holes (e.g., holes 302 shown in FIGS. 8A, 8C). The depicted frame members 202 are each slidably and/or non-slidably attached to at least a single support member 208 by way of bolts 804 (e.g., one end may be fastened securely to one of the frame members while the other end slides relative to the other frame member along the y axis, or in another embodiment, both ends may slide relative to the frame members along the y axis). The support member 208 is further configured with slots 806 through which one or more bolts 804 are slidably and/or non-slidably attached to the frame members 202. At least one bolt 804 may attach the support member 208 to a respective frame member 202. In some embodiments, two or more bolts 804 may be used on each frame member (e.g., two bolts within the same slots 806 or in separate slots). In some embodiments, the bolts 804 can be replaced by any type of fastener and fastening arrangement capable of allowing the frame members to slide relative to each other along the y axis while enforcing the rectangular shape of the suitcase 100. In some embodiments, the slots 806 may be made to any size, configuration, and/or shape. Applicant further appreciates and contemplates that the grommets 802 and holes 302 may be configured with the bolts 804 and slots 806 to align or otherwise complement the placement of each other. For example, in some embodiments, bolts 804 can at least partially integrate the functionality of the grommets 802, as would be understood by one skilled in the art in light of the present disclosure, to reduce the total number of fasteners required to implement an embodiment. As shown in FIG. 8D, the depicted slots 806 and the support member 208 are configured to slide parallel/coincident to each other along axis y. Further, in some embodiments, the plurality of support members can be configured to collapse, fold, telescope, bend, scissor, the like, and/or any combination thereof to allow the suitcase to expand and collapse between two or more configurations as described herein.

Figure 8E:
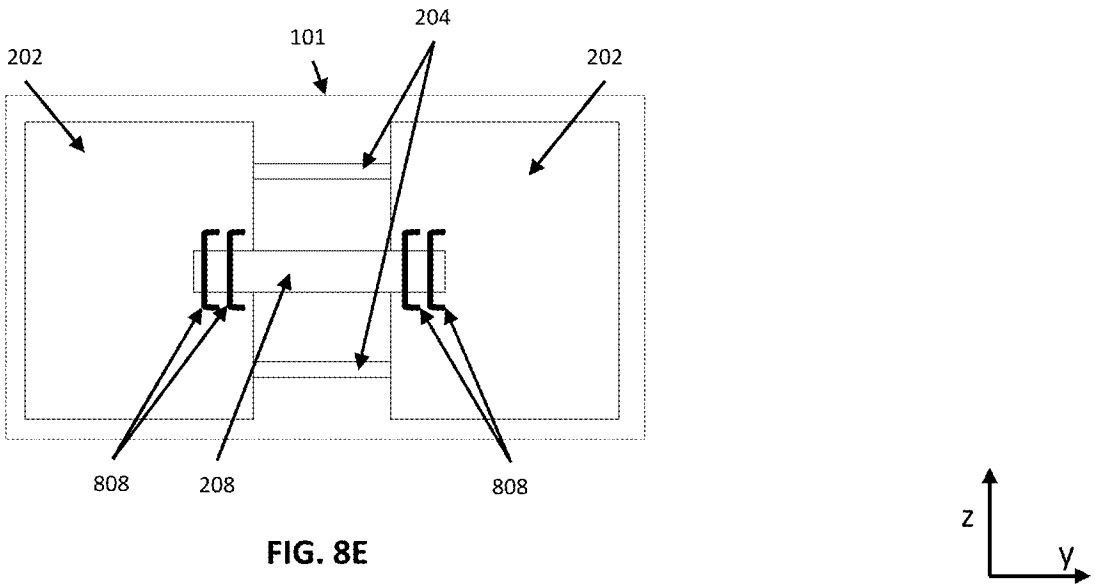

FIG. 8E shows a detailed view of a portion of an expandable frame assembly of an embodiment having a support member 208 according to an embodiment of the present disclosure. Two frame members 202 are shown with two sizing bands 204 of equal size and shape. The frame members 202 are slidably and/or non-slidably attached to the elastic portion 101 of the shell by way of grommets 802 (not shown) and holes 302 (not shown). The frame members 202 are slidably and/or non-slidably attached to at least a single support member 208 by way of guides 808. The guides 808 are attached to at least one frame member 202 by way of at least a fastener connection, such as adhesive, screws, integral molding, stitching, rivets, welding, or the like. The guides 808 are configured, as shown, to slidably hold the support member 208 against the two frame members 202. The guides 808 can be further configured to attach to the support member by way of at least a slidable fastener connection. In some embodiments, the guides 808 are configured to abut the sides and top surface of the support member 208 to limit the travel of the support member to the y direction. The support member and/or guides may include stops or other motion-restricting features to prevent the support member from decoupling from the guides 808, which features, in some embodiments, may also delimit the maximum expansion of the suitcase. The guides 808 can be further configured to comprise rollers, lubrication, and/or the like, to prevent binding of the support member 208 and frame member 202 interface. In some embodiments the frame members 202 are not attached to the shell but can still be completely surround by the shell. In some embodiments, the guides 808 can be configured to support at least partially the shell over the expandable frame assembly to minimize contact therebetween, and wherein the guides 808 can further comprise a shield (not shown) to provide increased support for the shell during the expansion/compression process and prevent snags. Such a configuration of guides 808 with the shield would further prevent malfunction of the expandable frame assembly and/or would further prevent damage to the shell (e.g., ripping, tearing, puncture, etc.)

Figure 8F:
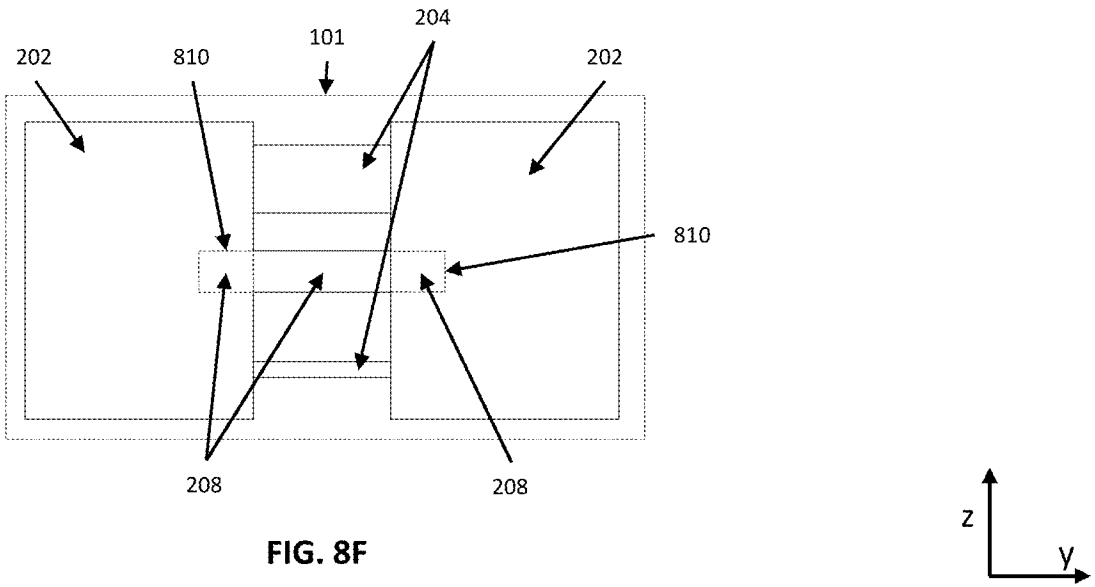

FIG. 8F shows a detailed view of a portion of an expandable frame assembly of an embodiment having a support member 208 according to an embodiment of the present disclosure. Two frame members 202 are shown with two sizing bands 204 of equal size and shape. Two frame members 202 are shown with two sizing bands 204 of unequal size and shape. The frame members 202 are slidably and/or non-slidably attached to the elastic portion 101 of the shell by way of grommets 802 (not shown) and holes 302 (not shown). The frame members 202 are slidably and/or non-slidably attached to at least a single support member 208 by way of a support channel 810 defined in the frame member 202. In some embodiments the support channel 810 can be configured to also function with the sizing band 204 and the support member 208 simultaneously, wherein the support channel 810 and the channel 504 are one in the same channel. Further, support channel 810 can be configured with fasteners such that the sliding, or similar, motion of support member 208 can be limited and/or otherwise controlled. For example, in some embodiments, the support member 208 and/or the support channel 810 may include stops or other motion-restricting features to prevent the support member from decoupling from the guides 808. In some embodiments, the support channel 810 may define a depth sufficient to allow the frame members 202 to contact each other and completely enclose the support member 208.

Figure 8G:
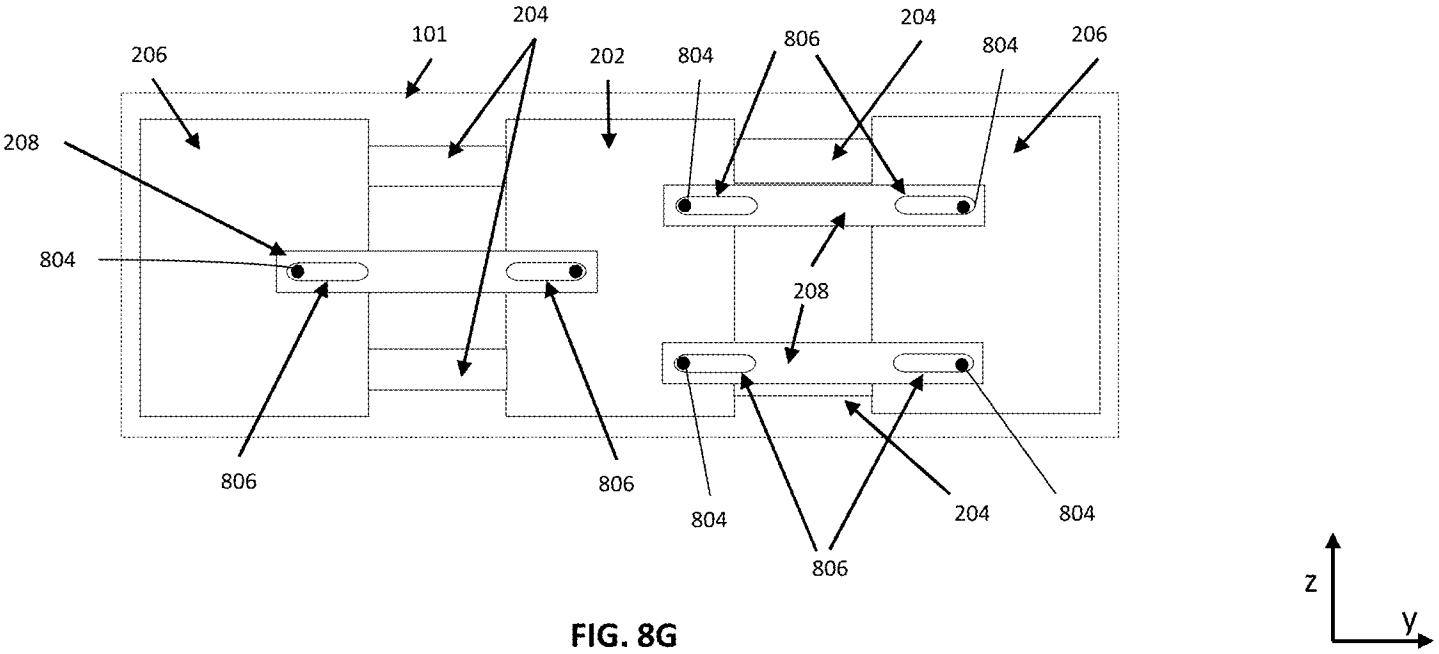

FIG. 8G shows the detailed view of a portion of an expandable frame assembly of the embodiment of FIG. 8D having a plurality of support members 208 according to an embodiment of the present disclosure. In the depicted embodiment the frame members 202, 206; support members 208; bolts 804; and slots 806 operate in substantially the same manner as the embodiment of FIG. 8D except multiple support members are shown connecting the three frame members 202, 206 in series. In the depicted embodiment, some frame members 202, 206 may have multiple support members 208 extending therebetween. The support members 208 are shown offset from each other along the z axis between adjacent frame members such that the support members do not contact each other when the suitcase is fully collapsed.

In some embodiments, each frame member may have at least one support member configured not to impinge the adjacent support members in the fully collapsed configuration, such that the at least one support member is offset in the z direction relative to the adjacent at least one support member. In any of the embodiments disclosed herein (e.g., the embodiments of FIGS. 8D-8F), multiple and/or offset support members 208 may be used between adjacent frame members 202, 202*a*, 206. In some embodiments, the frame members may be sufficiently long that the support members 208 do not impinge each other in the collapsed position when the support members are coaxial. In some embodiments, the support members 208 connected to the corner members 206 may be rigidly attached to the corner members or may be slidably attached in such a manner that the support members 208 cannot extend past the outermost edge of the corner member (e.g., the travel distance of the support member 208 is sufficiently low to prevent the support member 208 protruding into the shell 101, 102 past the end of the suitcase 100.

Figure 9A:
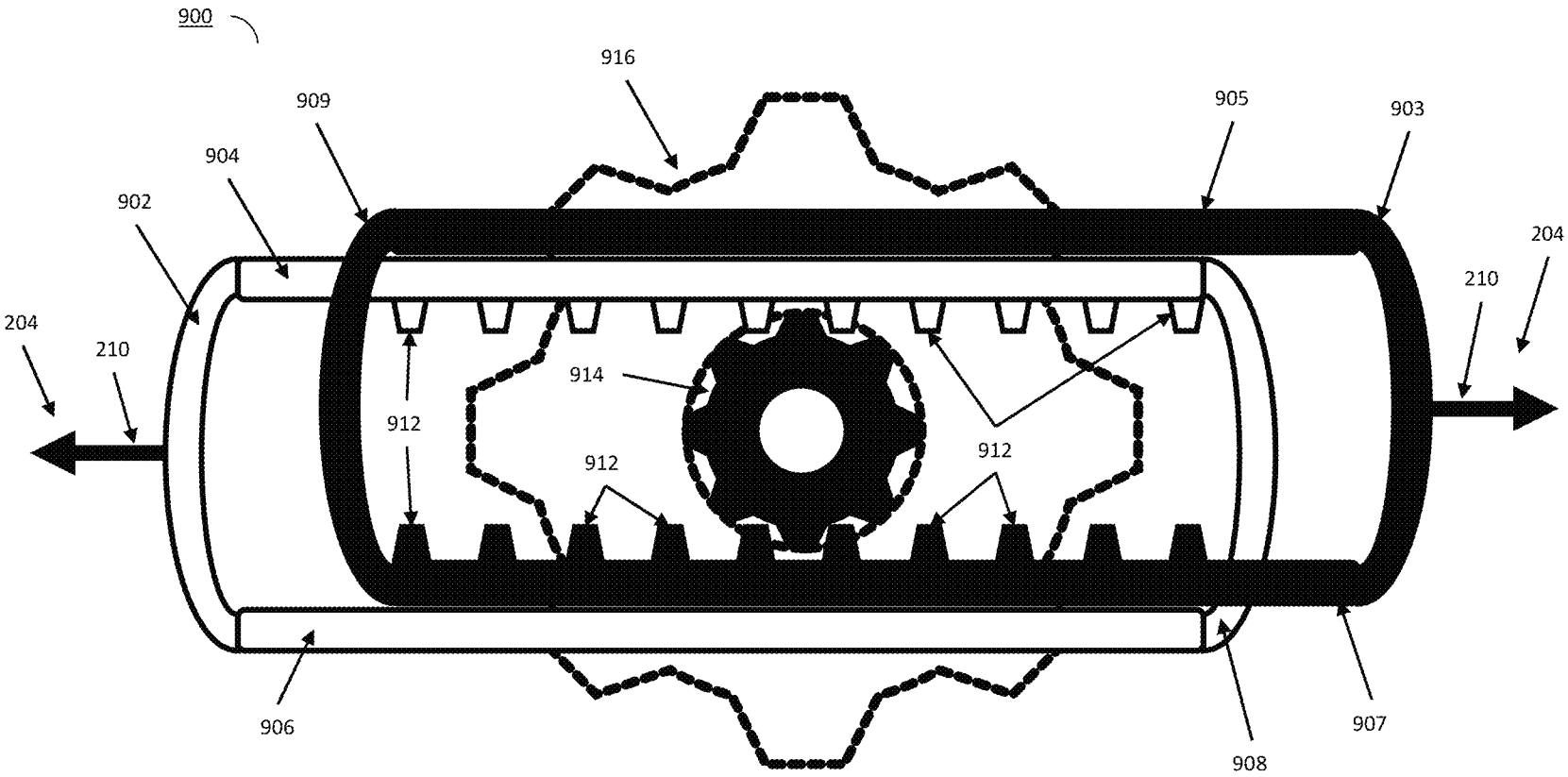
FIGS. 9A-9B are side views of an adjustment mechanism according to at least one embodiment of the present disclosure.

As described herein, the size of the suitcase 100 may be adjustable in at least two dimensions FIG. 9A shows a side view of an adjustment mechanism 900 structured in accordance with at least one embodiment of the present disclosure. In operation, as adjustment dial 916 is pressed-in, by a user, relative to the suitcase 100 to operatively engage with an adjustment gear 914. The adjustment gear 914 is operatively engaged with at least one set of adjustment teeth 912. The adjustment teeth 912 are mounted on or otherwise part of one or more adjustment bands 905, 906 which are engaged with one or more of the respective ends 210 of the sizing band(s) 204. While the adjustment dial 916 is operatively engaged with the adjustment gear 914, the adjustment dial 916 is rotated in a first direction to, at least partially, expand at least the expandable frame assembly 200 by pushing the ends 210 of the sizing band 204 away from each other. While the adjustment dial 916 is operatively engaged with the adjustment gear 914, the adjustment dial 916 is rotated in a second direction to at least partially contract and/or compress at least the expandable frame assembly 200 by pulling the ends 210 of the sizing band 204 towards each other. While the adjustment dial 916 is operatively engaged with the adjustment gear 914, the adjustment dial 916 is pulled-out, by a user, relative to the suitcase 100 to operatively disengage with an adjustment gear 914. In embodiments having multiple sizing bands 204, the adjustment dial 916 may engage with multiple adjustment gears 914 and/or adjustment teeth 912. The adjustment mechanism 900 may be embedded in or attached to one or more of the frame members 202, 202*a*, 206. In some embodiments, the adjustment mechanism 900 may take the place of one or more of the frame members 202, 202*a*, 206 along the circumference of the sizing band 204. In some embodiments, the adjustment mechanism 900 may be disposed between two or more of the frame members 202, 202*a*, 206.

While the adjustment dial 916 is operatively disengaged with the adjustment gear 914, the adjustment gear 914 is held in place by an adjustment lock preventing at least partial movement of at least the adjustment gear 914, adjustment teeth 912, and/or the sizing band 204. The adjustment lock (not shown) at least partially comprises at least one of a friction lock, cylinder pin-tumbler, spring, pawl, fixed gear, or like, and/or any combination thereof. In order to prevent damage and/or malfunction of suitcase 100 the adjustment mechanism 900 further comprises adjustment limits 903, 909, 902, and 908 which are configured to operatively engage with the adjustment gear 914 when the sizing band 204 has adjusted a predefined length to prevent excessive expansion or contraction of the sizing band 204 or breaking of the adjustment mechanism 900. Once the adjustment gear 914 operatively engages with at least one of the adjustment limits 903, 909, 902, and 908, the adjustment gear 914 will at least stop rotation in the first direction and/or the second direction. The adjustment limits 903, 909, 902, and 908 can further comprise at least one of a spring, pawl, cylinder pin, gear, teeth, the like, and/or any combination thereof configured to at least stop rotation of the adjustment gear 914 in the first direction and/or the second direction. In some embodiments, adjustment limits 903, 909, 902, and 908 are defined by a torque limiter (not shown), a smooth section of sizing band 204 (i.e., no gear teeth), a number of full or partial rotations of the adjustment dial 916 and/or the adjustment gear 914, or the like, and/or any combination thereof.

In the depicted embodiment, the sizing band 204 is attached on a first end 210 to a first adjustment section comprising at least adjustment limit 903, adjustment limit 909, adjustment band 905, and adjustment band 907, wherein adjustment band 907 further comprises a plurality of adjustment teeth 912. The sizing band 204 is attached on a second end 210 to a second adjustment section comprising at least adjustment limit 902, adjustment limit 908, adjustment band 906, and adjustment band 904, wherein adjustment band 904 further comprises a plurality of adjustment teeth 912. The first adjustment section and the second adjustment sections can be configured to be a single adjustment section forming a closed loop with sizing band 204. Further, adjustment teeth 912 can be configured along the full length of sizing band 204 defining a single continuous adjustment section, in such embodiments the sizing band can be configured as either an open or closed loop. In some embodiments, one end 210 of the sizing band 204 may be fixed to a frame member 202 such that only the other end 210 is adjusted relative to the expandable frame assembly. The embodiment shown in FIG. 9A can be implemented with a plurality of alternative components, for example adjustment gear 914 can comprise a sprocket operatively engaged with sizing band 204 comprising a chain.

Figure 9B:
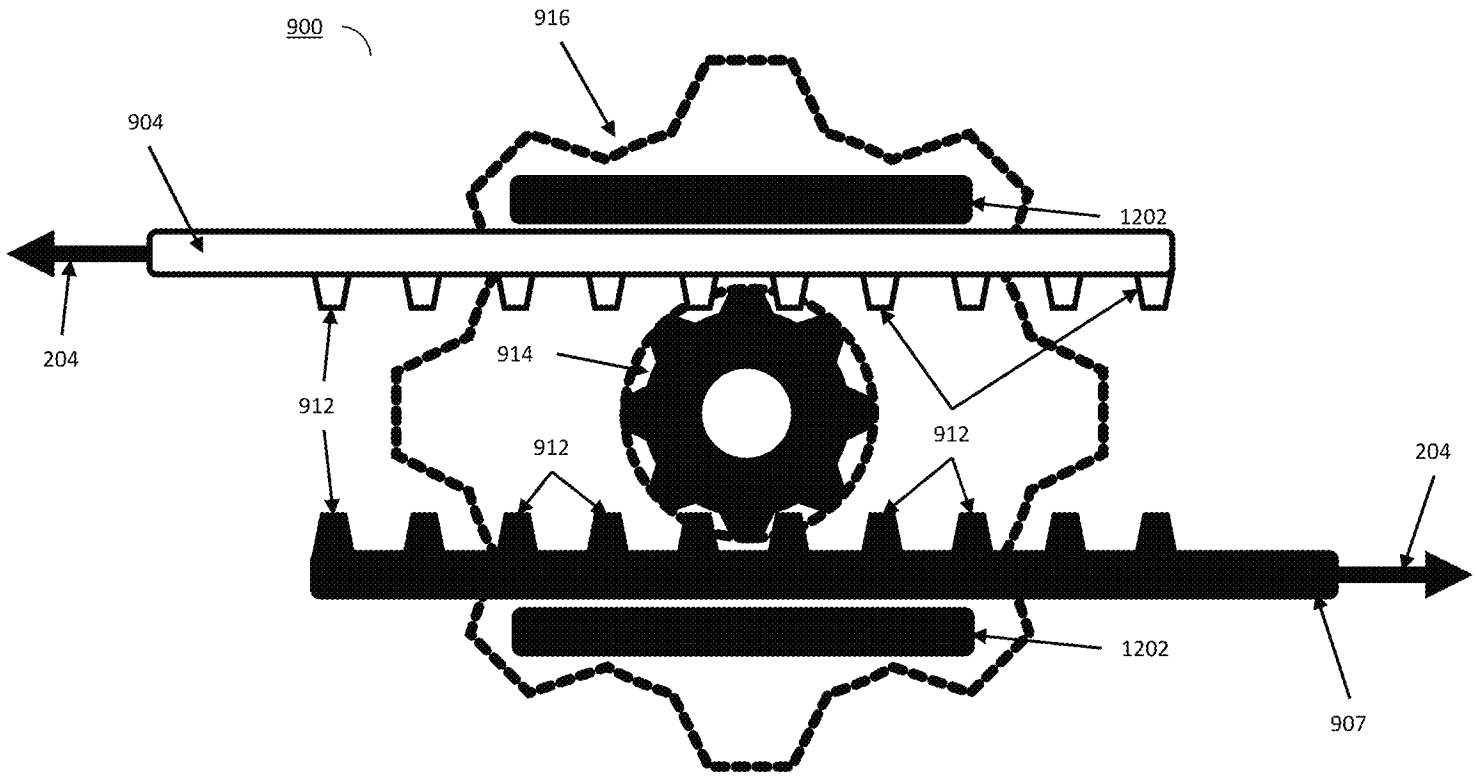

FIG. 9B shows a side view of an adjustment mechanism 900 structured in accordance with at least one embodiment of the present disclosure. In operation, the embodied adjustment mechanism 900 shown in FIG. 9B operates at least partially as described above for the embodied adjustment mechanism 900 shown in FIG. 9A. The sizing band 204 is held an operative distance from the adjustment gear 914 by two sizing band guides 1202, wherein an operative distance is defined by the distance required for functional engagement of the adjustment teeth 912 with the teeth of the adjustment gear 914.

Figure 10:
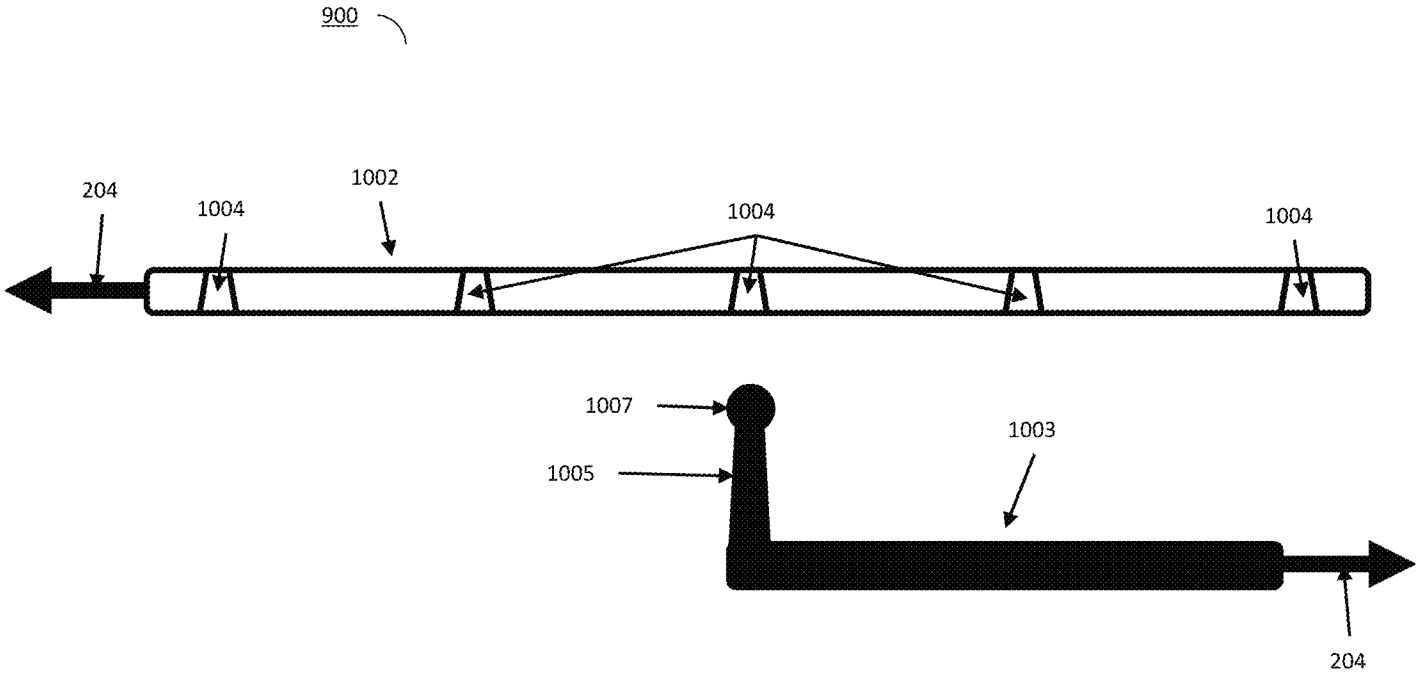
FIG. 10 is a view of an adjustment mechanism according to at least one embodiment of the present disclosure.

FIG. 10 shows a side view of an adjustment mechanism 900 structured in accordance with at least one embodiment of the present disclosure. In the depicted embodiment, the sizing band 204 may be selectively sized at predetermined lengths via engagement of an adjustment tool 1005 with an adjustment index 1004. By selectively repositioning the adjustment tool 1005 into different indices 1004, the circumference of the sizing band 204 and, thus, the expandable frame may be adjusted and held at the predetermined positions. The sizing band 204 is attached on a first end to a first adjustment section comprising at least adjustment band 1002 further comprising at least one adjustment index 1004. The sizing band 204 is attached on a second end to a second adjustment section comprising at least adjustment band 1003 further comprising at least one adjustment tool 1005. The adjustment tool 1005 may include at least an index geometry 1007, and the index geometry 1007 may be configured to removably hold the adjustment point 1005 in place at least one of a plurality of adjustment indexes 1004. In operation, a user of suitcase 100 can removably attach the first adjustment section of sizing band 204 to the second adjustment section of sizing band 204 by operatively engaging the adjustment tool 1005 and/or the index geometry 1007 with at least one adjustment index 1004. The adjustment bands 1002, 1003 may be separate components attached to the sizing band or may be an integral portion of the sizing band 204.

Figure 11:
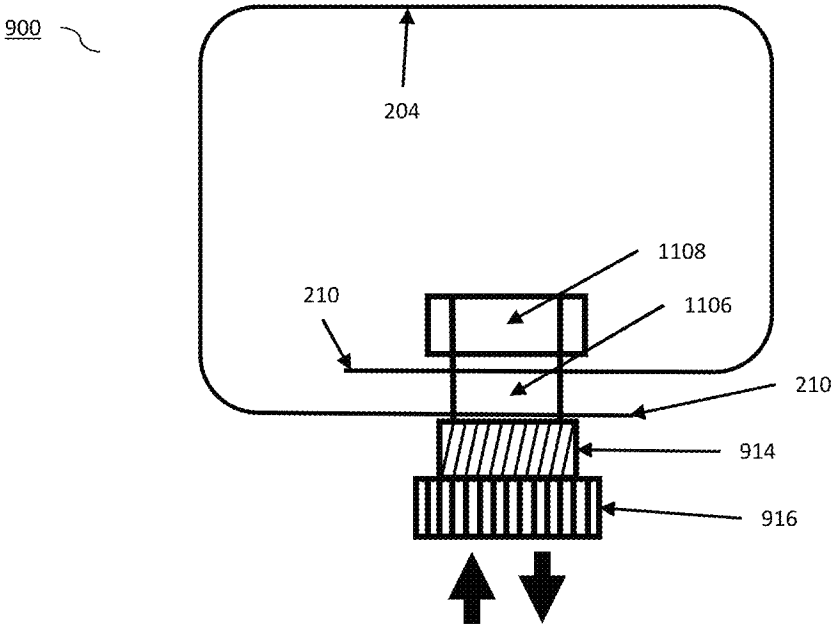
FIG. 11 is a view of an adjustment mechanism and sizing band according to at least one embodiment of the present disclosure.

FIG. 11 shows a top-down view of an adjustment mechanism 900 and sizing band 204 structured in accordance with at least one embodiment of the present disclosure. The adjustment mechanism 900 for a suitcase 100 comprises at least one of an adjustment dial 916, an adjustment gear 914, a body cylinder 1106, a tension spring (not shown), a torque limiter (not shown), and a body mount 1108. The body cylinder 1106 at least partially houses at least one of the tension spring (not shown), and/or the torque limiter (not shown). The body cylinder 1106 at least partially attaches to at least one of the adjustment dial 916, the adjustment gear 914, tension spring (not shown), a torque limiter (not shown), and the body mount 1108. The body mount 1108 is configured to attach the adjustment mechanism at least partially to the suitcase 100. Further, when a user applies a torque to adjustment dial 916 the body mount 1108 in configured to provide a reaction torque on at least the body cylinder 1106 to prevent rotation of at least the body cylinder 1106. The torque limiter (not shown) is configured to disengage the adjustment dial 916 and at least the adjustment gear 914. The tension spring (not shown) is configured to at least provide a tactile resistance to a user as a user pushes-in and/or pulls-out adjustment dial 916. As at least the adjustment dial 916 is pushed inward relative to suitcase 100, by the user of suitcase 100, at least the adjustment dial 916 can be held in a first engaged position by at least a first locking mechanism (e.g., tension spring, ball and detent, etc.). As at least the adjustment dial 916 is pulled outward relative to suitcase 100, by the user of suitcase 100, at least the adjustment dial 916 can be held in a second disengaged position by at least a second locking mechanism (e.g., tension spring, ball and detent, etc.).

Figure 12:
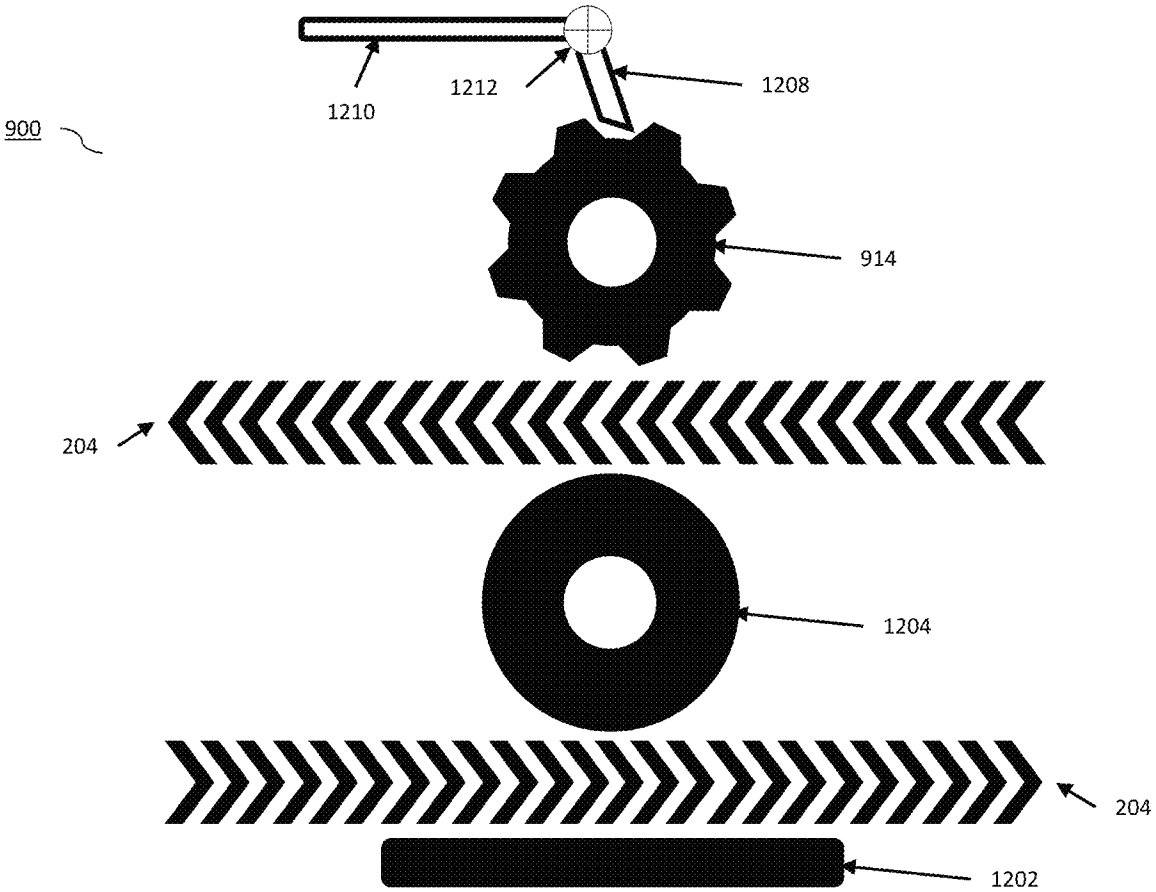
FIG. 12 is a view of an adjustment mechanism according to at least one embodiment of the present disclosure.

FIG. 12 shows a side view of an adjustment mechanism 900 structured in accordance with at least one embodiment of the present disclosure. The adjustment mechanism 900 for a suitcase 100 comprises at least one of an adjustment dial (not shown), an adjustment gear 914, an idler 1204, a tension spring (not shown), a torque limiter (not shown), a sizing band guide 1202, and/or a body mount (not shown). The adjustment mechanism 900, as embodied, is configured with a locking mechanism comprising at least one of a pawl 1208, a hinge 1212, and/or a lever 1210. The locking mechanism is configured to perform at least one of the following: stop the rotation of at least the rotating adjustment dial (not shown) and/or the rotating adjustment gear 914, slow the rotation of at least the rotating adjustment dial (not shown) and/or the rotating adjustment gear 914, or prevent the rotation of at least the adjustment dial (not shown) and/or the adjustment gear 914 in at least one direction. The idler 1204 is configured to transfer a linear motion in a first direction of a first end of the sizing band 204 to an opposite linear motion in a second direction of a second end of the sizing band 204.

In some embodiments, the idler 1204 can be further configured to attach to a first end of the sizing band 204 and/or a second end of the sizing band 204, and as the adjustment mechanism 900 expands and/or contracts the expandable frame assembly 200, the first end of the sizing band 204 and/or the second end of the sizing band 204 are wound and/or unwound about the circumference of idler 1204. Additionally, a plurality of other idlers (not shown) can be implemented such that the first end of the sizing band 204 is wound/unwound about the circumference of a first idler and/or the second end of the sizing band 204 is wound/unwound about the circumference of a second idler.

In some embodiments, the adjustment mechanism 900 is applied at least partially to other features of the suitcase 100. For example, a first adjustment mechanism 900 is implemented to expand and/or contract suitcase 100, while a second adjustment mechanism is attached to the resealable opening 103 (e.g., zipper, drawstring, hinged door, etc.) and configured to open and close the resealable opening 103. In some embodiments, a single adjustment mechanism is configured to expand and/or contract suitcase 100 and open and close the resealable opening 103 (e.g., zipper, drawstring, hinged door, etc.). In some embodiments, the second adjustment mechanism may allow the suitcase to, at least partially, expand in a third dimension. The opening 103 may extend partially around a perimeter of the inelastic portion 102, such that a large section of the inelastic portion opens for access to the interior while the remaining flap stays attached to the suitcase 100.

In some embodiments, multiple adjustment mechanisms 900 may be used around the circumference of the suitcase 100 along the path of the sizing band(s) 204 without departing from the scope of the present disclosure. In such embodiments, different sides of the suitcase may be adjusted separately. In some embodiments, the sizing band 204 may not extent contiguously around the suitcase 100 such that, for example, different sides have different sizing bands and adjust separately.

FIG. 13A shows an expandable container 1300 configuration according to various embodiments in the form of an expandable suitcase illustrating various components and features described herein. For example, expandable container 1300 may be configured in accordance with the embodiment shown in FIGS. 1A-1B, whereby the expandable container 1300 is able to expand and contract between two or more size configurations using a frame assembly. The configuration shown in FIG. 13A illustrates elastic portions 101 and inelastic portions 102. In the various embodiments discussed herein, the front, top, side, and corner sections of elastic portion 101 may be configured as individual panels of elastic material stitched together, or as a single piece of elastic material at least partially stretched over and/or around the frame assembly. The top and side sections of inelastic material 102 may be separate and interconnected at least by the elastic portions. In the rear, an inelastic portion (e.g., a hard plastic panel, a fabric material, or the like) may connect elastic portion(s) in substantially the same manner as the front panel shown in FIG. 13A and the rear panel shown in FIG. 1B. In various embodiments, the inelastic portions 102 may be stitched or otherwise connected to the elastic portions. In some embodiments, the elastic portions may contiguously surround the container with the inelastic portions laid on top of or beneath the elastic portions). In some embodiments, the frame members 202 of the expandable frame assembly (e.g., expandable frame assembly 200 of FIG. 2A described above, expandable frame assembly 1400 of FIG. 14A described below, or any other configurations discussed herein) may be used as the inelastic portions on at least the peripheral sides (e.g., top, bottom, left, and right sides) of the expandable container. The inelastic top and side shell panels of the depicted configuration (e.g., inelastic portions 102) may be configured, for example, as nylon side panels sewn over/onto the elastic portion(s) 101 or adjacent to the panels of the elastic portion(s) 101. In some embodiments, the inelastic portions 102 of the front and sides of the expandable container 1300 may be made of a flexible material (e.g., a structural nylon material). In some embodiments, the elastic and inelastic portions 101, 102 may be attached to each other (e.g., via stitching, welding, gluing, or the like) and disposed over a frame assembly as a single unit. In some embodiments, as discussed herein, a rear inelastic portion may be a rigid or semi-rigid panel. In some embodiments, some or all of the elastic and inelastic portions may be reversed (e.g., the depicted elastic portions 101 may instead be inelastic and the depicted inelastic portions 102 may instead by elastic). In some such embodiments, one or more features may be relocated (e.g., the zipper 103 may be moved to an inelastic portion) without departing from the scope of the present disclosure.

As illustrated in FIG. 13A, expandable container 1300 is configured with a resealable opening 103 (e.g., a zipper closure, etc.) on the front inelastic portion 102. In some embodiments, one or more of the inelastic portions 102 may have stitching to secure the inelastic portion to other portions of inelastic portion, to an elastic portion, and/or to a frame member (e.g., stitch line 103*a* shown in FIGS. 13A-13B). Resealable opening 103 may be configured to cover and/or allow access to an adjustment mechanism (e.g., adjustment mechanisms 900 shown in FIGS. 9-12, and described herein), an expandable frame assembly, the interior of the expandable container, and/or one or more components at least partially housed within the expandable container (e.g., sizing band 204, adjustment dial 916, etc.). In some embodiments, at least a portion of the adjustment mechanism may be accessible at the exterior of the expandable container (e.g., via an opening in the top inelastic portion 102).

With continued reference to FIG. 13A, the side inelastic portions 102 are shown at or near the centers of the long edges of the expandable container 1300, and the front inelastic portion 102 is shown at or near the center of the front face of the expandable container. The side inelastic portions 102 may be connected to one or more frame members (e.g., frame members 202 shown in FIG. 14A-14B).

FIGS. 13B-13C show the expandable container 1300 of FIG. 13A in a first configuration defining a smaller size than the second configuration of FIG. 13A. The expandable container may transition between the two sizes using the various expandable frame assemblies disclosed herein (e.g., the frame assembly 1400 shown in FIGS. 14A-14B). In the various embodiments discussed herein, the first and second configurations may define different volumes of the shell. A zoomed partial view of the contracted suitcase 1300 is shown in FIG. 13C with shell fasteners (e.g., shell buckle fastener 101*a* and shell zipper fastener 101*b*). The shell fasteners 101*a*, 101*b* are configured to, at least temporarily, lock the expandable container 1300 in the first, contracted configuration while optionally retaining any excess material associated with the shell (e.g., elastic portion 101) to the extent any excess material exists in the contracted configuration. The shell fasteners may be configured to maintain the panels of the inelastic portion 102 of the shell at a predefined distance to each other while the shell fasteners are engaged with at least one other shell fastener (e.g., two halves of a zipper) or with another feature of the expandable container. In some embodiments, the shell fasteners may maintain tension between the inelastic portions. In some embodiments, any configuration of fasteners, including multiple of either the shell buckle fastener 101*a* or the shell zipper fastener 101*b*, may be used between adjacent inelastic portions 102.

For example, shell buckle fastener 101*a* is fastened at one end to the top panel of inelastic portion 102 of the shell, such as by a screw or rivet, and at another end the shell buckle fastener 101*a* slides over, or clips into place on, the front panel of inelastic portion 102 of the shell to prevent expansion of contracted suitcase 1300 along the z direction as shown. The shell buckle fastener 101*a* may be disengaged (e.g., unclipped, slide off, unzipped, etc.) to transition an expandable container from a contracted configuration to one or more expanded configurations. The shell fasteners may comprise one or more of a zipper, clip, buckle, friction lock, spring clip, chain, cord (e.g., elastic/bungie, braided nylon, etc.), or other retention mechanism as known in the art in light of the present disclosure.

FIGS. 14A and 14B show an expandable frame assembly 1400 in a second, expanded configuration and a first, contracted configuration respectively. The expandable frame assembly 1400 may comprise one or more components, features, functionalities, and/or attributes described above with respect to at least expandable frame assembly 200 or any other expandable frame assembly configuration described herein, which may include frame members (202, 202*a*, 206) and sizing band(s) 204 with an adjustment mechanism 900 for adjusting the size of the expandable frame assembly 1400 and thereby adjust the size of the expandable container (e.g., expandable container 1300 shown in FIGS. 13A-13C). FIG. 14B shows the sizing bands 204 in an at least partially contracted configuration with excess sizing band material 204*a* extending downward from the top portion of the expandable frame assembly. The excess sizing band material 204*a* may be housed between the inner liner and the outer shell of the expandable container or may be wrapped around, or housed within, a portion of the adjustment mechanism 900, one or more frame members (e.g., 202, 202*a*, 206, or other frame members described herein), including within channels formed by the frame members (e.g., channels 504 shown in FIG. 6). In some embodiments, the sizing band(s) 204 may comprise other retractable belt/cord/cable/wire mechanisms as known in the art (e.g., automatic and/or retractable belt stanchions, seat belts, cord/cable reels, etc.). Although not depicted in FIGS. 13A-13B, in some embodiments the adjustment mechanism 900 may be accessed via the side inelastic portions 102.

In some embodiments, the frame assembly 1400 may be disposed within the shell's elastic and inelastic portions 101, 102 shown in FIGS. 13A-13B. The frame assembly 1400 and the elastic and/or inelastic portions may be attached at one or more positions to prevent slipping of the shell relative to the frame (e.g., via grommets, stitching, or the like as discussed with respect to the embodiments of FIGS. 8A-8E). In some embodiments the frame assembly 1400 may be attached to one or more of the side inelastic portions 102, and the frame assembly may slide relative to at least part of the elastic portions 101. In some embodiments, one or more of the frame members (e.g., 202, 202*a*, 206, or other frame members described herein) may define a portion of the shell. In some such embodiments, additional elastic and/or inelastic portions 101, 102 may extend between frame members (e.g., as shown in the embodiment of FIGS. 19A-20B). In some embodiments, for example, the inelastic portion 102 shown in FIGS. 13A-13B may be the same component as one or more frame members 202 shown in FIGS. 14A-14B.

FIGS. 15A and 15B illustrate the transition of the expandable container 1300 between the second, expanded configuration and the first, contracted configuration. The transition between the two (or more) suitcase configurations may be incremental (e.g., large, medium, and compact) or continuous (e.g., continuously adjustable between a maximum and minimum size configuration). The configuration of the expandable container 1300 (e.g., an expandable suitcase) shown in FIG. 15A may represent a maximum expansion of the depicted configuration (e.g., a large checked bag suitcase size conforming to one or more airline sizing standards with dimensions such as 12×20×30 inches) and the configuration shown in FIG. 15B may represent a minimum size of the depicted container (e.g., a compact carry on suitcase size conforming to one or more airline sizing standards with dimensions such as 9×14×22 inches). The expandable container 1300 depicted in FIG. 15A-B expands or contracts with respect to the x, y, and/or z directions and/or a combination thereof in accordance with the various embodiments discussed herein. The expandable container may expand or contract in one or more directions independent of the other directions.

Moreover, with reference to FIGS. 14A and 14B the transition of the expandable frame assembly 1400 between the second, expanded configuration and the first, contracted configuration is shown. The depicted expandable frame assembly 1400 may be at least a portion of the frame assembly housed within an expandable container configuration (e.g., expandable container 1300 formed as a suitcase). The expandable frame assembly (e.g., 1400) may be configured with one or more adjustment mechanisms 900 such as described below with at least respect to FIGS. 16A, 16B, and/or 16C, a telescope frame assembly such as described below with at least respect to FIG. 17, and/or any other configurations of expandable frame assemblies described herein.

FIG. 16A illustrates a front view of an expandable frame assembly configuration equipped with a single adjustment mechanism 900 according to various embodiments (e.g., the adjustment mechanism according to FIGS. 9A-12). The adjustment mechanism 900 may be configured to move sizing band 204 to increase or decrease one or more dimensions of the expandable frame assembly as described herein. For example, adjustment mechanism 900 may be turned (e.g., by hand) to move opposite portions of one or more sizing band(s) 204 housed within the adjustment mechanism 900 thereby allowing at least the top portion of the expandable frame assembly to expand. The adjustment mechanism 900 may lock and unlock to respectively hold the bands in position and release the bands for adjustment as described herein. Moreover, the sides and the bottom of the expandable frame assembly may expand in conjunction with the top portion as a result of additional expansion forces applied to the expandable frame assembly. For example, a user may pull or press on the sides and/or bottom of the expandable container configured with expandable frame assembly depicted in FIG. 16A to cause the sizing band 204 to more evenly distribute around the frame assembly.

The expandable frame assembly may also expand when adjustment mechanism 900 is turned to release a portion of sizing band 204 based on forces applied to the frame members (e.g., 202 or the like) caused by the size and/or weight of the expandable container's contents. For example, the container may be substantially filled with goods during packing, which may force the sides of the container to expand. In use, the user may opt to tighten the sizing band to the smallest size capable of holding the desired goods, which may result in the goods inside the container at least partially contributing to its final size.

The expandable frame assembly may be contracted, at least in part, by user manipulation (e.g., pushing, pulling, etc.) on the expandable frame assembly and/or reversing the rotation of the adjustment mechanism 900. In some embodiments, the adjustment mechanism 900 may be configured to lock and/or unlock the expandable frame assembly to allow a user to expand and contract the expandable frame assembly by hand. In some such embodiments, the adjustment mechanism 900 may not cause expansion and/or contraction and may only lock and/or unlock the expandable frame assembly for expansion and/or contraction by other means (e.g., gravity, internal pressure, user manipulation by hand, etc. as shown in the embodiment of FIG. 10). In some embodiments, multiple adjustment mechanisms may be used.

FIG. 16B illustrates a front view of an expandable frame assembly configuration comprising multiple operatively engaged adjustment gears (e.g., 914). As shown, the adjustment gears are driven by adjustment mechanism 900 via a secondary sizing band 205. For example, adjustment mechanism 900 may be turned (e.g., by hand) to release a portion of sizing band 204 housed within the adjustment mechanism 900 thereby allowing at least the top portion of the expandable frame assembly to expand. The rotational force applied to adjustment mechanism 900 is then transferred by way of the secondary sizing band 205 causing each of the adjustment gears to rotate to release respective portions of sizing band 204 housed in conjunction with each respective adjustment gear 914. The secondary sizing band 205 may comprise any of the embodiments of sizing band 204 as described herein.

Moreover, the secondary sizing band 205 may comprise one or more of a lead screw, rack and pinion, or other types of linear actuators as known in the art configured to operatively interface with one or more adjustment gears. The secondary sizing band 205 may be housed between the inner liner and the outer shell of the expandable container. Sizing band 204 may comprise a plurality of sizing bands, for example, each side of the expandable container may be configured with at least a respective sizing band 204 along at least a portion of the length of the side of the container. The expansion and contraction of each sides respective sizing band 204 may be controlled, at least in part, by the respective adjustment gear 914 corresponding to that particular side. With respect to FIGS. 13A and 13B discussed above, one or more resealable openings (e.g., 103, 103*a*) may be configured to cover and/or allow access to one or more respective adjustment gears.

FIG. 16C illustrates a front view of an expandable frame assembly configuration comprising a plurality of adjustment mechanisms (e.g., adjustment mechanism 900, or any other adjustment mechanism described herein). Each adjustment mechanism 900 depicted may facilitate expansion and/or contraction of a respective corresponding side of the expanding frame assembly. The adjustment mechanisms may be operatively connected via one or more sizing bands. For example, at least one sizing band 204 may be configured to interface with each adjustment mechanism 900. In some embodiments, each side of the expandable frame assembly may be configured with one or more respective sizing bands along at least a portion of the length of the side of the frame, the length of the respective sizing band 204 being controlled by a respective adjustment mechanism 900. For example, a sizing band 204 may be configured along the top of the frame assembly (e.g., toward the top of FIG. 16C along the y direction) to facilitate expansion of the top side of the frame assembly (e.g., as shown in FIG. 16A) and each of the other sides would be similarly configured with respect to respective sizing bands. In such embodiments, the individual sizing bands may be anchored on at least two frame members 202 on the respective sides, such as on the corner members 206.

The expandable frame assembly configurations discussed above with respect to FIGS. 16A, 16B, and 16C may be configured, in whole or in part, with the expandable frame assembly features described below with respect to FIG. 17. Moreover, any features or components described with respect to FIGS. 16A, 16B, 16C, and/or 17 may be combined in whole or in part with any other embodiments or configurations described herein as would be appreciated by a person of ordinary skill in the art in light of the present disclosure. For example, the sizing band and adjustment mechanism configurations described above with regard to FIG. 16C, or the like, may be utilized in conjunction with one or more configurations as discussed with respect to FIG. 17, such as to maintain a substantially cuboid, rectangular prism, or cube shape throughout expansion or contraction operations of a suitcase.

FIG. 17 is a perspective view of an expandable frame assembly 1700 configuration defining a rigid or semi-rigid cross frame shape/geometry, which frame may be used alone or together with other expandable frame assemblies (e.g., the assembly 1400 shown in FIGS. 14A-14B) in some embodiments. In the depicted embodiment, the expandable frame assembly 1700 includes individual frame member assembly elements including telescoping sizing members 222 telescopically engaged with central portions 224, which sizing members expand in diagonal directions to match a two-dimensional expansion of the expandable container. The frame members may be formed as rigid or semi-rigid arms configured to substantially retain the shape of the expandable container. The frame member assembly elements 222, 224 may be made of metal, polymer, or other similar rigid or semi-rigid materials. The expandable frame assembly 1700 may be configured to define one or more of an X, Y, V, T, or t shape. The expandable frame assembly 1700 may define one or more axes and/or points of symmetry (e.g., at center point 1702). As illustrated, the expandable frame assembly 1700 comprises four symmetrical frame member assemblies 222, 224 each comprising a central portion 224 connected to the other central portions 224 at the center point 1702 and a sizing member 222 that telescopes within the central portion and defines the corners of the expandable frame assembly. The four frame member assemblies may be connected (e.g., via a weld, adhesive, fastener mechanism, etc.) to each other at center point 1702 as shown. The frame member assemblies may comprise one or more scissor frame and/or four-bar linkage mechanisms configured to expand and contract along one or more directions radially outward from the center point 1702 (e.g., perpendicular to the sides, towards the corners as shown in FIG. 17, or in any other radial direction). While the depicted frame assembly 1700 includes four frame member assembly elements 222, 224, the frame assembly may have four or greater frame member assembly elements, such as five, six, seven, eight, or more sizing members 222 and central portions 224. For example, two additional sizing members 222 and corresponding central portions may be added opposite one another along a left-to-right axis in FIG. 17 and/or two additional sizing members 222 and corresponding central portions may be added opposite one another along a top-to-bottom axis in FIG. 17. The frame member assembly elements 222, 224 may connect to corresponding frame members and/or shell portions to further control the dimensions of the expandable container. In some embodiments, the frame assembly may have four or fewer frame member assembly elements, such as three, two, or one (e.g., a single opposing pair of frame member assembly elements).

The expandable frame assembly 1700 may increase the perimeter of the rectangular shape defined by the sizing band(s) 204. In some embodiments an elastic sizing band may be used to apply tension around the expandable frame assembly. The expandable frame assembly 1700 may further contract inward toward the center point 1702 with respect to the length of each of the four frame member assemblies (e.g., via telescoping), thereby decreasing the perimeter of the square shape defined by the sizing band 204. Moreover, a force may be applied to each of the four frame member assembly elements 222, 224 causing each sizing member 222 to expand or contract telescopically relative to each respective central portion 224. The force may be applied to each of the four frame member assemblies from an internal mechanism (e.g., a spring/elastic band housed within each frame member assembly) and/or from an external mechanism (e.g., pushing/pulling by hand, manipulation of adjustment mechanism 900 with another expandable frame assembly, or the like). The four frame member assemblies may be at least partially housed within the shell of an expandable container. In some embodiments, the expandable frame assembly 1700 of FIG. 17 may be added to the expandable frame assemblies described above (e.g., the expandable frame assembly 200 of FIGS. 2A-2C, 3C-8G, and/or 14A-14B) to constrain the movement and shape of the expandable container and help maintain rigidity during expansion and contraction and while the container is in use.

FIGS. 18A and 18B are perspective views of an expandable frame assembly 1800 in accordance with an example embodiment, with FIG. 18A depicting the expandable frame assembly in a second, expanded configuration and FIG. 18B depicting the expandable frame assembly in a first, contracted position. The expandable frame assembly 1800 depicted in FIGS. 18A-18D comprises four frame member assemblies 226, 228, each comprising a sizing member 226 and a central portion 228, with the sizing member being configured to telescope relative to the central portion in a similar manner and structure to the expandable frame assembly 1700 described above with respect to FIG. 17. As described above, The frame members may be formed as rigid or semi-rigid arms configured to substantially retain the shape of the expandable container. The frame members 226, 228 may be made of metal, polymer, or other similar materials. The expandable frame assembly 1800 may be configured to define one or more of an X, Y, V, T, or t shape. The expandable frame assembly 1800 may define one or more axes and/or points of symmetry (e.g., at center point at adjustment mechanism 900). In the embodiment of FIGS. 18A-18D, the expandable frame assembly 1800 further includes an adjustment mechanism 900 for facilitating expansion and contraction of the expandable frame assembly in a manner similar to any embodiment of adjustment mechanism discussed herein. For example, a user may manipulate the adjustment mechanism 900 (e.g., rotate the mechanism clockwise/counterclockwise) to expand/contract the length of the four frame member assemblies causing the expandable frame assembly 1800 to expand/contract the size of an associated expandable container (e.g., suitcase 100, or the like as described herein). In some embodiments, the embodiment shown in FIGS. 18A-18B may be a hybrid of the embodiments shown in at least FIGS. 17A-17B and the embodiments shown in at least FIGS. 19A-20B.

Whereas some embodiments of adjustment mechanism may adjust one or two components (e.g., sizing bands) along a single axis, the depicted adjustment mechanism of FIGS. 18A-18D may move the sizing member 226 along intersecting axes. By way of non-limiting example, the adjustment mechanism 900 may operate substantially the same as the adjustment mechanism of FIGS. 26A-26B). For example, the sizing members 226 of the four frame member assemblies may be operatively attached to adjustment mechanism 900. Moreover, foot portions 230 of the sizing member 226 may be considered frame members adjusted by the sizing members. Similarly, an additional structure or component mounted to the sizing member 226 (e.g., a corner member) may likewise be considered a frame member adjusted by the sizing members. Moreover, as the adjustment mechanism 900 is rotated clockwise, the rotation may cause each respective sizing member 226 to slide through a channel formed in the respective central portion 228 (e.g., similar to channel 504 described above). In some embodiments the sizing member 226 or an expansion component mounted thereto may wrap around a reel of the adjustment mechanism 900, slide along a gear of the adjustment mechanism, or otherwise engage with the adjustment mechanism according to any embodiment described herein.

Similar to the embodiment of FIG. 17, a sizing band(s) 204 may extend around the perimeter of the expandable frame assembly 1800. In some embodiments an elastic sizing band 204 may be used to apply tension around the expandable frame assembly 1800. The expandable frame assembly 1800 may further contract inward toward the center point 1702 with respect to the length of each of the four frame member assemblies (e.g., via telescoping), thereby decreasing the perimeter of the square shape defined by the sizing band 204. In some embodiments, the sizing band 204 may be separately driven, such as by a separate adjustment mechanism. In some embodiments, the sizing band may be passively engaged with the sizing member 226 (e.g., at the foot portions 230) and stretched, expanded via sliding two portions of the sizing band past each other, or otherwise change in circumference to reinforce the shape of the expandable container in response to expansion and contraction from the center adjustment mechanism. Each sizing member 226 may be attached (e.g., via fasteners, adhesive, stitching, etc.) to portions of the expandable container (e.g., the corners). Moreover, each respective sizing member 226 of expandable frame assembly 1800 may be attached directly or indirectly to a panel of an elastic portion 101 and/or inelastic portion 102 of the shell. Expandable frame assembly 1800 may be further configured within the interior of the shell or over the exterior of the shell or portions thereof. The expandable frame assembly 1800 may be used alone or in combination with other frame assemblies disclosed herein, such as with frame members 202, a support member 208, and/or the like as described herein about the perimeter of the expandable frame assembly 1800 to provide for at least a more rigid frame assembly. In some embodiments, the expandable frame assembly 1800 may be configured in a t-shape such that each of the four frame member assemblies are attached to a respective side of the associated expandable container instead of a respective corner as illustrated by FIG. 18A.

FIG. 18C illustrates a top-down view of an expandable container (e.g., a suitcase, or the like as described herein) configured with at least an expandable frame assembly 1800. The adjustment mechanism 900 is exposed at a rearward (toward the bottom of FIG. 18C) exterior surface of the expandable container. As the expandable frame assembly expands and/or contracts, the elastic portion(s) 101 of the shell may expand and contract therewith. Moreover, the elastic portion 101 of the shell may expand outward along the z direction, for example, in response to the contents of the expandable container pushing the inelastic portion(s) 102 and/or elastic portion(s) 101 and stretching the elastic portion(s) 101 in the z direction.

FIG. 18D is a front perspective view of expandable frame assembly 1800 having at least intermediate frame members 202 disposed along the sizing band(s) 204 (described above with respect to at least FIG. 2A). In some embodiments, the sizing band 204 may optionally be provided to provide additional support to the corners of the expandable frame assembly 1800 and to increase resistance to expansion and increase user feedback. In some embodiments, the expandable frame assembly 1800 may be used without any sizing band. In embodiments utilizing a sizing band 204, as expandable frame assembly 1800 expands outward the sizing band 204 stretches/expands to a larger perimeter. As expandable frame assembly 1800 contracts inward the sizing band 204 contracts to a smaller perimeter. In some embodiments, the sizing band 204 may contract due to elastic properties inherent in the material of the sizing band 204 (e.g., a vulcanized rubber material, or the like) and/or due to a retraction mechanism (e.g., automatic and/or retractable belt stanchions, seat belts, cord/cable reels, etc.) or any other means disclosed herein. The frame members 202 may facilitate attachment to the inelastic portion 102 and/or elastic portion 101, and may provide additional points of stability for the frame. Expansion and contraction of the expandable frame assembly 1800 may occur at a substantially uniform and/or constant rate with respect to each of the four depicted sizing members 226 to allow the sizing band 204 to maintain the perimeter shape/geometry throughout the range of sizes between the upper size limit and the lower size limit of the expandable container (as illustrated by at least FIGS. 15A, 15B, and 18A). The frame members 202, with or without the sizing band 204, may at least partially define a square perimeter, rectangular perimeter, and/or a similar geometric shaped perimeter. In some embodiments, an entire frame assembly 200 (shown in, inter alia, FIG. 2A) may be attached to the expandable frame assembly 1800 about its perimeter.

In some embodiments, some or all of the shell (e.g., comprising inelastic portion 102 and/or elastic portion 101) may be configured to, at least partially, cover the expandable frame assembly. In some embodiments, the elastic portion(s) 101 and/or inelastic portion(s) 102 may be configured to extend between the portions of the expandable frame assembly, such that the expandable frame assembly defines at least a portion of the shell, for example as shown in at least FIGS. 13A and 13B as described above. In addition, for example, corner members 1902 may engage with elastic portions 101 of expandable container 1900 as depicted in FIGS. 19A and 19B, such that the corner members are either on the outside of the expandable container or are contained within the material of the shell. As described in connection with at least FIGS. 25A and 25B below, overlapping frame members (e.g., 2502) of the expandable frame assembly may define, at least partially, the shell via one or more rigid, inelastic exterior surface portions (e.g., relative to the interior of the expandable container) of the frame members 2502.

In some embodiments, one or more frame members of the expandable frame assembly(ies) may define a portion of or the whole of the shell. For example, the shell may be defined as a plurality of outer surfaces of the plurality of overlapping/interlocking slidably attached frame members, or plates attached thereto, that are configured to expand and contract (e.g., with the sizing members, sizing bands, or the like as defined by the present disclosure). Further, the shell may be defined by, at least, a combination of exterior surfaces defined by a plurality of frame members and one or more sizing bands, such that when the frame members are separated during expansion the one or more sizing bands substantially cover any exposed gaps between each adjacent pair of frame members, such that the interior compartment of the container is not accessible (except via one or more configured resealable openings, for example, configured with a zipper). The shell may be made in accordance with any of the embodiments disclosed herein, including inelastic and/or elastic portions covering some or all of the exterior of the expandable container; including inelastic and/or elastic fabric portions engaged with one or more rigid or semi-rigid internal or external facing frame members (e.g., frame members such as corner members 1902 shown in FIGS. 19A-20B; frame members 2402, 2404 shown in FIGS. 24A-25B; and/or the like); and including inelastic and/or elastic fabric portions extending between one or more rigid or semi-rigid internal or external facing frame members.

Example embodiments of the expandable frame assembly described with respect to at least FIGS. 17-41 describe an expansion concept in the form of sizing member(s) comprising rigid or semi-rigid bars. The sizing members and corresponding expansion mechanisms as described below and illustrated with respect to the corresponding figures may take the form of bars, arms, rods, beams (e.g., I-beams, box beams, or any other structural beams), racks (i.e., of a rack and pinion set), linear actuators (e.g., mechanical, electrical, pneumatic, hydraulic, or the like), linear ball screws, pantographs, other types of rigid (or semi-rigid) linkages, and/or any other components as described herein (e.g., support members 208 described herein).

FIGS. 19A-20B depict views of an expandable container 1900 according to various embodiments of the present disclosure, which is formed as a suitcase although a person of ordinary skill in the art will appreciate, in light of the present disclosure, that the expandable container 1900 may take other form factors without departing from the scope of the present disclosure. FIG. 19A depicts a rear perspective view, FIG. 19B depicts a rear view, FIG. 20A depicts a front perspective view, and FIG. 20B depicts a front view of the expandable container 1900. The depicted embodiment of the expandable container 1900 may include one or more of an elastic portion 101 formed as one piece or multiple pieces, inelastic portions 102, a handle 104 with two telescoping arms 105, and wheels 107 as described above. In the depicted embodiment, the wheels 107 may be attached to and may expand and contract with the bottom corner members 1902. The expandable container 1900 further comprises corner members 1902 which are attached to an interior expandable frame assembly (some or all of which are respectively shown in FIGS. 21A-21B, 23A-23B, 26A-43) via one or more fasteners 1902A. In some embodiments, the corner members 1902 may form the outer surface of the expandable container (e.g., the corner members may define inelastic portions of a shell), and in some embodiments, the corner members may be covered in whole or in part by another material (e.g., a portion of shell material). For example, in some embodiments, instead of or in addition to elastic portions 101 extending between corner members 1902, one or more elastic portions and/or inelastic portions may cover some or all of the corner members 1902. In some embodiments, the elastic portions 101 or similar inelastic portions may be attached to an interior or exterior surface of the corner members 1902.

In some embodiments, the expandable container of FIGS. 19A-20B may be configured to expand and contract from at or about 12×20×30 inches to about 9×14×22 inches. In some embodiments, a height and width adjustment (e.g., along the respective y and x axes shown in FIG. 20A) may be provided by the expandable frame assembly, and a depth adjustment (e.g., in a front-to-back direction along the z-axis shown in FIG. 20A) may be provided by stretching an elastic portion. The inelastic portions may be snapped, zipped, Velcro fastened, or otherwise attached to each other and/or to the frame members to constrain the expandable container when in the first, collapsed position (e.g., as shown with respect to FIG. 13C).

Corner members 1902 may take the form of an at least semi-rigid plate, a corner member 206 (as described above), a plastic and/or metal L-bracket, or structural members sufficient to structurally support a corner of the expandable container, which may at least assist in retaining the shape of the expandable container 1900 throughout a range of sizes. Although depicted in an "L-shape" in FIGS. 19A-20B, one of ordinary skill in the art will appreciate, in light of the present disclosure, that other shapes and configurations for forming the corners are possible. In the depicted embodiments, the corner members 1902 comprise two perpendicular plates 1912 joined by an angled connector plate 1914 at an intersection of the two plates. In some embodiments, the two perpendicular plates may be connected directly, and in some embodiments, the corner members may be formed as a more gradual curve or chamfer shape with one or more additional plates. The corner members 1902 may comprise a structural web (not shown) or diagonal support bracket (e.g., bar, rod, pipe, etc.) (not shown) configured to connect the two perpendicular plates (also referred to as "sides") 1912 of a respective corner member 1902. In some embodiments, one or more support members (e.g., support members 208 shown in FIGS. 8D-8E) may be disposed between corner members 1902 for additional rigidity and support.

A fastener 1902A may take the form of a screw, bolt, nut, dowel, press fit pin, rivet, grommet, chemical adhesive (e.g., glue, epoxy, etc.), mechanical joint (e.g., weld, folded seam, etc.), any other fastener type as described by the present disclosure, or any other method for attaching the corner member 1902 to one or more members of the interior expandable frame assembly (e.g., expandable frame assembly 200 as depicted in FIG. 2A-C, expandable frame assembly 2000 as depicted in FIG. 21A, or the like as described herein). One or more of the fasteners 1902A may additionally or alternatively be used to attach corner member 1902 to elastic portion 101 (e.g., grommet 802 in at least FIGS. 8A-8B) and/or retain at least part of the elastic portion 101 relative to corner member 1902 during expansion or contraction of the expandable container.

The inelastic portion 102 may take the form of a rigid or at least semi-rigid plate (e.g., stamped metal, molded plastic, or any other material described herein). In some embodiments, the inelastic portion 102 may take the form of an inelastic fabric or other flexible or semi-flexible material. For example, in the embodiment depicted in FIGS. 19A-19B, the rear inelastic portion 102*b* may define a plate as described above. The rear inelastic portion 102*b* may, in various embodiments, engage the adjustment mechanism 1990 for connecting the perimeter frame members (e.g., the corner members 1902) with the rear plate (also referred to as a rear panel) and handle 104. In the embodiment depicted in FIGS. 20A-20B, the inelastic portion 102*a* is shown as a fabric panel (e.g., an inelastic nylon panel or other suitcase material) having a zipper 103 thereon for allowing access to the interior of the expandable container 1900. In some embodiments, the front inelastic portion 102*a* may comprise a rigid or semi-rigid panel.

The rear inelastic portion 102*b* may be configured with one or more telescoping arm channels 1910 that are configured to slidably receive at least one telescoping arm 105. In some embodiments, the arms 105 may be fixed in the channel or the channel may be fixed relative to the arm (e.g., the arm may internally telescope within itself). The expandable container 1900 further comprises an adjustment mechanism 1990. The adjustment mechanism used with the expandable container of FIGS. 19A-20B, may take the form of any of the adjustment mechanisms disclosed herein capable of linearly actuating one or more sizing members.

With continued reference to FIGS. 19A-19B, the depicted embodiment of the adjustment mechanism 1990 may include, for example, an adjustment mechanism twist plate 1908 (e.g., adjustment mechanism twist plate 1908 of FIGS. 19A-19B, adjustment mechanism gear 2702 of at least FIGS. 27A and 27B below, adjustment mechanism index plate 2806 of FIGS. 28A and 28B below, adjustment mechanism adjustment index collar 2904 of FIGS. 29A and 29B, scalloped adjustment dial 3002 of FIGS. 30A-30B, and/or the like as described herein), an adjustment mechanism twist handle 1906 (e.g., handle 1906 in FIGS. 19A-19B, 27A-28B; rounded adjustment dial 2906 of FIG. 29A; the scallops of the scalloped adjustment dial 3002 of FIGS. 30A-30B; foldable lever crank 4200 of FIGS. 42-43; and/or the like as described herein), and/or locking latch 1904 (e.g., locking latch 1904 of FIGS. 27A-27B; locking latch 1904 of FIGS. 28A-28B; locking latch arm 2902 of FIGS. 29A-29B; detent hole 3006, adjustment mechanism index collar 3004, and the complementary detent pin/plunger/ball of FIGS. 30A-30B; and/or the like as described herein).

The adjustment mechanism twist plate 1908 may take the form of an at least semi-rigid plate, dial, or the like (e.g., stamped metal, molded plastic, or any other material described herein) configured with one or more retention features configured and/or connected circumferentially thereon (e.g., gear teeth, index holes, a clutch plate, a lockable brake caliper, and/or other locking mechanisms as described herein configured to prevent rotation of adjustment mechanism twist plate 1908).

In some embodiments, adjustment mechanism twist handle 1906 may take the form of a hinged foldable handle, a handle fixed relative to the adjustment mechanism twist plate 1908, a dial, a foldable lever arm, a crank, a ratcheting lever arm, and/or any other mechanism for enabling a user to apply a rotation force (i.e., torque) about a shaft (e.g., gear shaft 2602 in at least FIGS. 26A and 26B associated with an adjustment mechanism). In some embodiments, the handle may be integral with the twist plate and/or may be a part of the twist plate. The adjustment mechanism twist plate and handle may, for example, be structured and operate in accordance with the embodiment of FIG. 11, whereby disposing the dial axially in a first position engages the mechanism for movement, and disposing the dial axially in a second position disengages the mechanism. In some embodiments, the disengaged position may cause the dial to fix the sizing members in their current position (e.g., via a fixed gear, brake, pin, or the like) or may cause the dial to release the sizing members for free movement.

The locking latch 1904 may take the form of a button, a switch, a pull tab, a lever, a toggle, and/or the like as described herein that is configured to at least temporarily prevent rotation of adjustment mechanism twist plate 1908 and/or the like or to otherwise prevent relative movement of the frame members via the adjustment mechanism. The locking latch 1904 may engage and/or disengage the one or more retention features (e.g., gear teeth, index holes, a clutch plate, a lockable brake caliper, etc.).

FIGS. 21A and 21B are views of an expandable frame assembly 2000 according various embodiments of the present disclosure. The expandable frame assembly 2000 may be used as part of the expandable containers disclosed herein, such as, by way of non-limiting example, the expandable container of FIGS. 19A-20B. FIG. 21A illustrates expandable frame assembly 2000 in a contracted or collapsed configuration (e.g., corresponding to a first, contracted expandable of the expandable container) with the plurality of sizing members 2002 at least partially retracted from their maximum extension. In the various embodiments discussed herein, the first and second configurations may define different volumes of the shell. FIG. 21B illustrates expandable frame assembly 2000 in an extended or un-collapsed configuration (e.g., corresponding to a second, expanded configuration of the expandable container) with the plurality of sizing members 2002 at least partially extended radially outward from their minimum extension. The sizing members 2002 may define foot portions 2020 at distal ends thereof, which foot portions may be configured to engage various other components of the expandable container (e.g., frame members, such as corner members).

The expandable frame assembly 2000 as shown comprises an adjustment mechanism 1990. The expandable frame assembly 2000 may be used with any adjustment mechanism disclosed herein or any other structure capable of at least linearly moving one or more sizing members inwards and outwards. The depicted adjustment mechanism 1990 shown in FIGS. 21A-21B includes an adjustment mechanism base 2006, an adjustment mechanism cover 2004, and a roller bearing 2010. The roller bearing 2010 may be at least partially retained by the adjustment mechanism cover 2004. A second roller bearing may be used on the opposite side of the adjustment mechanism 1990 to support a gear shaft extending through the adjustment mechanism base 2006 and adjustment mechanism cover 2004. The adjustment mechanism cover 2004 is shown with fastener holes 2008 configured to receive a fastener (e.g., screw, rivet, and/or any other fastener as described herein) and at least partially align with a complementary set of fastener holes configured as part of adjustment mechanism base 2006. The adjustment mechanism base 2006 and the adjustment mechanism cover 2004 may be connected via one or more fasteners and fastener holes 2008. The fastener holes 2008 may be one or more thru holes, threaded holes, press-fit holes, and/or the like as described herein. The expandable frame assembly 2000 shown in FIGS. 21A and 21B may be used by one or more expandable containers described herein, for example, see at least the expandable container 1900, the expandable container 2400, and/or the expandable container 2500 as described herein and illustrated by their respective figures.

In some embodiments, a sizing band (e.g., a sizing band 204 as shown in FIG. 18) may optionally be provided to provide additional support to the corners of the expandable frame assembly 2000 and to increase resistance to expansion and increase user feedback.

FIGS. 22A and 22B illustrate isometric views of the expandable container 1900, described above with respect to FIGS. 19A-20B. FIG. 22A illustrates the expandable container 1900 in a first, contracted or collapsed configuration. FIG. 22B illustrates the expandable container 1900 in a second, expanded or extended configuration. The expandable container 1900 may transition between the first, contracted or collapsed configuration and the second, expanded or extended configuration, for example, by turning adjustment mechanism twist handle 1906 clockwise and/or counterclockwise or otherwise actuating the adjustment mechanism. The transition between the contracted or collapsed configuration and the expanded or extended configuration may comprise a plurality of intermediary configurations, for example, larger than the contracted or collapsed configuration and/or smaller than the expanded or extended configuration.

In some embodiments, twisting (e.g., turning, rotating, etc.) the adjustment mechanism twist handle 1906 (e.g., handle 1906 shown in at least FIGS. 19A-19B), or the like as described herein, clockwise may cause the expandable container 1900 to expand or contract. In some embodiments, twisting (e.g., turning, rotating, etc.) the adjustment mechanism twist handle 1906, or the like as described herein, counterclockwise may cause the reverse of twisting (e.g., turning, rotating, etc.) the adjustment mechanism twist handle 1906 clockwise. For example, in an instance clockwise rotation causes expansion then counterclockwise rotation causes contraction of the expandable container 1900. In some embodiments, continuous rotation (e.g., continuously clockwise or counterclockwise) may cause expansion and contraction of the expandable container 1900. The adjustment mechanism twist handle 1906 may be pushed and/or pulled before and/or after rotation to lock and/or unlock the associated adjustment mechanism (e.g., as shown in at least FIGS. 9A-9B, 11, and 26A-26B an described herein).

FIGS. 23A and 23B illustrate front views of the expandable container 1900, described above with respect to FIGS. 19A-20B, configured with the expandable frame assembly 2000. In the depicted views, some of the elastic and inelastic portions of the shell and the liner are removed for visibility of the frame assembly 1900. FIG. 23A illustrates the expandable container 1900 in a contracted or collapsed configuration. FIG. 23B illustrates the expandable container 1900 in an expanded or extended configuration. The expandable frame assembly 2000 may be configured with the adjustment mechanism twist handle 1906 on the rear side of the expandable container 1900 to cause expansion and/or contraction of the expandable frame assembly 2000. For example, as the adjustment mechanism twist handle 1906 is rotated clockwise the plurality of sizing members 2002 may be extended away from a center point defined substantially by at least the roller bearing 2010 and as the adjustment mechanism twist handle 1906 is rotated, for example, counterclockwise the plurality of sizing members 2002 may be pulled inward towards the center point defined substantially by at least the roller bearing 2010.

In the embodiment depicted in FIGS. 23A and 23B, each respective sizing member 2002 of the plurality of sizing members 2002 is connected to a respective corner member 1902 of the plurality of corner members 1902. A respective sizing member 2002 may be connected to a respective corner member 1902 via one or more fasteners (e.g., screws, etc.), chemical adhesives (e.g., epoxies, etc.), mechanical joints (e.g., welds, folded seams, etc.), or the like as described herein. For example, a respective sizing member 2002 may be screwed to a respective corner member 1902 (e.g., via a foot portion 2020 shown in FIGS. 21A-21B), such as via fastener holes 3102 (as shown in at least FIG. 31 and described below). In some embodiments, a corner support member 2302 may be attached to one or more corner members 1902, and/or their respective sizing member 2002, to increase the rigidity of a respective corner of expandable container 1900. A corner support member 2302 may take the form of one or more of a structural web (e.g., web of an I-beam or similar structural member), a structural flange (e.g., flange of an I-beam or similar structural member), a crossbar (e.g., strut bar, or the like), a plate, a rod, and/or any other support member as described herein (e.g., support member 208 as described above and/or corner foot portion 3704 as described below and shown in at least FIG. 37).

FIGS. 24A and 24B illustrate isometric views of an expandable container 2400 (e.g., an expandable suitcase). The embodiment of FIGS. 24A and 24B illustrate an embodiment of the expandable container 2400 having rigid or at least semi-rigid plates (e.g., frame members 2402, 2404) about its sides (e.g., inelastic portions), which plates move relative to each other to allow the expandable container to expand and contract using the various adjustment mechanisms and expandable frame assemblies discussed herein. FIG. 24A illustrates the expandable container 2400 in a first configuration (e.g., a contracted or collapsed configuration). FIG. 24B illustrates the expandable container 2400 in second configuration (e.g., an expanded or extended configuration). The expandable container 2400 may transition between the first, contracted or collapsed configuration and the second, expanded or extended configuration, for example, by turning adjustment mechanism twist handle 1906 clockwise and/or counterclockwise as described herein. The expandable container 2400 may comprise one or more components of expandable frame assembly 200 as described above with respect to FIG. 2A-2C. As shown, the expandable container 2400 comprises a plurality of exterior frame members 2402 and a plurality of interstitial members 2404 around at least the sides and top of the expandable container 2400.

An exterior frame member 2402 may take the form of any of the frame members described herein and/or any form suitable for the structurally supporting the expandable containers described herein. In various embodiments, the exterior frame member may include frame member 202, a corner member 206, a corner member 1902, and/or any rigid plate (e.g., metal, plastic, and/or the like). An interstitial member 2404 may take the form of a frame member 202, a corner member 206, an corner member 1902, a sizing band 204, a support member 208, a rigid plate/bar/rod/pipe (e.g., metal, plastic, and/or the like), and/or any combination thereof. The plurality of exterior frame members 2402 may comprise one or more forms of the exterior frame member 2402 as described above. The plurality of interstitial members 2404 may comprise one or more forms of the interstitial member 2404 as described above.

A respective interstitial member 2404 may be configured to, at least partially, cover the gap between two or more exterior frame members 2402 or otherwise be disposed between two exterior frame members. For example, a respective interstitial member 2404 may be a rigid plate slidably attached to at least one exterior frame member of two adjacent exterior frame members 2402 (e.g., via a screw, rivet, grommet and/or the like as described herein engaging one or more complementary channels of the one or more respective exterior frame members 2402). As the expandable container 2400 expands and the two adjacent exterior frame members 2402 move apart relative to each other, the respective interstitial member 2404 may be configured to at least partially cover (e.g., expand/extend over, fill, traverse, etc.) the space between the two adjacent exterior frame members 2402. An exterior frame member 2402 and/or an interstitial member 2404 may comprise one or more elastic or inelastic portions of the exterior of an expandable container (e.g., the frame members may include elastic portions and/or fabric in addition to a rigid plate material in the depicted embodiments). An interstitial member 2404 may be at least partially configured to slide relative to, and/or telescope with, one or more adjacent exterior frame members 2402 via any known means. In some embodiments, exterior frame members 2402 may engage each other without interstitial frame members (e.g., adjacent edges of adjacent exterior frame members may overlap each other). In some embodiments, with continued reference to FIGS. 24A-24B, a circumferential frame 2406 may be provided around the front and/or rear perimeter of the expandable container, with two or more circumferential frame members 2406*a*, 2406*b* configured to slide relative to each other and provide a channel for at least partially constraining the movement of the frame members 2402, 2404 to the circumferential direction along their respective sides.

FIGS. 25A and 25B illustrate isometric views of an expandable container 2500 (e.g., an expandable suitcase). The embodiment of FIGS. 25A and 25B illustrate an embodiment of the expandable container 2400 of FIGS. 24A-24B having only two plates (e.g., frame members 2502) disposed on each side, which plates also form corner members. FIG. 25A illustrates the expandable container 2500 in a first configuration (e.g., a contracted or collapsed configuration). FIG. 25B illustrates the expandable container 2500 in a second configuration (e.g., an expanded or extended configuration). The expandable container 2500 may comprise one or more features, attributes, characteristics, components, and/or the like of one or more expandable container configurations (e.g., expandable container 1900, expandable container 2400, etc.) as described herein. For example, the expandable container 2500 may transition between the contracted or collapsed configuration and the expanded or extended configuration as described above with respect to at least the expandable container 1900. As shown, the expandable container 2500 comprises a plurality of overlapping frame members 2502. An overlapping frame member 2502 may take the form of any frame member discussed herein and/or any form suitable for the structurally supporting the expandable containers described herein, including but not limited to exterior frame member 2402, a frame member 202, a corner member 206, a corner member 1902, and/or a rigid plate (e.g., substantially bent at 90-degrees comprising metal, plastic, and/or the like).

The plurality of overlapping frame members 2502 may comprise two or more instances of the overlapping frame member 2502 disposed about the expandable container 2500. The respective overlapping frame members 2502 may be configured to, at least partially, slide along, on top of, underneath, and/or into one or more adjacent overlapping frame members 2502. For example, a first overlapping frame member 2502 may define a portion of the top and a respective side of an expandable container 2500. A second overlapping frame member 2502 may define a portion of the bottom and the respective side of the expandable container 2500. The first overlapping frame member 2502 may be configured to slide over the second overlapping frame member 2502 along at least the respective side defined by both the first and second overlapping frame members. In some embodiments, both edges of one frame member may be disposed beneath edges of each adjacent frame member. In some embodiments, one edge of a frame member may be disposed beneath an edge of a first adjacent frame member while another edge of the frame member may be disposed above an edge of a second adjacent frame member.

FIGS. 26A and 26B illustrate an adjustment mechanism 1990 with the adjustment mechanism cover (e.g., adjustment mechanism cover 2004) removed to visualize the interior of the adjustment mechanism according to various embodiments of the present disclosure. The adjustment mechanism 1990, shown in at least FIGS. 26A-26B, may be used in conjunction with one or more expandable containers (e.g., expandable container 1900, 2400, 2500, and/or the like) and/or one or more expandable frame assemblies (e.g., 2000 and/or the like) as described by the present disclosure. The adjustment mechanism 1990, as shown, comprises a rack-and-pinion type structure utilizing at least a gear shaft 2602, a gear 2604, an adjustment mechanism base 2006, an adjustment mechanism cover 2004 (not shown). The adjustment mechanism 1990 linearly actuates four sizing members 2002 using the gear 2602 connected to an adjustment mechanism twist plate (not shown). The gear shaft 2602 may take the form of a dowel, rod, pipe, pin, and/or any other structural element described herein that can facilitate the rotation of the gear 2604.

The gear shaft 2602 may be integrated into, or separate from, the gear 2604. The material used for at least the gear shaft 2602 may be self-lubricating (e.g., oil impregnated bronze, Polytetrafluoroethylene (PTFE), and/or the like). The gear shaft 2602 may extend at least partially through the adjustment mechanism base 2006 (e.g., see at least FIG. 32A and shaft base hole 3502 of FIG. 35A-35B) and/or an adjustment mechanism cover 2004 (e.g., see at least FIG. and shaft cover hole 3608 of FIG. 36A-36B). The gear shaft 2602 may attached with and/or insert into the roller bearing 2010 as shown in FIGS. 21A-21B at one or more ends. The gear shaft 2602 may further attached to the adjustment mechanism twist plate 1908, or the like as described above, to transfer a rotational force/torque from the adjustment mechanism twist plate 1908 (e.g., a force/torque applied to the adjustment mechanism twist plate 1908, any other force transfer mechanism, or the like via one or more adjustment mechanism twist handles 1906) to the gear 2604 for actuating the. In some embodiments, the gear may have a fixed gear portion (e.g., similar to a "Park" gear on a transmission) to prevent rotation of the gear when not in use. In some embodiments, the gear may have a disconnect portion to permit free movement of the sizing members. In some embodiments, the gear may be actuated between the connected, rotatable position; a fixed position; and/or a disconnect position, such as by axially moving the gear (or a gear assembly) relative to the gear shaft.

The gear 2604 comprises a plurality of gear teeth 3302 configured to interface with a plurality of complementary gear teeth 3402 of each respective sizing member 2002. As adjustment mechanism twist plate 1908 or the like is rotated clockwise/counterclockwise the rotational force is transfer from the adjustment mechanism twist plate 1908 or the like through the gear shaft 2602 and to at least the gear 2604, the gear 2604 via the interface formed between the plurality of gear teeth 3302 and the plurality of complementary gear teeth 3402 translates the rotational force to each respective sizing member 2002 as a linear force and movement along a tangent of the gear (e.g., causing linear movement of each respective sizing member 2002 relative to the respective longitudinal axis of at least a portion of the sizing member adjacent the gear). The length of the teeth 3402 along each sizing member 2002 defines the total envelope of size change in at least two directions of movement for the expandable container (e.g., height and width). A third dimension may be provided by the elastic portion or other mechanisms as discussed herein. As shown, each respective sizing member 2002 may slide along the interior of a sizing member channel defined by at least the adjustment mechanism base 2006. The adjustment mechanism base 2006 defines an upper channel 3504 (labeled in at least FIG. 35A) and a lower channel 3506 (labeled in at least FIG. 35A). The adjustment mechanism cover 2004 may define at least a portion of one or more of the sizing member channels upon assembly with the adjustment mechanism base 2006. In various embodiments, the adjustment mechanism cover 2004 and adjustment mechanism base 2006 may define the channels therebetween with portions of the cover and/or the base being configured to constrain lateral movement of the sizing members 2002 (e.g., movement not along the respective axis of motion of each respective sizing member 2002) to provide smooth translation of the sizing members upon actuation by the gear. The gear 2604 and sizing members 2002 may be made of metal (e.g., steel), plastic, or other durable materials.

In the various embodiments discussed herein, alternatives to the rack-and-pinion type gear-driven actuation mechanism 1990 shown in FIGS. 26A-26B may include, by way of non-limiting example, a non-gear friction driven mechanism, a pulley mechanism, a linear actuator, and/or any other embodiment disclosed herein. In some embodiments, the user may directly apply the force to linearly translate the sizing members, such as by a handle or other mechanism attached directly to the sizing members. In some embodiments, a clamp mechanism, fixed gear mechanism (e.g., similar to a "Park" position on a transmission), or any other holding device may be used whereby the sizing members are held and released by the holding device and the user supplies the force to move the sizing members between positions held by the holding device. In some embodiments, multiple gear driven mechanisms may be used. In some embodiments, multiple gears may be used (e.g., a reduction gear) between the handle and the sizing members to improve the user's mechanical advantage. In some embodiments, the adjustment mechanism may comprise any component(s) capable of moving one or more sizing members between two or more positions and/or holding one or more sizing members in two or more positions.

FIGS. 27A and 27B illustrate an adjustment mechanism 1990 comprising at least an adjustment mechanism gear 2702 and an adjustment mechanism pawl 2704. The adjustment mechanism 1990 may further comprise one or more components and structures of one or more other adjustment mechanisms described herein (e.g., adjustment mechanism 1990, etc.) and may be configured to perform one or more actions (e.g., cause expansion/contraction of an expandable container, translate forces/torques, etc.) as described herein for the one or more other adjustment mechanisms (e.g., adjustment mechanism 1990, etc.). For example, the adjustment mechanism 1990 may include substantially the same internal components, including the gear and shaft mechanism, as described in association with the adjustment mechanism 1990 of FIGS. 26A-26B. As the adjustment mechanism gear 2702 is rotated counterclockwise (e.g., via rotation of the adjustment mechanism twist handle 1906, or the like), the adjustment mechanism pawl 2704 may interface/engage with one or more circumferential teeth 2703 of the adjustment mechanism gear 2702 to prevent clockwise rotation of the adjustment mechanism gear 2702 (e.g., thereby preventing unintentional expansion or contraction of the associated expandable container). For example, in some embodiments, the engagement of the teeth 2703 and pawl 2704 may be configured to prevent expansion of the expandable container without first depressing the locking latch 1904, while the expandable container is able to freely contract to the smallest size permitted by the contents of the container. In some embodiments, the engagement of the teeth 2703 and pawl 2704 may be configured to prevent contraction of the expandable container without depressing the locking latch 1904, while the expandable container is able to freely expand.

The locking latch 1904 may protrude through or otherwise proud of the rear panel of the expandable container, and the locking latch 1904 may be pressed (e.g., slid, moved, rocked, toggled, etc. downward toward the bottom of the page of FIG. 27A) to move the distal end of the adjustment mechanism pawl 2704 upward away from the plurality of circumferential teeth 2703 of the adjustment mechanism gear 2702 (e.g., rotating the pawl about an axis between the user-engageable portion of the locking latch 1904 and the distal end), thereby disengaging the adjustment mechanism pawl 2704 from the one or more circumferential teeth 2703. In an instance the adjustment mechanism pawl 2704 is disengaged from the one or more circumferential teeth 2703, the adjustment mechanism gear 2702 may be able to rotate in the clockwise and/or counterclockwise directions (e.g., about gear shaft 2602). In some embodiments, the position of the adjustment mechanism gear 2702 and the adjustment mechanism pawl 2704 may be reversed/flipped/mirrored to allow rotation in the clockwise direction when the adjustment mechanism pawl 2704 is engaged with the one or more circumferential teeth 2703.

FIGS. 28A and 28B illustrate an adjustment mechanism 2800 comprising at least an adjustment mechanism twist plate in the form of an adjustment mechanism index plate 2806 and an adjustment mechanism indexer 2804 connected to the locking latch 1904. The adjustment mechanism 2800 may further comprise one or more components of one or more other adjustment mechanisms described herein (e.g., adjustment mechanism 1990, etc.) and may be configured to perform one or more actions (e.g., cause expansion/contraction of an expandable container, translate forces/torques, etc.) as described herein for the one or more other adjustment mechanisms (e.g., adjustment mechanism 1990, etc.). For example, the adjustment mechanism 2800 may include substantially the same internal components, including the gear and shaft mechanism, as described in association with the adjustment mechanism 1990 of FIGS. 26A-26B.

The adjustment mechanism index plate 2806 may take the form of a rigid plate (e.g., metal, plastic, etc.) configured with one or more index holes 2802. In some embodiments, at least one index hole 2802 may be configured to mark a full rotation of the adjustment mechanism index plate 2806, and each full rotation of the adjustment mechanism index plate 2806 may be associated with one of a plurality of particular sizes of the associated expandable container (e.g., carry-on, checked baggage sizes, small, medium, large sizes, etc.). The adjustment mechanism indexer 2804 may take the form of one or more of a pin, hook, dowel, rod, detent mechanism (e.g., spring loaded ball bearing, pin, etc.), or any other locking element that may be at least partially inserted into one or more of the index holes 2802 to prevent or restrict rotation of the adjustment mechanism index plate 2806 (e.g., about the gear shaft 2602). The locking latch 1904 may be configured to be slid, rocked, moved, pushed, pulled, turned, and/or the like to insert/engage and/or remove/disengage the adjustment mechanism indexer 2804 from the index holes 2802. The index holes 2802 may define a plurality of geometry shapes (e.g., circle, square, oval, rectangle, triangle, crescent, and/or the like). For example, the locking latch 1904 may rotate about an axis between a distal end of the latch (e.g., towards the left in FIG. 28A) and the adjustment mechanism indexer 2804 to lift the indexer from the index holes when the locking latch 1904 is rocked towards the rear panel (e.g., pushed inwardly at its distal end). The index holes 2802 may define a thru hole and/or a hole shallower than a thickness defined by the adjustment mechanism index plate 2806. The index holes 2802 may take the form of slots that extend through an exterior of a radially-outward circumferential surface of the adjustment mechanism index plate 2806 inwardly, for example, toward gear shaft 2602 (e.g., an open gear configuration rather than a hole).

FIGS. 29A-29B illustrate portions of an adjustment mechanism 2900 according to at least one embodiment of the present disclosure. The adjustment mechanism 2900 comprises an adjustment mechanism twist plate in the form of a rounded adjustment dial 2906, an adjustment mechanism index collar 2904, and a locking latch arm 2902. The rounded adjustment dial 2906 may perform one or more of the functions described herein for, and/or be interchangeable with, the adjustment mechanism twist handle 1906 (e.g., the functions of a handle and a twist plate may be integrated into the dial 2906). The rounded adjustment dial 2906 comprise an adjustment mechanism index collar 2904. The adjustment mechanism index collar 2904 may be configured with index notches 2904A around a circumferential surface of the adjustment mechanism index collar 2904. The index notches 2904A may take the form of a groove, cutout, scallop, hole (e.g., index holes 2802 or the like), or any other feature for at least temporarily retaining the locking latch arm 2902. During operation, the rounded adjustment dial 2906 may engage a gear shaft and rotate a gear to drive one or more sizing members in accordance with any of the embodiments described herein (e.g., the gear shaft 2602 may engage a radial center of the rounded adjustment dial 2906 for rotation by the user when the dial is rotated).

FIG. 29B illustrates the locking latch arm 2902 according to at least one embodiment of the present disclosure. In the depicted embodiment, the locking latch arm 2902 defines at least a latch hook 2902A, a pressure tab 2902B, a lever arm 2902C, a mounting plate 2904D, and one or more mounting holes 2904E. The locking latch arm 2902 may be configured of a semi-rigid or flexible material (e.g., spring steel, plastic, etc.) that can flex away from the adjustment mechanism index collar 2904 when a force is applied to the pressure tab 2902B. In an instance, a force (in the direction represented by arrow 2908) is applied to the pressure tab 2902B, the lever arm 2902C may be configured to bend/flex rearward such that the latch hook 2902A may be removed/disengaged from one or more index notches 2904A, that the latch hook 2902A may be engaged/inserted therewith. In some embodiments, the latch hook may prevent rotation in either circumferential direction of the rounded adjustment dial 2906. In some embodiments, the latch hook 2902A may define a ramped shape to facilitate rotation of the adjustment mechanism index collar 2904 while engaged therewith via the one or more index notches 2904A in a first direction (e.g., clockwise/counterclockwise) and prevent rotation in a second direction (e.g., clockwise/counterclockwise) opposite the first direction (e.g., the latch hook 2902A may slip to allow rotation of the dial 2906 in a first direction without being lifted, while preventing rotation without lifting in a second direction opposite the first direction). The locking latch arm 2902 may be mounted to a surface of an expandable container (e.g., a rear panel) via at least one or more mounting holes 2904E in the mounting plate 2904D and associated fasteners (e.g., machine screws, rivets, and/or the like as described herein). The adjustment mechanism 2900 may further comprise one or more components of one or more other adjustment mechanisms described herein (e.g., adjustment mechanism 1990, 2800, etc.) and may be configured to perform one or more actions (e.g., cause expansion/contraction of an expandable container, translate forces/torques, etc.) as described herein for the one or more other adjustment mechanisms (e.g., adjustment mechanism 1990, 2800, etc.). For example, the adjustment mechanism 2800 may include substantially the same internal components, including the gear and gear shaft mechanism, as described in association with the adjustment mechanism 1990 of FIGS. 26A-26B.

FIGS. 30A and 30B illustrate an adjustment mechanism 3000 according to at least one embodiment of the present disclosure having an adjustment mechanism twist plate in the form of a scalloped adjustment dial 3002 and an adjustment mechanism index collar 3004. The adjustment dial 3002 may include one or more detent holes 3008 extending through the dial and oriented in a radially inward and outward direction for allowing a pin 3010 or other similar element described below to extend therethrough for engaging the adjustment mechanism index collar 3004. The adjustment mechanism index collar 3004 may include a corresponding one or more detent holes 3006 for receiving the pin 3010 or other similar elements therein. The scalloped adjustment dial 3002 may perform one or more of the functions described herein for, and/or be interchangeable with, the adjustment mechanism twist handle 1906 with respect to being actuated by a user, the adjustment mechanism twist plate with respect to rotating a gear shaft and gear assembly, and/or the rounded adjustment dial 2906. The scalloped adjustment dial 3002 may be attached to the gear shaft 2602 which may be positioned as shown in FIG. 30A through the roller bearing 2010.

During operation, as the scalloped adjustment dial 3002 is rotated (e.g., clockwise or counterclockwise) the gear shaft 2602 may be rotated therewith. The scalloped adjustment dial 3002 may be configured with at least one detent hole 3008 as shown, which when and engaged with a corresponding detent hole 3006 in the adjustment mechanism index collar 3004 with a detent pin 3010 in the adjustment mechanism index collar 3004, may at least temporarily impede rotation of the scalloped adjustment dial 3002. The detent pin may, in some embodiments, be formed as any component capable of restricting or prohibiting the relative rotation between the scalloped adjustment dial 3002 and an adjustment mechanism index collar 3004, including but not limited to a detent pin, a plunger, a ball and spring, or the like. In some embodiments, the detent pin may be formed in substantially the same manner as the locking latch 1904 of FIGS. 28A-28B, whereby the latch may be configured to attach to the scalloped adjustment dial, the rear panel of the expandable container, or another component of the expandable container to engage and disengage the detent hole 3006 of the adjustment mechanism index collar 3004. The detent pin may be pushed radially outward away from the detent hole 3006 (e.g., by hand, a lever/button, and/or by an increased rotation force applied to the scalloped adjustment dial 3002) to allow the scalloped adjustment dial 3002 to rotate. In some embodiments, the scalloped adjustment dial 3002 may include a protrusion extending towards the detent hole 3006 in the adjustment mechanism index collar 3004 without necessarily including a separate detent hole in the dial. The adjustment mechanism index collar 3004 may be rigidly attached to one or more surfaces defined by an adjustment mechanism 3000 and/or an expandable container (e.g., an adjustment mechanism base). The adjustment mechanism 3000 may further comprise one or more components of one or more other adjustment mechanisms described herein (e.g., adjustment mechanism 1990, 2800, 2900 etc.) and may be configured to perform one or more actions (e.g., cause expansion/contraction of an expandable container, translate forces/torques, etc.) as described herein for the one or more other adjustment mechanisms (e.g., adjustment mechanism 1990, 2800, 2900, etc.). For example, the adjustment mechanism 3000 may include substantially the same internal components, including the gear and gear shaft mechanism, as described in association with the adjustment mechanism 1990 of FIGS. 26A-26B. In some embodiments, the scalloped adjustment dial 3002 may lock and unlock using an axially-translating engagement mechanism as described with respect to the embodiment of FIG. 11 to engage the sizing members 2002 for movement in a first position and disengage in a second position (e.g., either lock to prevent movement of the sizing members in the second position or release to allow the sizing members to freely move).

FIG. 31 illustrates a partial view of an expandable frame assembly 2000 having an adjustment mechanism 1990 engaged with sizing members 2002 as described above with respect to FIGS. 26A-26B. As shown, each sizing member 2002 is configured with a substantially 90-degree bend at one end defining the foot portion 2020 comprising fastener holes 3102. As shown, the foot portion 2020 may be substantially axially aligned with the gear 2604 and gear shaft 2602 such that an axis connecting opposite foot portions 2020 may intersect the gear shaft. As further shown, the sizing members 2002 may include parallel proximal portions 3100 defining engagement elements (e.g., complementary teeth 3402) for engagement with and control by the adjustment mechanism 1990. The parallel proximal portions 3100 may be parallel to and offset from the axis connecting opposite foot portions 2020 for each respective pair of sizing members, such that the pairs of sizing members are configured to accommodate the gear 2604 therebetween at the adjustment mechanism 1990. Between the parallel proximal portions 3100 and the foot portion 2020 may be an angled portion 3104 of the sizing members 2002.

FIG. 32A illustrates an expandable frame assembly 2000 configured with an adjustment mechanism 1990, described above with respect to at least FIGS. 26A-26B, and an adjustment mechanism twist plate 2702 and handle 1906 of the adjustment mechanism, described above with respect to at least FIGS. 27A-27B. As discussed herein, the various embodiments of twisting and actuating mechanisms capable of rotating the gear shaft 2602 may be used interchangeably. Moreover, any embodiment of adjustment mechanism may be used with embodiments of the sizing members 2002. In some embodiments, the foot portions 2020 may each be defined on a respective axis extending through the gear shaft 2602. In some embodiments, the foot portions 2020 may each be aligned along axes connecting respective corners of the expandable container such that the expandable container defines a rectangular prism shape. In such embodiments, at least a portion of the sizing members 2002 may have foot portions 2020 that are offset parallel to an axis of the gear shaft 2602 relative to their proximal portions 3100 so that each foot portion is aligned front-to-back relative to the expandable container. This offset may be accomplished, for example, via the angled portion 3104 of the sizing members.

FIG. 32B illustrates an embodiment of an expandable frame assembly 3200 that may include sizing members 2002 as described herein and may include an adjustment mechanism 3202 that may be controlled by a motor 3204 (e.g., instead of or in addition to hand cranking by a user). The adjustment mechanism may otherwise have a gear 2604 and gear shaft 2602 and may interact with the sizing members 2002 in substantially the same manner as described herein. In some embodiments, the motor 3204 may engage the gear shaft 2602 to rotate the gear 2604 and simultaneously drive each of the sizing members 2002 to expand or contract between expanded and contracted configurations and to any position therebetween. By way of non-limiting example, the motor 3204 may be a servo motor allowing control of the angular position of the motor to expand or contract the expandable container to a desired size and holding the expandable container at the desired size for use (e.g., with or without one or more of the various locking mechanisms discussed herein). An output shaft of the servo motor may be connected to the gear 2604. In some embodiments, the motor 3204 may be attached to any portion of the expandable frame assembly or expandable container more generally, such as, but not limited to, the adjustment mechanism base 2006, the rear plate 3902, or the like. The motor 3204 may likewise be used to drive any of the adjustment mechanisms discussed herein.

The motor 3204 may be controlled by a controller 3206 configured for operating the motor automatically and/or in response to user input. The controller 3206 may include one or more computing devices either as a single unit or multiple devices configured to programmatically operate the motor 3204. For example, the controller 3206 may include at least one processor 3208 (e.g., a microprocessor) and at least one memory 3210, which may include a non-transitory computer-readable medium. The memory 3210 may store computer program instructions configured to, when executed by the processor 3208 and/or one or more other components of the controller 3206, cause the controller to operate the motor and/or one or more other electrical components of the expandable container. In some embodiments, at least a portion of the functions of the controller 3206 may be performed remotely from the expandable container (e.g., in the cloud or on a user's mobile device). In some embodiments, any other local or remote computing devices known in the art and capable of controlling a motor may be used to carry out one or more of the functions described herein. The controller 3206 may further include a power supply 3212 (e.g., a battery) configured to receive and/or store power for operating the motor 3204 and controller 3206.

In some embodiments, the controller 3206 may include a user interface 3214, such as a display (e.g., with or without a touch panel), one or more buttons, one or more switches, or any other analog or digital control device capable of providing input into the controller from a user in physical possession of the expandable container. In some embodiments, the controller 3206 may include communications circuitry 3216 capable of wired and/or wireless communication with one or more computing devices (e.g., a user mobile phone, a server, a personal computer, or the like). In some embodiments, the communications circuitry 3216 may include an antenna 3218. In some embodiments, the communications circuitry 3216 may be configured for wireless communication via any known wireless technology or protocol, such as, but not limited to, Wi-Fi, NFC, RFID, Zigbee, Bluetooth, or the like. The communications circuitry 3216 may enable the controller 3206 to receive and/or transmit data to/from the expandable container. For example, a user may have a software application installed on her or his mobile device, which may wirelessly connect with the expandable container (either directly or via one or more intermediate networks and computing systems) for the user to transmit instructions to operate the motor and for the user to receive information about the status of the expandable container on her or his mobile device (e.g., a current size, battery level, and/or motor status). The expansion of the expandable container may thus be controlled remotely and/or locally by the user via the motor 3204 and controller 3206.

FIG. 33 illustrates a gear 2604 as described above with respect to various embodiments of adjustment mechanism 1990, 2800, 2900, 3000, and the like. As shown, the gear 2604 comprises a plurality of gear teeth 3302 around a circumferential surface of the gear 2604. The plurality of gear teeth 3302 may be configured to interface with a plurality of gear teeth of one or more other components/parts described herein (e.g., adjustment band 904 described above with at least respect to FIG. 9B, sizing member 2002 described below with at least respect to FIG. 34, or any other parts shown or described as having at least one gear tooth). The gear 2604 may take the form of a helical gear, a worm gear, a spur gear, a bevel gear, a cam, a linkage, a lever, and/or a gear comprising a single tooth. The gear 2604 may be configured with a shaft hole 3304 configured to receive and facilitate rotation on or about a shaft (e.g., gear shaft 2602 or the like). The shaft hole 3304 may take the form a thru hole, a blind hole, and/or a tapered hole. The shaft hole 3304 may define one or more geometric shapes, for example, a circle, a square, or the like as described herein.

FIG. 34 illustrates a sizing member 2002 configured with a plurality of gear teeth 3402 on a proximal portion 3100 at a first end and fastener holes 3102 on a foot portion 2020 at a second end. The sizing member 2002 may be configured as described above with respect to at least FIGS. 21A-21B, 23A-23B, 26A-27B, 31, and 32.

FIGS. 35A and 35B illustrate an adjustment mechanism base 2006 as described above with respect to at least FIGS. 21A-21B and 26A-26B. In the depicted embodiment, the adjustment mechanism base 2006 defines an upper channel 3504 and a lower channel 3506. The upper channel 3504 may be configured to at least partially hold and slidably support a portion of the sizing members 2002 (e.g., proximal portions 3100 as shown in at least FIGS. 26A-26B and 31). The adjustment mechanism base 2006 further defines guide blocks 3508 within the upper channel 3504 and/or the lower channel 3506 at either end of the upper channel 3504 and/or the lower channel 3506 along at least a portion of a circumferential surface defined by the adjustment mechanism base 2006. The guide blocks 3508 or any structural component or channel attached to or defined by the adjustment mechanism base 2006 may be used to differentiate parallel sub-channels for holding a pair of sizing members, with the upper channel 3504 and lower channel 3506 each supporting and guiding the linear motion of a respective pair of sizing members. The sub-channels defined within each channel may be disposed on opposite sides of the gear shaft and gear. The upper channel 3504 may comprise two surfaces at least slightly above the bottom most surface of the lower channel 3506. The lower channel 3506 may define at least one continuous surface extending through the adjustment mechanism base 2006. The adjustment mechanism base 2006 may further define a shaft base hole 3502 configured to receive a gear shaft 2602 and facilitate embodiments of the gear shaft 2602 as described herein. The reverse side of the adjustment mechanism base 2006 (shown in FIG. 35B) may have a roller bearing mount 3510 for engaging a roller bearing.

FIGS. 36A and 36B illustrate an adjustment mechanism cover 2004 as described above with respect to at least FIGS. 21A-21B and 26A-26B. The adjustment mechanism cover 2004 defines a plurality of upper channel rails 3602 and a plurality of lower channel rails 3604. The plurality of upper channel rails 3602 and the plurality of lower channel rails 3604 may be configured to slidably support the sizing members 2002 within the upper channel 3504 and the lower channel 3506 respectively. The plurality of upper channel rails 3602 and the plurality of lower channel rails 3604 configured to, at least partially, engage with the upper channel 3504 and the lower channel 3506 respectively when the adjustment mechanism cover 2004 is fastened to the adjustment mechanism base 2006 via at least the plurality of fastener holes 2008. The adjustment mechanism cover 2004 and/or the adjustment mechanism base 2006 may be at least partially coated with, or made of, a lubricating material (e.g., coated with silicon lubricant, a layer of PTFE, etc.). The channel rails and the features of the adjustment cover base may function together to constrain motion of the sizing members along a linear path while maintaining contact between each sizing member and the gear or other adjustment mechanism components configured for permitting and/or causing linear motion of the sizing members. The reverse side of the adjustment mechanism cover 2004 (shown in FIG. 36B) may have a roller bearing mount 3610 for engaging a roller bearing.

While the depicted frame assemblies (e.g., expandable frame assembly 2000 and 3700), include four sizing members 2002, the frame assembly may have four or more sizing members, such as five, six, seven, eight, or more sizing members. For example, two additional sizing members 2002 may be added opposite one another along a left-to-right axis in FIGS. 23A-23B and/or two additional sizing members 2002 may be added opposite one another along a top-to-bottom axis in FIGS. 23A-23B. The adjustment mechanism (e.g., adjustment mechanism 1990 or any other embodiment disclosed herein) may have additional channels (e.g., additional instances of channels 3504, 3506) disposed at additional vertical heights within the 2004 and adjustment mechanism base 2006 so that the added support members 2002 can travel on intersecting axes with the existing support members 2002 in the existing channels 3504, 3506. In such embodiments, the gear 2604 may likewise control operation of the additional sizing members, with or without intermediate gearing therebetween to achieve expansion and contraction of the expandable container as described herein. In some embodiments, additional sizing members 2002 and corresponding structure of the adjustment mechanism may be added in a pairwise manner, such that opposing sizing members oriented in opposite directions are always present. In some embodiments, the axes along which each sizing member travels may all intersect with the gear shaft 2602. The sizing members 2002 may connect to corresponding frame members (e.g., frame members, such as frame members 202 described herein, disposed between the corner members 1902). In some embodiments, the frame assemblies discussed herein may have four or fewer sizing members, such as three, two, or one (e.g., a single opposing pair of frame member assembly elements, by removing one of the pairs shown in the figures).

FIG. 37 illustrates an expandable frame assembly 3700, which is substantially the same as expandable frame assembly 2000 as illustrated in at least FIGS. 21A-21B and 23A-23B and described above unless stated otherwise, and which is depicted with four corner foot portions 3704 engaging four frame members (e.g., corner members 1902). As described with respect to various embodiments herein, the corner members may be frame members configured for defining at least a portion of a corner of the structure of an expandable container. Each of the four corner foot portions 3704 may attach via fasteners (as described above) to a respective corner member 1902 and a respective sizing member 2002. In some embodiments, any other attachment means or integral formation may connect the sizing members with the corner members via respective corner foot portions.

FIG. 38 illustrates a partial view of the expandable frame assembly 3700 showing a corner member 1902 attached via at least a corner foot portion 3704 to a sizing member 2002. In some embodiments, the corner foot portion 3704 may define attachment features configured to engage respective perpendicular plates 1912 and the angled connector plate 1914 of the corner member 1902 to provide additional support for the corner of the expandable container. The sizing member 2002 may otherwise be structured and function in accordance with the various embodiments discussed herein. The corner foot portion 3704 may be configured with a plurality of corner member fastener holes 3802 configured to attach the corner foot portion 3704 to the corner member 1902 via fasteners (e.g., screw, bolts, nuts, or any other fastener as described herein), complementary holes may be made in the corner member 1902 that at least partially align with the plurality of corner member fastener holes 3802. The corner foot portion 3704 may be configured with a plurality of sizing member fastener holes 3702 configured to attach the corner foot portion 3704 to the sizing member 2002 via fasteners (described above), complementary holes may be made in the sizing member 2002 that at least partially align with the plurality of sizing member fastener holes 3702.

FIG. 39 illustrates a rear plate 3900 (also referred to as a rear panel) of an expandable container in accordance with various embodiments discussed herein, which rear plate may be interchangeably used with any other rear plate described herein. The rear plate 3900 may be configured to attach the expandable frame assembly 2000, 3700, or other expandable frame assemblies as described herein, to an expandable container (e.g., expandable container 1900, or other expandable containers as described herein). The rear plate 3900 may define a portion of the exterior of an expandable container, for example, see inelastic portion 102 as illustrated in FIGS. 19A-19B. In the depicted embodiment, the rear plate 3900 defines a base plate 3902, four sizing member supports 3904, and an recessed bracket hole 3906. The base plate 3902 may take the form of a rigid plate (e.g., metal, plastic, or other material described herein). The four sizing member supports 3904 may slidably support respective sizing members 2002 during expansion and/or contraction operations described herein. In some embodiments a proximal portion (e.g., proximal portion 3100 of the sizing members 2002 may be guided by the sizing member supports. The sizing member supports may be positioned in line with and at the height of the channels defined in the adjustment mechanism base (e.g., adjustment mechanism base 2006) when the base is coupled with the rear plate 3900. The sizing member supports 3904 may be used to reduce the lever arm of the sizing members to prevent unwanted torqueing or distortion of the expandable frame assembly by rigidly supporting the sizing members closer to their foot portions. As described herein, while FIG. 39 depicts supports 3904 for four sizing members, the frame assembly may be modified to include more or fewer sizing members and the number and height of the supports may be adjusted accordingly without departing from the scope of the present disclosure.

The recessed bracket hole 3906 may be configured to receive one or more of the adjustment mechanism base 2006 or the adjustment mechanism cover 2004. The adjustment mechanism base 2006 and/or the adjustment mechanism cover 2004 may be pressed (or otherwise held with fasteners, epoxies, or the like) in the recessed bracket hole 3906 to prevent the adjustment mechanism base 2006 and/or the adjustment mechanism cover 2004 from coming out of the recessed bracket hole 3906, for example, during use, travel, or other operation of the associated adjustment mechanism. The recessed bracket hole 3906 may facilitate access to an adjustment mechanism twist handle 1906, a rounded adjustment dial 2906, a scalloped adjustment dial 3002, or another twisting mechanism for applying a rotational force/torque to the associated adjustment mechanism to facilitate expansion and/or contraction of an associated expandable counter and/or frame assembly.

FIG. 40 illustrates a corner of an expandable frame assembly 3700 configured with at least one corner foot portion 3704 and attached to the rear plate 3900 described above with respect to FIG. 39. As shown, the adjustment mechanism base 2006 of the expandable frame assembly 3700 is at least partially within the recessed bracket hole 3906 of the rear plate 3900. The sizing member 2002 is slidably attached to the adjustment mechanism base 2006 and/or the adjustment mechanism cover 2004 at one end and is rigidly attached to the corner foot portion 3704 (via at least sizing member fastener holes 3702) at the other end.

FIG. 41 illustrates a corner of an expandable frame assembly 3700 attached to the rear plate 3900 as described above with respect to FIG. 40. In the depicted embodiment, an upper surface of the sizing member support 3904 defines a first plane parallel to second plane defined by a lower surface of the upper channel 3504. A sizing member (as illustrated in FIG. 40) may slide parallel to the first plane and the second plane along the upper surface of the sizing member support 3904 and/or the lower surface of the upper channel 3504 during expansion and/or contraction operations as described above.

FIG. 42 illustrates an embodiment of an adjustment mechanism twist plate and handle assembly comprising a foldable lever crank 4200. The foldable lever crank 4200 may be used as an alternative to one or more of the adjustment mechanism twist plate 1908 and handle 1906 (illustrated in at last FIGS. 19A-19B and described above), the rounded adjustment dial 2906 (illustrated in at last FIG. 29A and described above), the scalloped adjustment dial 3002 (illustrated in at last FIGS. 30A-30B and described above), and/or the like as described herein, and may be interchanged with such components in the various embodiments described herein to rotate a gear shaft attached to the base plate 4208. In the depicted embodiment, the foldable lever crank 4200 comprises at least a crank knob 4204, crank lever 4202, lever hinge 4206, a base plate 4208, a knob recess 4210, and a locking latch 4212. When the crank lever 4202 is twisted via user movement of the crank knob 4204, the base plate 4208 and any gear shaft attached thereto may be configured to rotate.

FIG. 43 illustrates the foldable lever crank 4200 as shown in FIG. 42 and described above. As shown, in FIG. 43, the foldable lever crank 4200 is folded inward to insert the crank knob 4204 into the knob recess 4210 to stow the crank when not in use. In some embodiments, the foldable lever crank 4200 may be used in conjunction with one or more locking mechanisms disclosed herein, such as the locking latch 1904 and pawl 2704 shown in FIG. 27A, the locking latch 1904 and adjustment mechanism indexer 2804 shown in FIG. 28A, the locking latch arm 2902 and adjustment index collar 2904 shown in FIG. 29A, the pin 3010 and detent hole 3006 shown in FIGS. 30A-30B, the adjustment mechanism 900 and movable gear 914 shown in FIG. 11, or any other locking mechanism capable of holding the foldable lever crank 4200 in an at least partially fixed rotational position or restricting rotation of the foldable lever crank. For example, the locking latch 4212 may be engaged by the crank lever 4202 when the crank lever is in the stowed position shown in FIG. 43 to engage the latch with one or more engagement features in the adjustment mechanism to prevent rotation of the crank lever.

Figures 44A, 44B:
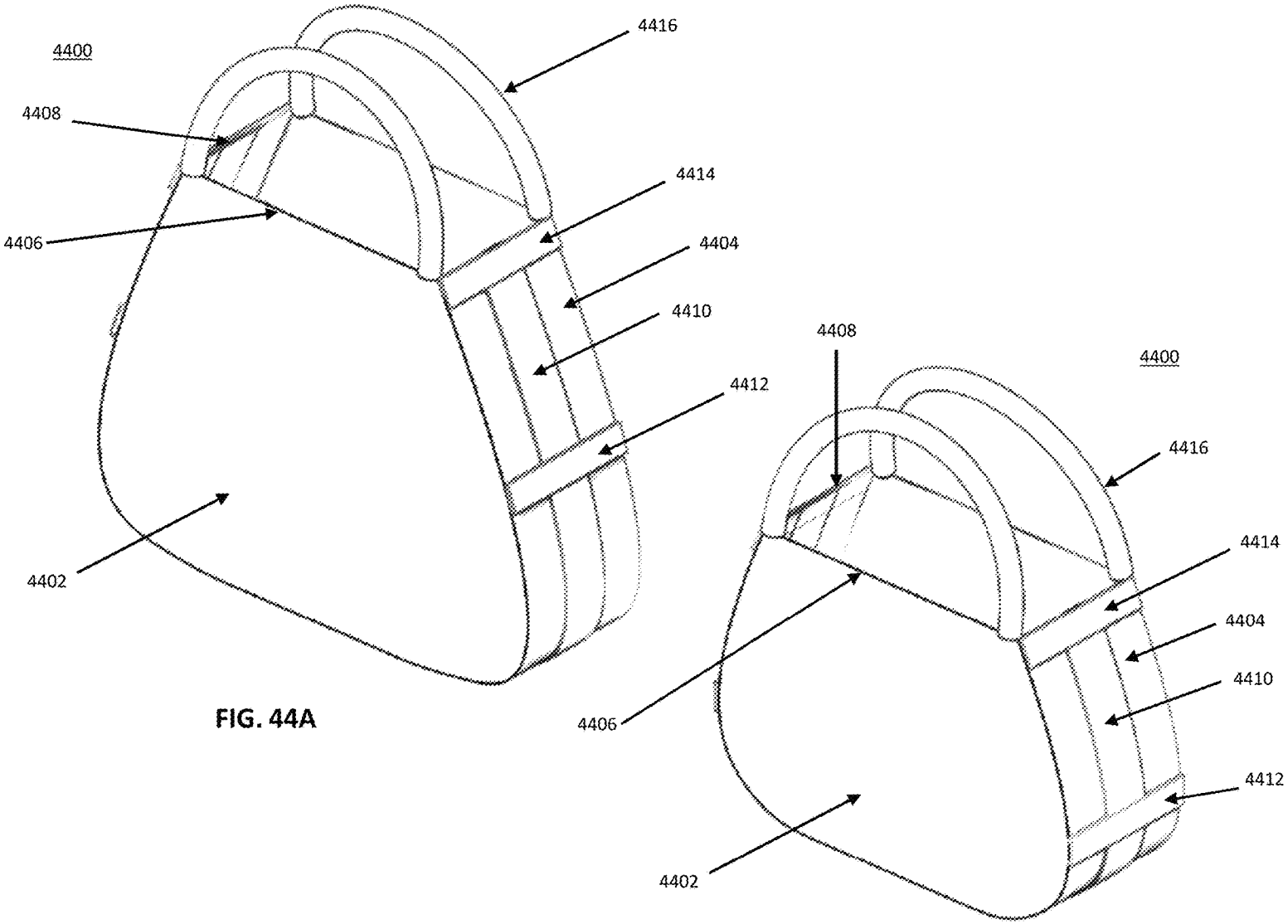

FIGS. 44A-45B illustrate a handbag 4400 form factor of an expandable container in accordance with various embodiments disclosed herein. The handbag 4400 includes a shell defined by front and rear portions 4402 and side edges 4404, with an upper edge 4406 of the front and rear portions 4402 and an upper edge 4408 of the side edges 4404 defining a handbag opening. The size of the handbag 4400 may be adjusted by one or more sizing members (e.g., a pair of sizing bands 4410 meeting at a bottom of the handbag in the embodiments of FIGS. 44A-45B). In the depicted embodiment, each of a pair of sizing bands 4410 are respectively attached at or proximate the upper edge 4408 of the side edges 4404 of the handbag, and the lengths of the side edges are adjusted via an adjustment mechanism moving the sizing bands to expand or contract the shell. In the depicted embodiment, the handbag 4400 further includes guide straps 4412 configured to hold the sizing bands 4410 along the side edges 4404 while allowing the sizing bands to slide therethrough during adjustment. In some embodiments, the handbag 4400 may include an attachment band 4414 to attach the distal ends of the sizing bands 4410 to the upper edges 4408. The handbag 4400 may include one or more handles 4416 for a user to hold. FIG. 44A shows the handbag 4400 in a second, expanded configuration and FIG. 44B shows the handbag 4400 in a first, contracted configuration. In the various embodiments discussed herein, the first and second configurations may define different volumes of the shell.

Figure 45B:
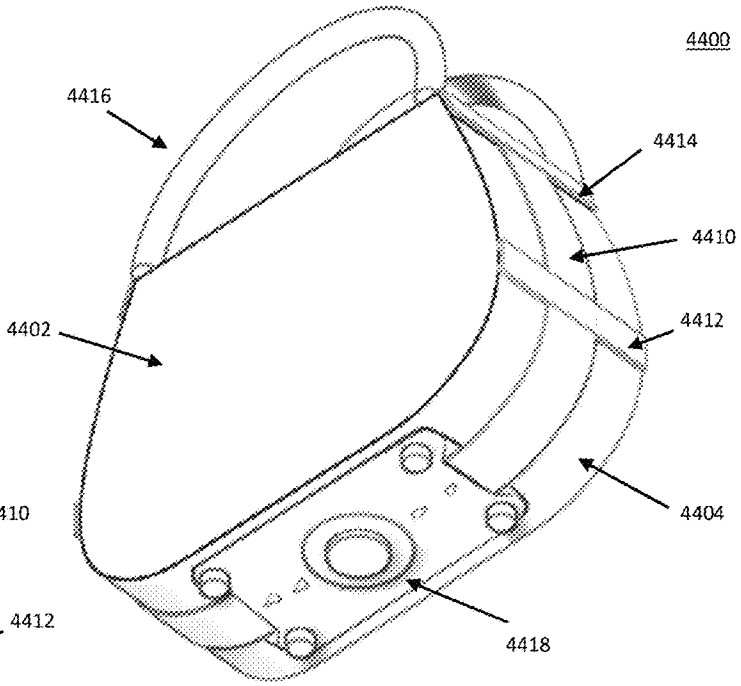
Figure 45A:
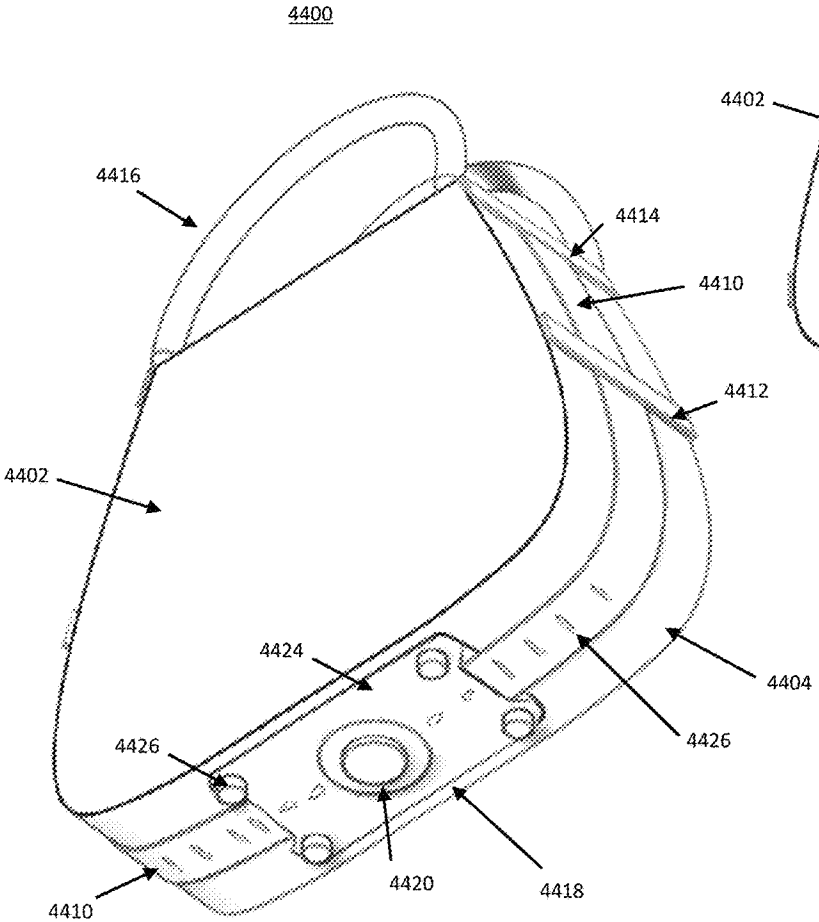

FIGS. 45A-45B illustrate bottom perspective views of the handbag 4400 of FIGS. 44A-44B. In the depicted embodiment, the handbag 4400 may include an adjustment mechanism 4418 configured to hold the sizing bands 4410 at and/or linearly actuate the sizing bands to a plurality of positions (e.g., the respective expanded and contracted positions shown in FIGS. 45A and 45B) in accordance with any embodiment of adjustment mechanism disclosed herein. For example, the adjustment mechanism 4418 may include a twist plate (e.g., a dial) 4420 connected to a gear or other drive mechanism configured to move proximal ends of two sizing bands 4410 linearly in opposite directions to expand and contract the handbag. The adjustment mechanism 4418 may further include a base 4424 attached to the side edges 4404 of the handbag 4400 via one or more fasteners 4426, via stitching, via adhesive, or via any other means. In some embodiments, the sizing bands 4410 may include size indicators 4426 configured to provide a visual indication (e.g., via spaced markings) of the current position of the sizing bands and thus the current size of the handbag.

In some embodiments, the sizing bands 4410 may be configured to contract the handbag 4400 along the plane of the front and/or rear surface 4402 (e.g., in the height-wise and/or widthwise directions). In some embodiments, the sizing bands may not contract the handbag perpendicular to the plane of the front and/or rear surface 4402. In some embodiments, the handbag may at least passively expand and contract (e.g., via elastic material) perpendicular to the plane of the front and/or rear surface 4402. In some embodiments, the upper edge 4406 of the front and rear portions 4402 may expand and contract with the handbag 4400. In some embodiments, the expansion and contraction of the handbag 4400 may not cause the upper edge 4408 of the side edges 4404 to expand and contract. In some embodiments, the front side 4402, rear side, and/or the side edges 4404 may be made of elastic material (e.g., may comprise an elastic portion(s)). In some embodiments, the front side 4402, rear side, and/or the side edges 4404 may be made of inelastic material (e.g., may comprise an inelastic portion(s)). In some embodiments, the front side 4402, rear side, and/or the side edges 4404 may be made of a combination of inelastic and elastic material.

Figure 46B:
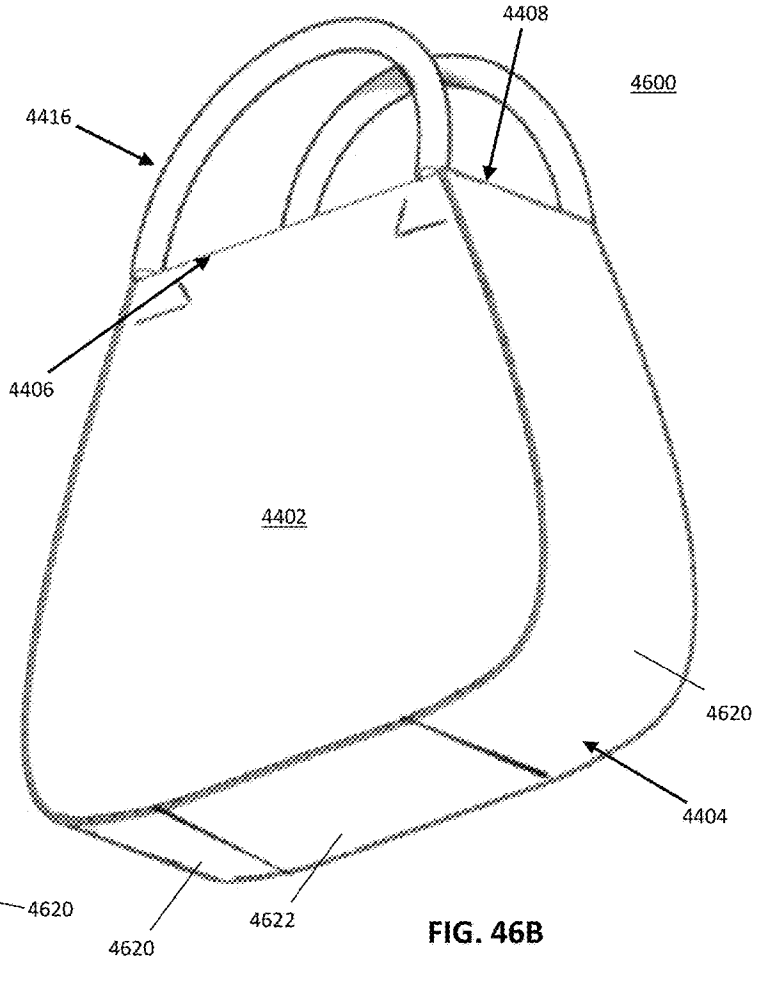
Figure 46A:
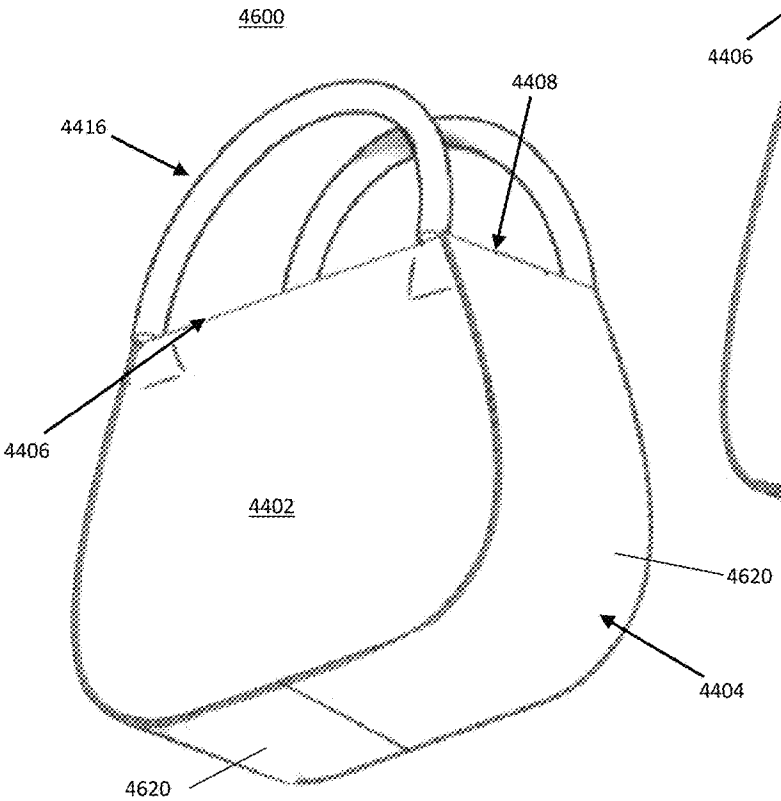
Figure 47B:
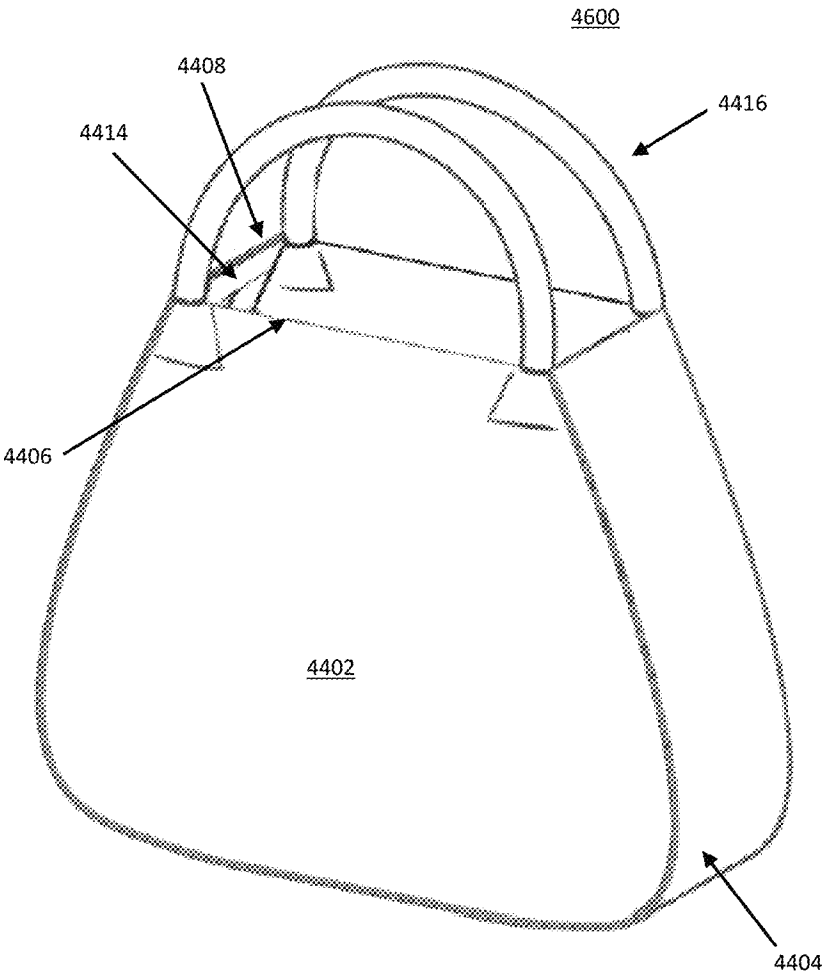
Figure 47A:
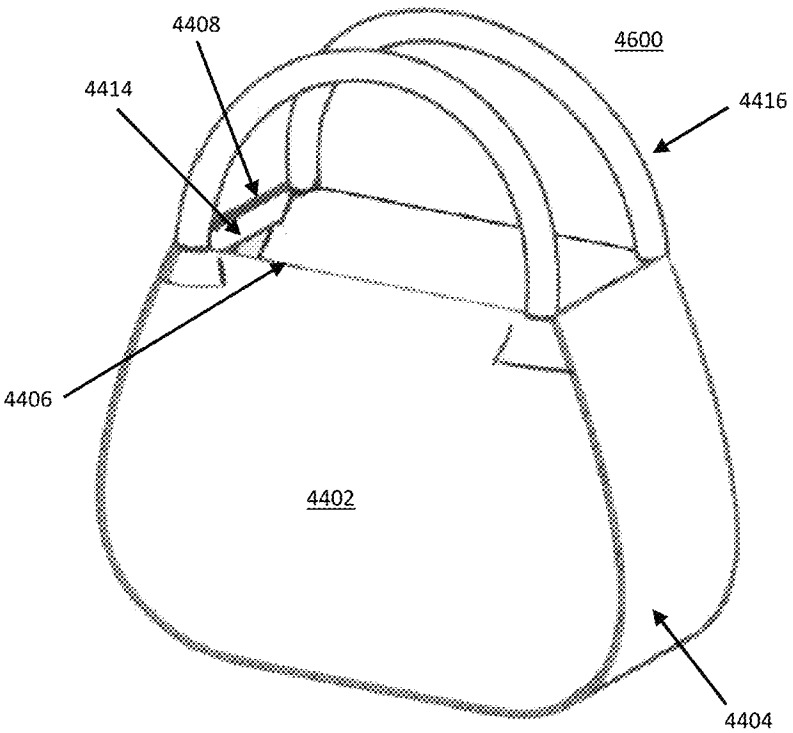

FIGS. 46A-48B illustrate a handbag 4600 form factor of an expandable container in accordance with various embodiments disclosed herein. FIGS. 46A, 47A, and 48A each show the handbag 4600 in a first, contracted configuration, and FIGS. 46B, 47B, and 48B each show the handbag 4600 in a second, expanded configuration. The handbag 4600 of FIGS. 46A-48B may be structured and may function the same as the handbag 4400 of FIGS. 44A-45B but may have the sizing bands 4410 and/or adjustment mechanism 4418 positioned inside the handbag (e.g., on a reverse surface of the side edges from the embodiment shown in FIGS. 44A-45B). In some embodiments, a liner within the handbag may cover some or all of the adjustment mechanism 4418 and/or sizing bands 4410. In some embodiments, the adjustment mechanism 4418 and/or sizing bands 4410 may not be visible from the outside of the handbag 4400. In some, but not necessarily all, embodiments, portions of the adjustment mechanism 4418 and/or sizing bands 4410 may be visible in the interior (e.g., when looking through the top opening of the handbag).

With reference to FIGS. 46A-46B, in some embodiments, the handbag (e.g., handbags 4400 and 4600) may include side edges 4400 having a single contiguous piece of material (e.g., elastic and/or inelastic material). In some embodiments of the handbag (e.g., handbags 4400 and 4600), the side edges 4400 may be made of two or more pieces of material. For example, FIGS. 46A-46B show three portions 4620, 4622 of the side edges 4404, whereby a middle portion 4622 is disposed between two outer portions 4620 of the side edges, and is revealed and hidden via the expansion and contraction of the handbag. In some embodiments, the middle portion 4622 may be an elastic material that may partially or wholly contract out of view when the handbag is in its smallest size. In some embodiments, the middle portion 4622 may be an inelastic material that folds or slides partially or wholly out of view when the handbag is in its smallest size. In various embodiments, the outer portions 4620 of the side edges 4404 may be elastic and/or inelastic. In some embodiments, the middle portion 4622 may overlap with and slide relative to the outer portions 4620 (e.g., similar to the frame members 2402 and 2404 shown in FIGS. 24A-25B).

Figure 48B:
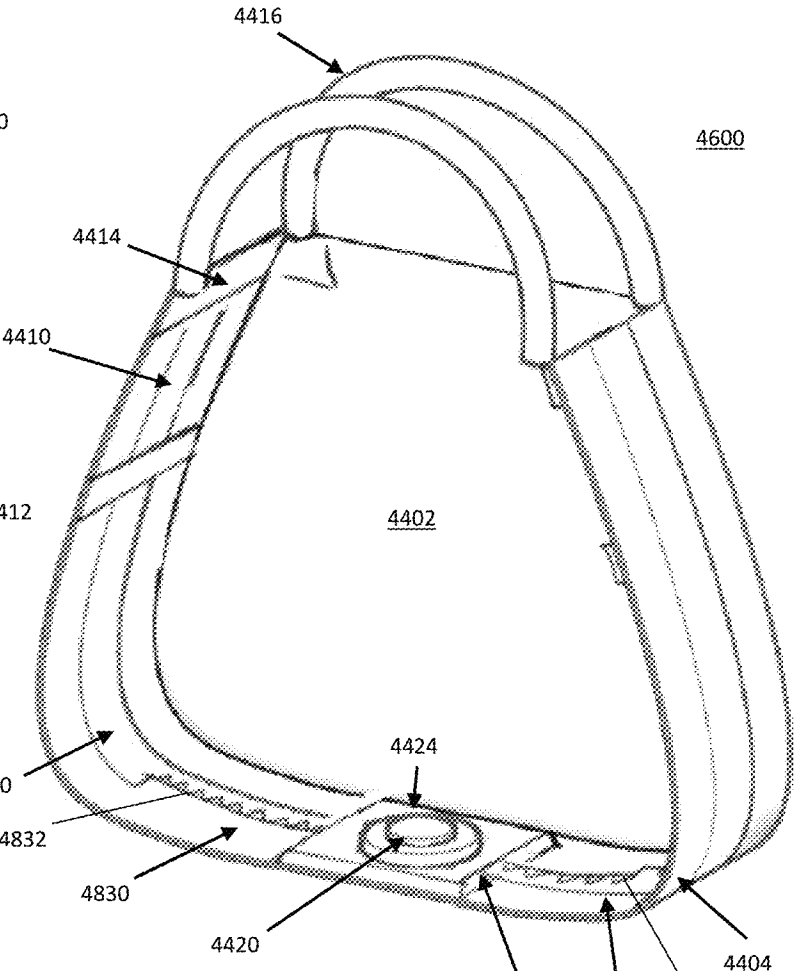
Figure 48A:
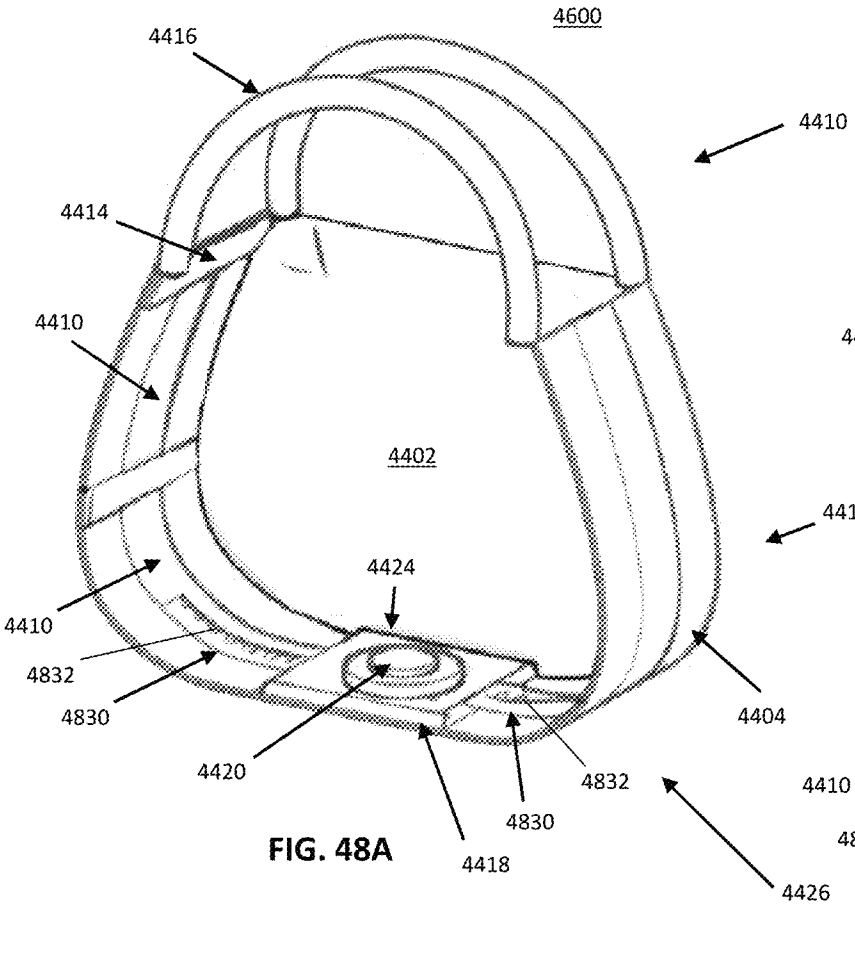

With reference to FIGS. 48A-48B, the sizing bands 4410 include a proximal portion 4830 adjacent the adjustment mechanism 4418. In the depicted embodiment, the proximal portion 4830 has a reduced width relative to the rest of the sizing band 4410, with each respective sizing band having material offset from the other and having teeth 4832 configured to be actuated by the adjustment mechanism 4418. Similar to other embodiments of the adjustment mechanism discussed herein, the proximal portions 4830 may be disposed parallel to each other on opposite sides of a gear for parallel, linear actuation by the gear to adjust the size of the handbag 4600.

NON-LIMITING EXAMPLE EMBODIMENTS

The subject matter described herein includes, but is not limited to, the following specific embodiments:

Embodiment 1. An expandable frame assembly for an expandable container configured to expand in at least two dimensions, the expandable frame assembly comprising:

a plurality of frame members configured to move relative to each other;

a plurality of sizing members, each of the plurality of sizing members connected to at least one of the plurality of frame members; and an adjustment mechanism operably coupled to the plurality of sizing members, the adjustment mechanism configured to move the plurality of sizing members between a first configuration and a second configuration, and wherein the first configuration defines a different distance between the plurality of frame members than the second configuration.

Embodiment 2. The expandable frame assembly of Embodiment 1, wherein the expandable frame assembly defines a width dimension and a length dimension, wherein the length dimension is perpendicular to the width dimension, wherein the width dimension in the first configuration is less than the width dimension in the second configuration, and wherein the length dimension in the first configuration is less than the length dimension in the second configuration.

Embodiment 3. The expandable frame assembly of Embodiment 2, wherein the expandable frame assembly defines a depth dimension that is perpendicular to a plane defined by at least the width dimension and the length dimension, and wherein the depth dimension in the first configuration is less than the depth dimension in the second configuration.

Embodiment 4. The expandable frame assembly of any one of the preceding embodiments, wherein the adjustment mechanism is configured to cause linear movement of a respective sizing member of the plurality of sizing members.

Embodiment 5. The expandable frame assembly of Embodiment 4, wherein the adjustment mechanism is configured to move at least a first sizing member in a first linear direction along a first axis and a second sizing member in a second linear direction along a second axis, and wherein the first axis intersects at least the second axis.

Embodiment 6. The expandable frame assembly of any one of Embodiment 4 or Embodiment 5, wherein the plurality of sizing members comprises at least four sizing members defining two pairs of sizing members, and wherein a respective pair of the two pairs of sizing members comprises a first sizing member configured for linear movement along a first axis and a second sizing member configured for linear movement along a second axis.

Embodiment 7. The expandable frame assembly of Embodiment 6, wherein the first axis and the second axis are one or more of colinear, coplanar, parallel, offset, perpendicular, or intersecting.

Embodiment 8. The expandable frame assembly of any one of Embodiment 6 or Embodiment 7, wherein a first pair of sizing members of the two pairs of sizing members is offset from a second pair of sizing members of the two pairs of sizing members at least at a location of the adjustment mechanism, wherein the offset is in a direction perpendicular to both the first axis and the second axis.

Embodiment 9. The expandable frame assembly of Embodiment 8, wherein the adjustment mechanism defines a center axis that is equidistant from a respective distal end of each of the plurality of sizing members, and wherein the respective distal end of each of the plurality of sizing members is shaped to align with a respective axis perpendicular to the center axis and intersecting the center axis.

Embodiment 10. The expandable frame assembly of any one of Embodiments 5-9, wherein the first linear direction is between the first configuration and the second configuration and the second linear direction is between the second configuration and the first configuration.

Embodiment 11. The expandable frame assembly of Embodiment 10, wherein the first linear direction and the second linear direction are associated with one or more of a shared axis or a shared magnitude, and wherein the first linear direction is opposite the second linear direction.

Embodiment 12. The expandable frame assembly of any one of the preceding embodiments, wherein the plurality of frame members comprises a plurality of corner members, a respective corner member of the plurality of corner members defining a first corner member portion substantially perpendicular to a second corner member portion, and wherein the respective corner member of the plurality of corner members is configured to at least partially structurally define a respective corner of the expandable container.

Embodiment 13. The expandable frame assembly of Embodiment 12, wherein a respective sizing member of the plurality of sizing members is connected to a respective corner member of the plurality of corner members at an intersection of the first corner member portion and the second corner member portion of the respective corner member.

Embodiment 14. The expandable frame assembly of any one of Embodiments 5-13, wherein the adjustment mechanism and the plurality of sizing members are configured to translate each of the plurality of frame members away from the adjustment mechanism when moving from the first configuration to the second configuration, and wherein the adjustment mechanism and the plurality of sizing members are further configured to translate each of the plurality of frame members toward the adjustment mechanism when moving from the second configuration to the first configuration.

Embodiment 15. The expandable frame assembly of any one of the preceding embodiments, wherein a respective sizing member of the plurality of sizing members is a rigid linkage configured to translate forces between the adjustment mechanism and a respective frame member of the plurality of frame members.

Embodiment 16. The expandable frame assembly of Embodiment 15, wherein the plurality of frame members comprises a plurality of corner members, and wherein the forces comprises one or more of a compressive force, a tension force, or a torque.

Embodiment 17. The expandable frame assembly of any one of Embodiment 15 or Embodiment 16, wherein a respective sizing member of the plurality of sizing members is configured to move relative to at least a channel defined by the adjustment mechanism, and wherein the channel is configured to at least partially direct linear movement of the respective sizing member.

Embodiment 18. The expandable frame assembly of any one of Embodiments 15-17, wherein the adjustment mechanism comprises one or more of a gear configured to engage one or more teeth of a respective sizing member, a pin configured to engage one or more holes of a respective sizing member, a clamp configured to engage a surface of at least a respective sizing member, or a screw configured to engage one or more threads or teeth of a respective sizing member.

Embodiment 19. The expandable frame assembly of Embodiment 18, wherein the respective sizing member at least partially comprises a sizing band.

Embodiment 20. The expandable frame assembly of any one of Embodiment 18 or Embodiment 19, wherein the adjustment mechanism comprises at least one gear, and wherein the at least one gear is disposed between the plurality of sizing members to at least partially engage at least one tooth of each sizing member of the plurality of sizing members, and wherein the at least one gear is disposed along at least the first axis and the second axis.

Embodiment 21. An expandable container comprising the expandable frame assembly of any one of the preceding embodiments.

Embodiment 22. The expandable container of Embodiment 21, wherein the expandable container is a suitcase.

Embodiment 23. An expandable container comprising:

an expandable frame assembly comprising:

a plurality of frame members configured to move relative to each other;

a plurality of sizing members, each of the plurality of sizing members connected to at least one of the plurality of frame members; and an adjustment mechanism operably coupled to the plurality of sizing members, the adjustment mechanism configured to move the plurality of sizing members between a first configuration and a second configuration, wherein the first configuration defines a different distance between the plurality of frame members than the second configuration.

Embodiment 24. The expandable container of Embodiment 23, further comprising:

an elastic shell portion extending between two or more of the plurality of frame members, wherein the elastic shell portion comprises one or more of a sizing band, a support member, or an elastic fabric.

Embodiment 25. The expandable container of Embodiment 24, wherein the expandable container is expandable in at least three directions.

Embodiment 26. The expandable container of Embodiment 25, wherein expansion in at least one direction of the at least three directions of the expandable container is passively caused by pushing or pulling on the elastic shell portion, and wherein expansion in at least one direction of the at least three directions of the elastic shell portion is actively caused by expansion or contraction of an expandable frame assembly.

Embodiment 27. The expandable container of any one of Embodiment 25 or Embodiment 26, further comprising a zipper expansion section configured to allow the expandable container to expand in at least one direction of the at least three directions.

Embodiment 28. The expandable container of any one of Embodiments 23-27, further comprising:

an inelastic shell portion comprising a zipper; and an interior compartment, wherein the zipper is configured to provide access an interior compartment.

Embodiment 29. The expandable container of any one of Embodiments 23-28, wherein the plurality of frame members are rigidly fixed relative to each other each of the first configuration and the second configuration when not moving between configurations, and wherein the adjustment mechanism is affixed to a rigid panel disposed at a rear of the expandable container.

Embodiment 30. The expandable container of Embodiment 29, wherein the plurality of frame members each connect two sides of the expandable container, and wherein the adjustment mechanism is disposed in a location between each of the plurality of frame members.

Embodiment 31. The expandable container of any one of Embodiments 23-30, where the plurality of frame members define at least a plurality of corners of the expandable container, wherein the plurality of sizing members are configured to move the plurality of frame members at least partially away from a central point defined by the expandable container when moving from the first configuration to the second configuration, and wherein the plurality of sizing members are configured to move the plurality of frame members at least partially toward the central point defined by the expandable container when moving from the second configuration to the first configuration.

Embodiment 32. The expandable container of Embodiment 31, wherein the plurality of sizing members are configured to move the plurality of frame members away from the adjustment mechanism when moving from the first configuration to the second configuration and towards the adjustment mechanism when moving from the second configuration to the first configuration.

Embodiment 33. An expandable container comprising:

a shell defining a volume;

at least one sizing member connected directly or indirectly to at least a portion of the shell; and an adjustment mechanism operably coupled to the at least one sizing member, the adjustment mechanism configured to move the at least one sizing member between a first configuration and a second configuration, and wherein the first configuration defines a different volume of the shell than the second configuration.

Embodiment 34. The expandable container of Embodiment 33, wherein the shell comprises an opening.

Embodiment 35. The expandable container of any one of Embodiment 33 or Embodiment 34, wherein the at least one sizing member and the at least one adjustment mechanism are disposed on a side edge of the expandable container.

Embodiment 36. The expandable container of any one of Embodiments 33-35, wherein the expandable container is a handbag.

Embodiment 37. The expandable container of any one of Embodiments 33-35, wherein the expandable container is a backpack.

Embodiment 38. The expandable container of any one of Embodiments 33-35, wherein the expandable container is a suitcase.

Embodiment 39. One or more methods of using or manufacturing the expandable containers, frame assemblies, and components described herein. An example method of using an expandable frame assembly may include causing an adjustment mechanism to expand and/or contract according to the operations described herein.

Many modifications and other embodiments of the inventions set forth herein will come to mind to one skilled in the art to which these inventions pertain having the benefit of the teachings presented in the foregoing descriptions and the associated drawings. Embodiments described herein may be combined in whole or in part. Embodiments described herein may be modified with additional, different, and/or fewer components. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. An expandable frame assembly for an expandable container configured to expand in at least two dimensions, the expandable frame assembly comprising:

a plurality of frame members configured to move relative to each other, the plurality of frame members defining corner supports of the expandable frame assembly;

a plurality of sizing members, each of the plurality of sizing members rigidly connected to a respective frame member of the plurality of frame members; and an adjustment mechanism comprising a single-piece adjustable sizing band and a center portion, wherein the single-piece adjustable sizing band is configured to extend between and engage each of the plurality of frame members, wherein the single-piece adjustable sizing band is configured to be adjustable between a plurality of lengths, including a first length and a second length, to define the relative portions of the frame members, wherein the center portion is operably coupled to the plurality of sizing members and is configured to permit relative movement between the plurality of sizing members between a first configuration and a second configuration, wherein the first configuration defines a different distance between the plurality of frame members than the second configuration, and wherein the first length of the single-piece adjustable sizing band corresponds to the first configuration and the second length of the single-piece adjustable sizing band corresponds to the second configuration.

2. The expandable frame assembly of claim 1, wherein the expandable frame assembly defines a width dimension and a length dimension, wherein the length dimension is perpendicular to the width dimension, wherein the width dimension in the first configuration is less than the width dimension in the second configuration, and wherein the length dimension in the first configuration is less than the length dimension in the second configuration.

3. The expandable frame assembly of claim 2, wherein the expandable frame assembly defines a depth dimension that is perpendicular to a plane defined by at least the width dimension and the length dimension, and wherein the depth dimension in the first configuration is less than the depth dimension in the second configuration.

4. The expandable frame assembly of claim 1, wherein the adjustment mechanism is configured to move at least a first sizing member in a first linear direction along a first axis and a second sizing member in a second linear direction along a second axis, and wherein the first axis intersects at least the second axis.

5. The expandable frame assembly of claim 4, wherein the adjustment mechanism is configured to translate each of the plurality of frame members away from the center portion of the adjustment mechanism when moving from the first configuration to the second configuration, and wherein the adjustment mechanism is further configured to translate each of the plurality of frame members toward the adjustment mechanism when moving from the second configuration to the first configuration.

6. The expandable frame assembly of claim 1, wherein the adjustment mechanism is configured to cause linear movement of a respective sizing member of the plurality of sizing members, wherein the plurality of sizing members comprises at least four sizing members defining two pairs of sizing members, and wherein a respective pair of the two pairs of sizing members comprises a first sizing member configured for linear movement along a first axis and a second sizing member configured for linear movement along a second axis.

7. The expandable frame assembly of claim 6, wherein a first pair of sizing members of the two pairs of sizing members is offset from a second pair of sizing members of the two pairs of sizing members at least at a location of the adjustment mechanism, wherein the offset is in a direction perpendicular to both the first axis and the second axis.

8. The expandable frame assembly of claim 1, wherein the plurality of frame members comprises a plurality of corner members, a respective corner member of the plurality of corner members defining a first corner member portion substantially perpendicular to a second corner member portion, and wherein the respective corner member of the plurality of corner members is configured to at least partially structurally define a respective corner of the expandable container.

9. The expandable frame assembly of claim 1, wherein a respective sizing member of the plurality of sizing members is a rigid linkage configured to translate forces between the adjustment mechanism and a respective frame member of the plurality of frame members.

10. The expandable frame assembly of claim 1, further comprising a plurality of springs configured to apply radially outward force to the plurality of sizing members or the plurality of frame members, wherein the single-piece adjustable sizing band is configured to resist the radially outward force of the plurality of springs at each of the first length to hold the expandable frame assembly in the first configuration and the second length to hold the expandable frame assembly in the second configuration.

11. An expandable container comprising:

an expandable frame assembly comprising:

a plurality of frame members configured to move relative to each other, the plurality of frame members defining corner supports of the expandable frame assembly;

a plurality of sizing members, each of the plurality of sizing members rigidly connected to a respective frame member of the plurality of frame members; and an adjustment mechanism comprising a single-piece adjustable sizing band and a center portion, wherein the single-piece adjustable sizing band is configured to extend between and engage each of the plurality of frame members, wherein the single-piece adjustable sizing band is configured to be adjustable between a plurality of lengths, including a first length and a second length, to define the relative positions of the frame members, wherein the center portion is operably coupled to the plurality of sizing members and is configured to permit relative movement between the plurality of sizing members between a first configuration and a second configuration, wherein the first configuration defines a different distance between the plurality of frame members than the second configuration, and wherein the first length of the single-piece adjustable sizing band corresponds to the first configuration and the second length of the single-piece adjustable sizing band corresponds to the second configuration.

12. The expandable container of claim 11, further comprising:

an elastic shell portion extending between two or more of the plurality of frame members, wherein the elastic shell portion comprises one or more of the single-piece adjustable sizing band, a support member, or an elastic fabric.

13. The expandable container of claim 12, wherein the expandable container is expandable in at least three directions.

14. The expandable container of claim 11, further comprising:

an inelastic shell portion comprising a zipper;

at least one elastic portion supporting the inelastic portion and comprising an attachment portion comprising to move with the plurality of frame members; and an interior compartment, wherein the zipper is configured to provide access an interior compartment.

15. The expandable container of claim 11, wherein the plurality of frame members are rigidly fixed relative to each other each of the first configuration and the second configuration when not moving between configurations, and wherein the center portion of the adjustment mechanism is affixed to a rigid panel disposed at a rear of the expandable container.

16. The expandable container of claim 15, wherein the plurality of frame members each rigidly connect portions of two lateral sides of the expandable container and each rigidly extend between a front side and a rear side of the expandable container, and wherein the center portion of the adjustment mechanism is disposed in a location between each of the plurality of frame members.

17. The expandable container of claim 11, where the plurality of frame members define at least a plurality of corners of the expandable container, wherein the plurality of sizing members are configured to move the plurality of frame members at least partially away from a central point defined by the expandable container when moving from the first configuration to the second configuration, and wherein the plurality of sizing members are configured to move the plurality of frame members at least partially toward the central point defined by the expandable container when moving from the second configuration to the first configuration.

18. The expandable container of claim 11, wherein the expandable container comprises only one center portion disposed at a rear side of the expandable container, and the expandable container defines an openable front surface configured to provide access to an interior compartment from a front of the expandable container.

19. The expandable container of claim 11 further comprising an expandable zipper section at a front side of the expandable container, wherein the plurality of frame members are configured to move between the first configuration and the second configuration by translating along a plane, and wherein the expandable zipper section is configured to adjust the size of the expandable container in a third direction perpendicular to the plane.

* * * * *